United States Patent [19]

Kobayashi et al.

[11] Patent Number: 4,868,089

[45] Date of Patent: Sep. 19, 1989

[54] POSITIVE IMAGE FORMING METHOD

[75] Inventors: Tatsuhiko Kobayashi; Sohei Goto; Ken Okauchi, all of Tokyo, Japan

[73] Assignee: Konishiroku Photo Industry Co., Ltd., Tokyo, Japan

[21] Appl. No.: 183,432

[22] Filed: Apr. 13, 1988

Related U.S. Application Data

[63] Continuation of Ser. No. 814,114, Dec. 27, 1985, abandoned.

[30] Foreign Application Priority Data

| | | | |
|---|---|---|---|
| Dec. 30, 1984 | [JP] | Japan | 59-280128 |
| Dec. 31, 1984 | [JP] | Japan | 59-281491 |
| Jul. 11, 1985 | [JP] | Japan | 60-152803 |
| Jul. 15, 1985 | [JP] | Japan | 60-155360 |
| Jul. 17, 1985 | [JP] | Japan | 60-157910 |
| Jul. 17, 1985 | [JP] | Japan | 60-157911 |
| Aug. 30, 1985 | [JP] | Japan | 60-191750 |
| Nov. 22, 1985 | [JP] | Japan | 60-263061 |

[51] Int. Cl.[4] ..... G03C 5/54; G03C 5/26

[52] U.S. Cl. ..... 430/203; 430/350; 430/409; 430/410; 430/425; 430/599; 430/617; 430/619; 430/620

[58] Field of Search ..... 430/620, 619, 617, 599, 430/425, 410, 409, 203, 350

[56] References Cited

U.S. PATENT DOCUMENTS

| | | | |
|---|---|---|---|
| 3,586,505 | 6/1971 | Ridgway | 430/409 |
| 3,761,266 | 9/1973 | Milton | 430/409 |
| 3,891,446 | 6/1975 | Janusonis | 430/599 |
| 4,075,020 | 2/1978 | Saleck et al. | 430/569 |
| 4,324,855 | 4/1982 | Oishi et al. | 430/598 |
| 4,433,050 | 2/1984 | Abe et al. | 430/599 |
| 4,504,570 | 3/1985 | Evans et al. | 430/217 |

OTHER PUBLICATIONS

Response of Type IIIa-J Kodak Spectroscopic Plates to Baking in Various Controlled Atmospheres by Smith et al., Applied Optics, vol. 10, No. 7, Jul. 1971, pp. 1597-1599.

*Primary Examiner*—Richard L. Schilling
*Assistant Examiner*—Janet C. Baxter
*Attorney, Agent, or Firm*—Jordan B. Bierman

[57] ABSTRACT

A positive image forming method is disclosed. Said method comprises in sequence the steps of subjecting to imagewise exposure a silver halide photographic material having a silver halide emulsion layer containing a non-prefogged internal image forming silver halide, increasing the surface sensitivity of said silver halide in the substantial absence of water and performing development.

16 Claims, No Drawings

POSITIVE IMAGE FORMING METHOD

This application is a continuation, of application Ser. No. 814,114, filed Dec. 27, 1985, now abandoned.

FIELD OF THE INVENTION

The present invention relates to a positive image forming method. More particularly, the present invention relates to a novel positive image forming method wherein, after imagewise exposure with a silver halide emulsion containing a non-prefogged internal image forming silver halide, the surface sensitivity of said silver halide is increased in the substantial absence of water, thereby producing a positive image.

BACKGROUND OF THE INVENTION

It is well known that a direct positive photographic image can be formed on a silver halide photographic material without employing any intermediate processing step or forming a negative photographic image. Aside from any special techniques, the conventional methods that are practically useful for the purpose of forming a positive image on direct-positive type silver halide photographic materials are divided into the following two major types: in one type, an emulsion containing a prefogged silver halide is used and development for the formation of a positive image is carried out by destroying fog (latent-image) centers in the exposed areas by making use of solarization or the Herschel effect; and in the other type, an amulsion containing a non-prefogged internal image forming silver halide is used, and after image exposure, a positive image is produced by performing surface development after and/or during fogging.

In the second type of direct positive image forming method, fogging of the exposed silver halide is performed either by applying overall exposure within a developer or a prebath, or by using a foggant. The term "emulsion containing an internal image forming silver halide" means a silver halide emulsion that has sensitivity specks predominantly in the interior of a silver halide grain and which forms a latent image in the inside of the grain upon exposure. The second type of direct positive image forming method generally attains a higher sensitivity than the first type and, hence, is suitable for use in applications requiring high sensitivity.

Methods of forming a direct positive image on a photographic material using an emulsion containing an internal image forming silver halide by performing, after imagewise exposure, surface development either by applying overall exposure or by using a foggant, as well as the photographic emulsions or photographic emulsions used in such methods are described in U.S. Pat. Nos. 2,456,953, 2,497,875, 2,497,876, 2,497,917, 2,507,154, 2,588,982, 2,563,785, 2,675,318, 3,227,552, 3,447,927 and 3,511, 662, and British Pat. No. 1,151,363.

No clear-cut explanation has been made of the detailed mechanism underlying the formation of a direct positive image with the use of an emulsion containing an internal image forming silver halide, but a certain picture of the process of the positive image formation can be obtained from the "desensitizing effects of an internal latent image" discussed in, for example, "The Theory of the Photographic Process", fourth edition, ed. by T. H. James, p. 190, Macmillan Publishing Co., Inc. When an "internal latent image" is formed in the inside of a silver halide grain by the first imagewise exposure, said latent image provides the surface desensitizing effect that allows fog centers to form selectively on the surfaces of unexposed silver halide grains, and the surface fog centers are subsequently developed by ordinary surface development, thereby forming a photographic image in the unexposed areas.

Selective formation of fog centers is customarily done either by photofogging involving the applying exposure to the entire surface of the light-sensitive layer or by chemical fogging involving the use of a chemical such as a foggant.

The term "foggant" used hereinafter is intended to mean a fogging agent that enables selective development of internal image forming silver halide grains that have sites for the formation of an internal latent image but which are yet to receive imagewise exposure, rather than the development of silver halide grains having an internal latent image formed by imagewise exposure.

Methods for obtaining a direct positive image by performing surface development of an internal image forming silver halide emulsion in the presence of a foggant, as well as the photographic emulsions or photographic materials used in such methods are described in U.S. Pat. Nos. 2,456,953, 2,497,875, 2,497,876, 2,588,982, 2,592,250, 2,675,318, 3,227,552, and 3,317,322; British Pat. Nos. 1,011,062, 1,151,363, 1,269,640, and 2,011,391; Japanese Patent Publication Nos. 29405/1968 and 38164/1974; and Unexamined Published Japanese Patent Application Nos. 16623/1978, 137133/1978, 37732/1979, 40629/1979, 74536/1979, 74729/1979, 52055/1980 and 90940/1980.

In order to form a direct positive image by the chemical fogging method, contact with the processing solution is essential and the desired effect of a foggant is attained only under extreme pH conditions ($\leqq 12$). This is responsible for an increased chance of deterioration of the foggant by aerial oxidation and the resulting degradation of the fogging effect is substantial. Further problems result from the fact that treatment with the high pH processing solution is time-consuming and painstaking and that the foggant's performance is sensitive to the effects of variations in processing conditions such as the temperature and agitation of the processing solution.

In most of the known techniques described above, improved photographic characteristics are intended to be obtained by improving the technology of preparing silver halide emulsions and few proposals have been made for producing improved photographic characteristics by means of improving the processing scheme.

U.S. Pat. Nos. 4,124,387 and 4,186,009 describe photothermographic materials designed for producing positive images by the dry process but neither patent suggests a method for producing a direct positive image by employing in the heat-developable photographic material an emulsion containing an internal image forming silver halide.

The present inventors made various studies on the formation of a positive image on a silver halide photographic material and found that, if after imagewise exposure of a silver halide photographic material having an emulsion containing an internal image forming silver halide, the surface sensitivity of the silver halide is increased in the substantial absence of water, fog centers are formed selectively on the surface of the silver halide, whereby a positive image is formed. The present invention has been accomplished on the basis of this finding.

SUMMARY OF THE INVENTION

One object, therefore, of the present invention is to provide a novel method for forming a positive image using a silver halide emulsion containing a non-prefogged internal image forming silver halide.

Another object of the present invention is to provide such a method that forms a positive photographic image in unexposed areas by selectively forming fog centers on the surfaces of unexposed silver halide grains.

These objects can be attained by a positive image forming method comprising the steps of subjecting to image-wise exposure a silver halide photographic material having a silver halide emulsion layer containing a non-prefogged, internal image forming silver halide, increasing the surface sensitivity of said silver halide in the substantial absence of water, and performing development.

DETAILED DESCRIPTION OF THE INVENTION

Details of the non-prefogged, internal image forming silver halide used in the present invention are found in U.S. Pat. Nos. 2,592,250, 3,206,313, 3,317,322, 3,511,662, 3,447,927, 3,761,266, 3,703,584, 3,736,140, etc., and stated simply, this type of silver halide is defined as one having a higher sensitivity in the inside of a silver halide grain than on its surface. Methods of forming a silver halide emulsion containing such internal image forming silver halide are also described in the patents listed above; in one method, AgCl grains are first prepared, and to these grains are added either a bromide or a combination thereof with a small amount of an iodide, so as to effect halide exchange; in another method, the center speck on a chemically sensitized silver halide is coated with a yet to be chemically sensitized silver halide; and in still another method a chemically sensitized, coarse-grained emulsion is mixed with a chemically sensitized or yet to be chemically sensitized fine-grained emulsion, thereby depositing the fine-grained emulsion on the coarse-grained emulsion. Also usable in the present invention are silver halide emulsions that have silver halide grains incorporating polyvalent metal ions as described in U.S. Pat. Nos. 3,271,157, 3,447,927 and 3,531,291; a silver halide emulsion comprising doped silver halide grains that are weakly sensitized chemically at the grain surface; silver halide emulsions comprising grains with a dual structure as shown in Unexamined Published Japanese Patent Application Nos. 8524/1975, 38525/1975 and 2408/1978; as well as silver halide emulsions of the types described in Unexamined Published Japanese Patent Application Nos. 156614/1977 and 127549/1980.

The silver halide emulsion containing the internal image forming silver halide used in the present invention (hereunder sometimes referred to as the internal image forming silver halide emulsion) may be defined more specifically as such an emulsion that the maximum density attained by development with an "internal developer" is higher than what is attained by development with a "surface" developer.

An internal image forming silver halide emulsion is considered to be suitable for use in the present invention if a sample, which is formed by coating said emulsion onto a transparent base, then given an exposure for a fixed period of time in the range of 0.01 to 1 second and which subsequently is treated in an "internal" developer A (for its composition, see below) at 20° C. for 3 minutes, provides a maximum density which, when measured by ordinary photographic densitometric procedures, is at least five times as high as the maximum density attained by treating a similarly exposed sample in a "surface" developer B (for its composition, also see below) at 20° C. for 4 minutes.

| Developer A: | |
|---|---|
| Components | Amounts |
| Hydroquinone | 15 g |
| Methol | 15 g |
| Anhydrous sodium sulfite | 50 g |
| Potassium bromide | 10 g |
| Sodium hydroxide | 25 g |
| Sodium thiosulfate | 20 g |
| Water to make | 1,000 ml |
| **Developer B:** | |
| Compounds | Amounts |
| p-Hydroxyphenyl glycine | 10 g |
| Sodium carbonate | 100 g |
| Water to make | 1,000 ml |

In accordance with the most important feature of the present invention, the non-prefogged, internal image forming silver halide emulsion is subjected to imagewise exposure, and subsequently, the surface sensitivity of such silver halide is increased in the substantial absence of water, thereby forming a positive image. The internal image forming silver halide is used in accordance with the present invention in an amount which generally ranges from 0.001 to 100 g/m$^2$ in terms of silver, preferably from 0.05 to 50 g/m$^2$ in terms of silver. Examples of the internal image forming silver halide that can be used in the present invention include silver chloride, silver chlorobromide, silver chloroiodide, silver bromide, silver iodobromide, silver chloroiodobromide and silver iodide.

These silver halide grains have an average size which preferably ranges from 0.001 to 2 μm, more preferably from 0.01 to 1 μm. Two or more silver halides having different grain sizes and/or halide compositions may be used in admixture. The average grain size is determined by averaging the projected areas of individual grains, with the grain size being indicated by the diameter of a spherical or near-spherical silver halide grain, the length of one side of a cubic grain, or the diameter of an equivalent circle for neither spherical nor cubic grains.

The internal image forming silver halide grain preferably used in the present invention is that of the core/-shell structure wherein the core made of a conversion type silver halide grain is coated with a silver halide shell, and details of this type of grain are found in Unexamined Published Japanese Patent Application No. 127549/1980.

The conversion type silver halide grain used as the core is prepared by first forming silver salt grains at least part of which has a higher water solubility than silver bromide, and then converting at least part of said highly water-soluble grains to silver bromide or silver iodobromide. Usually, such silver halide grains are readily prepared by first mixing an aqueous solution of silver nitrate with an aqueous solution of a chloride in the presence of a protective colloid such as gelatin, and then adding an aqueous solution of a bromide to the resulting silver chloride emulsion.

The core grains of the conversion type silver halide preferably contain at least 80 mol % of silver bromide and may contain up to 10 mol % of silver iodide. A particularly preferred conversion type silver halide core contains at least 90 mol % of silver bromide and up to 5 mol % (including 0 mol %) of silver iodide, with the remaining halide being made up of silver chloride.

The silver halide grains of the core/shell structure used in the present invention are prepared by depositing a shell of silver halide on the surfaces of the aforementioned conversion type silver halide core grains. The silver halide shell may have any of the silver halide compositions such as silver chloride, silver bromide, silver chlorobromide, silver iodobromide and silver chloroiodobromide.

A satisfactory shell thickness may be obtained if the silver halide content of the shell ranges from 30 to 70 mol % of the total silver halide in the core/shell combination. If the silver halide content of the shell is less than 30 mol % of the total silver halide, the resulting grains have poor keeping quality at elevated temperatures and are prone to provide an increased minimum density, and if the silver halide content of the shell exceeds 70 mol %, maximum density that can be attained is decreased.

Particularly preferred internal image forming silver halide emulsions are metal ion doped emulsions and core/shell type emulsions with a chemically sensitized interior, as described in U.S. Pat. Nos. 3,206,316, 3,317,322, 3,367,778, 3,447,927, 3,531,291, 3,271,157 and 3,761,276.

The internal image forming silver halide emulsion that is useful in the present invention is one containing silver halide grains in the interior of which are occluded dissimilar metal ions or metal compounds. The term "dissimilar metal ions" are non-silver ions. The dissimilar metal ions occluded within silver halide grains may include sulfur ion, iridium ion, gold ion, platinum ion, lead ion, antimony ion, bismuth ion, rhodium ion, osumium ion, palladium ion, ruthenium ion, etc. The dissimilar metal compounds occluded within silver halide grains may include sulfur compound, gold salt compound, platinum salt compound, iridium salt compound, zinc salt compound, lead salt compound, antimony salt compound, bismuth salt compound, rhodium salt compound, osmium salt compound, palladium salt compound, rutheniam salt compound, etc. These dissimilar metal ions or metal compounds may be occluded in the interior of silver halide grains by causing such grains to grow in the presence of these ions or compounds. In one example of such method, certain dissimilar metal ions or metal compounds are deposited on silver halide grains that are eventually to form a core, and then, a silver halide that is to form a shell is deposited on the outer surfaces of said silver halide grains.

The emulsion for use in the present invention that contains internal image forming silver halide grains is an emulsion that contains silver halide grains which will form a latent image predominantly in the interior of the grains and which have most of the sensitivity specks present in their interior. Illustrative silver halides of which the grains are made include silver bromide, silver chloride, silver chlorobromide, silver iodobromide and silver chloroiodobromide. A particularly useful internal image forming silver halide emulsion is such that the predominant component of the silver halide grains is silver bromide, and the case where at least two mol % of the silver halide composition is provided by silver bromide is preferred.

A core/shell type emulsion is particularly preferred for use in the present invention as the internal image forming silver halide emulsion, and it may be prepared by the following procedures: first, silver halide grains that will eventually provide a core are prepared; then, these grains are chemically sensitized by the combination of gold or noble metal sensitization, sulfur sensitization and reduction sensitization using known techniques, or by the combination of two of these sensitization methods, for example, gold sensitization and sulfur sensitization, or a single sensitization method, for example, sulfur sensitization; and finally, a shell forming silver halide is deposited on the outer surfaces of the sensitized silver halide grains.

As already mentioned, the core/shell emulsion useful in the present invention may employ any silver halide composition. The silver halide composition may be the same or different for the core and shell.

In a preferred embodiment, the core is composed of silver iodobromide with 0–4 mol % of AgI while the shell is made of silver iodobromide with 0.5–8 mol % of AgI. Preferably, the shell has a higher AgI content than the core; for example, the AgI content of the shell is higher than that of the core by at least 1 mol %. The most preferred emulsion is a silver iodobromide core/-shell emulsion and the shell has a AgI content of 2–6 mol %.

The shell thickness is preferably such that the shell contains 30–95 mol % of silver halide on the basis of the total silver halide in the core/shell combination. If the silver halide content of the shell is less than 30 mol % of the total silver halide, the emulsion has a tendency to exhibit an increased minimum density, and if the silver halide content of the shell exceeds 95 mol % of the total silver halide, maximum density that can be achieved will decrease.

The internal image forming silver halide grains used in the present invention may be prepared in various crystallographic morphologies by properly controlling the pAg used in the manufacturing process. Illustrative morphologries are cubes, octahedrons and tetradecahedrons grains. There is no particular limitation on the crystal habit that can be assumed by the silver halide grains useful in the present invention.

The step of increasing the surface sensitivity of silver halide in the substantial absence of water is hereunder described.

The surface sensitivity of a silver halide is considered to have increased if the silver halide that has been passed through this step has a higher surface sensitivity than before said step. The preferred degree of increase in sensitivity is such that when two photographic samples prepared by coating the aforementioned emulsion onto a base to give a silver deposit of 3.5–4.5 g/m$^2$ are exposed and developed under the conditions specified below, the sample treated by the sensitizing step will provide a sensitivity that is, as expressed by the method also described below, at least 0.10 higher than the value attained by the untreated sample.

| | Amounts |
|---|---|
| Exposure | |
| Exposed for 1/1,000 second | |
| Developer | |
| Components | |
| p-Hydroxyphenyl glycine | 10 g |
| Sodium carbonate | 100 g |
| Water to make | 1,000 ml |
| Development | |

-continued

| | Amounts |
|---|---|
| Developed at 20° C. for 4 minutes | |

Sensitivity indication method

The photographic sensitivity of a negative image as expressed in terms of the common logarithm of the reciprocal of the amount of exposure necessary for providing a density of (fog+0.1).

The step of increasing the surface sensitivity of silver halide in the substantial presence of water may be implemented by various means of sensitizing methods. In one method, the silver halide photographic material of the present invention may be placed for the necessary period of time in an atmosphere provided by such active gases as hydrogen, ammonia, sulfurous acid and hydrogen sulfide. The same result may be obtained by applying ultrasonic waves to the photographic material. Any other methods may be employed if they are capable of increasing the surface sensitivity of silver halide in the substantial absence of water. For instance, a silver halide photographic material containing the internal image forming silver halide emulsion layer is first subjected to imagewise exposure and then heated in its entirety at a suitably elevated temperature. During or after the heating, the photographic material is preferably subjected to overall exposure. Alternatively, it is preferred to perform the heating in the presence of a chemical foggant.

In one preferred embodiment, the surface sensitivity of silver halide is increased by treatment with a hydrogen gas. The basic principles of using hydrogen for the purpose of increasing the sensitivity of silver halide photographic materials were proposed by J. A. Babcock et al., and are described in "Photographic Science and Engineering", 13, 54, 15, 75, and 19, 49 -55 and 211 -214; "Journal of Photographic Science", 24, 19 -24; and U.S. Pat. Nos. 3,891,446 and 3,984,249, Japanese Patent Publication No. 35810/1975, and Unexamined Published Japanese Patent Application No. 121728/1979. The method of the present invention may be practiced by referring to these publications.

Details of the hydrogen sensitization method that may be used in the present invention are shown below. In the first step, the container accommodating the silver halide photographic material of interest is evacuated; in the next step, the container is fed with a hydrogen gas to sensitize the photographic material with hydrogen. The purpose of evacuation is to remove any oxygen and moisture from the container and the emulsion layers in the photographic material, and in order to attain this purpose, the container is usually held at a pressure of $10^{-2}$ Torr or below for a period of at least 1 minute. In order to insure that the purpose of evacuation is thoroughly achieved, the cycle of evacuation, supply of a hydrogen gas and another evacuation may be repeated several times. For this purpose, a vessel with a pressure gage to which are connected pipes or tubes may be employed.

Treatment with a hydrogen gas may be carried out by methods that are similar to those described in the aforementioned literature and patent publications. The term "hydrogen gas atmosphere" as used herein means an atmosphere that is substantially free of oxygen and water vapor and which is entirely made of a hydrogen gas, provided that part of the hydrogen gas may be replaced by an inert gas such as neon, helium, or argon. The pressure of the hydrogen gas atmosphere may be properly determined depending on the partial pressure of hydrogen gas by taking into account its correlation with the type of the silver halide photographic material, the treating temperature and time. The practical preferred ranges of pressure, temperature and time are from $10^{-3}$ to 10 atmospheres, from 20° to 80° C, and from 30 seconds to 16 hours, respectively.

Instead of a hydrogen gas, other active gases such as ammonia, sulfurous acid and hydrogen sulfide may be employed for the sensitization purposes in the same manner as described above.

In a preferred embodiment of the present invention, a core/shell emulsion having a chemically sensitized core in a non-prefogged, internal image forming emulsion is used, and a photographic material containing this emulsion is first subjected to imagewise exposure, then placed in a hydrogen gas atmosphere so as to increase the surface sensitivity of the emulsion, and the photographic material is subsequently developed in the appropriate manner, thereby forming a positive image.

In accordance with the present invention at the time of the sensitizing treatment using an active gas such as hydrogen gas, the development step may be preceded by a photofogging step. Instead of photofogging, chemical coupling may be carried out by means of a foggant that is incorporated in either the photographic material or a developer. Photofogging may be realized by applying overall exposure in the following fashion: the photographic material that has been exposed imagewise and sensitized in the substantial absence of water by, for example, treatment with a hydrogen gas, is dipped in or wetted with a developer or other aqueous solutions, then recovered and flooded with a uniform intensity of light over the entire area. If desired, the sensitized photographic material may be flooded with light in the dry state without being dipped in water. Any light source that emits light having a wavelength within the spectral sensivity range for the photographic material may be employed. The photographic material may be illuminated by a very short, high irradiance flash exposure, or may be illuminated for a long period with a weak light. In order to produce the best positive image, the period of overall exposure may be varied over a wide range depending on the type of the photographic material, development conditions, or the type of light source used.

A broad range of compounds may be used as foggants in the present invention. The foggants may be available at the time of development and they may be incorporated in photographic layers other than the base (silver halide emulsion layers are particularly preferred) or within a developer solution or any processing solution that is used prior to the development step. The amount of the foggants used may be varied over a wide range depending upon the specific object; the preferred range is from 1 to 1,500 mg, more preferably from 10 to 1,000 mg, per mole of silver halide if the foggants are incorporated in silver halide emulsion layers, and from 0.01 to 5 g/1,000 ml, more preferably from 0.05 to 1 g/1,000 ml if the foggants are incorporated in a processing solution such as a developer solution.

Illustrative foggants that may be used in the present invention include the hydrazines disclosed in U.S. Pat. Nos. 2,563,785 and 2,588,982; the hydrazide or hydrazone compounds disclosed in U.S. Pat. No. 3,227,552; the heterocyclic quaternary nitrogen salt compounds disclosed in U.S. Pat. Nos. 3,615,615, 3,718,470, 3,719,494, 3,734,738 and 3,759,901; and the acylhydrazinophenylthioueas described in U.S. Pat. No. 4,030,925. These foggants may be used in combination; for example, a non-adsorptive foggant may be used in combination with an adsorptive foggant as shown in Research Disclosure No. 15,162.

Specific examples of the useful foggants are listed below: hydrazine compounds such as hydrazine hydrochloride, phenylhydrazine hydrochloride, 4-methylphenylhydrazine hydrochloride, 1-formyl-2-(4-methylphenyl)hydrazine, 1-acetyl-2-phenylhydrazine, 1-acetyl-2-(4-acetamidophenyl)hydrazine, 1-methylsulfonyl-2-phenylhydrazine, 1-benzoyl-2-phenylhydrazine, 1-methylsulfonyl-2-(3-phenylsulfonamidophenyl) hydrazine and formaldehyde phenylhydrazine; N-substituted quaternary cycloammonium salts such as 3-(2-formylethyl)-2-methylbenzothiazolium bromide, 3-(2-formylethyl)-2-propylbenzothiazolium bromide, 3-(2-acetylethyl)-2-benzylbenzoselenazolium bromide, 3-(2-acetylethyl)-2-benzyl-5-phenylbenzoxazolium bromide, 2-methyl-3-[3-(phenylhydrazono)propyl]benzothiazolium bromide, 2-methyl-3-[3-(p-tolylhydrazono) propyl]benzothiazolium bromide, 2-methyl-3-[3-(p-sulfophenylhydrazono)propyl]benzothiazolium bromide, 2-methyl-3-[3-(p-sulfophenylhydrazono)pentyl]benzothiazolium iodide, 1,2-hydro-3-methyl-4-phenylpyrido[2,1-b]benzothiazolium bromide, 1,2-dihydro-3-methyl-4-phenylpyride[2,1-b]-5-phenylbenzoxazolium bromide, 4,4'-ethylenebis(1,2-dihydro-3-methylpyrido [2,1-b]benzothiazolium bromide), and 1,2-dihydro-3-methyl-4-phenylpyrido[2,1-b]benzoselenazolium bromide; 5-[1-ethylnaphtho(1,2-b)thiazoline-2-ylideneethylidene]-1-(2-phenylcarbazoyl)methyl-3-(4-sulfamoylphenyl)-2-thiohydantoin, 5-(3-ethyl-2-benzothiazolinylidene)-3-[4-(2-formylhydrazino) phenyl]rhodanine, 1-[4-(2-formylhydrazino)phenyl]-3-phenyl thiourea and 1,3-bis[4-(2-formylhydrazino)phenyl]thiourea.

Heating as a step for increasing the surface sensitivity of silver halide in the substantial absence of water is performed in the process of the present invention after a silver halide photographic material having an internal image forming silver halide emulsion layer has been subjected to imagewise exposure. In this heating step, the entire part of the photographic material is heated at a suitably elevated temperature (e.g. ca. 80 -/ca. 200° C) for a period of ca. 0.5 to ca. 300 seconds. The temperature at which the photographic material is heated may be at the higher or lower end of the aforementioned range; if higher temperatures are selected, the heating period is shortened and if lower temperatures are selected, the heating period is prolonged. A particularly useful temperature range is from ca. 100° to ca. 160° C.

The heating means may be selected from among simple hot plates, an iron, and hot rollers; alternatively, the photographic material may be passed through a heated tunnel. High-frequency heating or heating by a laser beam may also be used.

As shown in Unexamined Published Japanese Patent Application No. 77442/1984, the silver halide photographic material may be provided with a pyrogenic layer that is composed of an electroconductive material (e.g. graphite, carbon black or metal) and which will, when supplied with current impression by electrodes, generate heat to increase the temperature of the light-sensitive layer. In this case, the exposed silver halide photographic material may be heated by impressing a current on the pyrogenic layer.

The aforementioned heating step is performed in the substantial absence of water. No adequate maximum density will be attained if the photographic material to be heated contains water in an amount no less than 10 wt % of the total solids content except in the base. A photographic material containing a hydrophilic binder such as gelatin will in most cases contain 10–20 wt % of water when it is left under natural conditions. Therefore, if the photographic material of the present invention uses a base that has little or no water permeability and if a light-sensitive layer on the side opposite the base is covered with another material that has little or no water permeability, the water inherently present in the photographic material will not evaporate in a sufficient amount to provide a satisfactory maximum density even if said material is heated. Therefore, in a preferred embodiment of the present invention, the photographic material is heated, with the surface coated with a light-sensitive layer being left open to the atmosphere. Even if the photographic material has a light-sensitive layer containing more than 10 wt % of water, a sufficient amount of water reduction will be realized by evaporation so as to attain the desired objects of the present invention.

In a particularly preferred embodiment of the present invention, a photographic material that has formed on a base an internal image forming silver halide emulsion layer comprising non-prefogged silver halide grains is subjected to imagewise exposure and, then, the back side (where no emulsion layer is coated) of the base is heated on a heat block for 1 second to 5 minutes at 100°–160° C. (i.e., the step of increasing the sensitivity of the silver halide), and subsequently, the photographic material is developed by a suitable method so as to form a positive image. In this heating step, the surface of the photographic material that is coated with an emulsion layer is preferably exposed to the atmosphere; namely, the emulsion-coated surface is preferably not in contact with any plastic sheet, glass sheet or metal surface. As already mentioned, this is in order to ensure unimpeded evaporation of water from within the photographic material.

The heating step described above may be carried out either independently or in combination with the step of overall exposure. Overall exposure is based on the formation of fog centers as a result of photodegradation of the internal image forming silver halide, so the optimum intensity and period of exposure are preferably varied depending upon the type and characteristics of the internal image forming silver halide used, or the number and arrangement of layers in the silver halide photographic material.

If, for example, a multi-color photographic material comprising a base coated with two or more non-prefogged, internal image forming silver halide emulsion layers having different wavelength ranges of sensitivity is first imagewise exposed and then given uniform overall exposure under light of a selected intensity, either during or after the heating step, it is difficult to attain satisfactory characteristics in all of the images formed on the emulsion layers. In order to produce good images under these conditions, overall exposure that is concurrent with or follows the heating step must be performed under light having fairly low intensities within a limited range. Stated more specifically, if one wants to produce a direct positive color image from a multi-color photographic material comprising a base coated with two or more non-prefogged, internal image forming silver halide emulsion layers having different wavelength ranges of sensitivity, overall exposure that is applied to each of the silver halide emulsion layers either during or after the heating step is preferably performed in such a manner that the relative photographic strength for each emulsion layer is not greater than 6. The term "photographic strength" as used herein means the strength of overall exposure that is capable of affording photographic effects on a certain silver halide emulsion layer, and a relative value of this parameter can be determined for each of the silver halide emulsion layers used. The photographic strength is dependent on the distribution of energy for overall exposure and the distribution of the spectral sensitivity of each silver halide emulsion layer. The relative value of photographic strength may be determined by, for example, the method described in Unexamined Published Japanese Patent Application No. 70223/1983.

Any light source for overall exposure may be used if it provides for such control that the relative photographic strength for each of the silver halide emulsion layers used is preferably greater than 6. Illustrative light sources are a tungsten lamp, a fluorescent lamp, a halogen lamp, a xenon lamp, a mercury lamp and the sunlight. These light sources may be used either independently or in combination.

The aforementioned requirement for the relative photographic strength that is provided for the photographic material by overall exposure may be satisfied by employing known methods. The distribution itself of the energy afforded by the specific light source may be varied; alternatively, filters such as for accomplishing color correction or conversion of color densities may be used.

Overall exposure may be performed using a plurality of light sources. In a preferred embodiment, separate light sources may be used for producing blue, green and red lights. If a plurality of light sources are used, the duration of overall exposure may be the same or different for the respective light sources.

Overall exposure may be performed with the intensity of light being increased as shown in Unexamined Published Japanese Patent Application No. 127587/1979.

As mentioned earlier in this specification, overall exposure may be performed under varying conditions of light intensity and duration. The intensity of exposure is preferably in the range of $0.1-10^5$ lux, more preferably $1-10^4$ lux; the duration of exposure preferably ranges from 0.5 to 300 seconds, more preferably from 1 to 100 seconds.

There is no fixed relationship between the timing of the heating step and that of overall exposure. In one case, the imagewise exposed silver halide photographic material containing an internal image forming silver halide emulsion layer is given overall exposure while the entire part of it is heated for a period of about 0.5—about 300 seconds at a suitably elevated temperature in the range of from about 80 to about 200° C. If desired, overall exposure may be performed after the heated photographic material is cooled down to room temperature. The period of time for which the cooled photographic material is left before it is given overall exposure may be freely adjusted so long as said material has passed through the heating step.

Preferably, the heating step is performed simultaneously with the step of overall exposure; in order to attain better photographic characteristics, it is more preferred that overall exposure is given at the time when, as a result of heating, the temperature in the light-sensitive layer containing the internal image forming silver halide emulsion has become substantially equal to the heating temperature, thereby rendering that light-sensitive layer substantially free of water (i.e., in the dry state). In a particularly preferred case, overall exposure should be applied at least about one second after the heating of the photographic material is started. In the present invention, in order to increase the surface sensitivity of the internal image forming silver halide in the substantial absence of water, the heater step may be carried out in the presence of a chemical fogging agent.

The chemical fogging agent used in the present invention is a compound whose effectiveness as a foggant depends largely upon temperature in that it will cause no effect on silver halide grains under ordinary temperature conditions but that it will form fog centers selectively on the surfaces of unexposed silver halide grains when it is given a heat treatment by, for example, heating to 80° C. or higher, especially 100° C. or upward.

It is generally known that under alkaline conditions, the action of a foggant depends on temperature. The foggant useful in the present invention preferably has a high degree of temperature dependency, and a particularly preferred foggant is a compound that will not exhibit any fogging action under ordinary temperature conditions but which suddenly turns to be an effective foggant when it is heated to 100° C. or higher. Such preferred foggant has an activation energy for the fogging action of at least about 20 kcal.

The "activation energy" is a well known constant that serves as a measure for the temperature dependency of a chemical reaction; the greater the value of "activation energy", the more temperature-dependent the chemical reaction is.

For the purposes of the present invention, the activation (E) energy for the fogging action of a foggant may be determined by the following equation:

$$E = 2.303R \times \frac{T1 \times T2}{T2 - T1} \times \log \frac{t2}{t1}$$

where T1 and T2 ($T1 < T2$) are temperatures at which a photographic emulsion layer containing a foggant of interest is placed; R is a constant; and t1 and t2 are the time periods required for the sample at T1 and T2, respectively, to attain the same fog level by the sole action of the foggant excluding the fog caused by the silver halide grains alone.

A foggant preferred for use in the present invention can be readily determined in a simple experiment by the following procedures.

Preparing emulsion

A silver bromide emulsion was prepared from the following three solutions.

| Solution 1-A | |
|---|---|
| Ossein gelatin | 40 g |
| Distilled water | 400 ml |
| 10% Ethanol solution of sodium polyisopropylene-polyethylene-oxydisuccinate ester | 30 ml |
| KBr | 2 g |
| 1 N $HNO_3$ | 76 ml |
| **Solution 1-B** | |
| $AgNO_3$ | 1,200 g |

-continued

| | |
|---|---|
| 0.1 N $HNO_3$ | 60 ml |
| Distilled water to make | 1,750 ml |

| Solution 1-C | |
|---|---|
| Ossein gelatin | 35 g |
| KBr | 810 g |
| 10% Ethanol solution of sodium polyisopropylene-polyethylene-oxydisuccinate ester | 35 ml |
| Distilled water to make | 1,750 ml |

Using a mixer-agitator of the type described in Unexamined Published Japanese Patent Application Nos. 92523/1982 and 92524/1982, solutions 1-B and 1-C. were added to solution 1-A by the double-jet method over a period of 32 minutes.

The addition rate was increased with time in a zigzag manner as shown in Table A. The pAg of solution 1-A was controlled at 9.0 with a 20% aqueous KBr solution. The pAg measurements were conducted with an apparatus comprising a metallic silver electrode and a double-junction saturated Ag/AgCl reference electrode.

A roller tube metering pump capable of variable flow rates was used in performing the addition of solutions 1-B and 1-C, and the 20% aqueous KBr solution.

The emulsion thus prepared was washed to remove any water-soluble halides, and after addition of 130 g of gelatin, water was added to make a total of 6,000 g. The resulting emulsion comprised silver bromide grains with an average size of 0.13 μm.

TABLE A

| | Addition rate (ml/min) | |
|---|---|---|
| Time (min) | Solution 1-B | Solution 1-C |
| 0 | 15.1 | 15.1 |
| 5 | 15.9 | 15.9 |
| 10 | 27.0 | 27.0 |
| 14 | 40.0 | 40.0 |
| 16.5 | 49.3 | 49.3 |
| 20.5 | 65.8 | 65.8 |
| 22.5 | 74.0 | 74.0 |
| 26.5 | 94.0 | 94.0 |
| 29.0 | 107.5 | 107.5 |
| 31.0 | 118.5 | 118.5 |
| 32.0 | 126.0 | 126.0 |

To the silver bromide emulsion, a test compound for foggant was added in an amount of 0.5 mole per mole of silver, and to the mixture, a hardener (formaldehyde) and a spreader (di-2-ethylhexyl sodium sulfosuccinate) were added to provide a silver deposit of 0.5 g/m$^2$ and a gelatin weight of 2 g/m$^2$. The so prepared coating solution was applied to a subbed polyester base and dried. A comparative sample was also prepared by coating a foggant-free solution onto a subbed polyester base.

The dried samples were cut to suitable sizes and heated on a heat block (170° C.) for 1 minute. Thereafter, the samples were developed at 20° C. for 4 minutes within a surface developer having the composition indicated below. The test compounds that produced fog densities at least 0.2 higher than the values attained by developing the comparative sample (foggant-free) after heat treatment were considered to be particularly useful as a foggant in the present invention.

| Developer | |
|---|---|
| p-Hydroxyphenyl glycine | 10 g |

-continued

| Developer | |
|---|---|
| Sodium carbonate | 100 g |
| Water to make 1,000 | ml |

Preferred examples of the foggant suitable for use in the present invention include sulfur compounds such as sulfur, sodium thiosulfate, ammonium thiosulfate and thiosulfonic acid; thioureas such as thiourea, diphenylthiourea, 1-tolylthiourea, ethylthiourea and ethylenethiourea; thiobiurets such as thiobiuret; thiosemicarbarides such as thiosemicarbazide; and rhodanines such as rhodanine and phenylrhodanine.

More preferred foggants may be selected from among known compounds such as the foggants described in U.S. Pat. Nos. 3,718,470, 3,772,030, 3,796,577, 4,306,016, 4,306,017 and French Patent No. 2,409,533; the hydrazines described in U.S. Pat. Nos. 2,563,785, 2,588,982, 2,618,656 and 2,604,400; the hydrazides and hydrazine compounds described in U.S. Pat. No. 3,227,552 and British Pat. No. 1,269,640; the heterocyclic quaternary salt compounds described in U.S. Pat. Nos. 3,615,615, 3,719,494, 3,734,738, 3,759,901, 3,772,030, 3,923,513, 4,306,016, Unexamined Published Japanese Pat. Nos. 3426/1977, 69613/1977 and 138742/1980; and the thiourea-bonded acylphenylhydrazine compounds described in U.S. Pat. Nos. 4,030,925, 4,031,127, 4,080,207, 4,139,387, Unexamined Published Japanese Patent Application Nos. 74729/1979, 133126/1979, 74536/1980 and 16125/1981.

Better fog properties are attainable when the aforementioned foggants are adsorbed on the surfaces of silver halide grains by incorporation in silver halide emulsion layers or any other suitable layers in a photographic material. In this respect, the foggants that are described in U.S. Pat. Nos. 4,080,207, 4,278,748, British Pat. No. 2,011,391, Unexamined Published Japanese Patent Application No. 200230/1984 and Disclosed Technical Bulletin (Kokai Giho) No. 12203/1984 and which comprise the aforementioned acylhydrazine compounds having introduced thereto an adsorbing group such as a heterocyclic thioamido group or a mercapto-having heterocyclic group on triazole derivatives, benzotriazole-2-thiols, 1-phenyl-5-mercaptotetrazoles and 1,2,3-benzotriazole-4-thiols are particularly preferred because they have a greater adsorbance on the surfaces of silver halide grains and, hence, are required to be used in a smaller amount to exhibit the intended fogging effect. Among these foggants, the compounds having the following formula are especially preferred:

$$Ac—NH—NH—R_1 \quad (I)$$

where $R_1$ is an aryl or heterocyclic group which is bonded at the tertiary carbon to the nitrogen atoms in hydrazine.

Illustrative aryl groups as $R_1$ include phenyl and naphthyl; illustrative heterocyclic groups as $R_1$ include pyridyl, quinolinyl, thiazolyl, benzothiazolyl, naphthothiazolyl, oxazolyl, benzoxazolyl, naphthoxazolyl, imidazolyl, benzimidazolyl and naphthoimidazolyl, each of which has the nitrogen atoms in hydrazine bonded to the tertiary carbon atom at 2-position.

The symbol Ac in Formula (I) denotes

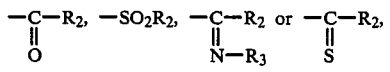

where $R_2$ is a hydrogen atom, an optionally substituted alkyl, alkenyl or alkynyl group having up to 20 carbon atoms, an optionally substituted aryl group (e.g. phenyl or naphthyl) or a group

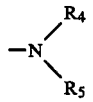

(where $R_4$ and $R_5$ are each a hydrogen atom, an alkyl or aryl group having 1–20 carbon atoms, provided that $R_4$ and $R_5$ may form a hetero ring), and R: is either the same as $R_2$ or a hydroxyl group.

Typical examples of $R_2$ include a hydrogen atom, methyl, ethyl, octyl, trifluoromethyl, perfluoro-propyl, phenyl, tolyl, chlorophenyl, nitrophenyl, naphthyl and substituted naphthyl groups.

Typical examples of $R_4$ and $R_5$ include a hydrogen atom, an alkyl group having up to 20 carbon atoms (e.g. methyl and ethyl), and a heterocyclic group (e.g. morpholino, piperazino or pyrrolidino) formed by $R_4$ and $R_5$ taken together.

More preferred compounds of Formula (I) are represented by Formula (II):

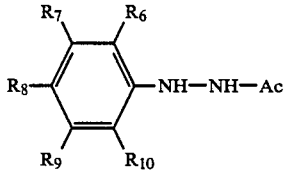

(II)

where Ac is the same as Ac in Formula (I); $R_6$ to $R_{10}$ are each a hydrogen atom, a halogen atom, a cyano group, an optionally substituted alkylsulfonyl group, an arylsulfonyl group, an alkoxy group, an aryloxy group, an alkyl group, an alkenyl group, an alkynyl group, a haloalkyl group, a haloaryl group, an amino group, an optionally substituted alkylamino group, an arylamino group, a sulfonic acid group (including salts thereof), a nitro group,

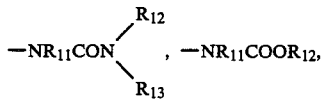

$-NR_{11}COR_{12}$, $-COOR_{11}$, $-OCOR_{11}$, $-N{=}CR_{11}-R_{14}$, $-SR_{11}$, $-SO_2R_{11}$ or an adsorption acclerating group to be defined hereinafter (where $R_{11}$, $R_{12}$ and $R_{11}$ are each a hydrogen atom, an optionally substituted alkyl or aryl group having up to 20 carbon atoms; and $R_{14}$ is an optionally substituted aryl group); each of $R_6$ to $R_{10}$ may be a —NH—NH—Ac or $-R_1'$—NH—NH—Ac group (where Ac is the same as Ac in Formula (I); and $R_1'$ is a divalent arylene group or a heterocyclic group, with a phenylene group, a naphthylene group or a pyridinylene group being preferred) or they may be the aforementioned groups containing the group —NH—NH—Ac or $-R_1'$—NH—NH—Ac.

The compound of Formula (I) may contain in Ac and/or $R_1$ an adsorption accelerating group that will provide the compound with affinity for silver halide. Illustrative adsorption accelerating groups include thiocarbonyl- and/or thioether-containing groups such as thioureido, thiocarbazido, thiosemicarbazido, thioamido and oxythioamido groups; sulfur-containing heterocyclic groups; quaternary nitrogen containing groups (e.g. benzothiazolium cyclic group, pyridinium cyclic group and a group having the long-chained alkylammonium structure); a mercapto group and a benzotriazolyl group.

At least one of $R_6$ to $R_{10}$ in Formula (II) is preferably substituted by

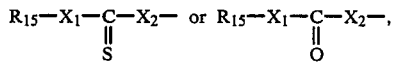

where one of $X_1$ and $X_2$ is $-N(R_{16})-$ and the other is —O—, —S— or $-N(R_{17})$-(where $R_{16}$ and $R_{17}$ are each a hydrogen atom or an optionally substituted alkyl or aryl group having up to 20 carbon atoms, provided that in the case of

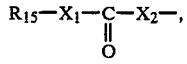

at least one of $X_1$ and $X_2$ is S); $R_{15}$ is a hydrogen atom, an optionally substituted alkyl, cycloalkyl or aryl group, a group which is the same as defined for $R_{11}$ to $R_{13}$, $-R_1'$—NH—NH—Ac group, —NH—NH—Ac group, or an alkyl, aryl or heterocyclic group substituted by $-R_1'$—NH—NH—Ac; $R_{15}$ may form a 5- or 6-membered ring together with $X_1$ or $X_2$.

If $X_1$ and $X_2$ are $-N(R_{16})-$ and $-N(R_{17})-$, respectively, the adsorption accelerating group is a thiourea group. In this case, preferred examples of $R_{16}$ and $R_{17}$ include a hydrogen atom, an alkyl group, a cycloalkyl group, a haloalkyl group (e.g. perfluoroalkyl), an aralkyl group (e.g. phenylalkyl or naphthylalkyl), and an aryl group (e.g. phenyl, naphthyl, alkylphenyl, cyanophenyl, halophenyl and alkoxyphenyl), with each of the alkyl and aryl groups preferably having up to 20 carbon atoms, more preferably up to 8 carbon atoms.

In case of a thiocarbonyl-containing group, the adsorption accelerating group is an oxythioamido group if $X_1$ is —O— and $X_2$ is $-N(R_{17})$, and a dithioamido group if $X_1$ is —S— and $X_2$ is $-N(R_{17})-$. Either group is preferred.

Typical and specific examples of the foggant represented by Formula (I) are listed below but they should by no means be taken as limiting.

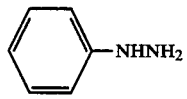

-continued
2
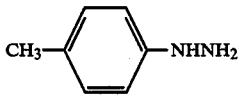
3
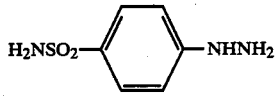
4
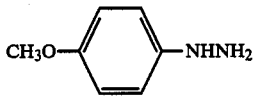
5
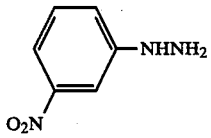
6
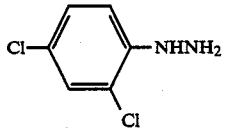
7
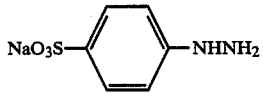
8
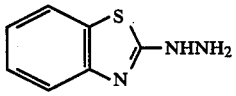
9
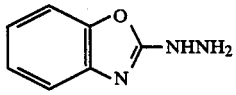
10
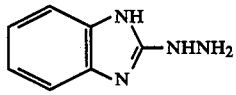
11
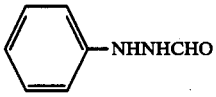
12
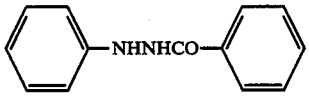
13
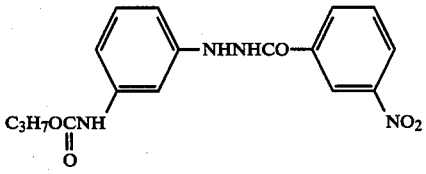

-continued
14
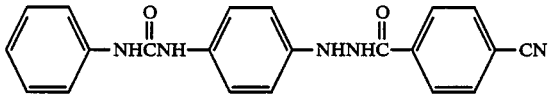
15
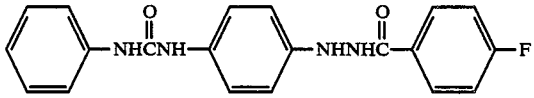
16
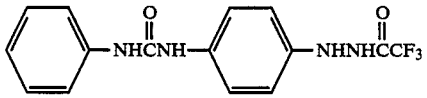
17
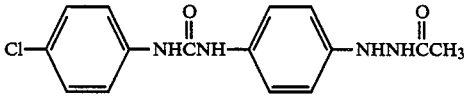
18
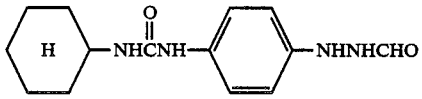
19
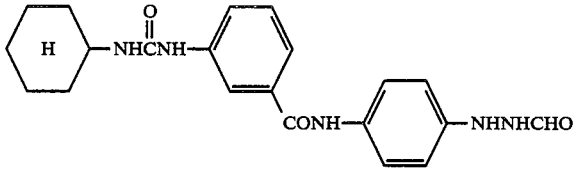
20
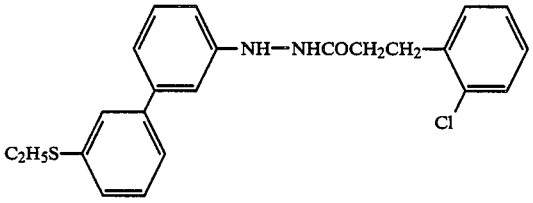
21
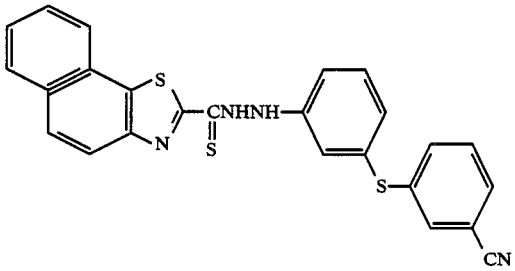
22
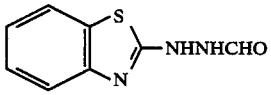
23
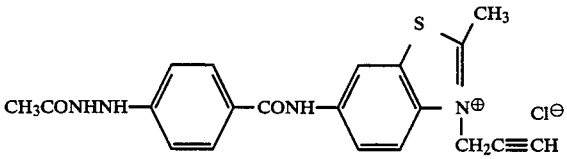

-continued
24
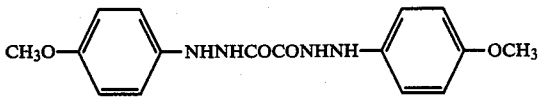
25
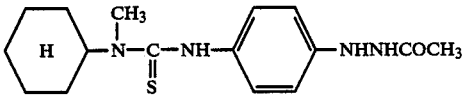
26
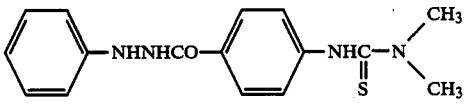
27
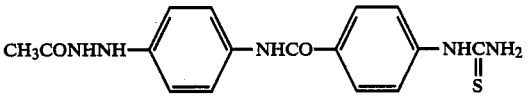
28
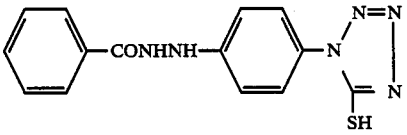
29
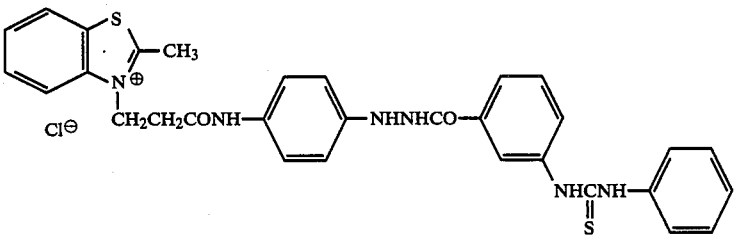
30
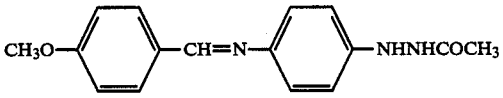
31
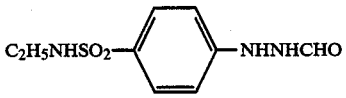
32
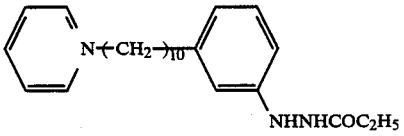
33
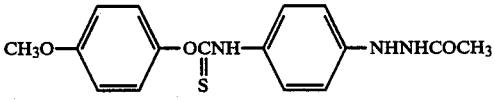
34
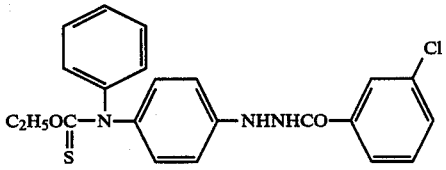

-continued
35
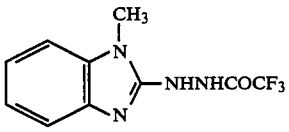
36
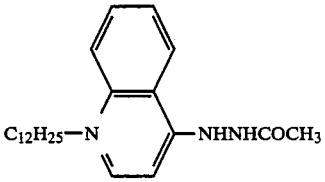
37
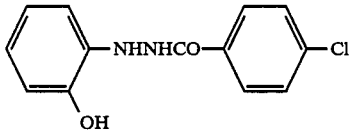
38
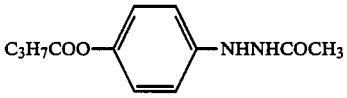
39
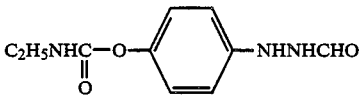
40
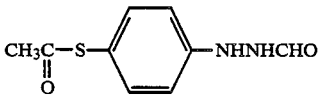
41
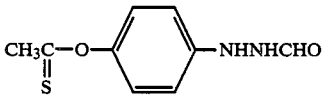
42
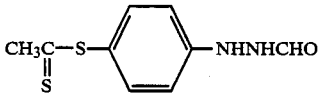
43
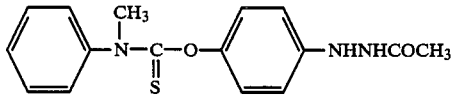
44
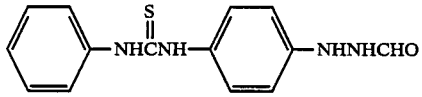
45
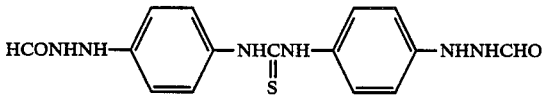
46
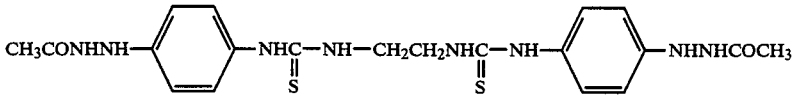

-continued

47

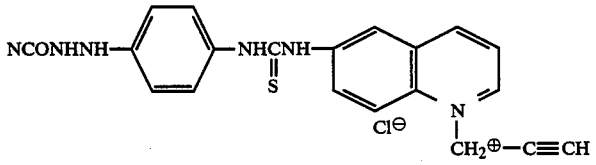

For the methods of synthesis of the foggants represented by Formula (I), see U.S. Pat. Nos. 2,663,732, 2,563,785, 2,588,982, 2,604,400, 2,618,656, 3,227,552 and 4,278,748; British Pat. Nos. 1,269,640 and 2,011,391; RD-23510 (1983); and Unexamined Published Japanese Patent Application Nos. 22325/1977, 20318/1978, 3326/1978, 74729/1979, 133126/1979, 136821/1979, 74536/1980, 151635/1980, 163533/1980, 16125/1981 and 86829/1982.

Other preferred foggants are the compounds represented by Formula (III):

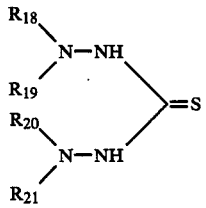

(III)

where $R_{18}$ and $R_{21}$ are each a hydrogen atom, a saturated or unsaturated aliphatic group, an aryl group, a heterocyclic group, an acyl group, an alkylsulfonyl group, an arylsulfonyl group, an alkylcarbamoyl group, an arylcarbamoyl group, an alkylsulfamoyl group, an arylsulfamoyl group or an alkoxycarbonyl group; $R_{19}$ and $R_{20}$ are each a hydrogen atom, a saturated or unsaturated aliphatic group, an aryl group or a heterocyclic group, provided that $R_{18}$ taken together with $R_{19}$, or $R_{20}$ taken together with $R_{21}$ may form a methylidene group which may be substituted by an alkyl group, an aryl group, a heterocyclic group, etc; $R_{18}$ when taken together with $R_{21}$ may form a 5- or 6-membered ring, for example, a hetero ring such as 1,2,3,4-tetrazolidine-5-thione ring or hexahydro-1,2,4,5-tetrazine-3-thione ring. The group necessary for the formation of the aforementioned hetero rings is generally a methylene group which may be mono- or di-substituted by a substituent such as an alkyl, cycloalkyl, aralkyl or aryl group. Two of such substituents (e.g. two alkyl groups) may form a ring that combines with the carbon atom in the methylene group. Illustrative rings include carbon rings such as cyclopentane, cyclohexane, 3,3,5-trimethylcyclohexane, cyclododecane and indane rings, and heterocyclic rings such as a piperidine ring.

An example of the saturated aliphatic group is an alkyl group which may be a straight-chained, branched or cyclic alkyl group having up to 18 carbon atoms. This alkyl group may have a substituent such as a carboxyl group, a carbamoyl group or a nitrile group.

An example of the olefinically unsaturated aliphatic group is an allyl group.

A particularly preferred example of the aryl group is a phenyl group which may be substituted by, for example, a halogen atom, a hydroxyl, carboxyl, sulfamoyl, amino or alkyl group. Two or more of these substituents may be present.

Examples of the acyl, alkylsulfonyl, arylsulfonyl, alkylcarbamoyl, arylcarbamoyl, alkylsulfamoyl, arylsulfamoyl and alkoxycarbonyl groups represented by R18 and R21 include formyl, acetyl, benzoyl, phenylcarbamoyl, dimethylcarbamoyl, dimethylsulfamoyl and ethoxycarbonyl groups.

Examples of the heterocyclic group are 5- or 6-membered rings having a hetero-atom such as nitrogen, oxygen or sulfur, and a specific example is furyl.

Specific examples of the compounds of Formula (III) are listed below.

48

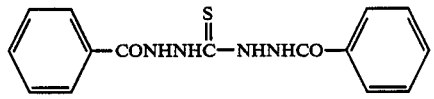

49

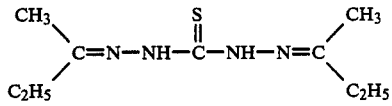

50

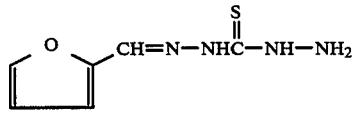

51

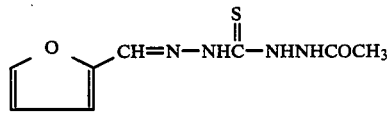

52

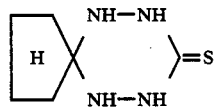

53

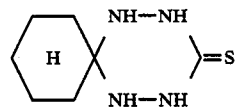

54

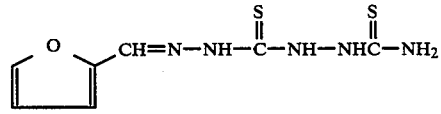

55

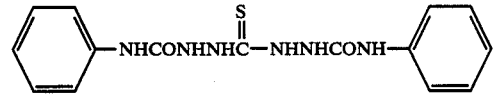

56

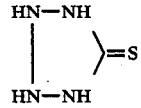

-continued

57

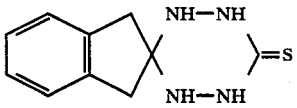

58

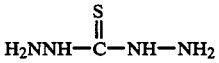

For the methods of synthesis of the foggants represented by Formula (III), see U.S. Pat. No. 4,139,387 and Research Disclosure No. 15750 (1977).

Other preferred foggants are the quaternary salt compounds of Formula (IV):

(IV)

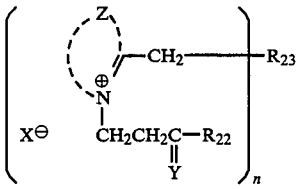

where Z represents the atomic group necessary for forming a 5- or 6-membered heterocyclic ring that has a quaternary nitrogen atom and which is selected from the group consisting of carbon, nitrogen, oxygen, sulfur and selenium atoms; Y is =O, =N—NH—$R_{24}$, =N—$R_{24}$ or =N—OH group, wherein $R_{24}$ is a hydrogen atom, an alkyl group, an aryl group or a heterocyclic group, provided that a preferred alkyl group is a lower alkyl group, with an illustrative aryl group being a phenyl group, and illustrative heterocyclic groups being azolyl groups such as indolyl, imdazolyl, oxazolyl, thiazolyl, selenazolyl and quinolyl; $R_{22}$ is a hydrogen atom, an alkyl group or an aryl group, with a lower alkyl and phenyl being preferred as alkyl and aryl groups, respectively; $R_{23}$ is a hydrogen atom, an alkyl group (preferably a lower alkyl group), an aryl group (preferably phenyl), an aryloxy group or a simple bond; n is 1 or 2, provided that n is 2 when $R_{23}$ is a simple bond; and $X^{\ominus}$ is an anion.

Examples of the quaternary nitrogen atom containing heterocyclic nucleus completed by Z in Formula (IV) are azole nuclei such as indole, imidazole, oxazole, thiazole, selenazole and quinoline nuclei. Preferred lower alkyl groups are those having 1–4 carbon atoms, such as methyl, ethyl, propyl and butyl, with alkyl groups having 1 or 2 carbon atoms being more preferred. These lower alkyl groups include substituted alkyl groups such as aralkyls (e.g. benzyl, phenetyl and phenoxymethyl).

A typical aryl group is phenyl, and an illustrative aryloxy group is phenoxy.

Illustrative anions as represented by $X^{\ominus}$ include halide anions such as bromide, chloride and iodide; sulfates such as lower alkyl sulfates (e.g. sulfate, methyl sulfate and ethyl sulfate) and aromatic sulfates (e.g. p-toluenesulfate and benzenesulfate); carboxylic acid derived acid anions such as acetate, trifluoroacetate and propionate; and various other anions such as perchlorate, cyanate, thiocyanate, sulfamate and benzoate. A particularly preferred anion is that of a halide.

Azole nuclei as the heterocyclic nuclei that are completed by Z and which contain a quaternary nitrogen atom may be illustrated by the following more specific examples: imidazole based nuclei including benzimidazole nuclei (e.g. indolenine and 5-chlorobenzimidazole) and naphthoimidazole nuclei; thiazole based nuclei such as thiazole, 4-methylthiazole, 4-phenylthiazole, 5-methylthiazole, 5-phenylthiazole, 4,5-dimethylthiazole, 4,5-diphenylthiazole and 4-(2-thienyl)thiazole; benzothiazole based nuclei such as benzothiazole, 4-chlorobenzothiazole, 5-methylbenzothiazole, 6-bromobenzothiazole, 4-phenylbenzothiazole, 4-methoxybenzothiazole, 5-iodobenzothiazole, 4-ethoxybenzothiazole, 5,6-dimethoxybenzothiazole and 5-hydroxbenzothiazole; naphthothiazole based nuclei such as naphtho(2,1-d)thiazole; oxazole based nuclei such as 4-methyloxazole, 5-methyloxazole, 4-phenyloxazole, 4,5-diphenyloxazole, 4-ethyloxazole, 4,5-dimethyloxazole and 5-phenyloxazole; benzoxazole based nuclei such as benzoxazole, 5-chlorobenzoxazole, 5-methylbenzozazole, 5-phenylbenzoxazole, 4,6-dimethylbenzoxazole, 5-methoxybenzoxazole and 5-hydroxybenzoxazole; naphthoxazole based nuclei; selenazole based nuclei such as 4-methylselenazole, and 4-phenylselenazole; banzoselenazole based nuclei such as benzoselenazole, 5-chlorobenzoselenazole, 5-methoxybenzoselenazole and 5-hydroxybenzoselenazole; naphthoselenazole based nuclei; and quinoline based nuclei such as quinoline. In order to provide affinity for silver halide, the compounds of Formula (IV) may contain in the molecule an adsorption accelerating group of the same type as is present in the compound of Formula (I).

Typical examples of the foggants represented by Formula (IV) are listed below.

59

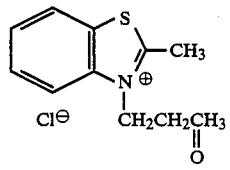

60

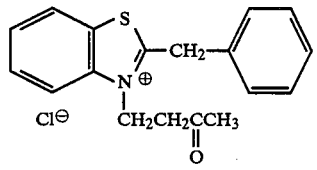

61

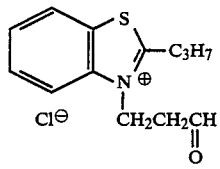

62

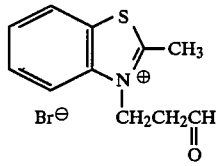

-continued

63

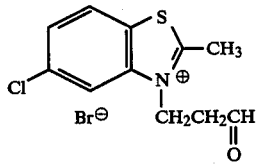

64

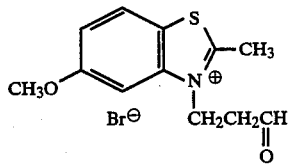

65

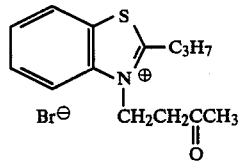

66

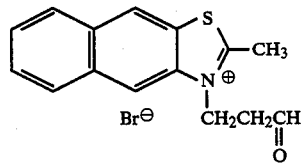

67

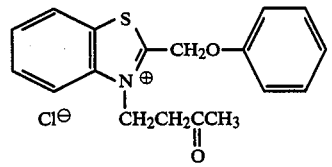

68

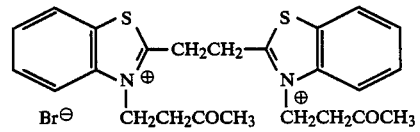

69

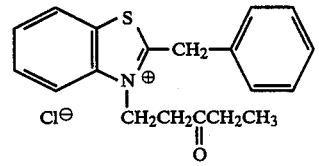

70

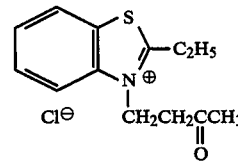

71

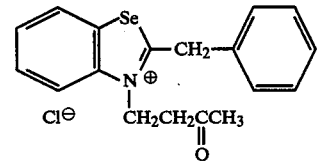

-continued

72

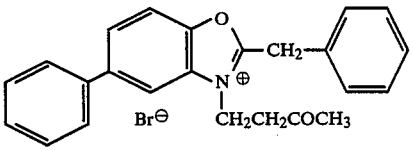

73

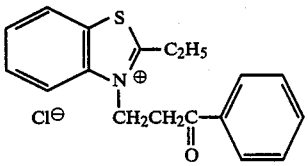

74

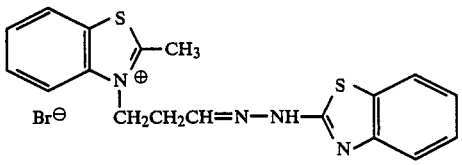

75

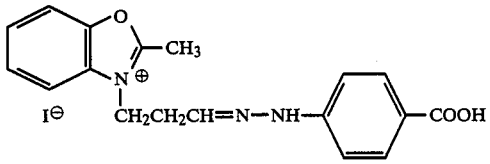

76

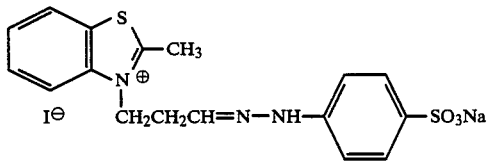

The foggants of Formula (IV) may be synthesized by referring to the method described in Unexamined Published Japanese Patent Application No. 9677/1972 and details are found in Japanese Patent Publication No. 38164/1974.

Foggants that may also be employed in the present invention are represented by Formula (V):

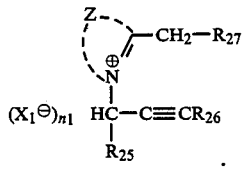

(V)

where Z′ represents the atomic group that has a quaternary nitrogen atom and which is necessary for forming the heterocyclic ring of an azolium or azinium nucleus; $R_{25}$ is a hydrogen atom or a methyl group; $R_{26}$ is a hydrogen atom or an alkyl group having 1–8 carbon atoms; $R_{27}$ is a hydrogen atom or an electron attracting substituent having a Hammet's value ($\sigma$) greater than 0.2; $X_1^{\ominus}$ is an anion which is the same as defined for $X^{\ominus}$ in Formula (IV); and $n_1$ is 0 or 1.

Examples of the azolium and azinium nuclei represented by Z′ are heterocyclic rings having thiazolinium, thiazolium, benzothiazolium, naphthothiazolium, selenazolium, benzoselenazolium, tellurazolium, benzotellurazolium, naphthotellurazolium, benzimidazolium, tetrazolium, pyridinium, quinolinium and indolenium nuclei. For further details, see Unexamined Published Japanese Patent Application Nos. 11837/1985 and 78444/1985.

The foggant represented by Formula (V) preferably contains an adsorption accelerating group in Z' or $R_{27}$ so that the foggant may be easily adsorbed on the surfaces of silver halide grains. Useful adsorption accelerating groups are thioamido groups such as oxythioamido, dithioamido and thioureido groups.

Typical examples of the foggants represented by Formula (V) are listed below.

77

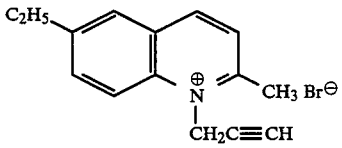

78

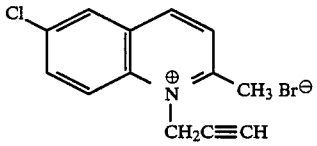

79

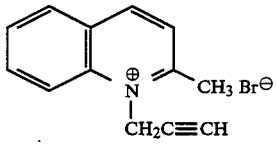

80

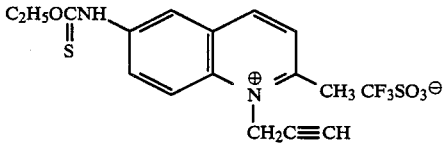

81

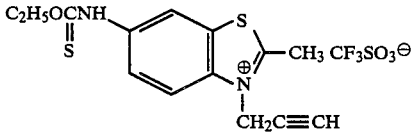

82

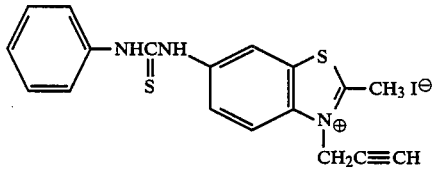

83

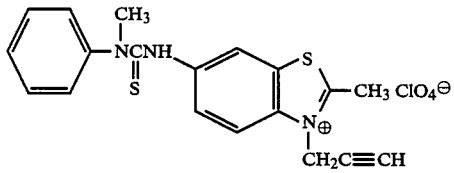

84

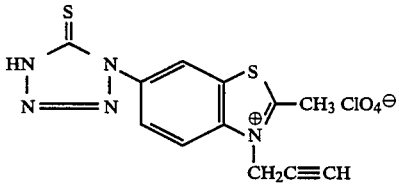

-continued

85

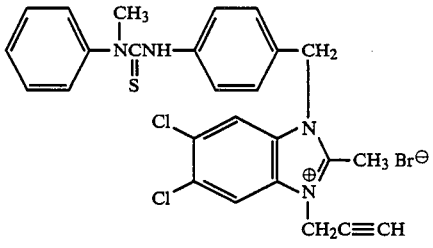

86

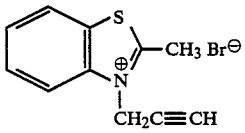

87

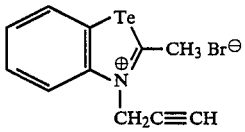

88

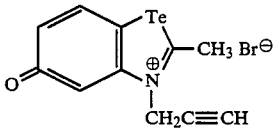

89

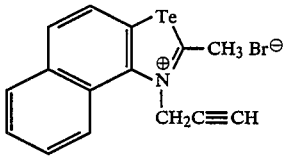

The methods of synthesis of the foggants of Formula (V) are described in Unexamined Published Japanese Patent Application Nos. 69613/1977 and 11837/1985.

Compounds represented by Formula (VI) may be used as other preferred examples of foggant:

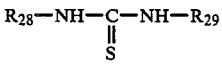

(VI)

where $R_{28}$ and $R_{29}$ are each a hydrogen atom, an alkyl group, an aryl group or a heterocyclic group.

Examples of the aryl group as $R_{28}$ and $R_{29}$ are phenyl and naphthyl; examples of the heterocyclic group include pyridyl, quinolinyl, thiazolyl, benzothiazolyl, naphthothiazolyl, oxazolyl, benzoxazolyl, naphthoxazolyl, imidazolyl, benzimidazolyl and naphthoimidazolyl.

Typical but by no means limiting examples of the foggant of Formula (VI) are listed below.

90

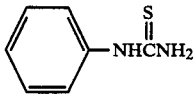

-continued

91

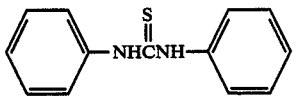

92

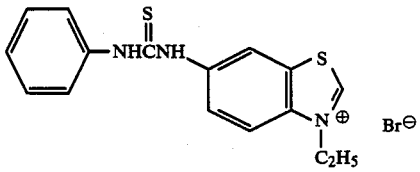

93

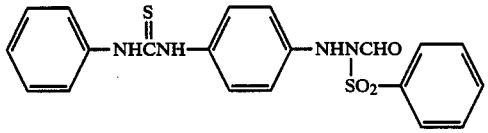

The foggants of Formula (VI) may be synthesized by known methods.

Compounds that are also useful as foggants in the present invention are listed below: N-substituted quaternary cycloammonium salts such as 2-acetyl-2-{4'-(N,N-dimethylsulfamoylamino)benzenesulfonyl}-phenylhydrazine, 2-(p-methybenzoyl)-1-(p-nitrobenzenesulfonyl)-p-hexyloxyphenylhydrazine, 2-benzoyl-2-trifluoroacetyl-1-toluenesulfonylphenylhydrazine, N,N'-ethylenediaminobis-(2-formyl-2-benzenesulfonylphenyl-hydrazine), 2-methyl-3-[3-(phenylhydrazono)-propyl]benzothiazolium bromide, 2-methyl-3-[3-(p-tolylhydarzono)propyl]benzothiazolium bromide, 2-methyl-3-[3-(p-sulfophenylhydrazono)propyl]benzothiazolium bromide, 2-methyl-3-[3-(p-sulfophenylhydrazono)pentyl]benzothiazolium iodide, 1,2-dihydro-3-methyl-4-phenylpyrido[2,1-b]benzothiazolium bromide, 1,2-dihydro-3-methyl-4-phenylpyrido[2,1-b]-5-phenylbenzoxazolium bromide, 4,4'-ethylenebis(1,2-dihydro-3-methylpyrido[2,1-b]benzothiazolium bromide), and 1,2-dihydro-3-methyl-4-phenylpyrido[2,1-b]benzoselenazolium bromide; and 5-[1-ethylnaphtho(1,2-b)thiazoline-2-ylideneethylidene]-1-(2-phenylcarbazoyl)methyl-3-(4-sulfamoylphenyl)-2-thiohydantoin, 5-(3-ethyl-2-benzothiazolinylidene)-3-[4-(2-formylhydrazino)phenyl]rhodanine, 1-[4-(2-formylhydrazino)-phenyl]3-phenylthiourea and 1,3-bis[4-(2-formylhydrazino)phenyl]thiourea.

The aforementioned foggants of Formulas (I) to (VI) may be supplied externally prior to the heating step, but preferably they are preliminarily incorporated in the silver halide photographic material.

The amount of the foggant to be used will vary significantly depending upon the type of silver halide photographic material to which the method of the present invention is applied. With an ordinary silver photographic material, the foggant is preferably used in an amount of 0.003–20 g per mole of silver halide, with the range of 0.005–5 g being more preferred. With a diffusion transfer silver halide photographic material, the foggant is preferably used in an amount of 0.005–30 g per mole of silver halide, with the range of 0.005–10 g being more preferred. With a heat developable photographic material, the foggant is preferably used in an amount of 0.002–50 g, with the range of 0.005–20 g being more preferred.

The aforementioned internal image forming silver halide emulsion may be used in the present invention is combination with a sensiting dye. Typical sensitizing dyes are cyane dyes, merocyanine dyes, complex cyanine dyes, complex merocyanine dyes, holopolar cyanine dyes, hemicyanine dyes, styryl dyes and hemioxanole dyes.

Particularly useful dyes are cyanine dyes, merocyanine dyes and complex merocyanine dyes. These dyes may employ any of the following nuclei commonly used in cyanine dyes as basic heterocyclic nuclei: pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and nucleus having an alicyclic hydrocarbon ring fused to any one of these nuclei; and nuclei having an aromatic hydrocarbon ring fused to these nuclei, such as indolenine nucleus, benzindolenine nucleus, indole nucleus, benzoxazole nucleus, naphthaoxazole nucleus, benzothiazole nucleus, naphthothiazole nucleus, benzoselenazole nucleus, benzimidazole nucleus and quinoline nucleus. These nuclei may be substituted on a carbon atom.

Merocyanine or complex merocyanine dyes may contain 5-or 6-membered heterocyclid nuclei as nuclei having the ketomethylene structure, and examples of such nuclei are a pyrazolin-5-one nucleus, thiohydantoin nucleus, 2-thioxaxolidine-2,4-dione nucleus, thiazolidine-2,4-dione nucleus, rhodanine nucleus and a thiobarubituric acid nucleus.

Sensitizing dyes useful in blue-sensitive silver halide emulsion layers are illustrated by those described in German Pat. No. 929,080; U.S. Pat. Nos. 2,231,658, 2,493,748, 2,503,776, 2,519,001, 2,912,329, 3,656,959, 3,672,897, 3,694,217, 4,025,349, and 4,046,572; British Pat. No. 1,242,588; and Japanese Patent Publication Nos. 14030/1969 and 24844/1977. Typical examples of the sensitizing dyes useful in green-sensitive silver halide emulsion layers are the cyanine, merocyanine and complex cyanine dyes shown in U.S. Pat. Nos. 1,939,201, 2,072,908, 2,739,149, and 2,945,763; and British Pat. No. 505,979. Typical examples of the sensitizing dyes useful in red-sensitive silver halide emulsion layers are the cyanine, merocyanine and complex cyanine dyes shown in U.S. Pat. Nos. 2,269,234, 2,270,378, 2,442,710, 2,454,629, and 2,776,280. The cyanine, merocyanine and complex cyanine dyes described in U.S. Pat. Nos. 2,213,995, 2,493,748 and 2,519,001, and German Pat. No. 929,080 may be advantageously used in green- or red-sensitive silver halide emulsions.

The aforementioned sensitizing dyes may be used either independently or in combination. Combined sensitizing dyes are often used for the purpose of hypersensitization and typical examples of the combinations of sensitizing dyes are found in Japanese Patent Publication Nos. 4932/1968, 4933/1968, 4936/1968, 32753/1969, 25831/1970, 26474/1970, 11627/1971, 18107/1971, 8741/1972, 11114/1972, 25379/1972, 37443/1972, 28293/1973, 38406/1973, 38407/1973, 38408/1973, 41203/1973, 41204/1973, 6207/1974, 40662/1975, 12375/1978, 34535/1979, and 1569/1980: Unexamined Published Japanese Patent Application Nos. 33220/1975, 33828/1975, 38526/1975, 107127/1976, 115820/1976, 135528/1976, 151527/1976, 23931/1977, 51932/1977, 104916/1977, 104917/1977, 109925/1977, 110618/1977, 80118/1979, 25728/1981, 1483/1982, 10753/1983, 91445/1983, 153926/1983, 114533/1984, 116645/1984 and 116647/1984; and U.S. Pat. Nos. 2,688,545, 2,977,229, 3,397,060, 3,506,443, 3,578,447, 3,672,898, 3,679,428, 3,769,301, 3,814,609 and 3,837,862.

A silver halide photographic material having a silver halide emulsion layer containing the aforementioned internal image forming silver halide emulsion may be imagewise exposed by various means. If necessary, preheating may be performed prior to exposure. Light sources suitable for use in image-wise exposure include the sunlight, a tungsten lamp, a mercury lamp, a halogen lamp such as an iodide lamp, a xenon lamp, laser light, CRT, fluorescent tube and a light-emitting diode.

The amount of imagewise exposure varies with the sensitivity of the photographic material to be processed; about 1 lux. second is necessary for a high-sensitivity material and about $10^5$ lux. second is required for a low-sensitivity material.

Any method may be employed to develop the silver halide photographic material to which the positive image forming method of the present invention can be applied. More specifically, among the silver halide photographic materials to which the present invention can be applied are ordinary black-and-white photographic materials, color photographic materials, diffusion transfer black-and-white, and color photographic materials, as well as heat-developable black-and-white and color photographic materials. These materials may be developed by respective suitable methods.

In the following pages, one embodiment of the present invention wherein it is applied to ordinary silver halide photographic materials is described. The aforementioned non-prefogged internal image forming silver halide emulsion is mixed with a binder, such as, for example, gelatin, and after addition of a spreading agent, hardener, etc., the mixture is applied to a polyester base or RC paper. Color formers, developing agents or other various additives may be added. Various couplers may be used as color formers; they are Y, M and C couplers and combined with silver halide emulsions that have been subjected to regular, ortho- and panchromatic sensitizations, respectively. These couplers may be superimposed on each other with intermediate or yellow filter layers disposed therebetween.

After exposure, these ordinary silver halide photographic materials are developed with customary black-and-white developers if they are black-and-white photographic materials, and with color developers if they are color photographic materials. The developed photographic materials are subsequently processed by, for example, fixing or bleach-fixing, to eventually produce positive images.

The photographic emulsion layers and other hydrophilic colloid layers in a silver halide photographic material using the aforementioned fogging agent and internal image forming silver halide emulsion (this photographic material is hereunder referred to as the photographic material of the present invention) may be hardened with the aid of one or more hardeners that will crosslink the molecule of the binder (or protective colloid) to produce a stronger film. The hardener may be added in an amount sufficient to enable the photographic material to harden to such an extent that there is no need to incorporate any hardener in the processing solution, but if desired, an additional amount of hardener may be present in the processing solution.

The emulsion layers in the photographic material of the present invention contain a dye forming coupler that will, in color development, enter into coupling with the oxidized product of an aromatic primary amino developing agent (e.g. p-phenylenediamine derivative or aminophenol derivative) to form a dye. A suitable dye forming coupler usually is selected for each emulsion layer so that it will form a dye that absorbs light in the spectral range of sensitivity for each emulsion layer; a yellow dye forming coupler is used in a blue-sensitive emulsion layer; a magenta dye forming coupler is used in a green-sensitive emulsion layer; and a cyan dye forming coupler is used in a red-sensitive emulsion layer. Other combinations of coupler and emulsion may be employed if such are needed for particular silver halide color photographic materials.

The aforementioned dye forming couplers desirably contain in their molecules a ballst group of 8 or more carbon atoms that will render the couplers non-diffusible. These dye forming couplers may be of the four-equivalent type that requires the reduction of four silver ions for the formation of one molecule of a dye, or of the two-equivalent type that needs the reduction of two silver ions. The dye forming couplers may incorporate a compound that will, upon coupling with the oxidized product of a developing agent, release a photographically useful fragment such as a development accelerator, bleach accelerator, developing agent, silver halide solvent, tone conditioner, hardener, fogging agent, antifoggant, chemical sensitizer, spectral sensitizer or desensitizer. These dye forming couplers may be used in combination with a colored developer capable of color correction, or a DIR coupler that releases a development retarder during development so as to improve the sharpness or granularity of image. The DIR coupler is preferably of such a type that the dye it forms has the same color hue as that of the dye formed from a dye forming coupler used in the same emulsion layer. However, different types of dyes may be formed if the resulting color contamination is unnoticeable. Instead of, or in combination with, the DIR coupler, a DIR compound that will couple with the oxidized product of a developing agent so as not only to form a colorless compound but also to release a development retarder.

Two types of DIR coupler and DIR compound are usable: one is of the type wherein a retarder is directly bonded to the coupling site, and the other is referred to as a timing DIR coupler or a timing DIR compound wherein the retarder is bonded to the coupling site by a divalent group in such a manner that said retarder will be released as by intramolecular nucleophilic or electron transfer reaction within the group that leaves upon coupling reaction. A retarder that becomes diffusible upon leaving and one that is not highly diffusible may be used either singly or in combination depending on the need. They may also be used in combination with a colorless coupler that couples with the oxidized product of an aromatic primary amino developing agent but which will not form any dye.

Known acyl acetanilide based couplers may preferably be used as yellow dye forming couplers in the present invention. Benzoyl acetanilide and pivaloyl acetanilide based compounds are particularly advantageous. Specific examples of usable yellow couplers are described in British Pat. No. 1,077,874; Japanese Published Patent No. 40757/1970; Unexamined Published Japanese Patent Application Nos. 1031/1972, 26133/1972, 94432/1973, 87650/1975, 3631/1976, 115219/1977, 99433/1979, 133329/1979, 30127/1981, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155 and 4,401,752.

Known 5-pyrazolone based couplers, pyrazolobenzimidazole based couplers, pyrazolotriazole based couplers, and open-chain acylacetanilide based couplers may preferably be used as magenta dye forming couplers in the present invention. Specific examples of advantageously usable magenta couplers are described in Japanese Patent Application Nos. 164882/1983, 167326/1983, 206321/1983, 214863/1983, 217339/1983,and 24653/1984; Japanese Patent Publication Nos. 6031/1965, 6035/1965, 40757/1970, 27411,1972 and 37854/1974; Unexamined Published Japanese Patent Application Nos. 13041/1975, 26541/1976, 37646/1976, 105820/1976, 42121/1977, 123129/1978, 125835/1978, 129035/1978, 48540/1979, 29236/1981, 75648/1981, 17950/1982, 38585/1982, 146251/1982 and 99437/1984; British Pat. No. 1,252,418; and U.S. Pat. Nos. 2,600,788, 3,005,712, 3,062,653, 3,127,269, 3,214,437, 3,253,924, 3,311,476, 3,419,391, 3,519,429, 3,558,319, 3,582,322, 3,615,506, 3,658,544, 3,705,896, 3,725,067, 3,758,309, 3,823,156, 3,834,908, 3,891,445, 3,907,571, 3,926,631, 3,928,044, 3,935,015, 3,960,571, 4,076,533, 4,133,686, 4,237,217, 4,241,168, 4,264,723, 4,301,235, and 4,310,623.

Known naphtholic and phenolic couplers may preferably be used as cyan dye forming couplers in the present invention. Specific examples of advantageously usable cyan couplers are described in British Pat. Nos. 1,038,331 and 1,543,040; Japanese Patent Publication No. 36894/1973; Unexamined Published Japanese Patent Application Nos. 59838/1973, 137137/1975, 146282/1976, 105226/1978, 115230/1979, 29235/1981, 104333/1981, 126833/1981, 133650/1982, 155538/1982, 204545/1982, 118643/1983, 31953/1984, 11954/1984, 59656/1984, 124341/1984 and 166956/1984; U.S. Pat. Nos. 2,369,929, 2,423,730, 2,434,272, 2,474,293, 2,698,794, 2,772,162, 2,801,171, 2,895,826, 3,253,924, 3,311,476, 3,485,315, 3,476,563, 3,591,383, 3,737,316, 3,758,308, 3,767,411, 3,790,384, 3,880,661, 3,926,634, 4,004,929, 4,009,035, 4,012,258, 4,052,212, 4,124,396, 4,134,766, 4,138,258, 4,146,396, 4,149,886, 4,178,183, 4,205,990, 4,254,212, 4,264,722, 4,288,532, 4,296,199, 4,296,200, 4,299,914, 4,333,999, 4,334,011, 4,386,155, 4,401,752 and 4,427,767.

Dye forming couplers, colored couplers, DIR couplers, DIR compounds, image stabilizers, color fog preventing agents, UV absorbers and brighteners are examples of the additives that need not be adsorbed on the surfaces of silver halide grains. Among these additives, those compounds which are hydrophobic may be incorporated in emulsion layers by various methods such as solid dispersion, latex dispersion and oil-in-water emulsification/dispersion techniques. Suitable methods may be selected depending upon such factors as the chemical structure of a specific hydrophobic compound. The oil-in-water emulsification/dispersion method may be implemented by any of the known methods used to disperse couplers and other hydrophobic additives. The usual practice is as follows: the hydrophobic additive is dissolved in a high-boiling point organic solvent (b.p. ≧ca. 150° C.), optionally combined with a low-boiling point and/or water-soluble organic solvent; the resulting solution is dispersed in a hydrophilic binder, such as an aqueous solution of gelatin, in the presence of a surfactant using a dispersing machine such as an agitator, homogenizer, colloid mill, flow jet mixer or sonicator; the resulting emulsion is added to a hydrophilic colloid layer of interest. These procedures may be supplemented with a step of removing the low-boiling point organic solvent after or simultaneously with the dispersing step.

If a high-boiling point organic solvent is used in combination with a low-boiling point organic solvent, the ratio of the former to the latter is preferably in the range of 1:0.1 to 1:50, more preferably from 1:1 to 1:20.

Examples of the high-boiling point solvents that are used for the purpose of incorporating couplers in emulsions are those organic solvents that will not react with the oxidized product of a developing agent and which will boil at 150° C. or higher, such as phenolic derivatives, alkyl esters of phthalic acid, phosphate esters, citrate esters, benzoate esters, alkylamides, aliphatic acid esters and trimesate esters. More specific examples of such high-boiling point organic solvents are found in U.S. Pat. Nos. 2,322,027, 2,533,514, 2,835,579, 3,287,134, 2,353,262, 2,852,383, 3,554,755, 3,676,137, 3,676,142, 3,700,454, 3,748,141, 3,779,765 and 3,837,863; British Pat. Nos. 958,441 and 1,222,753; OLS 2,538,889; Unexamined Published Japanese Patent Application Nos. 1031/1972, 90523/1974, 23823/1975, 26037/1976, 27921/1976, 27922/1976, 26035/1976, 26036/1976, 62632/1975, 1520/1978, 1521/1978, 15127/1978, 119921/1979, 119922/1979, 25057/1980, 36869/1980, 19049/1980 and 81836/1980; Japanese Patent Publication No. 29060/1973.

Examples of the low-boiling point or water-soluble organic solvents that may be used in combination with, or in place of, the aforementioned high-boiling point organic solvents are listed in U.S. Pat. Nos. 2,801,171 and 2,949,360. Examples of low-boiling and substantially water-soluble organic solvents include ethyl acetate, propyl acetate, butyl acetate, butanol, chloroform, carbon tetrachloride, nitromethane, nitroethane and benzene; illustrative water-soluble organic solvents include acetone, methyl isobutyl ketone, β-ethoxyethyl acetate, methoxy glycol acetate, methanol, ethanol, acetonitrile, dioxane, dimethylformamide, dimethyl sulfoxide, hexamethyl-phosphoric amide, diethylene glycol monophenyl ether and phenoxyethanol.

Preferred examples of the latex dispersion method that may be employed for the purpose of incorporating couplers in emulsions are described in U.S. Pat. Nos. 4,199,363, 4,214,047, 4,203,716 and 4,247,627; and Unexamined Published Japanese Patent Application Nos. 74583/1974, 59942/1976, 49943/1976 and 32552/1979.

When a hydrophobic compound is dissolved in a low-boiling point solvent either alone or in combination with a high-boiling point solvent and the resulting solution is dispersed in water by mechanical means or ultrasonic wave application, an anionic, nonionic or cationic surfactant may be employed as a dispersing aid.

If the oxidized product of a developing agent or an electron transfer agent move between emulsion layers (between layers having sensitivity to the same color and/or between layers having sensitivity to different colors), color contamination will occur, or the sharpness of image may be deteriorated, or its graininess may become noticeable. In order to avoid these problems, the photographic material of the present invention may use a color fog preventing agent. This agent may be incorporated in a specific emulsion layer; alternatively, it may be incorporated in an intermediate layer disposed between adjacent emulsion layers.

The photographic material of the present invention may employ an image stabilizer that will prevent deterioration of a dye image.

Silver halide emulsion layers and/or other hydrophilic colloid layers in the photographic material of the present invention may also incorporate compounds such as development accelerator and development retarder that will change the developability of the photographic material, or bleach accelerators. Compounds that may be preferably used as development accelerators are described in Research Disclosure No. 17463, XXI, B–D. Preferred examples of the development retarder are described in ibid., XXI, E. Black-and-white developing agents and/or precursors thereof may be used for attaining accelerated development and other purposes.

For attaining various desirable effects such as increased sensitivity, improved contrast and accelerated development, photographic emulsion layers in the photographic material of the present invention may contain polyalkylene oxides or derivatives thereof, such as ethers, esters and amines, thioether compounds, thiomorpholines, quaternary ammonium compounds, urethane derivatives, urea derivatives and imidazole derivatives.

The photographic material of the present invention may also contain auxiliary layers such as filter layers, anti-halation layers and/or anti-irradiation layers. These layers and/or emulsion layers may incorporate dyes that will flow out of the photographic material or which will be bleached during development.

A mat agent may be added to silver halide emulsion layers and/or other hydrophilic colloid layers in the photographic material of the present invention with a view to reducing the gloss of the photographic material, improving ink receptivity, or avoiding blocking of two units of photographic material.

Various surfactants may also be incorporated in photographic emulsion layers and/or other hydrophilic colloid layers in the photographic materials of the present invention for attaining various purposes such as improving coating properties, preventing static buildup, improving slip properties, facilitating emulsification/-dispersion, antiblocking, and improving photographic properties (e.g. accelerated development, hardening and sensitization).

Bases that may be used with the photographic material of the present invention include flexible reflective bases such as paper or synthetic paper that is laminated with α-olefin polymers (e.g. polyethylene, polypropylene and ethylene/butene copolymer); films made of semi-synthetic or fully synthetic polymers such as acetyl cellulose, cellulose nitrate, polystyrene, polyvinyl chloride, polyethylene terephthalate, polycarbonate and polyamide; flexible bases having a reflective layer formed on these films; as well as glass, metal and ceramics.

After treating its surface by corona discharge, ultraviolet radiation or a flame, the base may be coated with emulsion layers either directly or after forming one or more subbing layers with a view to preventing blocking or static buildup, or improving dimensional stability, abrasion resistance, hardness, anti-halation properties, frictional properties and/or other properties.

In coating emulsions, a thickener may be used to provide better coating properties. Any additive such as a hardener that may, because of its high reactivity, cause gelation if it is incorporated in the coating solution prior to coating procedures is preferably mixed in the coating solution by a static mixer or the like, just before coating operations are started.

In preparing the photographic material of the present invention, silver halide emulsion layers and other protective colloid layers may be coated by the method described in Research Disclosure No. 17463, XV, A and dried by the method in B., ibid.

The photographic material of the present invention may incorporate plasticizers, UV absorbers, mordants for various dyes, brighteners, lubricants and other additives depending on the need.

If the photographic material of the present invention is an ordinary silver halide photographic material, it may be developed by any of the methods that are used with the ordinary silver halide photographic materials. The development process used may be for black-and-white photography intended to form a silver image, or for color photography wherein a color image is to be formed.

Each of the steps involved in the processing of the photographic material of the present invention is usually accomplished by immersing said material within a specific processing solution. Other methods may be employed and they include, for example, the spray method wherein a specific processing solution is sprayed, the web method wherein the photographic material is brought into contact with a carrier impregnated with a suitable processing solution, or by viscous development.

The essential steps for the processing of black-and-white photographic materials are development, fixing and washing. The washing step may be omitted if the stopping step is performed after development, or if the stabilizing step is carried out after fixing. Development may be accomplished by the sole use of an alkali solution, with a developing agent or its precursor being incorporated in the photographic material. Development using a lithographic developer may be performed.

Color photographic materials are processed by the sequence of color development, bleaching, fixing, and optionally washing and/or stabilization. The two different treatments using a bleaching solution and a fixing solution may be replaced by a bleach-fixing step using a monobath bleach-fixing solution. If desired, a monobath treatment may be performed using a monobath development-bleach-fixing solution capable of accomplishing color development, bleaching and fixing in a single bath.

These steps may be combined with a prehardening step, a neutralization step therefor, a stopping-fixing step, and a post-hardening step. The color development step may be replaced by an activator treatment wherein the photographic material containing a color development or its precursor is developed with an activator solution. In place of the monobath treatment, the activator treatment may be performed simultaneously with bleaching and fixing steps. Typical schemes for performing these processes are shown below (each of these schemes ends with either one of washing, stabilization, and washing/stabilization steps):

1. color development—bleaching—fixing;
2. color development—blixing;
3. prehardening—neutralization—color development—stopping/fixing—washing—bleaching—fixing—washing—posthardening;
4. color development—washing—auxiliary color development—stopping—bleaching—fixing;

5. monobath treatment;
6. activator treatment—blixing; and
7 activator treatment—bleaching—fixing.

Another embodiment of the present invention is what is generally referred to as the diffusion transfer process wherein the aforementioned color former is a diffusible dye releasing or forming compound and a diffusible dye that has formed as a function of development is diffusibly transferred onto an image-receiving layer that is disposed on a base which is the same as or separate from the one carrying said dye releasing or forming compound.

The photographic material of the present invention used as a diffusion transfer material is hereunder described. The dye providing material used for diffusion transfer photography in the present invention may be of the initially mobile type which is to be treated with an alkaline composition, or it may be immobilized (non-diffusible) from the beginning. Examples of the initially mobile dye providing materials that are useful in the present invention are described in U.S. Pat. Nos. 2,983,606, 3,536,739, 2,756,142, 3,705,184, 3,482,972, 3,880,658 and 3,854,985. Other examples are ordinary couplers that react with oxidized aromatic primary amino color developing agents to form or release dyes, as described in U.S. Pat. No. 3,227,550 and Canadian Pat. No. 602,607. Preferred examples of the dye providing materials that are immobilized from the beginning are dye releasing redox compounds (hereunder referred to as DRR compounds).

DRR compounds are well known in the art; they will react with oxidized or unoxidized developing agents or electron transfer agents to release dyes. Illustrative non-diffusible DRR compounds are those which are negatively developable, as described in U.S. Pat. Nos. 3,728,113, 3,725,062, 3,698,897, 3,628,952, 3,443,939, 3,443,940, 4,053,312 and 4,076,529; Unexamined Published Japanese Patent Application Nos. 104343/1976, 46730/1978, 50736/1978, 113624/1976, 3819/1978, 54021/1979, 16131/1981 and 85055/1982; and Research Disclosure Nos. 15157 (1976) and 15654 (1977).

In a preferred embodiment, dye releasing agents of the type described in Unexamined Published Japanese Pat. Nos. 104343/1976 and 85055/1982 are used. Illustrative compounds suitable for use as such agents are stabilized sulfonamides that are capable of releasing diffusible dyes as a result of cleavage with an alkali upon oxidation.

In another preferred embodiments, positively developable non-diffusible DRR compounds may be used and examples of such compounds are described in U.S. Pat. Nos. 3,980,479, 4,139,379, 4,139,389, 4,199,354, 4,199,355 and 4,232,107; and Unexamined Published Japanese Patent Application Nos. 142530/1981 and 105738/1982.

These dye providing materials are incorporated in emulsion layers or in layers adjacent thereto. A layer containing a dye providing material is usually formed as a separate layer that lies below an emulsion layer (i.e., farther away from the exposure light).

The photographic material of the present invention, when it is used in diffusion transfer photography, consists of an image-receiving sheet and a light-sensitive sheet containing the internal image forming silver halide emulsion and fogging agent in accordance with the present invention. The image-receiving sheet contains an image-receiving layer that is capable of receiving an image-forming material from the light-sensitive sheet. If the formation of a color image is desired, the image-receiving layer should contain a mordant that fixes a dye image forming material or its precursor. A variety of mordants may be used in the present invention and useful types are selected in consideration of such factors as the physical properties of the dye image forming material, transfer conditions and the other components present in the photographic material.

Widely known mordants are nitrogen-containing secondary and tertiary amines, nitrogen-containing heterocyclic compounds and quaternary cationic compounds thereof. Vinyl pyridine polymers and vinyl pyridinium cationic polymers are disclosed in U.S. Pat. Nos. 2,548,564, 2,484,430, 3,148,061 and 3,756,814. Aqueous sol type mordants are disclosed in U.S. Pat. Nos. 3,958,995, 2,721,852 and 2,798,063. Water-insoluble mordants are disclosed in Unexamined Published Japanese Patent Application No. 61228/1975. Other usable mordants are disclosed in U.S. Pat. Nos. 3,709,690 and 3,788,855; German Patent Application No. 2,843,320; Unexamined Published Japanese Patent Application Nos. 30328/1978, 155528/1977, 125/1978, 1024/1978, 74430/1979, 124726/1979 and 22766/1980; U.S. Pat. Nos.3,642,482, 3,488,706, 3,557,066, 3,271,147 and 3,271,148; Japanese Patent Publication Nos. 29418/1980, 36414/1981 and 12139/1982; Research Disclosure No. 12045(1974).

Among these mordants, those which will not easily move from the image-receiving layer to other layers are preferred; illustrative preferred mordants are those which will crosslink with matrices such as gelatin, water-insoluble mordants and water-reducible latex type mordants. Particularly preferred are mordants that are made of N-vinyl imidazole containing polymers that will produce a transfer dye image having a higher degree of lightfastness.

The image-receiving layer may be a coat solely made of one or more of the mordants listed above, but preferably, they are dispersed in hydrophilic binders such as gelatin, polyvinyl alcohol, polyacrylamide, hydroxyethyl cellulose, polyvinyl methyl ether, N-methoxymethyl polynexylmethylene adipamide, polyvinyl pyrrolidone, and hydrodiene phthalate.

Known types of gelatin may be used in the image-receiving layer, but more often than not, acid-treated gelatin is used.

The ratio of mixing mordants and gelatin and the amount of the mordant to be coated may be readily determined by those skilled in art in consideration of the amount of the dye image forming material to be fixed, the type and composition of the mordant, and the image forming process employed. The preferred mixing ratio of mordant to gelatin ranges from 20/80 to 80/20 (w/w) and the mordant is preferably coated in an amount of 0.5–8 g/m$^2$.

The image-receiving layer may contain an ultraviolet absorber that prevents fading of a fixed dye image by ultraviolet radiation. The image-receiving layer may also contain a brightener such as stilbene, coumalin, triazine or oxazole, and an anti-fading agent such as chromanol or alkylphenol.

The image-receiving layer may further contain one or more of the development retarders (or inhibitors) or precursors thereof described in U.S. Pat. Nos. 3,260,597, 3,575,699 and 3,649,267; and British Pat. No. 2,035,589.

The aforementioned compounds other than mordants may be incorporated in layers adjacent the image-receiving layer.

If the image-forming material from the light-sensitive layer is made of a silver complex salt that forms a black-and-white image on the image-receiving layer, the latter contains silver precipitation nuclei (also called physical development specks) of heavy metals (e.g. gold, silver, platinum and palladium) or sulfides or selenides of sparingly water-soluble zinc, mercury, lead, chromium, nickel, copper, silver or gold.

The image-receiving sheet or light-sensitive sheet may contain a neutralizing layer that will neutralize the alkali carried over from the processing solution, thereby providing a stabler transfer image. The neutralizing layer contains an acid substance that will, when formation of a transfer image has been substantially completed, reduce the pH of the image-receiving material from about 14 down to at least 11, preferably 10 or below, so as to substantially prevent further progress of the image forming process. Preferred acid substances are those which contain an acidic group having a pKa value of 9 or below (e.g. carboxyl or sulfonic acid group) or a precursor that will be hydrolyzed to provide such acid groups. Particularly preferred examples are copolymers of acrylic acid, ethylene and maleic anhydride, and copolymers of a half ester of n-butyl, acrylic acid and butyl acrylate. Other usable acid substances and their functions are described in Research Disclosure Nos. 12331 (1974) and 13525 (1975).

Above or below the neutralizing layer may be disposed (either directly or indirectly) one or more timing layers or inactive spacer layers. These layers have the capability of "timing" or controlling the pH as a function of the rate at which the alkali treating agent will diffuse through the inactive spacer layer. Examples of such timing layer and its function are disclosed in Unexamined Published Japanese Patent Application Nos. 69629/1981, 6842/1982, 6843/1982, 145217/1977, 54341/1980 and 60332/1982.

A timing layer that may be used with particular advantage is made of carboxy-ester-lactone as described in Unexamined Published Japanese Patent Application Nos. 54341/1980 and 179841/1982.

The neutralization as combined with the timing layer is disposed in the light-sensitive layer or image-receiving layer.

The process of forming a dye image in a "two-sheet" diffusion transfer photographic material consists of an exposure step, a step of increasing the surface sensitivity of the aforementioned silver halide in the substantial absence of water, a step of developing the light-sensitive sheet by application of the processing composition, and a step of superposing the light-sensitive sheet on the image-receiving sheet.

After increasing the surface sensitivity of silver halide in the substantial absence of water, the exposed light-sensitive sheet is immersed in the processing composition at 15°–33° C. for a period of 5–30 seconds. The light-sensitive sheet and the image-receiving sheet are then passed between a pair of nip rollers so that the light-sensitive layer in the former sheet is in close contact with the image-receiving layer in the latter. These treatments may be performed either manually or automatically using a tank or shallow tray type apparatus holding the processing composition. A particularly preferred apparatus is an image transfer processor of the type described in U.S. Pat. No. 4,233,991 and Unexamined Published Japanese Patent Application No. 4143/1983.

The assembled light-sensitive and image-receiving sheets are then held in that condition for 1–15 minutes, during which time at least part of the imagewise distribution of the image forming material produced in the light-sensitive layer as a result of development transfers to the image-receiving layer to form a transfer image. Thereafter, the light-sensitive layer is separated from the image-receiving layer.

The alkaline processing or activating composition used in the present invention is a liquid composition containing the processing components necessary both for the development of a silver halide emulsion and for the formation of a diffusion transfer image. The solvent is principally composed of water and may contain hydrophilic solvents such as methanol and methyl cellosolve.

The processing composition contains a sufficient amount of alkali to maintain the pH necessary for causing development of the emulsion layer and, if a dye image is desired, to neutralize the acid that forms during development and dye image formation. Usable alkalis include alkali metal halides such as sodium hydroxide, potassium hydroxide and cesium hydroxide, and amines such as diethylamine. These alkalis preferably have a pH of about 12 or higher. The processing composition may contain a developing agent.

Various silver halide developing agents are useful in the present invention. Different developing agents may be combined as shown in U.S. Pat. No. 3,039,869. The developing agents may be incorporated in the processing composition, but better results are obtained if they are incorporated in light-sensitive layers that are to be activated by the alkaline processing composition (e.g. silver halide emulsion layers), dye image forming material layers, intermediate layers or image-receiving layers.

Developing agents that may be used in the present invention are listed below: hydroquinone, aminophenol (e.g. N-methylaminophenol), 1-phenyl-3-pyrazolidinone, 1-phenyl-4,4-dimethyl-3-pyrazolidinone, 1-phenyl-4-methyl-4-hydroxymethyl-3-pyrazolidinone, 1-p-tolyl-3-pyrazolidinone, p-tolyl-4-methyl-4-hydroxymethyl-3-pyrazolidinone, N,N-diethyl-p-phenylenediamine, 3-methyl-N,N-diethyl-p-phenylenediamine and 3-methoxy-N-ethoxy-p-phenylenediamine.

If delayed release of the developing agent is required, development precursors bonded to blocking groups as shown in Unexamined Published Japanese Patent Application No. 53330/1980 are preferably used.

It is sometimes advantageous that the processing composition contains a light-absorbing material (e.g. carbon black or pH indicator) or a compound of the type described in U.S. Pat. No. 3,579,333, so as to prevent the light-sensitive layer from being fogged during the processing. The liquid processing composition may also contain a development retarder such as benzotriazole.

The processing composition may also contain compounds that will provide for accelerated development or dye diffusion, such as benzyl alcohol, the glycols and/or aminoalcohols described in Unexamined Published Japanese Patent Application No. 127233/1978, and the saturated aliphatic alcohols or saturated alicyclic alcohols described in Unexamined Published Japanese Patent Application No. 74541/1980. Particularly preferred are aliphatics and aliphatic primary amines such as the 11-aminoundecanoic acids and/or 6-aminohexanoic acid described in Unexamined Published Japanese Patent Application No. 81119/1978.

The processing composition may also contain buffers (see Research Disclosure Nos. 19565 and 19566) and various surfactants in order to improve the penetrability of the processing components.

In still another embodiment, the photographic material of the present invention is a heat developable material which is processed by a scheme containing a heat development step.

This embodiment wherein the present invention is applied to a heat developable photographic material is hereunder described.

The heat developable photographic material is known in the art, and details of this material and methods of processing the same are found in U.S. Pat. Nos. 3,152,904, 3,301,678, 3,392,020, and 3,457,075; British Pat. Nos. 1,131,108 and 1,167,777; and Research Disclosure No. 17029(1978).

If the photographic material of the present invention is a heat developable material (hereunder referred to as the heat developable photographic material of the present invention), it may be of any type that is capable of forming an image by heat development, for example, the black-and-white type that forms a silver image by heat development, or the color type that uses a dye providing material. Photographic materials of the color type are divided into two groups, one being intended to produce a monochromatic color using a black dye providing material or any other monochromatic dye providing material, and the other being designed to produce multiple color such as yellow, cyan and magenta. In the method usually employed for the photographic materials of the color type, only the dyes that have formed color are transferred onto an image-receiving element.

The black-and-white type heat developable photographic material which forms a silver image is basically composed of a heat developable light-sensitive layer (i.e., a silver halide emulsion layer on a base) that contains, in addition to the aforementioned fogging agent, (1) an internal image forming silver halide, (2) a reducing agent, (3) a binder, and optionally (4) an organic silver salt.

The color type photographic material which forms a dye image is basically composed of at least one heat developable light-sensitive layer (i.e., a silver halide emulsion layer on a base) that contains, in addition to the aforementioned fogging agent, (1) an internal image forming silver halide, (2) a reducing agent, (3) a binder and (5) a dye providing material, and optionally (4) an organic silver salt. Not all of these agents need be incorporated in a single light-sensitive layer and they may be incorporated in two or more light-sensitive layer so long as they are kept in a mutually reactive state; for example, one light-sensitive layer may be divided into two sublayers, and components (1) to (4) are incorporated in one sublayer while the dye providing material (5) is incorporated in the other sublayer which is adjacent the first layer.

Alternatively, one light-sensitive layer may be divided into two or more sublayers in such a manner that one of them has a higher sensitivity and the other has a lower sensitivity. If desired, one or more additional layers having sensitivity to different colors, or various photographic layers such as an overcoat, subbing layer, a backing layer, and an intermediate layer may be provided.

Coating solutions are prepared not only for the provision of the heat developable light-sensitive layer of the present invention but also for the formation of other photographic layers such as protective, intermediate, subbing and backing layers; such respective coating solutions may be applied by various techniques such as dip coating, air knife coating, curtain coating or the hopper coating method described in U.S. Pat. No. 3,681,294, whereby the heat developable photographic material of the present invention is obtained.

If necessary, two or more layers may be coated simultaneously by the methods described in U.S. Pat. No. 2,761,791 and British Pat. No. 837,095.

The components of the light-sensitive layer and other photographic layers in the heat developable photographic material of the present invention are thus applied to a base to provide a thickness which, in the dry state, preferably ranges from 1 to 1,000 μm, more preferably from 3 to 20 μm.

The heat developable photographic material of the present invention may use a variety of organic silver salts with a view to providing enhanced sensitivity and developability.

Illustrative organic silver salts suitable for use in the heat developable photographic material of the present invention include silver salts of aliphatic carboxylic acids (e.g. silver laurate, silver myristate, silver palmitate, silver stearate, silver arachidonate, silver behenate and silver α-(1-phenyltetrazolethio)acetate) and silver salts of aromatic carboxylic acids (e.g. silver benzoate and silver phthalate) of the types described in Japanese Patent Publication Nos. 4921/1968, 26582/1969, 18416/1970, 12700/1970 and 22185/1970, Unexamined Published Japanese Patent Application Nos. 52626/1974, 31728/1977, 137321/1977, 141222/1977, 36224/1978 and 37610/1978 and U.S. Pat. Nos. 3,330,633, 3,794,496, 4,105,451, 4,123,274 and 4,168,980 and silver salts containing an imino group as described in Japanese Patent Publication Nos. 26582/1967, 12700/1970, 18416/1970, 22185/1970, Unexamined Published Japanese Patent Application Nos. 118638/1983 and 118639/1983.

With these imino containing silver halides being illustrated by benzotirazole silver, 5-nitrobenzotriazole silver, 5-chlorobentriazole silver, 5-methoxybenzotriazole silver, 4-sulfobenzotriazole silver, 4-hydroxybenzotriazole silver, 5-aminobenzotriazole silver, 5-carboxybenzotriazol silver, imidazole silver, benzimidazole silver, 6-nitrobenzimidazole silver, pyrazole silver, urazole silver, 1,2,4-triazole silver, 1H-tetrazole silver, 3-amino-5-benzylthio-1,2,4-triazole silver, saccharin silver, phthalazinone silver and phthalimide; as well as 2-mercaptobenzoxazole silver, mercaptooxadiazole silver, 2-mercaptobenzothiazole silver, 2-mercaptobenzimidazole silver, 3-mercapto-4-phenyl-1,2,4-triazole silver, 4-hydroxy-6-methyl-1,3,3a,7-tetrazaindene silver and 5-methyl-7-hydroxy-1,2,3,4,6-pentazaindene silver. Among these organic silver salts, those containing an imino group are preferred, and silver salts of benzotirazole derivatives are more preferred. Particularly preferred silver salts are those of sulfobenzotriazole derivatives.

The aforementioned organic silver salts may be used either independently or in combination. Isolated forms may be used after being dispersed in binders by suitable means. Alternatively, organic silver salts prepared in suitable binders maybe directly used without being isolated.

The organic silver salts are preferably used in amounts of 0.01–500 moles, more preferably 0.1–100 moles, per mole of the light-sensitive silver halide.

The heat developable photographic material of the present invention may employ reducing agents that are commonly used in the field of thermally developable photographic materials. Examples are p-phenylenediamine and p-aminophenol based developing agents, phosphoroamidophenol and sulfonamidophenol based developing agents, and hydrazone based color developing agents of the types described in U.S. Pat. Nos. 3,531,286, 3,761,270, and 3,764,328; RD Nos. 12146, 15108 and 15127; and Unexamined Published Japanese Patent Application No. 27132/1981. Precursors for color developing agents of the types described in U.S. Pat. Nos. 3,342,599, and 3,719,492; and Unexamined Published Japanese Patent Application Nos. 135628/1978 and 79035/1979 may be used with advantage.

Particularly preferred reducing agents are those which are represented by formula (1) as shown in Unexamined Published Japanese Patent Application No. 146133/1981:

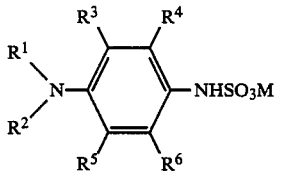

(1)

where $R^1$ and $R^2$ are each a hydrogen atom or an optionally substituted alkyl group having 1 to 30 (preferably 1–4) carbon atoms, provided that $R^1$ and $R^2$ may, when taken together, form a heterocyclic ring; $R^3$, $R^4$, $R^5$ and $R^6$ are each a hydrogen atom, a halogen atom, a hydroxy group, an amino group, an alkoxy group, an acylamido group, a sulfonamido group, an alkylsulfonamido group or an optionally substituted alkyl group having 1–30 (preferably 1–4) carbon atoms, provided that $R^3$ and $R^1$, and $R^5$ and $R^2$ may, when each taken together, form a heterocyclic ring; and M is an alkali metal atom, an ammonium group, a nitrogen-containing organic base, or a compound having a quaternary nitrogen atom.

The nitrogen-containing organic base in formula (1) is an organic compound having a nitrogen atom that exhibits basicity and which is capable of forming a salt with an inorganic acid. A particularly important organic base is an amine compound. Illustrative chained amine compounds are primary, secondary and tertiary amines; illustrative cyclic amine compounds include pyridine, quinoline, piperidine and imidazole, each being notable as a typical heterocyclic organic base. Other useful chained amines are hydroxylamine, hydrazine and amidine. Preferred salts of the nitrogen-containing organic base are inorganic acid salts (e.g. hydrochloride, sulfate and nitrate) of the aforementioned organic bases.

Examples of the compound having a quaternary nitrogen atom in formula (1) are salts and hydroxides of nitrogen compounds having four covalent bonds.

Preferred examples of the reducing agent represented by formula (1) are listed below.

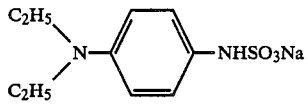

(R-1)

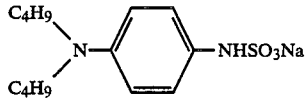

(R-2)

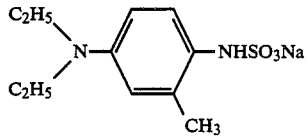

(R-3)

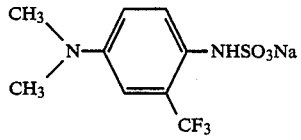

(R-4)

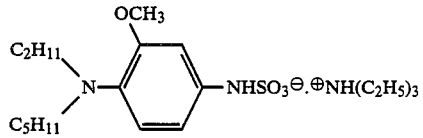

(R-5)

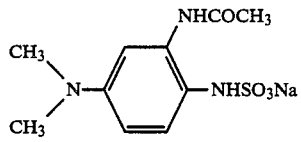

(R-6)

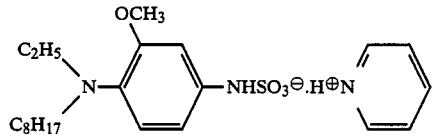

(R-7)

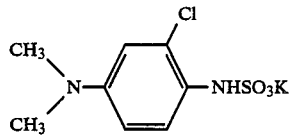

(R-8)

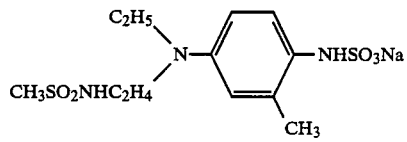

(R-9)

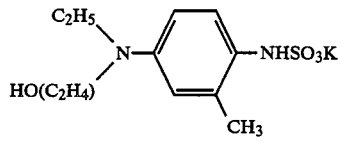

(R-10)

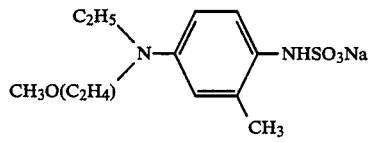

(R-11)

-continued (R-12)

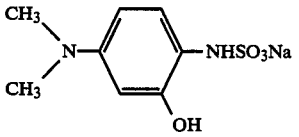

(R-13)

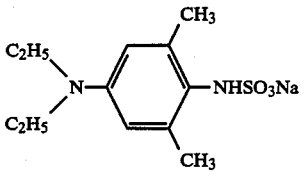

(R-14)

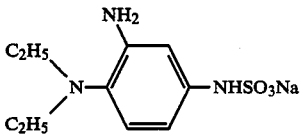

(R-15)

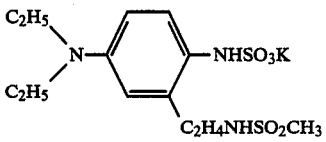

(R-16)

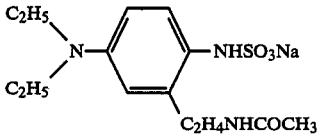

(R-17)

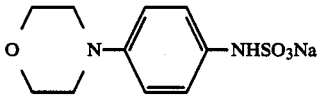

(R-18)

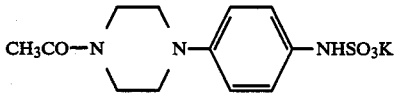

(R-19)

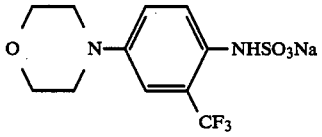

(R-20)

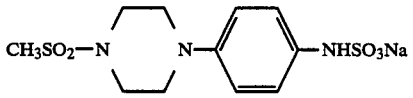

(R-21)

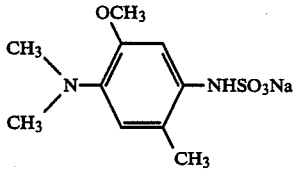

(R-22)

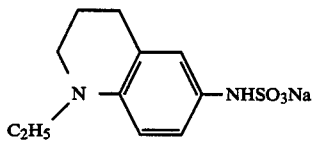

-continued (R-23)

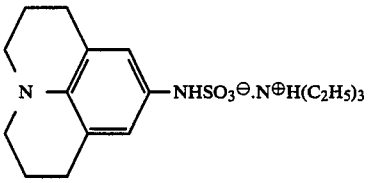

The reducing agents of formula (1) may be synthesized by any known method such as the one described in Houben-Weyl, Methoden der Organischen Chemie, Band XI/2, pp. 645–703.

If the dye providing material is one of the compounds described in Unexamined Published Japanese Patent Application Nos. 179840/1982, 58543/1983, 152440/1984 and 154445/1984 (i.e., a compound that will release a dye upon oxidation, a compound that will lose its dye releasing ability upon oxidation, or a compound that will release a dye upon reduction), or in the case where only a silver image is to be formed in the absence of any dye providing material, the reducing agents described below may be employed: phenols such as p-phenylphenol, p-methoxyphenol, 2,6-di-tert-butyl-p-cresol, and N-methyl-p-aminophenol; sulfonamidophenols such as 4-benzenesulfonamidophenol, 2-benzenesulfonamidophenol, 2,6-dichloro-4-benzenesulfonamidophenol, and 2,6-dibromo-4-(p-toluenesulfonamido)phenol; polyhydroxybenzenes (e.g. hydroquinone, tert-butylhydroquinone, 2,6-dimethylhydroquinone, chlorohydroquinone, carboxyhydroquinone, catechol and 3-carboxycatechol; naphthols such as α-naphthol, β-naphthol, 4-aminonaphthol and 4-methoxynaphthol; hydroxynaphthyls and methylenebisnaphthols such as 1,1'-dihydroxy-2,2'-binaphthyl, 6,6'-dibromo-2,2'-dihydroxy-1,1'-binaphthyl, 6,6'-dinitro-2,2'-dihydroxy-1,1'-binaphthyl, 4,4'-dimethoxy-1,1'-dihydroxy-2,2'-binaphtyl and bis(2-hydroxy-1-naphthyl) methane; methylenebisphenols such as 1,1-bis(2-hydroxy-3,5-dimethylphenyl)-3,5,5-trimethylhexane, 1,1-bis(2-hydroxy-3-tert-butyl-5-methylphenyl)-methane, 1,1-bis(2-hydroxy-3,5-di-tert-butylphenyl)methane, 2,6-methylenebis(2-hydroxy-3-tert-butyl-5-methylphenyl)-4-methylphenol, α-phenyl-α,α-bis(2-hydroxy-3,5-di-tert-butylphenyl)methane, α-phenyl-α,α-bis(2-hydroxy-3-tert-butyl-5-methylphenyl)methane, 1,1-bis(2-hydroxy-3,5-dimethylphenyl)-2-methylpropane, 1,1,5,5,-tetraquis(2-hydroxy-3,5-dimethylphenyl)-2,4-ethylpentane, 2,2-bis(4-hydroxy-3,5-dimethylphenyl)-propane, 2,2-bis(4-hydroxy-3-methyl-5-tert-butylphenyl)propane, and 2,2-bis(4-hydroxy-3,5-di-tert-butylphenyl)propane; as well as ascorbis acids, 3-pyrazolidones, pyrazolones, hydrazones and paraphenylenediamines.

These reducing agents may be used either independently or in combination. The amount of the reducing agent used depends on the type of each of the light-sensitive silver halide, organic silver salt and other additives used. Usually, the reducing agent is used in an amount of 0.01–1,500 moles, preferably 0.1–200 moles, per mole of the light-sensitive silver halide.

Binders that are used in the heat developable photographic material of the present invention include polyvinyl butyral, polyvinyl acetate, ethyl cellulose, polymethyl methacrylate, cellulose acetate butyrate, polyvinyl alcohol, polyvinylpyrrolidone, gelatin and phthalated gelatin. These synthetic or natural polymers may be used either alone or in combination. Preferably, gelatin or derivatives thereof are used in combination with hydrophilic polymers such as polyvinylpyrrolidone and polyvinyl alcohol. More preferred binders are described in Japanese Patent Application No. 104249/1983, and their essential components are gelatin and a vinylpyrrolidone polymer. The vinylpyrrolidone polymer may be polyvinylpyrrolidone which is a homopolymer of vinylpyrrolidone, or may be a copolymer (or graft copolymer) of vinylpyrrolidone and one or more copolymerizable monomers. These polymers may be used independently of their degree of polymerization. The polyvinylpyrrolidone may be a substituted polyvinylpyrrolidone, and the preferred molecular weight range for polyvinylpyrrolidone is from 1,000 to 400,000. Illustrative monomers that are copolymerizable with vinylpyrrolidone are vinyl monomers such as acrylic acid, methacrylic acid, (meth)acrylic acid esters, (e.g. esters of alkyls), vinyl alcohols, vinylimidazoles, (meth)acrylamides, vinylcarbinols, and vinylalkyl ethers. At least 20 wt % (all percents hereunder are by weight) of the vinylpyrrolidones copolymer is preferably made of polyvinylpyrrolidone. The preferred molecular weight range for such copolymer is from 5,000 to 400,000.

Gelatin may be treated with lime or acids. Other usable gelatins include ossein gelatin, pigskin gelatin, hide gelatin, and modified gelatin obtained by esterifying, phenylcarbamoylating, or otherwise modifying these gelatins.

The aforementioned binders preferably have a gelatin content of 10–90%, more preferably 20–60%, of the total binder. The preferred vinylpyrrolidone content ranges from 5 to 90%, with the range of 10–80% being more preferred.

The aforementioned binders may contain other high-molecular weight substances; preferred examples are a mixture of gelatin, polyvinylpyrrolidone with a molecular weight of 1,000–400,000, and one or more other high-molecular weight substances, and a mixture of gelatin, a vinylpyrrolidone copolymer with a molecular weight of 5,000–400,000, and one or more other high-molecular weight substances. Examples of other high-molecular weight substances that may be used include polyvinyl alcohol, polyacrylamide, polymethacrylamide, polyvinyl butyral, polyethylene glycol, and polyethylene glycol ester; proteins such as cellulose derivatives; and natural substances such as polysaccharides typified by starch and gum arabic. These high-molecular weight substances are incorporated in amounts of 0–80%, preferably 0–70%.

The vinylpyrrolidone polymer may be a crosslinked polymer, and in this case, crosslinking is preferably caused to occur after coating solutions using the binder are applied to a base (cross-linking may also take place while the applied coat is left to stand).

The binder is generally used in an amount of 0.05–50 $g/m^2$, preferably 0.1–10$g/m^2$, per layer.

Bases that may be used with the heat developable photographic material of the present invention include synthetic plastic films made of polyethylene, cellulose acetate, polyethylene terephthalate and polyvinyl chloride; paper bases such as photographic raw paper, printing paper, baryta paper and resin coated paper; and bases having a reflective layer formed on the aforementioned plastic films.

Besides the aforementioned components, the heat developable photographic material of the present invention may incorporate other various additives. An exemplary additive is a development accelerator selected from among the alkali releasing agents (e.g. urea and guanidium trichloroacetate) described in U.S. Pat. Nos. 3,220,840, 3,531,285, 4,012,260, 4,060,420, 4,088,496 and 4,207,392; Research Disclosure Nos. 15733, 15734 and 15776; Unexamied Published Japanese Patent Application Nos. 130745/1981 and 132332/1981, the organic acid described in Japanese Patent Publication No. 12700/1970; the nonaqueous polar solvent compounds having —CO—, —$SO_2$ or —SO group as shown in U.S. Pat. No. 3,667,959; the melt former described in U.S. Pat. No. 3,438,776; and the polyalkylene glycols described in U.S. Pat. No. 3,666,477 and Unexamine Published Japanese Patent Application No. 19525/1976. Another additive is a toning agent selected from among the compounds described in Unexamined Published Japanese Patent Application Nos. 4925/1971, 6077/1971, 5019/1974, 5020/1974, 91215/1974, 107727/1974, 2524/1975, 67132/1974, 67641/1975, 114217/1975, 33722/1977, 99813/1977, 1020/1978, 55115/1978, 76020/1978, 125014/1978, 156523/1979, 156524/1979, 156525/1979, 156526/1979, 4060/1980, 4061/1980 and 32015/1980, as well as German Pat. Nos. 2,140,406, 2,147,063 and 2,220,618, U.S. Pat. Nos. 3,080,254, 3,847,612, 3,782,941, 3,994,732, 4,123,282 and 4,201,582; they are phthalazinone, phthalimide, pyrazolone, quinazolinone, N-hydroxynaphthalimide, benzoxazine, naphthoxazindione 2,3-dihydrophthalazindione, 2,3-dihydro-1,3-oxazine-2,4-dione, oxypyridine, aminopyridine, hydroxyquinoline, aminoquinoline, isocarbostyryl, sulfonamide, 2H-1,3-benzothiazone-2,4-(3H)dione, benzotriazine, mercaptotriazole, dimercaptotetrazapentalene, phthalic acid, naphthalic acid and phthalamic acid. Also usable are a mixture of one or more of the aforementioned compounds and an imidazole compound, a mixture of a phthalazine compound and one or more of the acids (e.g. phthalic acid or naphthalic acid) or acid anhydrides, and combinations of phthalazine and acids such as maleic acid, itaconic acid, quinolinic acid, and gentisic acid. The 2-amino-5-mercapto-1,2,4-triazoles and 3-acyl-amino-5-mercapto-1,2,4-triazoles described in Unexamined Published Japanese Patent Application Nos. 189628/1983 and 193460/1983 are also effective as toning agents.

Compounds suitable for use as anti-foggants are described in Japanese Patent Publication No. 11113/1972, Unexamined Published Japanese Patent Application Nos. 90118/1974, 19724/1974, 97613/1974, 101019/1975, 0720/1974, 123331/1975, 47419/1976, 57435/1976, 78227/1976, 104338/1976, 19825/1976, 20923/1978, 50725/1976, 3223/1976, 42529/1976, 81124/1976, 51821/1979 and 93149/1980, as well as British Pat. No. 1,455,271, U.S. Pat. Nos. 3,885,968, 3,700,457, 4,137,079 and 4,238,265 and German Pat. No. 2,617,907; they include mercuric salts; oxidizing agents such as N-halogenoacetamide, N-halogenosuccinimide, perchloric acid and salts thereof, inorganic peroxides and persulfates; acids and salts thereof such as sulfinic acid, lithium laurate, rosin, diterpenylic acid and thiosulfonic acid; and sulfur containing compounds (e.g. mercapto compound releasing compounds, thiouracil, disulfides, elemental sulfur, mercapto-1,2,4-triazole, thiazolinthione and polysulfide compounds). Also usable as anti-foggants are oxazoline, 1,2,4-triazole and phthalimide. The thiol compounds (preferably thiophenol compounds) described in Unexamined Published Japanese Patent Application No. 111636/1984 are also effective as anti-foggants. The hydroquinone derivatives (e.g. d-t-octylhydroquinone and dodecanylhydroquinone) described in Japanese Patent Application No. 56506/1984 or the hydroquinone derivatives described in Japanese Patent Application No. 66380/1984 are preferably used in combination with benzotriazole derivatives such as 4-sulfobenzotriazole and 5-carboxybenzotriazole.

Agents that will prevent printout in the post-processing stage may also be used as a stabilizer, and examples of such printout preventing agents are hydrocarbon halides of the types described in Unexamined Published Japanese Patent Application Nos. 45228/1973, 119624/1975, 120328/1975 and 46020/1978; more specifically, they include tetrabromobutane, tribromoethanol, 2-bromo-2-tolylacetamide, 2-bromo-2-tolysulfonyl acetamide, 2-tribromomeothylsulfonyl benzothiazole, and 2,4-bis(tribromomethyl)-6-methyl triazine.

Post-treatment may be carried out using sulfur containing compounds as shown in Japanese Patent Publication No. 5393/1971, and Unexamined Published Japanese Patent Application Nos. 54329/1975 and 77034/1975.

The heat developable photographic material of the present invention may contain isothiuronium based stabilizer precursors of the types described in U.S. Pat. Nos. 3,301,678, 3,506,444, 3,824,103 and 3,844,788, or activator stabilizer precursors of the types described in U.S. Pat. Nos. 3,669,670, 4,012,260 and 4,060,420.

Water releasing agents such as succrose and $NH_4Fe(SO_4)$. $12H_2O$ may be employed. If desired, heat development may be performed with water supplied as shown in Unexamined Published Japanese Patent Application No. 132332/1981.

In addition to the aforementioned components, the heat developable photographic material of the present invention may also contain anti-halation dyes, brighteners, hardeners, antistats, plasticizers, spreading agents, and coating aids.

If the heat developable photographic material of the present invention is of the color type, it will contain a dye providing material. Any compound may be employed as the dye providing material if it participates in the reducing reaction of a light-sensitive silver halide and/or an optionally used organic silver salt and if it is capable of forming or releasing a diffusible dye as a function of the reaction. Depending upon the mode of reaction, the dye providing material is either a negative-acting type (which will form a negative dye image when a negative acting silver halide is used) or a positive-acting type (which will form a positive dye image when a negative acting silver halide is used). The negative-acting dye providing material is classified as follows:

- Negative-acting dye providing material
  - Reducing dye releasing compound (which will release a diffusible dye upon oxidation)
  - Compound forming a diffusible dye upon coupling reaction with a reducing agent
    - Coupling dye releasing compound
    - Coupling dye forming compound The respective types of dye providing material are hereunder described.

The reducing dye releasing compound may be illustrated by compounds of formula (2):

$$Car—NHSO_2—Dye \quad (2)$$

where Car is a reducing substrate (i.e., carrier) that is oxidized to release d dye in the reduction of a light-sensitive silver halide and/or an optionally used organic silver salt; and Dye is a diffusible dye residue.

Specific examples of this reducing dye releasing compound are given in Unexamined published Japanese Patent Application Nos. 179840/1982, 1165537/1983, 60434/1984, 65839/1984, 71046/1984, 87450/1984, 88730/1984, 123837/1984, 165054/1984 and 165055/1984; and they include the following:

Illustrative dye providing materials

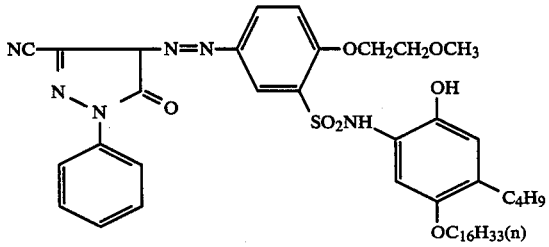

1

-continued
2
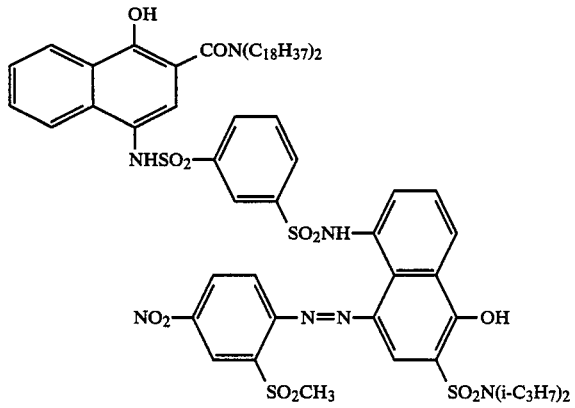
3
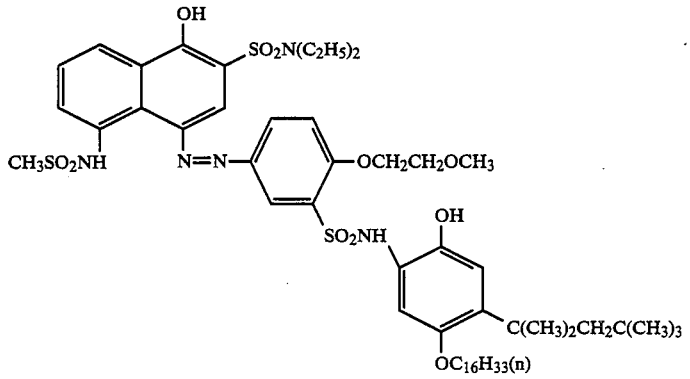
4
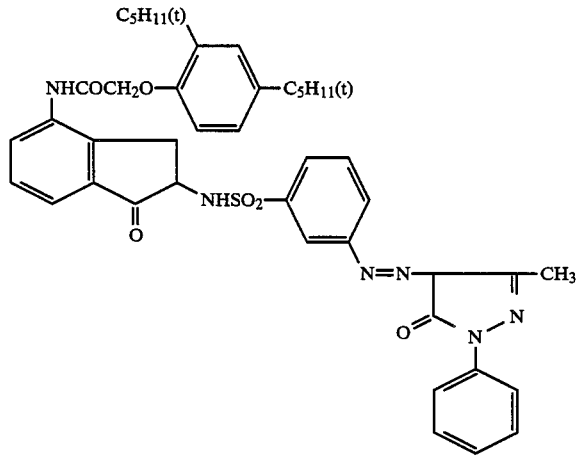
5
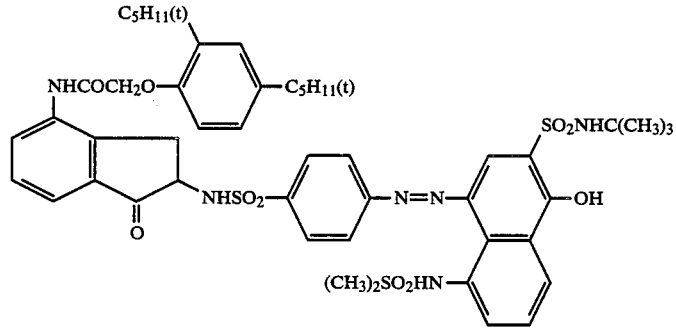

-continued

6

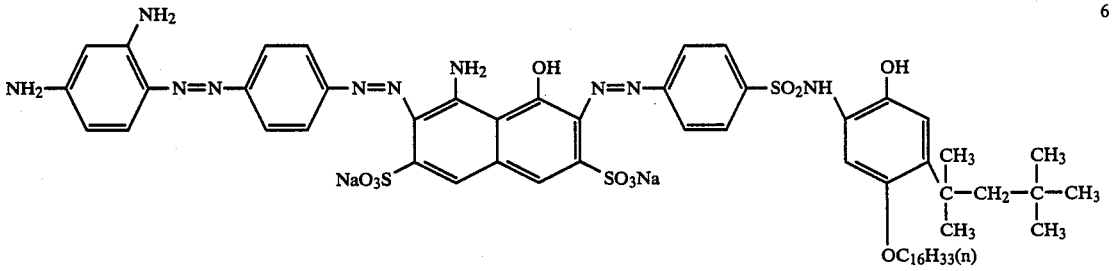

Another type of the reducing dye releasing compound is represented by formula (3):

(3)

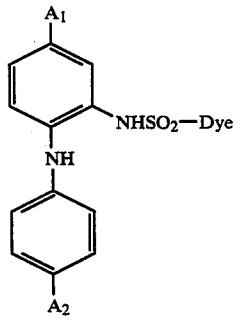

where $A_1$ and $A_2$ are each a hydrogen atom, a hydroxy group or an amino group; Dye has the same meaning as defined in formula (2). Specific examples of this type of reducing dye releasing compound are given in Unexamined Published Japanese Patent Application No. 124329/1984.

The coupling dye releasing compound may be illustrated by compounds of formula (4);

$Cp_1$-(-J-)$_{n_1}$Dye (4)

where $Cp_1$ is an organic group (i.e., coupler residue) that is capable of releasing a diffusible dye upon reaction with the oxidized product of a reducing agents; J is a divalent bonding group; the bond between $Cp_1$ and J will break as a result of reaction with the oxidized product of a reducing agent; $n_1$ is 0 or 1; and Dye has the same meaning as defined in formula (2).

The group $Cp_1$ is preferably substituted by a variety of ballast groups in order to render the coupling dye releasing compound non-diffusible, and a suitable ballast group is selected, depending upon the form of the photographic material used, from among organic groups having at least 8 (preferably at least 12) carbon atoms, hydrophilic groups such as sulfo and carboxyl, and groups having both no less than 8 (preferably, no less than 12) carbon atoms and a hydrophilic group such as sulfo or carboxyl. Other ballast groups that are also preferred are polymer chains.

Specific examples of the compound of formula (4) are found in Unexamined Published Japanese Patent Application Nos. 186744/1982, 122596/1982, 160698/1982, 174834/1984, 224883/1982, and 159159/1984; and Japanese Patent Application No. 104901/1984; and they include the following:

Illustrative dye providing materials

7

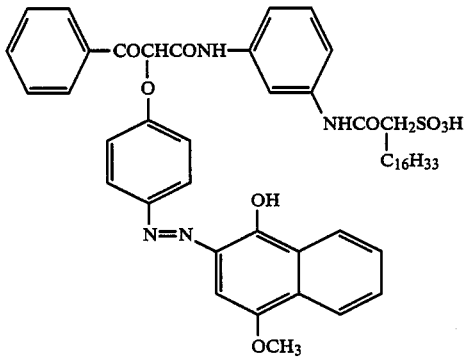

8

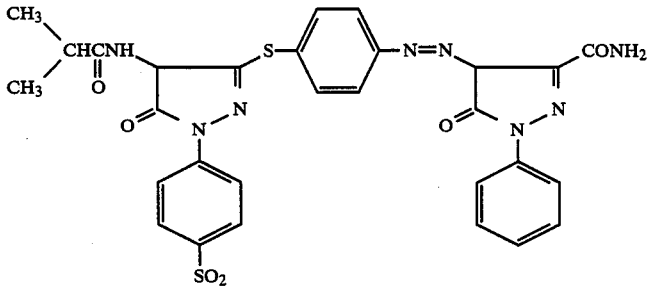

The coupling dye forming compound may be illustrated by compounds of formula (5):

$$Cp_2\text{-}(F)(B) \quad (5)$$

where $Cp_2$ is an organic group (i.e., coupler residue) capable of forming a diffusible dye upon reaction (coupling) with the oxidized product of a reducing agent; F is a divalent bonding group; and B is a ballast group.

In order to ensure the formation of a highly diffusible dye, the coupler residue represented by $Cp_2$ preferably has a molecular weight of no higher than 700, more preferably no higher than 500.

The preferred ballast group is the same as defined for the ballast in formula (4); a particularly preferred ballast group contains both no less than 8 (preferably no less than 12) carbon atoms and a hydrophilic group such as sulfo or carboxyl. A polymer chain is a more preferred ballast group.

A preferred coupling dye forming compound having a polymer chain is a polymer having a repeating unit derived from a monomer of formula (6):

$$Cp_2\text{-}(F)(Y)_l(Z)(L) \quad (6)$$

where $Cp_2$ is the same as defined in formula (5); Y is an alkylene, arylene or aralkylene group; l is 0 or 1; Z is a divalent organic group; and L is an ethylenically unsaturated group or a group having an ethylenically unsaturated group.

Specific examples of the coupling dye forming compounds of formulas (5) and (6) are found in Unexamined Published Japanese Patent Application Nos. 124339/1984, and 181345/1984; Japanese Patent Application Nos. 109293/1983, 179657/1984, 181604/1984, 182506/1984 and 182507/1984; and they include the following:

Illustrative dye providing materials

9

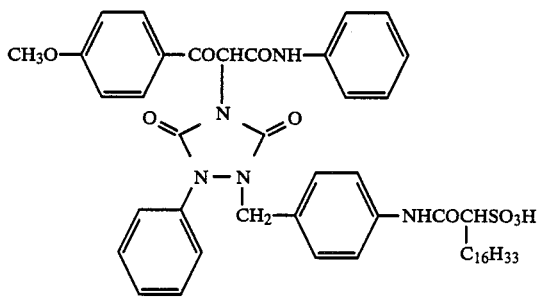

10

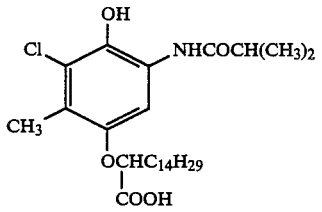

11

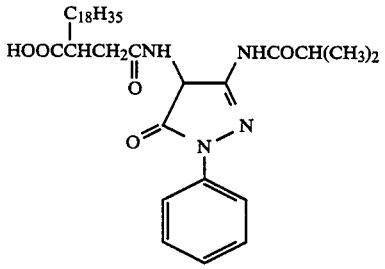

Polymer type

12

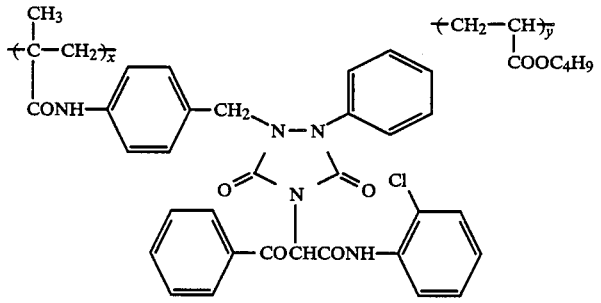

x: 60 wt % y: 40 wt %

-continued
13
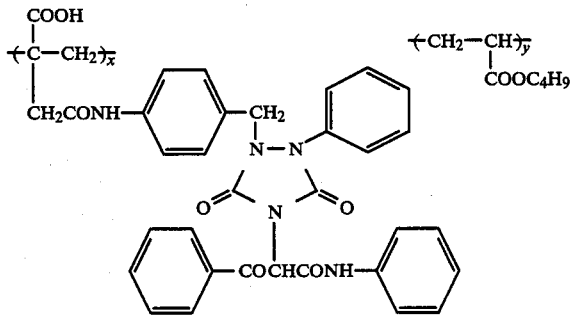
x: 60 wt %
y: 40 wt %
14
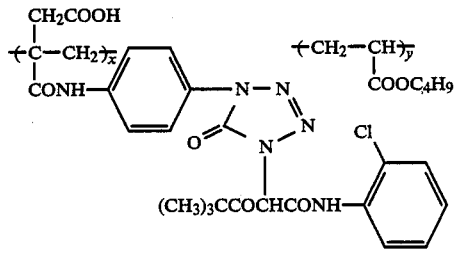
x: 50 wt %
y: 50 wt %
15
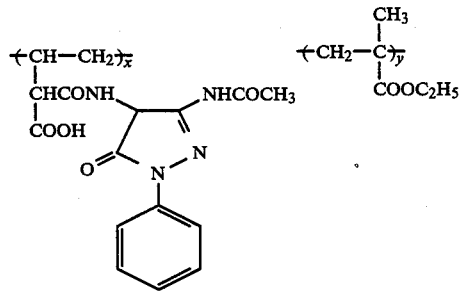
x: 40 wt %
y: 60 wt %
16
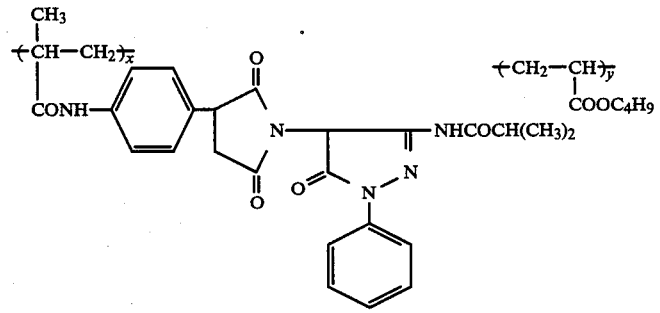
x: 40 wt %
y: 60 wt %

-continued
17
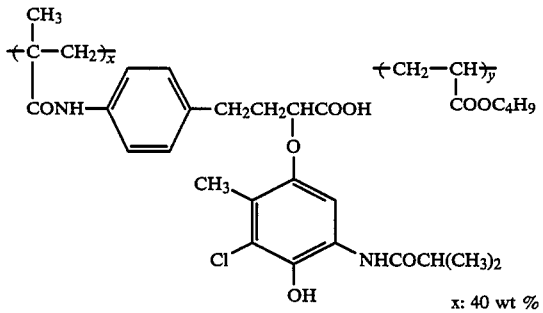
x: 40 wt %
y: 60 wt %
18
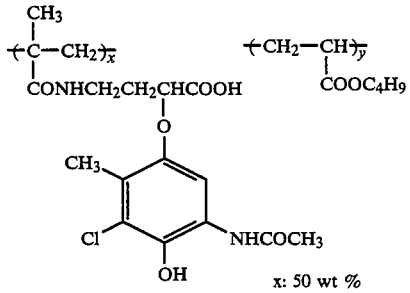
x: 50 wt %
y: 50 wt %
19
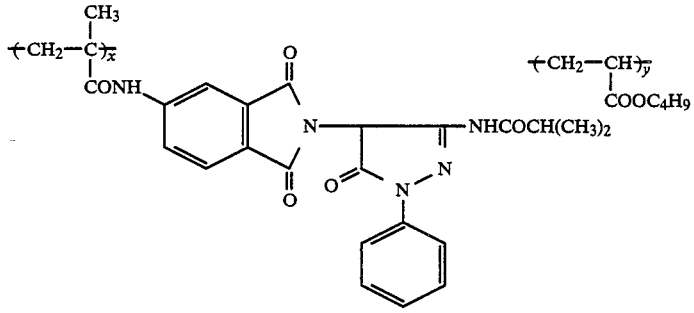
x: 50 wt %
y: 50 wt %
20
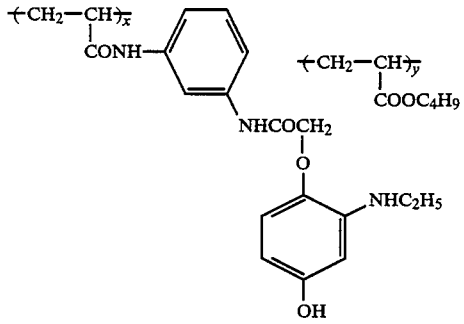
x: 50 wt %
y: 50 wt %
The following are the preferred examples of the coupler residue represented by $CP_1$ in formula (4) or $Cp_2$ in each of formulas (5) and (6):
formula (7)
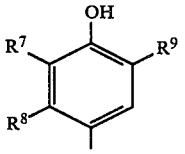

-continued formula (8)

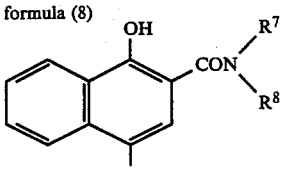

formula (9)

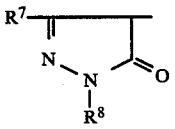

formula (10)

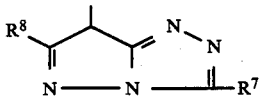

formula (11)

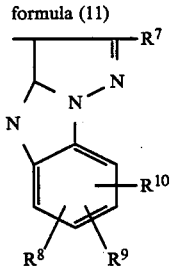

formula (12)

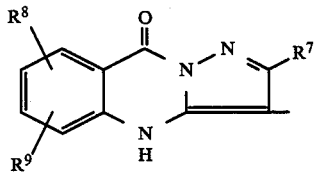

formula (13)

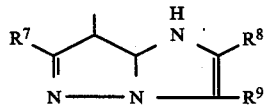

formula (14)

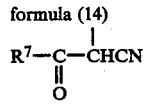

formula (15)

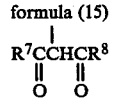

-continued formula (16)

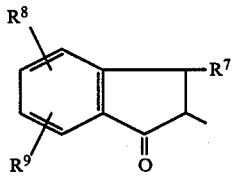

where $R^7$, $R^8$, $R^9$ and $R^{10}$ are each a hydrogen atom, a halogen atom, an alkyl, cycloalkyl, aryl acyl, alkyloxycarbonyl, aryloxycarbonyl, alkylsulfonyl, arylsulfonyl, carbamoyl, sulfamoyl, acryloxy, amino, alkoxy, aryloxy, cyano, ureido, alkylthio, arylthio, carboxy, sulfo group or a heterocyclic residue; each of these groups may be substituted by a hydroxyl, carboxyl, sulfo, alkoxy, cyano, nitro, alkyl, aryl, aryloxy, acyloxy, acyl, sulfamoyl, carbamoyl, imino group or a halogen atom.

The aforementioned substituents are selected depending upon the objects of $Cp_1$ and $Cp_2$, and as already mentioned, at least one substituent in $Cp_1$ is preferably a ballast group, and the substituents in $Cp_2$ are so selected that its molecular weight is preferably no higher than 700, more preferably no higher than 500.

The positive-acting dye providing material may be illustrated by oxidizable dye releasing compounds of formula (17):

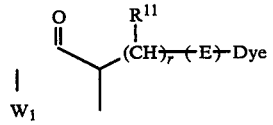

where $W_1$ is a group of the atoms necessary for forming a quinone ring (which may have a substituent on the ring); $R^{11}$ is an alkyl group or a hydrogen atom; E is

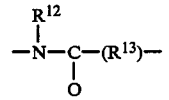

(where $R^{12}$ is an alkyl group or a hydrogen atom; and $R^{13}$ is an oxygen atom or

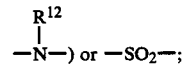

r is 0 or 1; and Dye has the same meaning as defined in formula (2).

Specific examples of these compounds are given in Unexamined Published Japanese Patent Application Nos. 166954/1984 and 154445/1984; they include the following:

Illustrative dye providing materials

21

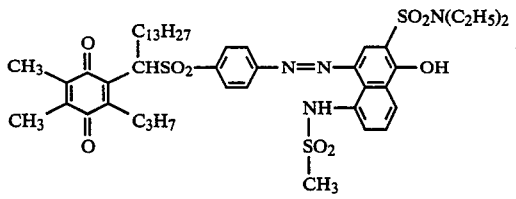

22

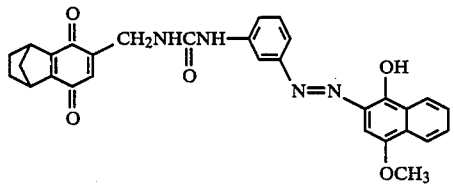

23

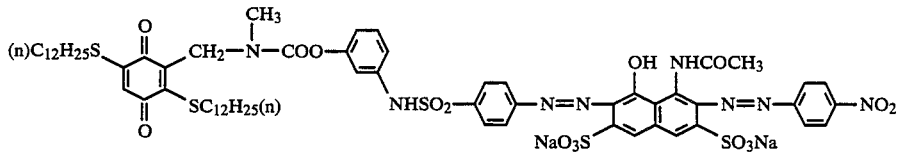

Another type of the positive-acting dye providing material is illustrated by compounds of formula (18) that will lose their dye releasing ability upon oxidation:

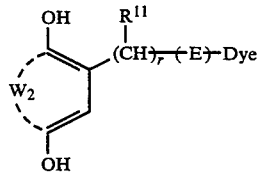

where $W_2$ is a group of the atoms necessary for forming a benzene ring (which may have a substituent on the ring); $R^{11}$, r, E and Dye are each the same as defined in formula (17). Specific examples of these compounds are given in Unexamined Published Japanese Patent Application Nos. 124329/1984 and 154445/1984; and they include the following:

Illustrative dye providing materials

24

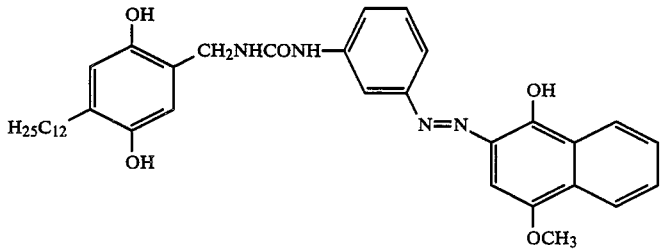

25

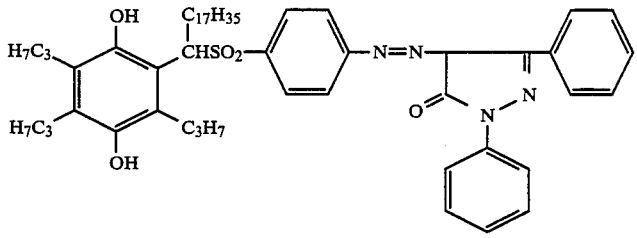

Still another type of the positive-acting dye providing material is illustrated by compounds of formula (19):

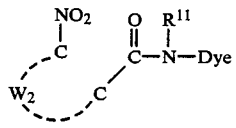

where $W^2$, $R^{11}$ and Dye are each the same as defined in formula (18). Specific examples of such compounds are given in Unexamined Published Japanese Patent Application No. 154445/1984;

Illustrative dye providing materials

26

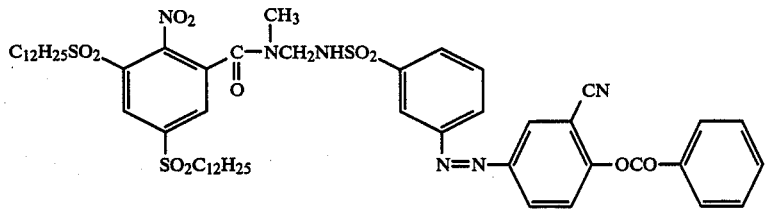

27

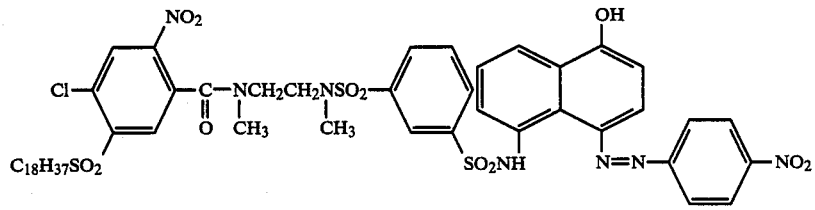

The diffusible dye residue represented by Dye in each of the formulas (2), (3), (4), (17), (18) and (19) is hereunder described in greater detail. In order to ensure the formation of a highly diffusible dye, this residue preferably has a molecular weight of not higher than 80° C., more preferably not higher than 600. Illustrative residues are those of azoe, azomethine, anthraquinone, naphthoquinone, styryl, nitro, quinoline, carbonyl and phthalocyanine dyes. The spectral absorption of these dye residues may be shifted temporarily, either during heat development or at transfer, to shorter wavelength in order to regenerate the desired image color afterward. In a preferred embodiment, these dye residues may be rendered chelatable, as shown in Unexamined Published Japanese Patent Application Nos. 48765/1984 and 124337/1984, in order to provide an image having a greater degree of light-fastness.

The aforementioned dye providing materials may be used either independently or in combination. The amount of the dye providing material used is not critical and may be determined depending upon various factors such as the type of that material, whether these materials are used singly or in combination, and whether the photographic material of the present invention consists of one or more photographic layers. A typical range is from 0.005 to 50 g/m$^2$, with the range of 0.1 to 10 g/m$^2$ being preferred.

The dye providing material used in the present invention may be incorporated in a photographic material in the heat developable photographic material. The following procedures may be employed: a dye providing material of interest is dissolved in a low-boiling point solvent (e.g. methanol, ethanol or ethyl acetate) or high-boiling point solvent (e.g. methanol, ethanol or ethyl acetate) or high-boiling point solvent (e.g. dibutyl phthalate, dioctyl phthalate or tricresyl phosphate) and subsequently dispersed by ultrasonic wave application; the dye providing material is dissolved in an aqueous alkaline solution (e.g. 10% NaOH solution) and neutralized with a mineral acid (e.g. HCl or $NHO_3$); alternatively, the dye providing material is dispersed in an aqueous solution of a suitable polymer (e.g. gelatin, polyvinyl butyral or polyvinylpyrrolidone) by means of a ball mill.

The heat developable photographic material of the present invention may be exposed by a variety of means. Latent image is formed by imagewise exposure to radiations including visible light. Light sources customarily used in the preparation of color prints may be employed, and they include a tungsten lamp, a mercury lamp, a xenon lamp, laser light, and CRT.

Any of the heating methods that can be applied to ordinary heat developable photographic materials may be employed in the present invention; they include, for example, contact with a heated block or plate, contact with hot rollers or drum, passage through a hot atmosphere, use of high-frequency heating, and the use of the Joule heat produced by application of an electric current or a strong magnetic field to an electroconductive layer provided in the photographic material of the present invention or in a heat transfer image receiving element. Heating pattern is not limited to any particular type; preheating may be followed by another heating, short heating at high temperatures or prolonged heating at low temperatures may be performed to realize continuous temperature elevation and decline or such heating may be carried out through cycles, or discontinuous heating may be employed. The simpler the heating pattern, the better. Exposure and heating may proceed simultaneously.

If the heat developable photographic material of the present invention is of the black-and-white type which will form a silver image, it is subjected to imagewise exposure and may be directly developed by mere heating in the temperature range of 80°-250° C., preferably 100°-200° C., for a period of 1 to 240 seconds, preferably 1.5 to 120 seconds. Prior to exposure, the photographic material may be heated in the temperature range of 70°-200° C.

The heat developed photographic material carrying a silver image may be directly displayed and kept in storage. If a particularly prolonged storage is required, the unreacted silver salt is preferably removed. For this purporse, a bleach bath, fix bath or a bleach-fix bath employed in the ordinary wet photographic process (e.g. the processing methods described in Unexamined Published Japanese Patent Application Nos. 54329/1975, 77034/1975, 328/1976 and 80226/1976) may be utilized. Alternatively, the bleach-fixing sheet of the types described in Unexamined Published Japanese Patent Application No. 136733/1984, and Research Disclosure Nos. 16407, 16408 and 16414 may be employed.

In a preferred embodiment, the heat developable photographic material of the present invention is of the color type using a dye providing material; in this case, the exposed photographic material is superposed on an image-receiving element (to be described later in this specification) in such a manner that the light-sensitive layer in the photographic material is in contact with the image-receiving element, and by heating the assembly in the temperature range of 80°-200° C. (preferably 120°-170° C.) for a period of 1-180 seconds (preferably 1.5-120 seconds), color development takes place as the developed image transfers onto the image-receiving element. Prior to exposure, the photographic material may be heated in the temperature range of 70°-180° C.

It suffices that the image-receiving element used in the present invention fulfills the function of receiving the image that has been released or formed by heat development. This image-receiving element is preferably made of any of the mordants used in dye diffusion transfer photographic materials, or of a heat-resistant organic high-molecular weight material of the type described in Unexamined Published Japanese Patent Application No. 207250/1982 that has a glass transition point of not lower than 40° C. but not higher than 250° C.

Specific examples of the mordants include nitrogen-containing secondary and tertiary amines, nitrogen-containing heterocyclic compounds, and quaternary cationic compounds thereof; the vinylpyridine polymers and vinylpyridinium cation polymers described in U.S. Pat. Nos. 2,548,564, 2,484,430, 3,148,061 and 3,756,814; the dialkylamino containing polymer described in U.S. Pat. No. 2,675,316; the aminoguanidine derivative described in U.S. Pat. No. 2,882,156; the covalent bonded reactive polymer described in Unexamined Published Japanese Patent No. 137333/1979; the mordants cross-linkable with gelatin, etc., as described in U.S. Pat. Nos. 3,625,694, 3,859,096, British Patent Nos. 1,277,453 and 2,011,012; the aqueous sol type mordants described in U.S. Pat. Nos. 3,958,995, 2,721,852 and 2,798,063; the water-insoluble mordant disclosed in Unexamined Published Japanese Patent Application No. 61228/1975; as well as the mordants disclosed in U.S. Pat. No. 3,788,855, German Patent Application (OLS) No. 2,843,320, Unexamined Published Japanese Patent Application Nos. 30328/1978, 155528/1977, 125/1978, 1024/1978, 74430/1979, 124726/1979, 22766/1980, U.S. Pat. Nos. 3,642,482, 3,488,706, 3,557,066, 3,271,147 and 3,271,148, Japanese Patent Publication Nos. 29418/1980, 36414/1981 and 12139/1982, Research Disclosure No. 12045 (1974).

A particularly useful mordant is a polymer containing an ammonium salt, especially the amino group containing polymer described in U.S. Pat. No. 3,709,690. An illustrative polymer containing an ammonium salt is polystyrene-co-N,N,N-tri-n-hexyl-N-vinylbenzyl ammonium chloride, with the ratio of styrene to vinylbenzyl ammonium chloride lying between 1:4, preferably at 1:1.

A typical image-receiving layer for use in dye diffusion transfer photogrpahy is prepared by applying to a base a mixture of gelatin and a polymer containing an ammonium salt.

Examples of the aforementioned heat-resistant organic high-molecular weight material are listed below: polystyrene having a molecular weight material are listed below: polystyrene having a molecular weight of 2,000-85,000; polystyrene derivatives having a substituent with no more than 4 carbon atoms; polyvinyl cyclohexane; polyvinylbenzene; polyvinylpyrrolidone; polyvinylcarbazole; polyallylbenzene; polyacetals such as polyvinyl alcohol, polyvinyl formal and polyvinyl butyral; polyvinyl chloride; chlorinated polyethylene; polychlorofluroethylene; polyacrylonitrile; poly-N,N-dimethylacrylamide; polyesters (e.g. polyacrylate, polyacrylchloroacrylate, polymethyl methacrylate, polyethyl methacrylate, polypropyl methacrylate, polyisopropyl methacrylate, polyisobutyl methacrylate, poly-tert-butyl methacrylate, polycyclohexyl methacrylate, polyethylene glycol dimethacrylate, poly-2-cyanoethyl methacrylate and polyethylene terephthalate) having a p-cyano-phenyl group, pentachlorophenyl group or 2,4-dichlorophenyl group; polycarbonates such as polysulfone and bisphenol A polycarbonate; polyanhydrides, polyamides and cellulose acetates. Also useful are the synthetic polymers having glass transition points of 40° C. or higher, as described in Polymer Handbook, 2nd ed., edited by J. Brandrup and E. H. Immergut, John Wiley & Sons. These high-molecular weight materials may be used independently or they may be combined with each other for use as copolymers.

Particularly useful polymers are cellulose acetates such as triacetate and diacetate; polyamides from the combinations of heptamethylenediamine and terephthalic acid, fluorenediporpylamine and adipic acid, hexamethylenediamine and diphenic acid, and hexamethylenediamine and isophthalic acid; polyesters from the combinations of diethylene glycol and diphenylcarboxylic acid, and bis-p-carboxyphenoxybutane and ethylene glycol; and polyethylene terephthalate, polycarbonate and polyvinyl chloride. These polymers may be modified; for example, polyethylene terephthalates modified by cyclohexanedimethanol, isophthalic acid, methoxypolyethylene-glycol, or 1,2-dicarbomethoxy-4-benzenesulfonic acid are effective. Particularly preferred polymer layers are the one made of polyvinyl chloride as shown in Japanese Patent Application No. 97907/1983 and the one composed of a polycarbonate and a plasticizer as shown in Japanese Patent Application No. 128600/1983.

The aforementioned polymers are dissolved in appropriate solvents and the solution is applied to a base to make an image-receiving layer; or an image-receiving layer in a film form that is made of one or more of the aforementioned polymers is laminated on a base; if desired, an element (such as in a film form) made of one or more of the aforementioned polymers may serve as the sole component of the image-receiving layer on a transparent base may be coated with an opacifying (reflective) layer that contains titanium dioxide, etc. as dispersed in gelatin. This opacifying layer will enable the viewing of a reflected transfer color image as seen through the transparent base behind the image-receiving layer.

EXAMPLE 1

A conversion type silver chlorobromide emulsion was prepared by the following procedures.

To an aqueous solution containing 80 g of gelatin and 200 ml of an aqueous solution of 1 mole of silver nitrate, 200 ml of an aqueous solution of 1.2 moles of potassium chloride was added at a controlled temperature of 40° C. over a period of 1 minute. Following 1-minute physical ripening, 200 ml of an aqueous solution of 1 mole of potassium bromide was added, and physical ripening was conducted for an additional 1 minute. Washing was made to remove the watersoluble halides. After addition of 5 g of gelatin, water was added to make a total of 400 g.

The resulting silver chlorobromide emulsion comprised grains having an average size of 0.15 μm, and is hereunder referred to as EM-1.

EXAMPLE 2

Using the grains in the conversion type emulsion prepared in Example 1 as cores, core/shell emulsions were prepared by the following procedures.

To 400 g of the core emulsion (EM-1), 275 ml of an aqueous solution of 1 mole of silver nitrate, 275 ml of an aqueous solution of 1 mole of potassium bromide and 30 ml of an aqueous solution of 1 mole of potassium chloride were added simultaneously at 60° C. over a period of 5 minutes so as to precipitate a shell of silver chlorobromide. After removing the water-soluble halides by washing with water, 20 g of gelatin was added and water was added to make a total of 600 g. The resulting silver chlorobromide core/shell emulsion comprised grains having an average size of 0.2 μm, and is hereunder referred to as EM-2.

To 400 g of the core emulsion (EM-1), 365 ml of an aqueous solution of 2 moles of silver nitrate, 365 ml of an aqueous solution of 2 moles of potassium bromide and 40 ml of an aqueous solution of 0.2 mole of potassium chloride were added simultaneously at 60° C. over a period of 15 minutes so as to precipitate a shell of silver chlorobromide. After removing the water-soluble halides by washing, 45 g of gelatin was added and water was added to make a total of 1,200 g. The resulting silver chlorobromide core/shell emulsion comprised grains having an average size of 0.25 μm, and is hereunder referred to as EM-3.

To 400 g of the core emulsion (EM-1), 275 ml of an aqueous solution of 1 mole of silver nitrate, 275 ml of an aqueous solution of 1 mole of potassium bromide, and 25 ml of an aqueous solution of 0.05 mole of potassium iodide were added simultaneously at 60° C. over a period of 5 minutes so as to precipitate a shell of silver iodobromide. After removing the water-soluble halides by washing, 20 g of gelatin was added and water was added to make a total of 600 g. The resulting silver iodochlorobromide core/shell emulsion comprised grains having an average size of 0.2 m, and is hereunder referred to as EM-4.

EXAMPLE 3

A silver bromide core emulsion was prepared using the following solutions.

| Solution 1-A | |
|---|---|
| Ossein gelatin | 40 g |
| Distilled water | 400 ml |
| 10% Ethanol solution of sodium salt of polyisopropylene-polyethyleneoxy-disuccinate ester | 30 ml |
| KBr | 2 g |
| 1 N $HNO_3$ | 76 ml |
| **Solution 1-B** | |
| $AgNO_3$ | 1200 g |
| 0.1 N $NHO_3$ | 60 ml |
| Distilled water to make | 1750 ml |
| **Solution 1-C** | |
| Ossein gelatin | 35 g |
| KBr | 810 g |
| 10% Ethanol solution of sodium salt of polyisopropylene-polyethyleneoxy-disuccinate ester | 35 ml |

-continued

| | |
|---|---|
| Distilled water to make | 1750 ml |

At 40° C., solutions 1-B and 1-C were added to solution 1-A over a period of 32 minutes by the double-jet method using a mixer/agitator of the type shown in Unexamined Published Japanese Patent Application Nos. 92523/1982 and 92524/1982. The rate of addition was increased with time in a zigzag fashion as shown in Table 1 below. The pAg value for solution 1-A was controlled to be at 9.0 by addition of a 20% aqueous KBr solution. Measurement of pAg values was conducted with a metallic silver electrode and a double junction type saturated Ag/AgCl reference electrode.

Solutions 1-B, 1-C and 20% aqueous KBr solution were added using a roller tube metering pump capable of variable flow rates.

The thus prepared emulsion was washed with water to remove any water-soluble halides. Thereafter, 130 g of gelatin was added and water was added to make a total of 6000 g. The resulting silver bromide core emulsion comprised grains having an average size of 0.13 μm, and is hereunder referred to as EM-5.

TABLE 1

| | Rate of addition (ml/min) | |
|---|---|---|
| Time (min) | Solution 1-B | Solution 1-C |
| 0 | 15.1 | 15.1 |
| 5 | 15.9 | 15.9 |
| 10 | 27.0 | 27.0 |
| 14 | 40.0 | 40.0 |
| 16.5 | 49.3 | 49.3 |
| 20.5 | 65.8 | 65.8 |
| 22.5 | 74.0 | 74.0 |
| 26.5 | 94.0 | 94.0 |
| 29.0 | 107.5 | 107.5 |
| 31.0 | 118.5 | 118.5 |
| 32.0 | 126.0 | 126.0 |

EXAMPLE 4

A silver iodobromide core emulsion containing 2 mol % silver iodide was prepared by repeating the procedures of Example 3 except that solution 1-C was replaced by the following solution 2-C.

| Solution 2C | |
|---|---|
| Ossein gelatin | 35 g |
| KBr | 810 g |
| KI | 23.4 g |
| 10% Ethanol solution of sodium salt of polyisopropylene-polyethyleneoxy-disuccinate ester | 35 ml |
| Distilled water to make | 1750 ml |

The resulting silver iodobromide core emulsion comprised grains having an average size of 0.11 μm, and is hereunder referred to as EM-6.

EXAMPLE 5

A silver iodobromide core emulsion containing 4 mol % silver iodide was prepared by repeating the procedures of Example 3 except that solution 1-C was replaced by the following solution 3-C.

| Solution 3-C | |
|---|---|
| Ossein gelatin | 35 g |
| KBr | 810 g |
| KI | 46.9 g |
| 10% Ethanol solution of sodium salt of polyisopropylene-polyethyleneoxy-disuccinate ester | 35 ml |
| Distilled water to make | 1750 ml |

The resulting silver iodobromide core emulsion comprised grains having an average size of 0.10 μm, and is hereunder referred to as EM-7.

EXAMPLE 6

To the silver bromide grains having an average size of 0.13 μm that were prepared in Example 3, 50 mg per mole of silver of sodium thiosulfate and 10 mg per mole of silver of potassium chloroaurate were added, and the grain surfaces were chemically sensitized by heating at 60° C. for 90 minutes. A stabilizer and water were added to make a total of 1500 g (containing 1 mole of silver). Using the thus chemically sensitized silver bromide grains as cores, an internal image forming silver bromide core/shell emulsion was prepared from the following solutions.

| Solution 4-A | |
|---|---|
| Ossein gelatin | 5 g |
| Distilled water | 3300 ml |
| 10% Ethanol solution of sodium salt of polyisopropylene-polyethyleneoxy-disuccinate ester | 10 ml |
| 28% Aqueous ammonia solution | 60 ml |
| 56% aqueous acetic acid solution | 50 ml |
| Chemically sensitized silver bromide emulsion | 1500 g |

| Solution 4-B | |
|---|---|
| $AgNO_3$ | 280 g |
| 28% aqueous ammonia solution | 220 ml |
| Distilled water to make | 560 ml |

| Solution 4-C | |
|---|---|
| Ossein gelatin | 5 g |
| KBr | 210 g |
| 10% Ethanol solution of sodium salt of polyisopropylene-polyethyleneoxy-disuccinate ester | 10 ml |
| Distilled water to make | 560 ml |

At 40° C., solution 4-B and 4-C were added to solution 4-A over a period of 20 minutes by the double-jet method using a mixer/agitator of the type shown in Unexamined Published Japanese Patent Application Nos. 92523/1982 and 92524/1982. The rate of addition was changed with time in a zigzag fashion as shown in Table 2 below.

Throughout the addition period, the pAg value was controlled to be at 9.0 by addition of a 20% aqueous KBr solution, and the pH value was controlled at 7.5 by addition of a 28% aqueous acetic acid solution. The pAg values were measured by the same method as used in Example 3, while the pH measurement was conducted with a glass electrode and a double junction type saturated Ag/AgCl reference electrode. The respective solutions were added using a roller tube metering pump capable of variable flow rates.

The thus prepared emulsion was washed with water to remove any water-soluble halides. Thereafter, 50 g of gelatin was added and water was added to make a total of 2200 g. The resulting silver bromide core/shell emulsion comprised grains having an average size of 0.18 μm, and is hereunder referred to as EM-8.

TABLE 2

| Time (min) | Rate of addition (ml/min) Solution 4-B | Solution 4-C |
|---|---|---|
| 0 | 12.2 | 12.2 |
| 1 | 13.5 | 13.5 |
| 2 | 15.0 | 15.0 |
| 5 | 20.1 | 20.1 |
| 10 | 28.8 | 28.8 |
| 15 | 36.0 | 36.0 |
| 20 | 37.4 | 37.4 |

EXAMPLE 7

The silver bromide grains having an average size of 0.13 μm that were prepared in Example 3 were chemically sensitized on the surfaces as in Example 6.

Using the thus chemically sensitized silver bromide grains as cores, an internal image forming silver iodobromide core/shell emulsion containing 2 mol % AgI in the shell was prepared as in Example 6 except that solution 4-C was replaced by the following solution 5-C.

| Solution 5-C | |
|---|---|
| Ossein gelatin | 5 g |
| KBr | 210 g |
| KI | 5.5 g |
| 10% Ethanol solution of sodium salt of polyisopropylene-polyethyleneoxy-disuccinate ester | 10 ml |
| Distilled water to make | 560 ml |

The resulting silver iodobromide core/shell emulsion comprised grains having an average size of 0.18 μm, and is hereunder referred to as EM-9.

EXAMPLE 8

The silver bromide grains having an average size of 0.13 μm that were prepared in Example 3 were chemically sensitized on the surfaces as in Example 6.

Using the thus chemically sensitized silver bromide grains as cores, an internal image forming silver iodobromide core/shell emulsion containing 2 mol % AgI in the shell was prepared as in Example 6 except that instead of solutions 4-B and 4-C, solutions 6-B and 6-C having the formulations indicated below were added over a period of 40 minutes.

| Solution 6-B | |
|---|---|
| $AgNO_3$ | 770 g |
| 28% Aqueous ammonia solution | 605 ml |
| Distilled water to make | 1540 ml |

| Solution 6-C | |
|---|---|
| Ossein gelatin | 15 g |
| KBr | 580 g |
| KI | 15.1 g |
| 10% Ethanol solution of sodium salt of polyisopropylene-polyethyleneoxy-disuccinate ester | 25 ml |
| Distilled water to make | 1540 ml |

The resulting silver iodobromide core/shell emulsion comprised grains having an average size of 0.23 μm, and is hereunder referred to as EM-10.

EXAMPLE 9

To the silver iodobromide grains with 2 mol % AgI having an average size of 0.11 μm that were prepared in Example 4, 50 mg per mole of silver of sodium thiosulfate and 10 mg per mole of silver of potassium chloroaurate were added, and the grain surfaces were chemically sensitized by heating at 60° C. for 80 minutes. A stabilizer and water were added to make a total of 1500 g (containing 1 mole of silver). Using the thus chemically sensitized silver iodobromide grains as cores, an internal image forming silver iodobromide core/shell emulsion with 5 mol % AgI was prepared as in Example 6 except that instead of solutions 4-B and 4-C, solutions 7-B and 7-C having the formulations indicated below were added over a period of 25 minutes.

| Solution 7-B | |
|---|---|
| $AgNO_3$ | 353 g |
| 28% Aqueous ammonia solution | 277 ml |
| Distilled water to make | 705 ml |
| **Solution 7-C** | |
| Ossein gelatin | 6.3 g |
| KBr | 260 g |
| KI | 17.2 g |
| 10% Ethanol solution of sodium salt of polyisopropylene-polyethyleneoxy-disuccinate ester | 10 ml |
| Distilled water to make | 705 ml |

The resulting silver iodobromide core/shell emulsion comprised grains having an average size of 0.16 μm, and is hereunder referred to as EM-11.

EXAMPLE 10

The silver iodobromide grains with 2 mol % AgI having an average size of 0.11 μm that were prepared in Example 4 were chemically sensitized on the surfaces as in Example 9.

Using the thus chemically sensitized silver iodobromide grains as cores, an internal image forming silver iodobromide core/shell emulsion containing 5 mol % AgI in the shell was prepared as in Example 6 except that instead of solutions 4-B and 4-C, solutions 8-B and 8-C having the formulations indicated below were added over a period of 50 minutes.

| Solution 8-B | |
|---|---|
| $AgNO_3$ | 1013 g |
| 28% Aqueous ammonia solution | 795 ml |
| Distilled water to make | 2026 ml |
| **Solution 8-C** | |
| Ossein gelatin | 18 g |
| KBr | 700 g |
| KI | 49.5 g |
| 10% Ethanol solution of sodium salt of polyisopropylene-polyethyleneoxy-disuccinate ester | 35 ml |
| Distilled water to make | 2026 ml |

The resulting silver iodobromide core/shell emulsion comprised grains having an average size of 0.21 μm, and is hereunder referred to as EM-12.

EXAMPLE 11

To the silver iodobromide grains with 4 mol % AgI having an average size of 0.10 μm that were prepared in Example 5, 50 mg per mole of silver of sodium thiosulfate and 10 mg per mole of silver of potassium chloroaurate were added and the grain surfaces were chemically sensitized by heating at 60° C. for 70 minutes. A stabilizer and water were added to make a total of 1500 g (containing 1 mole of silver). Using the thus chemically sensitized silver iodobromide grains as cores, an internal image forming silver iodobromide core/shell emulsion with 8 mol % AgI was prepared as in Example 6 except that instead of solutions 4-B and 4-C, solution 9-B and 9-C having the formulations indicated below were added over a period of minutes.

| Solution 9-B | |
|---|---|
| $AgNO_3$ | 403 g |
| 28% Aqueous ammonia solution | 317 ml |
| Distilled water | to make 806 ml |
| **Solution 9-C** | |
| Ossein gelatin | 7 g |
| KBr | 190 g |
| KI | 31.5 g |
| 10% Ethanol solution of sodium salt of polyisopropylene-polyethyleneoxy-disuccinate ester | 15 ml |
| Distilled water | to make 806 ml |

The resulting silver iodobromide core/shell emulsion comprised grains having an average size of 0.15 μm, and is hereunder referred to as EM-13.

EXAMPLE 12

An internal image forming silver chloride core/shell emulsion was prepared by the following procedures.

To an aqueous solution containing 80 g of gelatin and 200 ml of an aqueous solution of 1 mole of silver nitrate, 200 ml of an aqueous solution of 1.2 moles of potassium chloride was added at a controlled temperature of 40° C. over a period of 1 minute. After removing the water-soluble halides by washing, 5 g of gelatin was added and water was added to make a total of 400 g. As a result, silver chloride core grains having an average size of 0.15 μm were obtained.

To these core grains, 40 mg per mole of silver of sodium thiosulfate and 8 mg per mole of silver of chloroauric acid were added and the surfaces of the grains were chemically sensitized by heating at 55° C. for 100 minutes. A stabilizer and water were added to make a total of 2500 g (containing 1 mole of silver). To 500 g of the chemically sensitized silver chloride grains, 275 mg of an aqueous solution of 1 mole of silver nitrate and 275 ml of an aqueous solution of 1.1 moles of potassium chloride were simultaneously added over a period of 10 minutes, so as to precipitate a shell of silver chloride. Washing was made to remove the water-soluble halides. After adding 20 g of gelatin, water was added to make a total of 600 g. The resulting internal image forming silver chloride core/shell emulsion comprised grains having an average size 0.2 μm, and is hereunder referred to as EM-14.

EXAMPLE 13

A silver chlorobromide core emulsion with 5 mol % AgCl was prepared as in Example 3 except that solution 1-C was replaced by solution 10-C having the following formulation.

| Solution 10-C | |
|---|---|
| Ossein gelatin | 35 g |
| KBr | 800 g |

-continued

| Solution 10-C | |
|---|---|
| KCl | 26.3 g |
| 10% Ethanol solution of sodium salt of polyisopropylene-polyethyleneoxy-disuccinate ester | 35 ml |
| Distilled water | to make 1750 ml |

The resulting silver chlorobromide core emulsion comprised grains having an average size of 0.10 μm.

To the obtained silver chlorobromide core grains, 50 mg per mole of silver of sodium thiosulfate and 10 mg per mole of silver of chloroauric acid were added, and the grain surfaces were chemically sensitized by heating at 56° C. for 100 minutes. A stabilizer and water were added to make a togal of 1500 g (containing 1 mole of silver). Using the thus chemically sensitized silver chlorobromide grains as cores, an internal image forming silver chlorobromide core/shell emulsion with 5 mol % AgCl was prepared as in Example 11 except that solution 9-C was replaced by solution 11-C having the following formulation.

| Solution 11-C | |
|---|---|
| Ossein gelatin | 7 g |
| KBr | 190 g |
| KCl | 9.0 g |
| 10% Ethanol solution of sodium salt of polyisopropylene-polyethyleneoxy-disuccinate ester | 15 ml |
| Distilled water | to make 806 ml |

The resulting silver chlorobromide core/shell emulsion comprised grains having an average size of 0.15 μm, and is hereunder referred to as EM-15.

EXAMPLE 14

To each of the emulsions prepared in Examples 1 and 2 and 6 to 13, sodium 4-(diethylamino)-2-methylphenylsulfamate (1.0 g/m$^2$), a surfactant and a hardener were added, and the resulting coating solution was applied to a subbed polyethylene terephthalate base (150 μm thick) to give a silver deposit of 2.0 g/m$^2$, and dried.

Each of the resulting samples was subjected to imagewise exposure through a sensitometric optical wedge, and placed in a 5,000-ml pressure-resistant metal container that was held at $10^{-2}$ Torr for 10 minutes by a vacuum pump. Thereafter, hydrogen or ammonia gas was introduced into the container, the hydrogen gas being held at an atmosphere and 80° C. for 5 minutes while the ammonia gas was held at one atmosphere and 30° C. for 5 minutes. The samples were recovered from the metal container and developed with a developer having the following formulation at 20° C. for 5 minutes.

| Developer formulation | |
|---|---|
| Methol | 2.5 g |
| Ascorbic acid | 10 g |
| Potassium bromide | 1 g |
| Sodium metaborate | 35 g |
| Water | to make 1,000 ml |

The developed samples were fixed, washed and dried by the customary procedures. The maximum density (Dmax) and minimum density (Dmin) were measured for the positive image formed on each of the samples. The results are shown in Table 3.

TABLE 3

| Sample No. | Gas Emulsion | $H_2$ Dmin | $H_2$ Dmax | $NH_3$ Dmin | $NH_3$ Dmax | None Dmin | None Dmax |
|---|---|---|---|---|---|---|---|
| 1 | EM-1 | 0.41 | 1.15 | 0.45 | 1.08 | 0.02 | 0.02 |
| 2 | EM-2 | 0.29 | 1.07 | 0.33 | 1.01 | 0.02 | 0.02 |
| 3 | EM-8 | 0.18 | 1.25 | 0.21 | 1.16 | 0.02 | 0.02 |
| 4 | EM-9 | 0.17 | 1.34 | 0.20 | 1.23 | 0.02 | 0.02 |
| 5 | EM-10 | 0.16 | 1.27 | 0.20 | 1.20 | 0.02 | 0.02 |
| 6 | EM-11 | 0.17 | 1.41 | 0.22 | 1.29 | 0.02 | 0.02 |
| 7 | EM-12 | 0.16 | 1.31 | 0.20 | 1.14 | 0.02 | 0.02 |
| 8 | EM-13 | 0.18 | 1.45 | 0.22 | 1.31 | 0.02 | 0.02 |
| 9 | EM-14 | 0.16 | 1.32 | 0.21 | 1.18 | 0.02 | 0.02 |
| 10 | EM-15 | 0.17 | 1.30 | 0.21 | 1.19 | 0.02 | 0.02 |

(Similar results were obtained when other treating gases, such as sulfurous acid gas and hydrogen sulfide gas, were used.)

Table 3 shows that when imagewise exposed silver halide photographic materials having internal image forming silver halide emulsions were sensitized by gas treatment before development, superior positive images could be obtained.

EXAMPLE 15

To each of the emulsions prepared in Examples 1 and 2 and 6 to 13, sodium 4-(diethylamino)-2-methylphenylsulfamate (1.0 g/m$^2$), a sulfobenzotriazole silver salt emulsion (organic silver salt, with silver deposit of 2.0 g/m$^2$) prepared by the method described below, a surfactant and a hardener were added, and the resulting coating solution was applied to a polyethylene terephthalate base (150 μm thick) to give a silver deposit of 4.0 g/m$^2$, and dried.

Each of the resulting samples was subjected to imagewise exposure through a sensitometric optical wedge, and placed in a 5,000-ml pressure-resistant metal container that was held at $10^{-2}$ Torr for 10 minutes by a vacuum pump. Thereafter, hydrogen or ammonia gas was introduced into the container, the hydrogen gas being held at an atmosphere and 80° C. for 5 minutes while the ammonia gas was held at one atmosphere and 30° C. for 5 minutes. The samples were recovered from the metal container and subsequently developed, fixed, washed and dried as in Example 14. The maximum and minimum densities were measured for the positive image formed on each of the samples, and the results are shown in Table 4.

Preparation of sulfobenzotriazole silver emulsion

In a mixed solvent of water (150 ml) and ethanol (150 ml), 40 g of poly(4-vinylpyrrolidone), 30 g of 4-sulfobenzotriazole and 6 g of sodium hydroxide were dissolved. To the stirred solution, 30 ml of an aqueous solution of 5N silver nitrate was added so as to adjust the pH at between 6 and 8. Water was added to make a total of 600 ml, thereby providing a dispersion of organic silver salt.

TABLE 4

| Sample No. | Gas Emulsion | $H_2$ Dmin | $H_2$ Dmax | $NH_3$ Dmin | $NH_3$ Dmax | None Dmin | None Dmax |
|---|---|---|---|---|---|---|---|
| 11 | EM-1 | 0.39 | 1.31 | 0.47 | 1.22 | 0.02 | 0.02 |
| 12 | EM-2 | 0.23 | 1.21 | 0.35 | 1.08 | 0.02 | 0.02 |
| 13 | EM-8 | 0.16 | 1.40 | 0.21 | 1.31 | 0.02 | 0.02 |
| 14 | EM-9 | 0.15 | 1.42 | 0.20 | 1.33 | 0.02 | 0.02 |
| 15 | EM-10 | 0.14 | 1.30 | 0.19 | 1.20 | 0.02 | 0.02 |
| 16 | EM-11 | 0.16 | 1.51 | 0.20 | 1.42 | 0.02 | 0.02 |

TABLE 4-continued

| Sample No. | Gas Emulsion | $H_2$ Dmin | $H_2$ Dmax | $NH_3$ Dmin | $NH_3$ Dmax | None Dmin | None Dmax |
|---|---|---|---|---|---|---|---|
| 17 | EM-12 | 0.14 | 1.38 | 0.18 | 1.26 | 0.02 | 0.02 |
| 18 | EM-13 | 0.16 | 1.55 | 0.21 | 1.40 | 0.02 | 0.02 |
| 19 | EM-14 | 0.15 | 1.45 | 0.20 | 1.38 | 0.02 | 0.02 |
| 20 | EM-15 | 0.16 | 1.44 | 0.21 | 1.39 | 0.02 | 0.02 |

(Similar results were obtained when other treating gases, such as sulforous acid gas and hydrogen sulfide gas, were used.)

Table 4 shows that when imagewise exposed silver halide photographic materials having internal image forming silver halide emulsions were sensitized by gas treatment before development, superior positive images could be obtained.

EXAMPLE 16

To each of the emulsions prepared in Examples 1 and 2 and 6 to 13, sodium 4-(diethylamino)-2-methylphenylsulfamate (1.0 g/m$^2$), the dye providing material M-1 (0.8 g/m$^2$) shown below, a surfactant and a hardener were added, and the resulting coating solution was applied to a polyethylene terephthalate base (150 μm thick) to give a silver deposit of 2.0 g/m$^2$, and dried.

Preparation of a dispersion of dye providing material in gelatin

A dye providing material M-1 (10 g) having the structure shown below was uniformly dissolved in 30 g of ethyl acetate (hereunder referred to as EA) and 15 g of tricresyl phosphate (hereunder referred to as TCP) by heating at about 50° C. The resulting solution was added to 400 ml of a 7.5% aqueous gelatin solution containing 30 ml of a 5% aqueous solution of Alkanol XC (Du Pont) and the two solutions were mixed under agitation. Thereafter, the mixture was homogenized by an ultrasonic homogenizer for 30 minutes, so as to obtain a dispersion of the dye providing material in gelatin at a yield of 600 g.

Dye providing material M-1

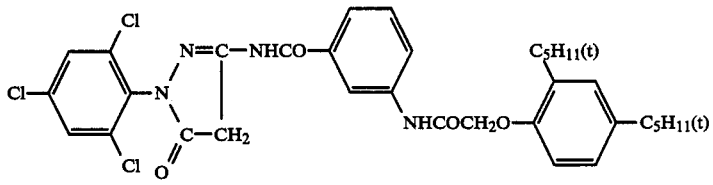

Each of the resulting samples was subjected to imagewise exposure through a sensitometric optical wedge, and placed in a 5,000-ml pressure-resistant metal container that was held at $10^{-2}$ Torr for 10 minutes by a vacuum pump. Thereafter, hydrogen or ammonia gas was introduced into the container, the hydrogen gas being held at one atmosphere and 80° C. for 5 minutes while the ammonia gas was held at one atmosphere and 30° C. for 5 minutes. The samples were recovered from the metal container and subsequently processed by the scheme shown below, so as to obtain samples carrying dye images.

| Processing steps (30° C.) | Time |
|---|---|
| Color development | 3 min and 30 sec |
| First washing | 1 min and 00 sec |
| Bleach-fixing | 1 min and 30 sec |
| Second washing | 1 min and 00 sec |

The respective processing solutions had the following formulations.

| | |
|---|---|
| Color development | |
| 4-amino-3-methyl-N—(β-methanesulfonamidoethyl)-aniline sulfate | 5 g |
| Sodium sulfite (anhydrous) | 2 g |
| Sodium carbonate (monohydrate) | 15 g |
| Potassium bromide | 1 g |
| Benzyl alcohol | 10 ml |
| Water | to make 1,000 ml |
| (pH adjusted to 10.2 with potassium hydroxide) | |
| Bleach-Fixing solution | |
| Ethylenediaminetetraacetic acid iron (III) ammonium dihydrate | 60 g |
| Ethylenediaminetetraacetic acid | 3 g |
| Sodium thiosulfate (70% aq. sol.) | 100 ml |
| Ammonium sulfite (40% aq. sol.) | 27.5 ml |
| Water | to make 1,000 ml |
| (pH adjusted to 7.10 with potassium carbonate) | |

The maximum density (Dmax) and minimum density (Dmin) were measured for the positive magenta color image formed on each of the samples, and the results are shown in Table 5.

TABLE 5

| Sample No. | Gas Emulsion | $H_2$ Dmin | $H_2$ Dmax | $NH_3$ Dmin | $NH_3$ Dmax | None Dmin | None Dmax |
|---|---|---|---|---|---|---|---|
| 21 | EM-1 | 0.36 | 1.20 | 0.42 | 1.12 | 0.09 | 0.09 |
| 22 | EM-2 | 0.25 | 1.09 | 0.36 | 0.98 | 0.09 | 0.09 |
| 23 | EM-8 | 0.15 | 1.28 | 0.21 | 1.19 | 0.09 | 0.09 |
| 24 | EM-9 | 0.14 | 1.36 | 0.20 | 1.27 | 0.09 | 0.09 |
| 25 | EM-10 | 0.15 | 1.21 | 0.22 | 1.07 | 0.09 | 0.09 |
| 26 | EM-11 | 0.14 | 1.42 | 0.19 | 1.32 | 0.09 | 0.09 |
| 27 | EM-12 | 0.14 | 1.31 | 0.19 | 1.20 | 0.09 | 0.09 |
| 28 | EM-13 | 0.16 | 1.45 | 0.21 | 1.34 | 0.09 | 0.09 |
| 29 | EM-14 | 0.15 | 1.38 | 0.19 | 1.30 | 0.09 | 0.09 |
| 30 | EM-15 | 0.16 | 1.39 | 0.19 | 1.31 | 0.09 | 0.09 |

(Similar results were obtained when other treating gases, such as sulfurous acid gas and hydrogen sulfide gas, were used.)

Table 5 shows that when imagewise exposed silver halide photographic materials having internal image forming silver halide emulsions were sensitized by gas treatment before development, superior positive images could be obtained.

EXAMPLE 17

To each of the emulsions prepared in Examples 1 and 2 and 6 to 13, sodium 4-(diethylamino)-2-methylphenylsulfamate (1.2 g/m$^2$), the sulfobenzotriazole silver salt emulsion shown in Example 15 (organic silver salt, with silver deposit of 2.2 g/m$^2$) the dye providing material C-1 (1.2 g/m$^2$) shown below, a surfactant and a hardener were added, and the resulting coating solution was applied to a polyethylene terephthalate base (150 μm thick) to give a silver deposit of 4.5 g/m$^2$, and dried.

Preparation of a dispersion of cyan dye providing material in gelatin

A dye providing material C-1 (10 g) having the structure shown below was uniformly dissolved in a mixture of TCP (20 g) and EA (40 ml). The resulting solution was added to 400 ml of a 7.5% aqueous gelatin solution containing 50 ml of a 5% aqueous solution of Alkanol XC and the two solutions were mixed under agitation. Thereafter, the mixture was homogenized by an ultrasonic homogenizer for 30 minutes, so as to obtain a dispersion of the cyan dye providing material in gelatin at a yield of 600 g.

Cyan dye providing material C-1

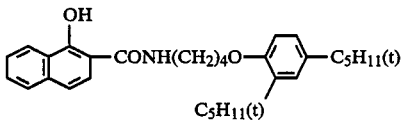

Each of the resulting samples was subjected to imagewise exposure through a sensitometric optical wedge, and placed in a 5,000-ml pressure-resistant metal container that was held at a pressure of $10^2$ Torr for 10 minutes by a vacuum pump. Thereafter, hydrogen or ammonia gas was introduced into the container, the hydrogen gas being held at one atmosphere and 80° C. for 5 minutes while the ammonia gas was held at one atmosphere and 30° C. for 5 minutes. The samples were recovered from the metal container and subsequently processed by the same scheme as shown in Example 16, thereby producing samples carrying dye images. The maximum density (Dmax) and minimum density (Dmin) were measured for the positive cyan color image formed on each of the samples, and the results are shown in Table 6.

TABLE 6

| Sample No. | Gas Emulsion | $H_2$ Dmin | $H_2$ Dmax | $NH_3$ Dmin | $NH_3$ Dmax | None Dmin | None Dmax |
|---|---|---|---|---|---|---|---|
| 31 | EM-1 | 0.41 | 1.32 | 0.48 | 1.24 | 0.08 | 0.08 |
| 32 | EM-2 | 0.32 | 1.26 | 0.36 | 1.16 | 0.08 | 0.08 |
| 33 | EM-8 | 0.20 | 1.37 | 0.25 | 1.25 | 0.08 | 0.08 |
| 34 | EM-9 | 0.19 | 1.41 | 0.24 | 1.30 | 0.08 | 0.08 |
| 35 | EM-10 | 0.20 | 1.32 | 0.26 | 1.20 | 0.08 | 0.08 |
| 36 | EM-11 | 0.18 | 1.46 | 0.22 | 1.31 | 0.08 | 0.08 |
| 37 | EM-12 | 0.17 | 1.38 | 0.20 | 1.25 | 0.08 | 0.08 |
| 38 | EM-13 | 0.19 | 1.48 | 0.26 | 1.33 | 0.08 | 0.08 |
| 39 | EM-14 | 0.19 | 1.39 | 0.25 | 1.30 | 0.08 | 0.08 |
| 40 | EM-15 | 0.20 | 1.40 | 0.26 | 1.29 | 0.08 | 0.08 |

(Similar results were obtained when other treating gases, such as sulfurous acid gas and hydrogen sulfide gas, were used.)

Table 6 shows that when imagewise exposed silver halide photographic materials having internal image forming silver halide emulsions were sensitized by gas treatment before development, superior positive images could be obtained.

EXAMPLE 18

To each of the emulsions prepared in Examples 1 and 2 and 6 to 13, methyl hydroquinone (1.0 g/m$^2$), 4-carboxymethyl-4-thiazoline-2-thione (0.06 g/m$^2$), the sulfobenzotriazole silver salt emulsion shown in Example 15 (organic silver salt, with silver deposit of 2.0 g/m$^2$), 3-methyl-1,3,5-pentanetriol (4.0 g/m$^2$), gelatin (3.0 g/m$^2$), polyvinylpyrrolidone with an average molecular weight of 30,000 (3.0 g/m$^2$), a surfactant and a hardener were added, and the resulting coating solution was applied to a polyethylene terephthalate base (150 μm thick) to give a silver deposit of 4.0 g/m$^2$, and dried.

Each of the resulting samples was subjected to imagewise exposure through a sensitometric optical wedge, and placed in a 5,000-ml pressure-resistant metal container that was held at $10^{-2}$ Torr for 10 minutes by a vacuum pump. Thereafter, hydrogen or ammonia gas was introduced into the container, the hydrogen gas being held at one atmosphere and 80° C. for 5 minutes while the ammonia gas was held at one atmosphere and 30° C. for 5 minutes. The samples were recovered from the metal container and subsequently heat-developed on a heat block at 150° C. for 1 minute. The maximum density (Dmax) and minimum density (Dmin) were measured for the positive image formed on each of the samples, and the results are shown in Table 7.

TABLE 7

| Sample No. | Gas Emulsion | $H_2$ Dmin | $H_2$ Dmax | $NH_3$ Dmin | $NH_3$ Dmax | None Dmin | None Dmax |
|---|---|---|---|---|---|---|---|
| 41 | EM-1 | 0.70 | 1.28 | 0.75 | 1.22 | 0.15 | 0.15 |
| 42 | EM-2 | 0.60 | 1.21 | 0.66 | 1.19 | 0.15 | 0.15 |
| 43 | EM-8 | 0.41 | 1.38 | 0.46 | 1.31 | 0.15 | 0.15 |
| 44 | EM-9 | 0.40 | 1.44 | 0.47 | 1.36 | 0.15 | 0.15 |
| 45 | EM-10 | 0.42 | 1.36 | 0.49 | 1.30 | 0.15 | 0.15 |
| 46 | EM-11 | 0.39 | 1.48 | 0.45 | 1.38 | 0.15 | 0.15 |
| 47 | EM-12 | 0.38 | 1.40 | 0.45 | 0.33 | 0.15 | 0.15 |
| 48 | EM-13 | 0.39 | 1.49 | 0.46 | 1.39 | 0.15 | 0.15 |
| 49 | EM-14 | 0.40 | 1.46 | 0.46 | 1.38 | 0.15 | 0.15 |
| 50 | EM-15 | 0.40 | 1.45 | 0.47 | 1.36 | 0.15 | 0.15 |

(Similar results were obtained when other treating gases, such as sulfurous acid gas and hydrogen sulfide gas, were used.)

Table 7 shows that when imagewise exposed silver halide photographic materials having internal image forming silver halide emulsions were sensitized by gas treatment before heat development, superior positive images could be obtained.

EXAMPLE 19

To each of the emulsions prepared in Examples 1 and 2 and 6 to 13, sodium 4-(diethylamino)-2-methylphenylsulfamate (2.0 g/m$^2$), the sulfobenzotriazole silver salt emulsion shown in Example 15 (organic silver salt, with silver deposit of 2.0 g/m$^2$), the dye providing material M-2 (1.5 g/m$^2$) shown below, 3-methyl-1,3,5-pentanetriol (3.0 g/m$^2$), a surfactant and a hardener were added, and the resulting coating solution was applied to a polyethylene terephthalate base (150 μm thick) to give a silver deposit of 4.0 g/m$^2$, and dried.

Preparation of a dispersion of dye providing material in gelatin

A dye providing material M-2 (10 g) having the structure shown below was uniformly dissolved in 30 g of ethyl acetate and 10 g of tricresyl phosphate (TCP) by heating at about 60° C. The resulting solution was mixed under agitation with 120 ml of a 2% aqueous gelatin solution containing 30 ml of a 5% aqueous solution of Alkanol XC (Du Pont) as a dispersant. Thereafter, the mixture was homogenized by an ultrasonic homogenizer for 10 minutes, so as to obtain a dispersion of the dye providing material in gelatin.

Dye providing material M-2

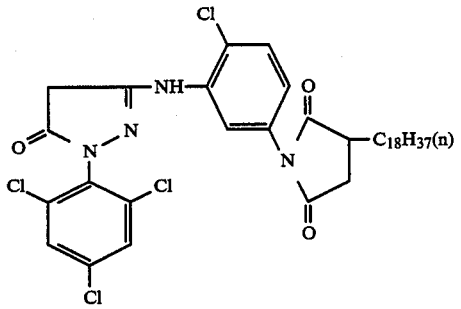

Each of the resulting samples was subjected to imagewise exposure through a sensitometric optical wedge, and placed in a 5,000-ml pressure-resistant metal container that was held at $10^{-2}$ Torr for 10 minutes by a vacuum pump. Thereafter, hydrogen or ammonia gas was introduced into the container, the hydrogen gas being held at one atmosphere and 80° C. for 5 minutes while the ammonia gas was held at one atmosphere and 30° C. for 5 minutes. The samples were recovered from the metal container and subsequently heat-developed on a heat block at 150° C. for 1 minute. The maximum density (Dmax) and minimum density (Dmin) were measured for the positive magenta color image formed on each of the samples, and the results are shown in Table 8.

TABLE 8

| Sample No. | Gas Emulsion | $H_2$ Dmin | $H_2$ Dmax | $NH_3$ Dmin | $NH_3$ Dmax | None Dmin | None Dmax |
|---|---|---|---|---|---|---|---|
| 51 | EM-1 | 0.64 | 1.32 | 0.69 | 1.30 | 0.18 | 0.18 |
| 52 | EM-2 | 0.57 | 1.26 | 0.63 | 1.22 | 0.18 | 0.18 |
| 53 | EM-8 | 0.38 | 1.43 | 0.42 | 1.40 | 1.18 | 0.18 |
| 54 | EM-9 | 0.36 | 1.46 | 0.41 | 1.43 | 0.18 | 0.18 |
| 55 | EM-10 | 0.39 | 1.40 | 0.46 | 1.36 | 0.18 | 0.18 |
| 56 | EM-11 | 0.37 | 1.49 | 0.44 | 1.44 | 0.18 | 0.18 |
| 57 | EM-12 | 0.39 | 1.38 | 0.45 | 1.33 | 0.18 | 0.18 |
| 58 | EM-13 | 0.41 | 1.48 | 0.48 | 1.42 | 0.18 | 0.18 |
| 59 | EM-14 | 0.42 | 1.47 | 0.48 | 1.41 | 0.18 | 0.18 |
| 60 | EM-15 | 0.40 | 1.46 | 0.46 | 1.40 | 0.18 | 0.18 |

(Similar results were obtained when other treating gases, such as sulfurous acid gas and hydrogen sulfide gas, were used.)

Table 8 shows that when imagewise exposed silver halide photographic materials having an internal image forming silver halide emulsions were sensitized by gas treatment before heat development superior positive images could be obtained.

EXAMPLE 20

To each of the emulsions prepared in Examples 1 and 2 and 6 to 13, sodium 4-(diethylamino)-2-methylphenylsulfamate (2.0 g/m²), the sulfobenzotriazole silver salt emulsion shown in Example 15 (organic silver salt, with silver deposit of 2.0 g/m²), the dye providing material Y-1 (1.8 g/m²) shown below, 3-methyl-1,3,5-pentanetriol (4.0 g/m²), gelatin (3.0 g/m²), polyvinylpyrrolidone with an average molecular weight of 30,000 (3.0 g/m²), a surfactant and a hardener were added, and the resulting coating solution was applied to a polyethylene terephthalate base (150 μm thick) to give a silver deposit of 4.0 g/m², and dried.

Preparation of a dispersion of yellow dye providing material in gelatin

A dye providing material Y-1 (5 g) was dissolved in 15 ml of EA. The resulting solution was added to 60 ml of a 5% aqueous gelatin solution containing 15 ml of a 5% aqueous solution of Alkanol XC and the two solutions were mixed under agitation. The mixture was homogenized by an ultrasonic homogenizer for 10 minutes, so as to obtain a dispersion of the dye providing material in gelatin at a yield of 100 g.

Dye providing material Y-1

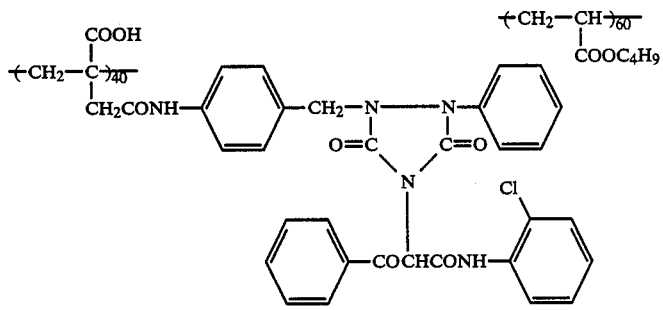

Each of the resulting samples was subjected to imagewise exposure through a sensitometric optical wedge, and placed in a 5,000-ml pressure-resistant metal container that was held at $10^{-2}$ Torr for 10 minutes by a vacuum pump. Thereafter, hydrogen or ammonia gas was introduced into the container, the hydrogen gas being held at an atmosphere and 80° C. for 5 minutes while the ammonia gas was held at one atmosphere and 30° C. for 5 minutes. The samples were recovered from the metal container, and each of them was superposed on a heat transfer image-receiving element (to be described below) so that the coating surface were in contact with each other. The assembly was heat developed at 150° C. for 1 minute by a commercial heat developer, Copy Mate (Graphic Corporation). Thereafter, the image-receiving element was immediately separately from the sample, and it carried a positive yellow color transfer image.

Preparation of a heat transfer image-receiving element

A photographic baryta paper was coated with a polyvinyl chloride containing latex NIPOLG-576 (Japan Zeon Co., Ltd.) and passed through a hot atmosphere (150° C.) to form an image-receiving element having a smooth latex coat.

The maximum density (Dmax) and minimum density (Dmin) were measured for the positive yellow color transfor image obtained from each of the samples. The results are shown in Table 9.

TABLE 9

| Sample No. | Gas Emulsion | $H_2$ Dmin | $H_2$ Dmax | $NH_3$ Dmin | $NH_3$ Dmax | None Dmin | None Dmax |
|---|---|---|---|---|---|---|---|
| 61 | EM-1 | 0.36 | 1.39 | 0.41 | 1.31 | 0.05 | 0.05 |
| 62 | EM-2 | 0.26 | 1.26 | 0.33 | 1.18 | 0.05 | 0.05 |
| 63 | EM-8 | 0.18 | 1.41 | 0.22 | 1.33 | 0.05 | 0.05 |
| 64 | EM-9 | 0.17 | 1.49 | 0.22 | 1.40 | 0.05 | 0.05 |
| 65 | EM-10 | 0.20 | 1.36 | 0.24 | 1.27 | 0.05 | 0.05 |
| 66 | EM-11 | 0.19 | 1.42 | 0.23 | 1.33 | 0.05 | 0.05 |
| 67 | EM-12 | 0.17 | 1.33 | 0.21 | 1.26 | 0.05 | 0.05 |
| 68 | EM-13 | 0.18 | 1.42 | 0.20 | 1.38 | 0.05 | 0.05 |
| 69 | EM-14 | 0.18 | 1.30 | 0.22 | 1.29 | 0.05 | 0.05 |
| 70 | EM-15 | 0.19 | 1.30 | 0.23 | 1.31 | 0.05 | 0.05 |

(Similar results were obtained when other treating gases, such as sulfurous acid gas and hydrogen sulfide gas, were used.)

Table 9 shows that when imagewise exposed silver halide photographic materials having internal image forming silver halide emulsions were sensitized by gas treatment before heat development, superior positive images could be obtained.

EXAMPLE 21

Each of the samples 61 to 70 prepared in Example 20 was subjected to imagewise exposure through a sensitometric optical wedge, and placed in a 5,000-ml pressure-resistant metal container that was held at $10^{-2}$ Torr for 10 minutes by a vacuum pump. Thereafter, hydrogen or ammonia gas introduced into the container, the hydrogen gas being held at an atmosphere and 80° C. for 5 minutes while the ammonia gas was held at one atmosphere and 80° C. for 5 minutes. The samples were recovered from the metal container and each of them was superposed on a heat transfer image-receiving element which was of the same type as prepared in Example 20 so that the coated surfaces were in contact with each other. The assembly was heated at 150° C. for 5 second by a heat developer of the same type as used in Example 20. Thereafter, the assembly was subjected to overall exposure at 500 lux for 10 seconds and heat-developed at 150° C. for 1 minute. When the image-receiving element was separated from the sample a positive yellow color transfer image had formed on the receiving element.

The maximum density (Dmax) and minimum density (Dmin) were measured for the positive yellow color transfer image obtained from each of the samples. The results are shown in Table 10

TABLE 10

| Sample No. | Gas Emulsion | $H_2$ Dmin | $H_2$ Dmax | $NH_3$ Dmin | $NH_3$ Dmax |
|---|---|---|---|---|---|
| 71 | EM-1 | 0.38 | 1.51 | 0.43 | 1.43 |
| 72 | EM-2 | 0.29 | 1.36 | 0.35 | 1.33 |
| 73 | EM-8 | 0.21 | 1.53 | 0.24 | 1.46 |
| 74 | EM-9 | 0.20 | 1.61 | 0.24 | 1.52 |
| 75 | EM-10 | 0.22 | 1.47 | 0.26 | 1.40 |
| 76 | EM-11 | 0.21 | 1.53 | 0.25 | 1.45 |
| 77 | EM-12 | 0.19 | 1.46 | 0.23 | 1.46 |
| 78 | EM-13 | 0.20 | 1.53 | 0.22 | 1.51 |
| 79 | EM-14 | 0.20 | 1.41 | 0.24 | 1.41 |
| 80 | EM-15 | 0.21 | 1.42 | 0.25 | 1.43 |

(Similar results were obtained when other treating gases, such as sulfurous acid gas and hydrogen sulfide gas, were used.)

Table 10 shows that when imagewise exposed silver halide photographic materials having internal image forming silver halide emulsions were sensitized by gas treatment and given overall exposure before heat development, superior positive images could be obtained.

EXAMPLE 22

To each of the emulsions prepared in Examples 1 and 2 and 6 to 13, sodium 4-(diethylamino)-2-methylphenylsulfamate (2.0 g/m$^2$), the sulfobenzotriazole silver salt emulsion shown in Example 15 (organic silver salt, with silver deposit of 2.0 g/m$^2$), the dye providing material Y-1 shown in Example 20 (1.8 g/m$^2$), 3-methyl-1,3,5-pentanetriol (4.0 g/m$^2$), gelatin (3.0 g/m$^2$), polyvinylpyrrolidone with an average molecular weight of 30,000 (3.0 g/m$^2$), a surfactant and a hardener were added. The resulting coating solution was applied to a polyethylene terephthalate base (150 μm thick) to give a silver deposit 4.0 g/m$^2$, and dried.

Each of the resulting samples was subjected to imagewise exposure through a sensitometric optical wedge, and placed in a 5,000-ml pressure-resistant metal container that was held at $10^{-2}$ Torr for 10 minutes by a vacuum pump. Thereafter, hydrogen or ammonia gas was introduced into the container, the hydrogen gas being held at an atmosphere and 80° C. for 5 minutes while the ammonia gas was held at one atmosphere and 30° C. for 5 minutes. The samples were recovered from the metal container, immersed in a 0.5% solution of t-butyl aminoborane and dried. Thereafter, each of the samples was superposed on a heat transfer image-receiving element of the same type as shown in Example 20 so that the coated surfaces were in contact with each other. The assembly was heat-developed at 150° C. for 1 minute by the same heat developer as used in Example 20. Thereafter, the image-receiving element was immediately separated from the sample and it carried a positive yellow color transfer image.

The maximum density (Dmax) and minimum density (Dmin) were measured for the positive yellow color transfer image obtained from each of the samples. The results are shown in Table 11

TABLE 11

| Sample No. | Gas Emulsion | $H_2$ Dmin | $H_2$ Dmax | $NH_3$ Dmin | $NH_3$ Dmax |
|---|---|---|---|---|---|
| 81 | EM-1 | 0.36 | 1.53 | 0.40 | 1.47 |
| 82 | EM-2 | 0.26 | 1.41 | 0.32 | 1.36 |
| 83 | EM-8 | 0.20 | 1.59 | 0.22 | 1.51 |
| 84 | EM-9 | 0.19 | 1.65 | 0.20 | 1.57 |
| 85 | EM-10 | 0.21 | 1.51 | 0.24 | 1.48 |
| 86 | EM-11 | 0.20 | 1.59 | 0.21 | 1.51 |
| 87 | EM-12 | 0.20 | 1.51 | 0.21 | 1.53 |
| 88 | EM-13 | 0.19 | 1.57 | 0.20 | 1.57 |
| 89 | EM-14 | 0.19 | 1.48 | 0.22 | 1.46 |
| 90 | EM-15 | 0.20 | 1.46 | 0.22 | 1.49 |

(Similar results were obtained when other treating gases, such as sulfurous acid gas and hydrogen sulfide gas, were used.)

Table 11 shows that when imagewise exposed silver halide photographic materials having internal image forming silver halide emulsions were sensitized by gas treatment before heat development, superior positive images could be obtained.

EXAMPLE 23

To each of the samples prepared in Examples 1 and 2 and 6 to 13, the reducing dye providing material M-3 (1.5 g/m$^2$) shown below, a reducing agent, or 1-phenyl-4-methyl-4-hydroxymethyl-pyrazolidinone (0.2 g/m$^2$), trimethylolethane (3.0 g/m$^2$), guanidinetrichloroacetic acid (0.6 g/m$^2$), polyvinylpyrrolidone (1.5 g/m$^2$), a surfactant and a hardener were added, and the resulting coating solution was applied to a polyethylene terephthalate base (150 μm thick) to give a silver deposit of 2.0 g/m², and dried.

Preparation of a dispersion of magenta reducing dye providing material in gelatin A reducing dye providing material M-3 (30 g) was dissolved in 30 g of dioctyl phthalate and 90 ml of EA. The resulting solution was added to 200 ml of a 10% aqueous gelatin solution containing Alkanol XC and the two solutions were mixed under agitation. The mixture was homogenized by an ultrasonic homogenizer for 30 minutes, so as to obtain a dispersion of the reducing dye providing material in gelatin at a yield of 500 g.

Reducing dye providing material M-3

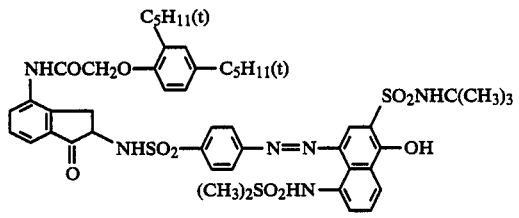

Each of the resulting samples was subjected to imagewise exposure through a sensitometric optical wedge, and placed in a 5,000-ml pressure-resistant metal container that was held at $10^{-2}$ Torr for 10 minutes by a vacuum pump. Thereafter, hydrogen or ammonia gas was introduced into the container, the hydrogen gas being held at an atmosphere and 80° C. for 5 minutes while the ammonia gas was held at one atmosphere and 30° C. for 5 minutes. The samples were then recovered from the metal container.

A subbed polyethylene terephthalate base (100 μm) containing a white pigment was coated with an image-receiving layer composed of a 1:1 copolymer of styrene and N-benzyl-N,N-dimethyl-N-(3-maleimidopropyl-)ammonium chloride and an acid- treated gelatin. The so prepared image-receiving element was immersed in water and superposed on the previously prepared light-sensitive material in such a manner that the coated surfaces were held in contact with the image-receiving layer for 30 seconds. Thereafter, the image-receiving element was separated from the light-sensitive material and a positive magenta color transfer image had formed on the receiving element. The maximum density (Dmax) and minimum density (Dmin) were measured for the positive magenta color transfer image obtained from each of the samples, and the results are shown in Table 12.

TABLE 12

| Sample No. | Gas Emulsion | $H_2$ Dmin | $H_2$ Dmax | $NH_3$ Dmin | $NH_3$ Dmax | None Dmin | None Dmax |
|---|---|---|---|---|---|---|---|
| 91 | EM-1 | 0.48 | 1.51 | 0.55 | 1.40 | 0.19 | 0.19 |
| 92 | EM-2 | 0.31 | 1.48 | 0.36 | 1.36 | 0.19 | 0.19 |
| 93 | EM-8 | 0.26 | 1.58 | 0.31 | 1.50 | 0.19 | 0.19 |
| 94 | EM-9 | 0.25 | 1.63 | 0.32 | 1.51 | 0.19 | 0.19 |
| 95 | EM-10 | 0.26 | 1.48 | 0.31 | 1.40 | 0.19 | 0.19 |
| 96 | EM-11 | 0.25 | 1.53 | 0.30 | 1.42 | 0.19 | 0.19 |
| 97 | EM-12 | 0.23 | 1.41 | 0.29 | 1.30 | 0.19 | 0.19 |
| 98 | EM-13 | 0.24 | 1.51 | 0.28 | 1.46 | 0.19 | 0.19 |
| 99 | EM-14 | 0.25 | 1.40 | 0.30 | 1.40 | 0.19 | 0.19 |

TABLE 12-continued

| Sample No. | Gas Emulsion | $H_2$ Dmin | $H_2$ Dmax | $NH_3$ Dmin | $NH_3$ Dmax | None Dmin | None Dmax |
|---|---|---|---|---|---|---|---|
| 100 | EM-15 | 0.26 | 1.39 | 0.31 | 1.42 | 0.19 | 0.19 |

(Similar results were obtained when other treating gases, such as sulfurous acid gas and hydrogen sulfide gas, were used.)

Table 12 shows that when imagewise exposed silver halide photographic materials having internal image forming silver halide emulsions were sensitized by gas treatment before development, superior positive images could be obtained.

EXAMPLE 24

A subbed transparent polyethylene terephthalate base (150 μm thick) was coated with the following layers in the order written.

(1) Blue-sensitive, internal image forming silver halide emulsion layer:

This layer was composed of one of the emulsions shown in Table 13 that were prepared in Examples 1–13 and which comprised blue-sensitized internal image forming silver halide grains (silver deposit: 3.5 g/m²), sodium 4-(diethylamino-2-methylphenylsulfamate (1.5 g/m²), the sulfobenzotriazole silver salt emulsion shown in Example 15 (silver deposit: 3.5 g/m²), the yellow dye providing material Y-1 shown in Example 20 (2.0 g/m²), polyethylene glycol with a molecular weight of 300 (3.0 g/m²), 3 methyl-1,3,5-pentanetriol (1.5 g/m²), gelatin (3.0 g/m²), polyvinylpyrrolidone with an average molecular weight of 30,000 (3.0 g/m²), a surfactant (0.05 g/m²) and a hardener (0.15 g/m²)

(2) Intermediate layer;

This layer was composed of gelatin (1.0 g/m²), polyvinylpyrrolidone (1.0 g/m²) and the non-diffusible dye providing material shown below (0.4 g/m²).

Non-Diffusible dye providing material:

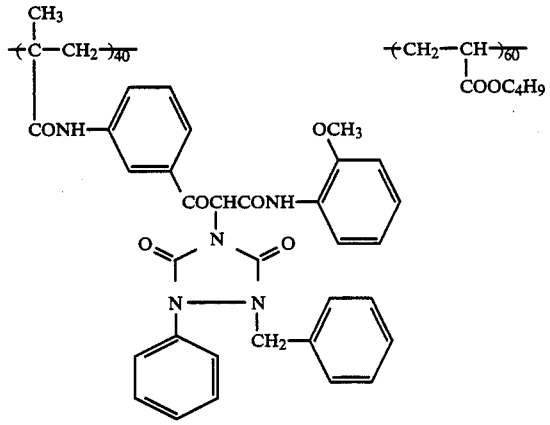

(3) Green-sensitive, internal image forming silver halide emulsion layer:

This layer was composed of one of the emulsions shown in Table 13 that were prepared in Examples 1 and 2 and 6 to 13 and which comprised green-sensitized internal image forming silver halide grains (silver deposit: 3.5 g/m²), sodium 4-(diethylamino)-2-methylphenylsulfamate (1.2 g/m²), a sulfobenzotriazole silver salt emulsion (silver deposit: 3.5 g/m²), the magenta dye providing material M-4 shown below (2.0 g/m²), polyethylene glycol (3.0 g/m$^2$), 3-methyl-1,3,5-pentanetriol (1.5 g/m$^2$), gelatin (3.0 g/m$^2$), polyvinylpyrrolidone (3.0 g/m$^2$), a surfactant (0.05 g/m$^2$) and a hardener (0.15 g/m$^2$).

Preparation of a dispersion of magenta dye providing material in gelatin

A dye providing material M-4 (5 g) having the structure shown below was dissolved in 15 ml of EA. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes so as to provide a dispersion of the dye providing material in gelatin at a yield of 100 g.

Dye providing material M-4

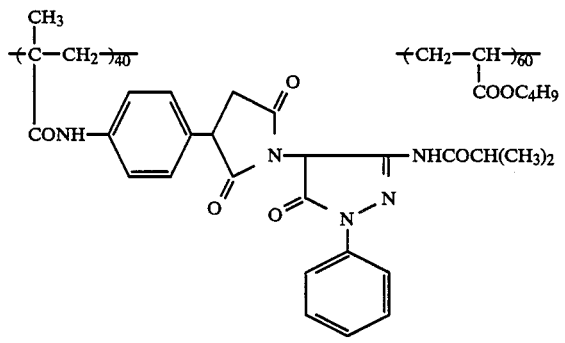

(4) Intermediate layer:

This layer was composed of gelatin (1.0 g/m$^2$) and polyvinylpyrrolidone (1.0 g/m$^2$).

(5) Red-sensitive, internal image forming silver halide emulsion layer:

This layer was composed of one of the emulsions shown in Table 13 that were prepared in Examples 1 and 2 and 6 to 13 and which comprised red-sensitized internal image forming silver halide grains (silver deposit: 3.0 g/m$^2$), sodium 4-(diethyl-amino)-2-methylphenylsulfamate (1.0 g/m$^2$), a sulfobenzotriazole silver salt emulsion (silver deposit: 3.0 g/m$^2$), the cyan dye providing material C-2 shown below (1.5 g/m$^2$), polyethylene glycol (2.5 g/m$^2$), 3-methyl-1,3,5-pentanetriol (1.0 g/m$^2$), gelatin (2.5 g/m$^2$), polyvinylpyrrolidone (2.5 g/m$^2$), a surfactant (0.05 g/m$^2$) and a hardener (0.13 g/m$^2$).

Preparation of a dispersion of cyan dye providing material in gelatin

A dye providing material C-2 (5 g) having the structure shown below was dissolved in 15 ml of EA. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes so as to provide a dispersion of the dye providing material in gelatin at a yield of 100 g.

Dye providing material M-4

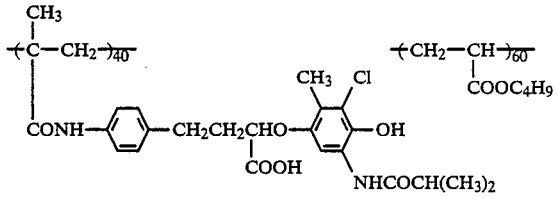

(6) Protective layer:

This layer was composed of gelatin (1.0 g/m$^2$), polyvinylpyrrolidone (1.0 g/m$^2$), a mat agent (0.3 g/m$^2$), a surfactant (0.1 g/m$^2$) and a hardener (0.05 g/m$^2$).

Each of the samples so prepared was subjected to imagewise exposure through a sensitometric optical wedge, and placed in a 5,000-ml pressure-resistant metal container that was held at $10^{-2}$ Torr for 10 minutes by a vacuum pump. Thereafter, hydrogen or ammonia gas was introduced into the container, the hydrogen gas being held at an atmosphere and 80° C. for 5 minutes while the ammonia gas was held at one atmosphere and 30° C. for 5 minutes. The samples were recovered from the container, and each of them was superposed on a heat transfer image-receiving element of the same type as prepared in Example 20 in such a manner that the coated surfaces were in contact with each other. The assembly was heat-developed at 150° C. for 1 minute. Thereafter, the image-receiving element was immediately separated from the sample, and it carried a positive multicolor transfer image. The maximum density (Dmax) and minimum density (Dmin) were measured for the positive color transfer image obtained from each of the samples. The results are shown in Table 13.

TABLE 13

| Sample | | Gas | $H_2$ | | $NH_3$ | | None | |
|---|---|---|---|---|---|---|---|---|
| No. | Color image | Emulsion | Dmin | Dmax | Dmin | Dmax | Dmin | Dmax |
| | Yellow | EM-1 | 0.48 | 1.43 | 0.53 | 1.31 | 0.08 | 0.08 |
| 101 | Magenta | EM-1 | 0.50 | 1.58 | 0.55 | 1.44 | 0.08 | 0.08 |
| | Cyan | EM-1 | 0.50 | 1.63 | 0.56 | 1.51 | 0.08 | 0.08 |
| | Yellow | EM-2 | 0.33 | 1.41 | 0.38 | 1.33 | 0.08 | 0.08 |
| 102 | Magenta | EM-2 | 0.36 | 1.57 | 0.40 | 1.50 | 0.08 | 0.08 |
| | Cyan | EM-2 | 0.37 | 1.61 | 0.40 | 1.53 | 0.08 | 0.08 |
| | Yellow | EM-8 | 0.23 | 1.68 | 0.29 | 1.53 | 0.08 | 0.08 |
| 103 | Magenta | EM-8 | 0.25 | 1.73 | 0.30 | 1.62 | 0.08 | 0.08 |
| | Cyan | EM-8 | 0.25 | 1.75 | 0.31 | 1.65 | 0.08 | 0.08 |
| | Yellow | EM-9 | 0.21 | 1.74 | 0.25 | 1.66 | 0.08 | 0.08 |
| 104 | Magenta | EM-9 | 0.22 | 1.80 | 0.25 | 1.71 | 0.08 | 0.08 |
| | Cyan | EM-9 | 0.22 | 1.82 | 0.26 | 1.74 | 0.08 | 0.08 |
| | Yellow | EM-10 | 0.18 | 1.61 | 0.22 | 1.53 | 0.08 | 0.08 |
| 105 | Magenta | EM-10 | 0.19 | 1.65 | 0.24 | 1.57 | 0.08 | 0.08 |
| | Cyan | EM-10 | 0.20 | 1.66 | 0.24 | 1.59 | 0.08 | 0.08 |
| | Yellow | EM-11 | 0.19 | 1.67 | 0.25 | 1.59 | 0.08 | 0.08 |
| 106 | Magenta | EM-11 | 0.20 | 1.70 | 0.26 | 1.61 | 0.08 | 0.08 |
| | Cyan | EM-11 | 0.21 | 1.70 | 0.26 | 1.61 | 0.08 | 0.08 |

TABLE 13-continued

| Sample No. | Color image | Gas Emulsion | $H_2$ Dmin | $H_2$ Dmax | $NH_3$ Dmin | $NH_3$ Dmax | None Dmin | None Dmax |
|---|---|---|---|---|---|---|---|---|
| | Yellow | EM-12 | 0.17 | 1.52 | 0.21 | 1.44 | 0.08 | 0.08 |
| 107 | Magenta | EM-12 | 0.18 | 1.58 | 0.23 | 1.51 | 0.08 | 0.08 |
| | Cyan | EM-12 | 0.18 | 1.60 | 0.23 | 1.53 | 0.08 | 0.08 |
| | Yellow | EM-13 | 0.18 | 1.71 | 0.24 | 1.66 | 0.08 | 0.08 |
| 108 | Magenta | EM-13 | 0.19 | 1.75 | 0.26 | 1.69 | 0.08 | 0.08 |
| | Cyan | EM-13 | 0.19 | 1.78 | 0.26 | 1.72 | 0.08 | 0.08 |
| | Yellow | EM-14 | 0.18 | 1.58 | 0.24 | 1.50 | 0.08 | 0.08 |
| 109 | Magenta | EM-14 | 0.19 | 1.62 | 0.25 | 1.55 | 0.08 | 0.08 |
| | Cyan | EM-14 | 0.19 | 1.62 | 0.25 | 1.57 | 0.08 | 0.08 |
| | Yellow | EM-15 | 0.18 | 1.61 | 0.23 | 1.47 | 0.08 | 0.08 |
| 110 | Magenta | EM-15 | 0.20 | 1.64 | 0.24 | 1.52 | 0.08 | 0.08 |
| | Cyan | EM-15 | 0.20 | 1.64 | 0.24 | 1.55 | 0.08 | 0.08 |

(Similar results were obtained when other treating gases, such as sulfurous acid gas and hydrogen sulfide gas, were used.)

Table 13 shows that multi-layered silver halide photographic materials using internal image forming silver halide emulsions also produced superior positive color images when they were processed by the method of the present invention.

EXAMPLE 25

To each of the emulsions prepared in Examples 1 and 2 and 6 to 13, the sulfobenzotriazole silver salt emulsion shown in Example 15 (organic silver salt, with silver deposit of 2.0 g/m$^2$), a surfactant and a hardener were added, and the resulting coating solution was applied to a polyethylene terephthalate (150 μm thick) to give a silver deposit of 4.0 g/m$^2$, and dried.

Each of the resulting samples was subjected to imagewise exposure through a sensitometric optical wedge, and placed in a 5,000-ml pressure-resistant metal container that was held at $10^{-2}$ Torr for 10 minutes by a vacuum pump. Thereafter, hydrogen or ammonia gas was introduced into the container, the hydrogen gas being held at an atmosphere and 80° C. for 5 minutes while the ammonia gas was held at one atmosphere and 30° C. for 5 minutes. The samples were recovered from the metal container and, subsequently developed, fixed, washed and dried as in Example 14. The maximum density (Dmax) and minimum density (Dmin) were measured for the positive image formed on each of the samples. The results are shown in Table 14.

TABLE 14

| Sample No. | Gas Emulsion | $H_2$ Dmin | $H_2$ Dmax | $NH_3$ Dmin | $NH_3$ Dmax |
|---|---|---|---|---|---|
| 111 | EM-1 | 0.38 | 1.13 | 0.46 | 1.06 |
| 112 | EM-2 | 0.24 | 1.08 | 0.36 | 0.98 |
| 113 | EM-8 | 0.17 | 1.23 | 0.22 | 1.12 |
| 114 | EM-9 | 0.15 | 1.26 | 0.20 | 1.16 |
| 115 | EM-10 | 0.14 | 1.12 | 0.19 | 1.06 |
| 116 | EM-11 | 0.15 | 1.33 | 0.19 | 1.04 |
| 117 | EM-12 | 0.13 | 1.17 | 0.18 | 1.05 |
| 118 | EM-13 | 0.15 | 1.34 | 0.20 | 1.16 |
| 119 | EM-14 | 0.15 | 1.28 | 0.20 | 1.13 |
| 120 | EM-15 | 0.16 | 1.29 | 0.22 | 1.11 |

(Similar results were obtained when other treating gases, such as sulfurous acid gas and hydrogen sulfide gas, were used.)

Table 14 shows that when imagewise exposed silver halide photographic materials having internal image forming silver halide emulsions were sensitized by gas treatment before development, superior positive images could be obtained.

EXAMPLE B-1

A conversion type silver chlorobromide emulsion was prepared by the following procedures.

To a solution containing 20 g of gelatin, 200 ml of an aqueous solution of 1 mole of silver nitrate and 200 ml of an aqueous solution of 1.2 moles of potassium chloride were added simultaneously at a controlled temperature of 60° C. over a period of 10 minutes. Following 10-minute physical ripening, 200 ml of an aqueous solution of 1 mole of potassium bromide was added, and physical ripening was conducted for an additional 10 minutes.

Washing was made to remove the water-soluble halides. After addition of 15 g of gelatin, water was added to make a total of 400 g.

The resulting silver chlorobromide emulsion comprised grains having an average size of 0.3 μm (compositional analysis revealed that this emulsion contained 97 mol % of AgBr), and is hereunder referred to as EM-1.

EXAMPLE B-2

A conversion type silver chlorobromide emulsion was prepared by the following procedures.

To a solution containing 80 g of gelatin, 200 ml of an aqueous solution of 1 mole of silver nitrate and 200 ml of an aqueous solution of 1.2 moles of potassium chloride were added simultaneously at a controlled temperature of 40° C. over a period of 1 minute. Following 1-minute physical ripening, 200 ml of an aqueous solution of 1 mole of potassium bromide was added, and physical ripening was conducted for an additional 1 minute.

Washing was made to remove the water-soluble halides. After addition of 5 g of gelatin, water was added to make a total of 400 g.

The resulting silver chlorobromide emulsion comprised grains having an average size of 0.2 μm (compositional analysis revealed that this emulsion contained 97 mol % of AgBr), and is hereunder referred to as EM-2.

EXAMPLE B-3

A conversion type silver chlorobromide emulsion was prepared by the following procedures.

To a solution containing 80 g of gelatin and 200 ml of one mole of silver nitrate, 200 ml of an aqueous solution of 1.2 moles of potassium chloride was added at a controlled temperature of 40° C. over a period of 1 minute. Following 1-minute physical ripening, 200 ml of an aqueous solution of 1 mole of potassium bromide was added, and physical ripening was conducted for an additional 1 minute.

Washing was made to remove the water-soluble halides. After addition of 5 g of gelatin, water was added to make a total of 400 g.

The resulting silver chlorobromide emulsion comprised grains having an average size of 0.15 μm (compositional analysis revealed that this emulsion contained 96 mol % of AgBr), and is hereunder referred to as EM-3.

Example B-4

A conversion type silver iodochlorobromide emulsion was prepared by the following procedures.

To a solution containing 80 g of gelatin and 200 ml of 1 mole of silver nitrate, 200 ml of an aqueous solution of 1.2 moles of potassium chloride was added at a controlled temperature of 40° C. over a period of 1 minute. Following 1-minute physical ripening, 200 ml of a mixture of an aqueous solution of 1 mole of potassium bromide and an aqueous solution of 0.05 mole of potassium iodide was added, and physical ripening was conducted for an additional 1 minute.

Washing was made to remove the water-soluble halides. After addition of 5 g of gelatin, water was added, to make a total of 400 g.

The resulting silver iodochlorobromide emulsion comprised grains having an average size of 0.15 μm (compositional analysis revealed that this emulsion contained 96 mol % of AgBr), and is hereunder referred to as EM-4.

EXAMPLE B-5

To each of the emulsions prepared in Examples B-1 to B-4, sodium 4-(diethylamino)-2-methylphenylsulfamate (1.0 g/m$^2$), a surfactant and a hardener were added, and the resulting coating solution was applied to a subbed polyethylene terephthalate base (150 μm thick) to give a silver deposit of 2.0 g/m$^2$, and dried.

Each of the resulting samples was subjected to imagewise exposure through a sensitometric optical wedge, and placed on a heat block for heating at a temperature of 30° C., 120° C., 140° C. or 160° C. for a period of 30 seconds. The samples were then developed at 20° C. for 5 minutes with a developer having the following formulation.

| Developer Formulation | |
|---|---|
| Methol | 2.5 g |
| Ascorbic acid | 10 g |
| Potassium bromide | 1 g |
| Sodium metaborate | 35 g |
| Water | to make 1,000 ml |

The developed samples were subsequently fixed, washed and dried by the customary procedures. The maximum density (Dmax) and minimum density (Dmin) were measured for the positive image formed on each of the samples, and the results are shown in Table B-1.

TABLE B-1

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 1 | EM-1 | 0.40 | 0.78 | 0.41 | 0.86 | 0.44 | 0.90 | 0.02 | 0.02 |
| 2 | EM-2 | 0.38 | 1.00 | 0.39 | 1.16 | 0.40 | 1.15 | 0.02 | 0.02 |
| 3 | EM-3 | 0.39 | 1.23 | 0.41 | 1.31 | 0.41 | 1.35 | 0.02 | 0.02 |
| 4 | EM-4 | 0.36 | 1.31 | 0.38 | 1.36 | 0.39 | 1.37 | 0.02 | 0.02 |

Table B-1 shows that when imagewise exposed silver halide photographic materials having internal image forming silver halides were subjected to heating before development, superior positive images could be obtained.

EXAMPLE B-6

To each of the emulsions prepared in Examples B-1 to B-4, sodium 4-(diethylamino)-2-methylphenylsulfamate (1.0 g/m$^2$), a sulfobenzotriazole silver salt emulsion (organic silver salt, with silver deposit of 2.0 g/m$^2$) prepared by the method described below, a surfactant and a hardener were added, and the resulting coating solution was applied to a polyethylene terephthalate base (150 μm thick) to give a silver deposit of 4.0 g/m$^2$, and dried.

Each of the resulting samples was subjected to imagewise exposure through a sensitometric optical wedge, and placed on a heat block for heating at a temperature of 30° C., 120° C., 140° C. or 160° C. for a period of 30 seconds. The samples were then developed, fixed, washed and dried as in Example B-5. The maximum density (Dmax) and minimum density (Dmin) were measured for the positive image formed on each of the samples, and the results are shown in Table B-2.

Preparation of sulfobenzotriazole silver emulsion

In a mixed solvent of water (150 ml and thanol (150 ml), 40 g of poly(4-vinylpyrrolidone), 30 g of 4-sulfobenzotriazole and 6 g of sodium hydroxide were dissolved. To the stirred solution, 30 ml of an aqueous solution of 5 N silver nitrate was added so as to adjust the pH at between 6 and 8. Water was added to make a total of 600 ml, thereby providing a dispersion of organic silver salt.

TABLE B-2

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 5 | EM-1 | 0.31 | 1.08 | 0.32 | 1.15 | 0.32 | 1.16 | 0.02 | 0.02 |
| 6 | EM-2 | 0.30 | 1.21 | 0.30 | 1.31 | 0.31 | 1.33 | 0.03 | 0.03 |
| 7 | EM-3 | 0.32 | 1.36 | 0.33 | 1.45 | 0.33 | 1.46 | 0.02 | 0.02 |

TABLE B-2-continued

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 8 | EM-4 | 0.30 | 1.40 | 0.31 | 1.47 | 0.32 | 1.48 | 0.02 | 0.02 |

Table B-2 shows that when imagewise exposed silver halide photographic materials having internal image forming silver halides were subjected to heating before development, superior positive images could be obtained.

EXAMPLES 1-7

To each of the emulsions prepared in Examples B-1 to B-4, sodium 4-(diethylamino)-2-methylphenylsulfamate (1.0 g/m$^2$), the dye providing material MI (0.8 g/m$^2$) shown below, a surfactant and a hardener were added, and the resulting coating solution was applied to a polyethylene terephthalate base (150 μm thick) to give a silver deposit of 2.0 g/m$^2$, and dried.

Preparation of a dispersion of dye providing material in gelatin

A dye providing material M-1 (10 g) having the structure shown below was uniformly dissolved in 30 g of ethyl acetate (hereunder referred to as EA) and 15 g of tricresyl phosphate (hereunder referred to as TCP) by heating at about 50° C. The resulting solution was added to 400 ml of a 7.5% aqueous gelatin solution containing 30 ml of a 5% aqueous solution of Alkanol XC (Du Pont) and the two solutions were mixed under agitation. Thereafter, the mixture was homogenized by an ultrasonic homogenizer for 30 minutes, so as to obtain a dispersion of the dye providing material in gelatin at a yield of 600 g.

Dye providing material M-1

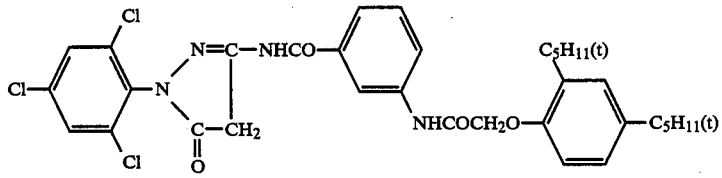

Each of the resulting samples was subjected to imagewise exposure through a sensitometric optical wedge, and placed on a heat block for heating at a temperature of 30° C., 120° C., 140° C. or 160° C. for a period of 30 seconds. The samples were subsequently processed by the scheme shown below, so as to obtain samples carrying dye images.

| Processing steps (30° C.) | Time |
|---|---|
| Color development | 3 min and 30 sec |
| First washing | 1 min and 00 sec |
| Bleach-fixing | 1 min and 30 sec |
| Second washing | 1 min and 00 sec. |

The respective processing solutions had the following formulations.

| | |
|---|---|
| Color development | |
| 4-Amino-3-methyl-N—(βmethanesulfonamidoethyl)aniline sulfate | 5 g |
| Sodium sulfite (anhydrous) | 2 g |
| Sodium carbonate (monohydrate) | 15 g |
| Potassium bromide | 1 g |
| Benzyl alcohol | 10 ml |
| Water | to make 1,000 ml |
| (pH adjusted to 10.2 with potassium hydroxide) | |
| Bleach-fixing solution | |
| Ethylenediaminetetraacetic acid iron (III) ammonium dihydrate | 60 g |
| Ethylenediaminetetraacetic acid | 3 g |
| Sodium thiosulfate (70% aq. sol.) | 100 ml |
| Ammonium sulfite (40% aq. sol.) | 27.5 ml |
| Water | to make 1,000 ml |
| (pH adjusted to 7.10 with potassium carbonate) | |

The maximum density (Dmax) and minimum density (Dmin) were measured for the positive magenta color image formed on each of the samples, and the results are shown in Table B-3.

TABLE B-3

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 9 | EM-1 | 0.23 | 1.08 | 0.24 | 1.17 | 0.24 | 1.17 | 0.13 | 0.13 |
| 10 | EM-2 | 0.25 | 1.16 | 0.25 | 1.30 | 0.26 | 1.31 | 0.11 | 0.11 |
| 11 | EM-3 | 0.24 | 1.31 | 0.25 | 1.46 | 0.25 | 1.48 | 0.10 | 0.10 |
| 12 | EM-4 | 0.25 | 1.47 | 0.26 | 1.60 | 0.25 | 1.59 | 0.11 | 0.11 |

Table B-3 shows that when imagewise exposed silver halide photographic materials having internal image forming silver halides were subjected to heating before development, superior positive images could be obtained.

EXAMPLE B-8

To each of the emulsions prepared in Examples B-1 to B-4, sodium 4-(diethylamino)-2-methylphenylsulfamate (1.2 g/m$^2$), the sulfobenzotriazole silver salt emulsion shown in Example B-6 (organic silver salt, with silver deposit of 2.2 g/m$^2$), the dye providing material C-1 (1.2 g/m$^2$) shown below, a surfactant and a hardener were added, and the resulting coating solution was applied to a polyethylene terephthalate base (150 μm thick) to give a silver deposit of 4.5 g/m$^2$, and dried.

Preparation of a dispersion of cyan dye providing material in gelatin

A dye providing material C-1 (10 g) having the structure shown below was uniformly dissolved in a mixture of TCP (20 g) and EA (40 ml). The resulting solution was added to 400 ml of a 7.5% aqueous gelatin solution containing 50 ml of a 5% aqueous solution of Alkanol XC and the two solutions were mixed under agitation. Thereafter, the mixture was homogenized by an ultrasonic homogenizer for 30 minutes, so as to obtain a dispersion of the cyan dye providing material in gelatin at a yield of 600 g.

Cyan dye providing material C-1

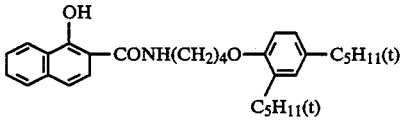

Each of the resulting samples was subjected to imagewise exposure through a sensitometric optical wedge, and placed on a heat block for heating at a temperature of 30° C., 120° C., 140° C. or 160° C. for a period of 40 seconds. The samples were subsequently processed by the same scheme as shown in Example B-7, thereby producing samples carrying dye images. The maximum density (Dmax) and minimum density (Dmin) were measured for the positive cyan color images formed on each of the samples, and the results are shown in Table B-4.

TABLE B-4

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 13 | EM-1 | 0.27 | 1.33 | 0.28 | 1.38 | 0.30 | 1.42 | 0.08 | 0.08 |
| 14 | EM-2 | 0.28 | 1.43 | 0.29 | 1.46 | 0.30 | 1.49 | 0.08 | 0.08 |
| 15 | EM-3 | 0.28 | 1.52 | 0.28 | 1.57 | 0.31 | 1.61 | 0.08 | 0.08 |
| 16 | EM-4 | 0.32 | 1.60 | 0.31 | 1.65 | 0.33 | 1.73 | 0.08 | 0.08 |

Table B-4 shows that when imagewise exposed silver halide photographic materials having internal image forming silver halides were subjected to heating before development, superior positive images could be obtained.

EXAMPLE B-9

To each of the emulsions prepared in Examples B-1 to B-4, methyl hydroquinone (1.0 g/m$^2$), 4-carboxymethyl-4-thiazoline-2-thione (0.06 g/m$^2$), the sulfobenzotriazole silver salt emulsion shown in Example B-6 (organic silver salt, with silver deposit of 2.0 g/m$^2$), 3-methyl-1,3,5-pentanetriol (4.0 g/m$^2$), gelatin (3.0 g/m$^2$), polyvinylpyrrolidone with an average molecular weight of 30,000 (3.0 g/m$^2$), a surfactant and a hardener were added, and the resulting coating solution was applied to a polyethylene terephthalate base (150μm thick) to give a silver deposit of 4.0 g/m$^2$, and dried.

Each of the resulting samples was subjected to imagewise exposure through a sensitometric optical wedge, and placed on a heat block for heating at a temperature of 120° C., 140° C. or 160° C. for a period of 20 seconds. The samples were developed by continued heating for an additional 40 seconds. The maximum density (Dmax) and minimum density (Dmin) were measured for the positive image formed on each of the samples, and the results are shown in Table B-5.

TABLE B-5

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 17 | EM-1 | 0.65 | 1.08 | 0.70 | 1.16 | 0.73 | 1.21 |
| 18 | EM-2 | 0.66 | 1.11 | 0.72 | 1.20 | 0.76 | 1.23 |
| 19 | EM-3 | 0.67 | 1.15 | 0.74 | 1.22 | 0.77 | 1.25 |
| 20 | EM-4 | 0.71 | 1.16 | 0.76 | 1.23 | 0.79 | 1.27 |

Table B-5 shows that when imagewise exposed silver halide photographic materials having internal image forming silver halides were first given heat treatment before conducting heat development, superior positive image could be obtained.

EXAMPLE B-10

To each of the emulsions prepared in Example B-1 to B-4, sodium 4-(diethylamino)-2-methylphenylsulfamate (2.0 g/m$^2$), the sulfobenzotriazole silver salt emulsion shown in Example B-6 (organic silver salt, with silver deposit of 2.0 g/m$^2$), the dye providing material M-2 (1.5 g/m$^2$) shown below, 3-methyl-1,3,5-pentanetriol (3.0 g/m$^2$), a surfactant and a hardener were added, and the resulting coating solution was applied to a polyethylene terephthalate base (150 μm thick) to give a silver deposit of 4.0 g/m$^2$, and dried.

Each of the resulting samples was subjected to imagewise exposure through a sensitometric optical wedge, and placed on a heat block for heating at a temperature of 120° C., 140° C. or 160° C. for a period of 20 seconds. The samples were developed by continued heating for an additional 40 seconds.

The maximum density (Dmax) and minimum density (Dmin) were measured for the positive magenta color image formed on each of the samples, and the results are shown in Table B-6.

Preparation of a dispersion of dye providing material in gelatin

A dye providing material M-2 (10 g) having the structure shown below was uniformly dissolved in 30 g of ethyl acetate and 10 g of tricresyl phosphate (TCP) by heating at about 60° C. The resulting solution was mixed under agitation with 120 ml of a 2% aqueous gelatin solution containing 30 ml of a 5% aqueous solution of Alkanol XC (Du Pont) as a dispersant. Thereafter, the mixture was homogenized by an ultrasonic homogenizer for 10 minutes, so as to obtain a dispersion of the dye providing material in gelatin.

Dye providing material M-2

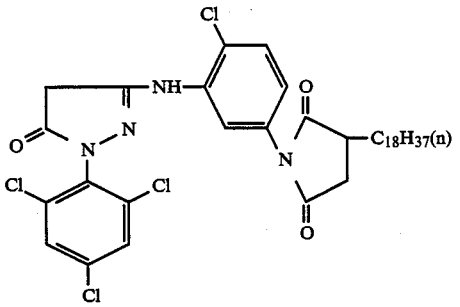

sion shown in Example B-6 (organic silver salt, with silver deposit of 2.0 g/m$^2$), the dye providing material Y-1 (1.8 g/m$^2$) shown below, 3-methyl-1,3,5-pentanetriol (4.0 g/m$^2$), gelatin (3.0 g/m$^2$), polyvinylpyrrolidone with an average molecular weight of 30,000 (3.0 g/m$^2$), a surfactant and a hardener were added, and the resulting coating solution was applied to a polyethylene terephthalate base (150 μm thick) to give a silver deposit of 4.0 g/m$^2$, and dried.

Preparation of a dispersion of yellow dye providing material in gelatin

A dye providing material Y-1 (5 g was dissolved in 15 ml of EA. The resulting solution was added to 60 ml of a 5% aqueous gelatin solution containing 15 ml of a 5% aqueous solution of Alkanol XC and the two solutions were mixed under agitation. The mixture was homogenized by an ultrasonic homogenizer for 10 minutes, so as to obtain a dispersion of the dye providing material in gelatin at a yield of 100 g.

Dye providing material Y-1

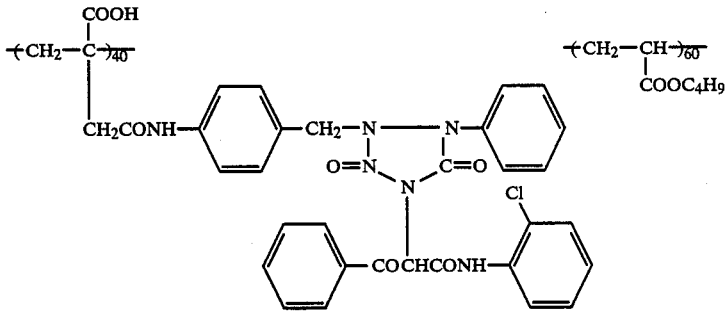

Each of the resulting samples was subjected to imagewise exposure through a sensitometric optical wedge, and placed on a heat block for heating at a temperature of 120° C., 140° C. or 160° C. for a period of 20 seconds. Subsequently, each of the samples was superposed on a heat transfer image-receiving element (to be described below) so that the coated surfaces were in contact with each other. The assembly was heat-developed at 150° C. for 1 minute by a commercial heat developer, Copy Mate (Graphic Corporation). Thereafter, the image-receiving element was immediately separated from the sample, and it carried a positive yellow color transfer image.

TABLE B-6

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 21 | EM-1 | 0.67 | 1.18 | 0.70 | 1.30 | 0.71 | 1.37 |
| 22 | EM-2 | 0 68 | 1.22 | 0.72 | 1.31 | 0.74 | 1.39 |
| 23 | EM-3 | 0.69 | 1.26 | 0.73 | 1.35 | 0.75 | 1.41 |
| 24 | EM-4 | 0.71 | 1.27 | 0.74 | 1.38 | 0.77 | 1.43 |

Table B-6 shows that when imagewise exposed silver halide photographic materials having an internal image forming silver halides were first given heat treatment before conducting heat development, superior positive images could be obtained.

EXAMPLE B-11

To each of the emulsions prepared in Examples B-1 to B-4, sodium 4-(diethylamino)-2-methylphenylsulfamate (2.0 g/m$^2$), the sulfobenzotriazole silver salt emul- Preparation of a heat transfer image-receiving element A photographic baryta paper was coated with a polyvinyl chloride containing latex NIPOLG-576 (Japan Zeon Co., Ltd.) and passed through a hot atmosphere (150° C.) to form an image-receiving element having a smooth latex coat.

The maximum density (Dmax) and minimum density (Dmin) were measured for the positive yellow color transfer image obtained from each of the samples. The results are shown in Table B-7.

TABLE B-7

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 25 | EM-1 | 0.24 | 1.26 | 0.25 | 1.30 | 0.27 | 1.34 |
| 26 | EM-2 | 0.25 | 1.33 | 0.26 | 1.37 | 0.26 | 1.39 |
| 27 | EM-3 | 0.24 | 1.39 | 0.24 | 1.45 | 0.26 | 1.46 |
| 28 | EM-4 | 0.26 | 1.41 | 0.27 | 1.53 | 0.27 | 1.55 |

Table B-7 shows that when imagewise exposed silver halide photographic materials having internal image forming silver halides were first given heat treatment before conducting heat development, superior positive image could be obtained.

EXAMPLE B-12

Each of the four unexposed samples prepared in Example B-11 was subjected to imagewise exposure through a sensitometric optical wedge and superposed on a heat transfer image-receiving element of the same as prepared in Example B-11 so that the coated surfaces were in contact with each other. The assembly was heated in a Copy Mate at a temperature of 120° C., 140° C. or 160° C. for a period of 20 seconds. The sample was then heat-developed at 150° C. for 1 minute. Immediately thereafter, the image-receiving element was separated from the sample, and a positive yellow color transfer image had formed on the receiving element.

The maximum density (Dmax) and minimum density (Dmin) were measured for the positive yellow color transfer image obtained from each of the samples. The results are shown in Table B-8.

TABLE B-8

| Sample No. | Heating temperature Emulsion (Sample No.) | 120° C. Dmin | 120° C. Dmax | 140° C. Dmin | 140° C. Dmax | 160° C. Dmin | 160° C. Dmax |
|---|---|---|---|---|---|---|---|
| 29 | EM-1 (25) | 0.26 | 0.88 | 0.26 | 0.96 | 0.28 | 0.98 |
| 30 | EM-2 (26) | 0.26 | 1.06 | 0.27 | 1.09 | 0.28 | 1.08 |
| 31 | EM-3 (27) | 0.25 | 1.16 | 0.26 | 1.25 | 0.27 | 1.27 |
| 32 | EM-4 (28) | 0.27 | 1.28 | 0.27 | 1.31 | 0.28 | 1.33 |

Table B-8 shows that when imagewise exposed silver halide photographic material having internal image forming silver halides were heat-developed in superposition on an image-receiving element, superior positive images could be obtained.

EXAMPLE B-13

To each of the samples prepared in Examples B-1 to B-4 the reducing dye providing material M-3 (1.5 g/m$^2$) shown below, a reducing agent, or 1-phenyl-4-methyl-4-hydroxymethyl- 3-pyrazolidinone((0.2 g/m$^2$), trimethylolethane (3.0 g/m$^2$), guanidine-trichloroacetic acid (0.6 g/m$^2$), polyvinylpyrrolidone (1.5 g/m$^2$), a surfactant and a hardener were added, and the resulting coating solution was applied to a polyethylene terephthalate base (150 μm thick) to give a silver deposit of 2.0 g/m$^2$, and dried.

Preparation of a dispersion of magenta reducing dye providing material in gelatin A reducing dye providing material M-3 (30 g) was dissolved in 30 g of dioctyl phthalate and 90 ml of EA. The resulting solution was added to 200 ml of a 10% aqueous gelatin solution containing Alkanol XC and the two solutions were mixed under agitation. The mixture was homogenized by an ultrasonic homogenizer for 30 minutes, so as to obtain a dispersion of the reducing dye providing material in gelatin at a yield of 500 g.

Reducing dye providing material M-3

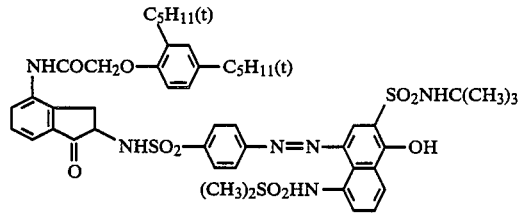

Each of the resulting samples was subjected to imagewise exposure through a sensitometric optical wedge, and placed on a heat block for heating at 30, 120, 140 or 160° C. for 1 minute.

A subbed polyethylene terephthalate base 100 μm) containing a white pigment w-s coated with an image-receiving layer composed of a 1:1 copolymer of styrene and N-benzyl-N,N-dimethyl-N-(3-maleimidopropyl-)ammonium chloride and an acid-treated gelatin. The so prepared image-receiving element was immersed in water and superposed on the previously prepared light-sensitive material in such a manner that the coated surfaces were held in contact with the image-receiving layer for 30 seconds. Thereafter, the image-receiving element was separated from the light-sensitive material and a positive magenta color transfer image had formed on the receiving element. The maximum density (Dmax) and minimum density (Dmin) were measured for the positive magenta color transfer image obtained from each of the samples, and the results are shown in Table B-9.

TABLE B-9

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 33 | EM-1 | 0.48 | 1.47 | 0.49 | 1.51 | 0.49 | 1.56 | 0.22 | 0.22 |
| 34 | EM-2 | 0.49 | 1.52 | 0.50 | 1.54 | 0.52 | 1.58 | 0.23 | 0.23 |
| 35 | EM-3 | 0.47 | 1.55 | 0.49 | 1.60 | 0.50 | 1.62 | 0.22 | 0.22 |
| 36 | EM-4 | 0.48 | 1:56 | 0.50 | 1.61 | 0.51 | 1.65 | 0.22 | 0.22 |

Table B-9 shows that when imagewise exposed silver halide photographic materials having internal image forming silver halide were subjected to heating before development, superior positive images could be obtained.

EXAMPLE B-14

A subbed transparent polyethylene terephthalate base (150 μm thick) was coated with the following layers in the order written.

(1) Blue-sensitive, internal image forming silver chloroiodobromide

This layer was composed of the emulsion that was prepared in Example B-4 and which comprised blue-sensitized internal image forming silver chloroiodobromide grains (silver deposit: 3.5 g/m$^2$), sodium 4-(diethylamino)-2-methylphenylsulfamate (1.5 g/m$^2$), the sulfobenzotriazole silver salt emulsion shown in Example B-6 (silver deposit: 3.5 g/m$^2$), the yellow dye providing material Y-1 shown in Example B-9 (2.0 g/m$^2$), polyethylene glycol with a molecular weight of 300 (3.0 g/m$^2$), 3-methyl-1,3,5-pentanetriol (1.5 g/m$^2$), gelatin (3.0 g/m$^2$), polyvinylpyrrolidone with an average molecular weight of 30,000 (3.0 g/m$^2$), a surfactant (0.05 g/m$^2$) and a hardener (0.5 g/m$^2$).

(2) Intermediate layer:

This layer was composed of gelatin (1.0 g/m$^2$), polyvinylpyrrolidone (1.0 g/m$^2$) and the non-diffusible dye providing material shown below (0.4 g/m$^2$):

Non-Diffusible dye providing material:

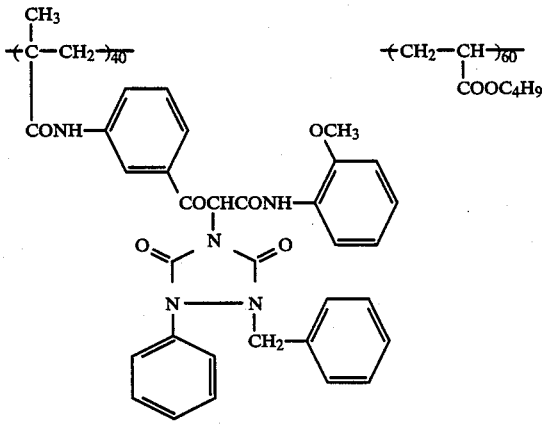

(3) Green-sensitive, internal image forming silver chloroiodobromide emulsion layer:

This layer was composed of the emulsion that was prepared in Example B-4 and which comprised green-sensitized internal image forming silver chloroiodobromide grains (silver deposit: 3.5 g/m$^2$), sodium 4-(diethylamino)-2-methylphenylsulfamate (1.2 g/m$^2$), a sulfobenzotriazole silver salt emulsion (silver deposit: 3.5 g/m$^2$), the magenta dye providing material M-4 shown below (2.0 g/m$^2$), polyethylene glycol (3.0 g/m$^2$), 3-methyl-1,3,5-pentanetriol (1.5 g/m$^2$), gelatin (3.0 g/m$^2$), polyvinylpyrrolidone (3.0 g/m$^2$), a surfactant (0.05 g/m$^2$) and a hardener (0.15 g/m$^2$).

Preparation of a dispersion of magenta dye providing material in gelatin

A dye providing material M-4 (5 g) having the structure shown below was dissolved in 15 ml of EA. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes so as to provide a dispersion of the dye providing material in gelatin at a yield of 100 g.

Dye providing material M-4

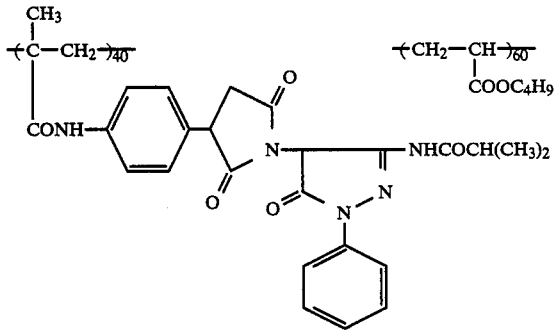

(4) Intermediate layer:

This layer was composed of gelatin (1.0 g/m$^2$) and polyvinyl-pyrrolidone (1.0 g/m$^2$).

(5) Red-sensitive, internal image forming silver chlorobromide emulsion layer:

This layer was composed of the emulsion that was prepared in Example B-3 and which comprised red-sensitized internal image forming silver chlorobromide grains (silver deposit: 3.0 g/m$^2$), sodium 4-(diethylamino)-2-methylphenylsulfamate (1.0 g/m$^2$), a sulfobenzotriazole silver salt emulsion (silver deposit: 3.0 g/m$^2$), the cyan dye providing material C-2 shown below (1.5 g/m$^2$), polyethylene glycol (2.5 g/m$^2$), 3-methyl-1,3,5-pentanetriol (1.0 g/m$^2$), gelatin (2.5 g/m$^2$), polyvinylpyrrolidone (2.5 g/m$^2$), a surfactant (0.05 g/m$^2$) and a hardener (0.13 g/m$^2$).

Preparation of a dispersion of cyan dye providing material in gelatin

A dye providing material C-2 (5 g) having the structure shown below was dissolved in 15 ml of EA. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes so as to provide a dispersion of the dye providing material in gelatin at a yield of 100 g.

Dye providing material M-4

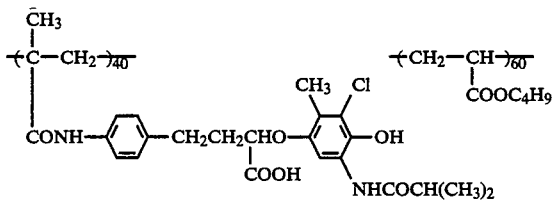

(6) Protective layer:

This layer was composed of gelatin (1.0 g/m$^2$), polyvinylpyrrolidone (1.0 g/m$^2$), a mat agent (0.3 g/m$^2$), a surfactant (0.1 g/m$^2$) and a hardener (0.05 g/m$^2$).

Each of the samples so prepared was subjected to imagewise exposure through a sensitometric optical wedge, and placed on a heat block for heating at 120° C., 140° C. or 160° C. for a period of 20 seconds. Thereafter, each of the samples was superposed on a heat transfer image-receiving element of the same type as prepared in Example B-11 in such a manner that the coated surfaces were in contact with each other. The assembly was heat-developed at 150° C. for 1 minute. Thereafter, the image-receiving element was immediately separated from the sample, and it carried a positive multicolor transfer image. The maximum density (Dmax) and minimum density (Dmin) were measured for the positive color transfer image obtained from each of the samples. The results are shown in Table B-10.

TABLE B-10

| Heating temperature | 120° C. | | 140° C. | | 160° C. | |
|---|---|---|---|---|---|---|
| | Dmin | Dmax | Dmin | Dmax | Dmin | Dmax |
| Yellow image | 0.43 | 1.46 | 0.46 | 1.63 | 0.48 | 1.69 |
| Magenta image | 0.42 | 1.43 | 0.45 | 1.61 | 0.48 | 1.65 |
| Cyan image | 0.40 | 1.32 | 0.43 | 1.48 | 0.45 | 1.57 |

Table B-10 shows that multi-layered silver halide photographic materials using internal image forming silver halides also produced superior positive color images when they were processed by the method of the present invention.

EXAMPLE B-15

To each of the emulsions prepared in Examples B-1 to B-4, the sulfobenzotriazole silver salt emulsion shown in Example B-6 (organic silver salt, with silver deposit of 2.0 g/m$^2$), a surfactant and a hardener were added, and the resulting coating solution was applied to a polyethylene terephthalate (150 μm thick) to give a silver deposit of 4.0 g/m$^2$, and dried.

Each of the resulting samples was subjected to imagewise exposure through a sensitometric optical wedge, and placed on a heat block for heating at 120° C., 140° C. or 160° C. for 30 seconds.

Subsequently, the samples were developed, fixed, washed and dried as in Example B-5. The maximum density (Dmax) and minimum density (Dmin) were measured for the positive image formed on each of the samples. The results are shown in Table B-11.

TABLE B-11

| Sample No. | Emulsion | Heating temperature 120° C. Dmin | 120° C. Dmax | 140° C. Dmin | 140° C. Dmax | 160° C. Dmin | 160° C. Dmax |
|---|---|---|---|---|---|---|---|
| 35 | EM-1 | 0.30 | 0.97 | 0.32 | 1.06 | 0.33 | 1.09 |
| 36 | EM-2 | 0.29 | 1.07 | 0.30 | 1.13 | 0.31 | 1.16 |
| 37 | EM-3 | 0.31 | 1.20 | 0.32 | 1.28 | 0.33 | 1.30 |
| 38 | EM-4 | 0.29 | 1.22 | 0.30 | 1.29 | 0.31 | 1.32 |

Table B-11 shows that when imagewise exposed silver halide photographic materials having internal image forming silver halides were subjected to heating before development, superior positive images could be obtained.

EXAMPLE C-1

A conversion type silver chlorobromide emulsion was prepared by the following procedures.

To a solution containing 80 g of gelatin, 200 ml of an aqueous solution of 1 mole of silver nitrate and 200 ml of an aqueous solution of 1.2 moles of potassium chloride were added simultaneously at a controlled temperature of 40° C. over a period of 1 minute. Following 1-minute physical ripening, 200 ml of an aqueous solution of 1 mole of potassium bromide was added, and physical ripening was conducted for an additional 1 minute. Washing was made to remove the water-soluble halides. After adding 5 g of gelatin, water was added to make a total of 400 g. The resulting silver chlorobromide emulsion comprised grains having an average size of 0.2 μm (compositional analysis revealed that this emulsion contained 97 mol % of AgBr), and is hereunder referred to as EM-1.

EXAMPLE C-2

A conversion type silver chlorobromide emulsion was prepared by the following procedures.

To an aqueous solution containing 80 g of gelatin and 200 ml of 1 mole of silver nitrate, 200 ml of an aqueous solution of 1.2 moles of potassium chloride was added at a controlled temperature of 40° C. over a period of 1 minute. Following 1-minute physical ripening, 200 ml of an aqueous solution of 1 mole of potassium bromide was added, and physical ripening was conducted for an additional 1 minute. Washing was made to remove the water-soluble halides. After addition of 5 g of gelatin, water was added to make a total of 400 g. The resulting silver chlorobromide emulsion comprised grains having an average size of 0.15 μm (compositional analysis revealed that this emulsion contained 96 mol % of AgBr), and is hereunder referred to as FM-2.

EXAMPLE C-3

Using the grains in the conversion type emulsion prepared in Example C-1 as cores, core/shell emulsions were prepared by the following procedures.

To 400 g of the core emulsion (EM-1), 190 ml of an aqueous solution of 1 mole of silver nitrate and 190 ml of an aqueous solution of 1.1 moles of potassium bromide were added simultaneously at 60° C. over a period of 5 minutes so as to precipitate a shell of silver bromide. After removing the water-soluble halides by washing with water, 20 g of gelatin was added and water was added to make a total of 600 g. The resulting silver chlorobromide core/shell emulsion comprised grains having an average size of 0.25 μm, and is hereunder referred to as EM-3.

To 400 g of the core emulsion (EM-1), 475 ml of an aqueous solution of 1 mole of silver nitrate and 475 ml of an aqueous solution of 1 mole of potassium bromide were added simultaneously at 60° C. over a period of 10 minutes so as to precipitate a shell of silver bromide. After removing the water-soluble halides by washing, 35 g of gelatin was added and water was added to make a total of 1,000 g. The resulting silver chlorobromide core/shell emulsion comprised grains having an average size of 0.3 μm, and is hereunder referred to as EM-4.

To 400 g of the core emulsion (EM-1), 435 ml of an aqueous solution of 2 moles of silver nitrate and 435 ml of an aqueous solution of 2.05 moles of potassium bromide were added simultaneously at 60° C. over a period of 20 minutes so as to precipitate a shell of silver bromide. After removing the water-soluble halides by washing, 50 g of gelatin was added and water was added to make a total of 1,500 g. The resulting silver chlorobromide core/shell emulsion comprised grains having an average size of 0.35 μm, and is hereunder referred to as EM-5.

EXAMPLE C-4

Using the grains in the conversion type emulsion prepared in Example C-2 as cores, core/shell emulsions were prepared by the following procedures.

To 400 g of the core emulsion (EM-2), 275 ml of an aqueous solution of 1 mole of silver nitrate, 255 ml of an aqueous solution of 1 mole of potassium bromide and 30 ml of an aqueous solution of 1 mole of potassium chloride were added simultaneously at 60° C. over a period of 5 minutes so as to precipitate a shell of silver chlorobromide. After removing the water-soluble halides by washing with water, 20 g of gelatin was added and water was added to make a total of 600 g. The resulting silver chlorobromide core/shell emulsion comprised grains having an average size of 0.2 μm, and is hereunder referred to as EM-6.

To 400 g of the core emulsion (EM-2), 365 ml of an aqueous solution of 2 moles of silver nitrate, 365 ml of an aqueous solution of 2 moles of potassium bromide and 40 ml of an aqueous solution of 0.2 mole of potassium chloride were added simultaneously at 60° C. over a period of 15 minutes so as to precipitate a shell of silver chlorobromide. After removing the water-soluble halides by washing, 45 g of gelatin was added and water was added to make a total of 1,200 g. The resulting silver chlorobromide core/shell emulsion comprised grains having an average size of 0.25 μm, and is hereunder referred to as EM-7.

To 400 g of the core emulsion (EM-2), 275 ml of an aqueous solution of 1 mole of silver nitrate, 275 ml of an aqueous solution of 1 mole of potassium bromide, and 25 ml of an aqueous solution of 0.05 mole of potassium iodide were added simultaneously at 60° C. over a period of 5 minutes so as to precipitate a shell of silver iodobromide. After removing the water-soluble halides by washing, 20 g of gelatin was added and water was added to make a total of 600 g. The resulting silver iodochlorobromide core/shell emulsion comprised grains having an average size of 0.2 μm, and is hereunder referred to as EM-8.

EXAMPLE C-5

A core/shell silver chlorobromide emulsion comprising grains having an average size of 0.2 μm was prepared as in the preparation of EM-6 except that 10 ml of a 0.01% aqueous solution of potassium hexachloroiridate was added to 400 g of core emulsion EM-2 prepared in Example C-2. This emulsion is hereunder referred to as EM-9.

EXAMPLE C-6

To each of the emulsions prepared in Examples C-1 to C-5, sodium 4-(diethylamino)-2-methylphenylsulfamate (1.0 g/m$^2$, a surfactant and a hardener were added, and the resulting coating solution was applied to a subbed polyethylene terephthalate base (150 μm thick) to give a silver deposit of 2.0 g/m$^2$, and dried.

Each of the resulting samples was subjected to imagewise exposure through a sensitometric optical wedge, and placed on a heat block for heating at a temperature of 30° C., 120° C., 140° C. or 160° C. for a period of 30 seconds. The samples were then developed at 20° C. for 5 minutes with a developer having the following formulation.

| Developer formulation | |
|---|---|
| Methol | 2.5 g |
| Ascorbic acid | 10 g |
| Potassium bromide | 1 g |
| Sodium metaborate | 35 g |
| Water | to make 1,000 ml |

The developed samples were subsequently fixed, washed and dried by the customary procedures. The maximum density (Dmax) and minimum density (Dmin) were measured for the positive image formed on each of the samples, and the results are shown in Table C-1.

TABLE C-1

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 1 (Comp. 1) | EM-1 | 0.38 | 1.00 | 0.39 | 1.16 | 0.40 | 1.15 | 0.02 | 0.02 |
| 2 (Comp. 2) | EM-2 | 0.39 | 1.23 | 0.41 | 1.31 | 0.41 | 1.35 | 0.02 | 0.02 |
| 3 | EM-3 | 0.29 | 1.02 | 0.30 | 1.19 | 0.30 | 1.21 | 0.02 | 0.02 |
| 4 | EM-4 | 0.28 | 1.03 | 0.29 | 1.17 | 0.31 | 1.19 | 0.02 | 0.02 |
| 5 | EM-5 | 0.28 | 0.97 | 0.30 | 1.08 | 0.30 | 1.09 | 0.02 | 0.02 |
| 6 | EM-6 | 0.30 | 1.20 | 0.31 | 1.28 | 0.33 | 1.31 | 0.02 | 0.02 |
| 7 | EM-7 | 0.27 | 1.15 | 0.29 | 1.19 | 0.28 | 1.22 | 0.03 | 0.03 |
| 8 | EM-8 | 0.26 | 1.22 | 0.27 | 1.29 | 0.27 | 1.32 | 0.02 | 0.02 |
| 9 | EM-9 | 0.26 | 1.29 | 0.27 | 1.35 | 0.28 | 1.39 | 0.02 | 0.02 |

Table C-1 shows that when imagewise exposed silver halide photographic materials having internal image forming silver halides were subjected to heating before development, superior positive images could be obtained. It is also clear from Table C-1 that in comparison with sample Nos. 1 and 2 which were silver halide photographic materials using conversion type emulsions, EM-1 and EM-2, sample Nos. 3 to 9 which were silver halide photographic materials using core/shell type emulsions containing EM-1 or EM-2 as a core exhibited good characteristics in that they had low minimum densities.

EXAMPLE C-7

To each of the emulsions prepared in Examples C-1 to C-5, sodium 4-(diethylamino)-2-methylphenylsulfamate (1.0 g/m$^2$) a sulfobenzotriazole silver salt emulsion (organic silver salt, with silver deposit of 2.0 g/m$^2$) prepared by the method described below, a surfactant and a hardener were added, and the resulting coating solution was applied to a polyethylene terephthalate base (150 μm thick) to give a silver deposit of 4.0 g/m$^2$, and dried.

Each of the resulting samples was subjected to imagewise exposure through a sensitometric optical wedge, and placed on a heat block for heating at a temperature of 30° C., 120° C., 140° C. or 160° C. for a period of 30 seconds. The samples were subsequently developed, fixed, washed and dried as in Example C-6. The maximum and minimum densities (Dmax and Dmin) were measured for the positive image formed on each of the samples, and the results are shown in Table C-2.

Preparation of sulfobenzotriazole silver emulsion

In a mixed solvent of water (150 ml) and ethanol (150 ml), 40 g of poly(4-vinylpyrrolidone), 30 g of 4-sulfobenzotriazole and 6 g of sodium hydroxide were dissolved. To the stirred solution, 30 ml of an aqueous solution of 5N silver nitrate was added so as to adjust the pH at between 6 and 8. Water was added to make a total of 600 ml, thereby providing a dispersion of organic silver salt.

TABLE C-2

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 10 (Comp.-3) | EM-1 | 0.30 | 1.21 | 0.30 | 1.31 | 0.31 | 1.33 | 0.03 | 0.03 |
| 11 (Comp.-4) | EM-2 | 0.32 | 1.36 | 0.33 | 1.45 | 0.33 | 1.46 | 0.02 | 0.02 |
| 12 | EM-3 | 0.20 | 1.19 | 0.21 | 1.27 | 0.21 | 1.28 | 0.02 | 0.02 |
| 13 | EM-4 | 0.19 | 1.14 | 0.20 | 1.23 | 0.21 | 1.23 | 0.02 | 0.02 |
| 14 | EM-5 | 0.17 | 1.10 | 0.19 | 1.20 | 0.19 | 1.21 | 0.02 | 0.02 |
| 15 | EM-6 | 0.21 | 1.23 | 0.22 | 1.33 | 0.22 | 1.34 | 0.03 | 0.03 |
| 16 | EM-7 | 0.19 | 1.18 | 0.21 | 1.29 | 0.21 | 1.30 | 0.03 | 0.03 |
| 17 | EM-8 | 0.17 | 1.24 | 0.19 | 1.32 | 0.20 | 1.34 | 0.03 | 0.03 |
| 18 | EM-9 | 0.17 | 1.25 | 0.18 | 1.36 | 0.19 | 1.39 | 0.02 | 0.02 |

Table C-2 shows that when imagewise exposed silver halide photographic materials having internal image forming silver halides were subjected to heating before development, superior positive images could be obtained. It is also clear from Table C-2 that in comparison with sample Nos. 10 and 11 which were silver halide photographic materials using conversion type emulsions, EM-1 and EM-2, sample Nos. 12 to 18 which were silver halide photographic materials using core/shell type emulsions containing EM-1 or EM-2 as a core exhibited good characteristics in that they had low minimum densities.

EXAMPLE C-8

To each of the emulsions prepared in Examples C-1 to C-5, sodium 4-(diethylamino)-2-methylphenylsulfamate (1.0 g/m$^2$), the dye providing material M-1 (0.8 g/m$^2$) shown below, a surfactant and a hardener were added, and the resulting coating solution was applied to a polyethylene terephthalate base (150 μm thick) to give a silver deposit of 2.0 g/m$^2$ and dried.

Preparation of a dispersion of dye providing material in gelatin

A dye providing material M-1 (10 g) having the structure shown below was uniformly dissolved in 30 g of ethyl acetate (hereunder referred to as EA) and 15 g of tricresyl phosphate (hereunder referred to as TCP) by heating at about 50° C. The resulting solution was added to 400 ml of a 7.5% aqueous solution containing 30 ml of a 5% aqueous solution of Alkanol XC (Du Pont) and the two solutions were mixed under agitation. Thereafter, the mixture was homogenized by an ultrasonic homogenizer for 30 minutes, so as to obtain a dispersion of the dye providing material in gelatin at a yield of 600 g.

Dye providing material M-1

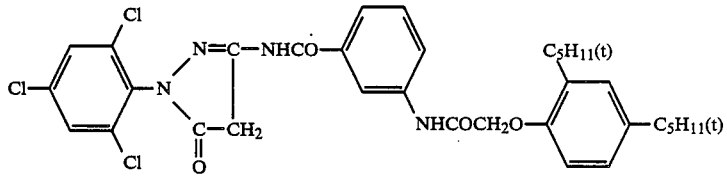

Each of the resulting samples was subjected to imagewise exposure through a sensitometric optical wedge, and placed on a heat block for heating at 30° C., 120° C., 140° C. or 160° C. for 30 seconds. The samples were subsequently processed by the scheme shown below, so as to obtain samples carrying dye images.

| Processing steps (30° C.) | Time |
|---|---|
| Color development | 3 min and 30 sec. |
| First washing | 1 min and 00 sec. |
| Bleach-fixing | 1 min and 30 sec. |
| Second washing | 1 min and 00 sec. |

The respective processing solutions had the following formulations.

| | |
|---|---|
| Color development | |
| 4-Amino-3-methyl-N—(β-methanesulfonamidoethyl)aniline sulfate | 5 g |
| Sodium sulfite (anhydrous) | 2 g |
| Sodium carbonate (monohydrate) | 15 g |
| Potassium bromide | 1 g |
| Benzyl alcohol | 10 ml |
| Water | to make 1,000 ml |
| (pH adjusted to 10.2 with potassium hydroxide) | |
| Bleach-fixing solution | |
| Ethylenediaminetetraacetic acid iron (III) ammonium dihydrate | 60 g |
| Ethylenediaminetetraacetic acid | 3 g |
| Sodium thiosulfate (70% aq. sol.) | 100 ml |
| Ammonium sulfite (40% aq. sol.) | 27.5 ml |
| Water | to make 1,000 ml |
| (pH adjusted to 7.10 with potassium carbonate) | |

The maximum density (Dmax) and minimum density (Dmin) were measured for the positive magenta color image formed on each of the samples, and the results are shown in Table C-3.

TABLE C-3

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 19 (Comp.-5) | EM-1 | 0.29 | 1.14 | 0.31 | 1.19 | 0.31 | 1.20 | 0.11 | 0.11 |
| 20 (Comp.-6) | EM-2 | 0.28 | 1.28 | 0.30 | 1.33 | 0.30 | 1.33 | 0.10 | 0.10 |
| 21 | EM-3 | 0.18 | 1.18 | 0.19 | 1.21 | 0.19 | 1.21 | 0.11 | 0.11 |
| 22 | EM-4 | 0.16 | 1.13 | 0.16 | 1.17 | 0.17 | 1.18 | 0.10 | 0.10 |
| 23 | EM-5 | 0.15 | 1.10 | 0.16 | 1.14 | 0.17 | 1.15 | 0.10 | 0.10 |
| 24 | EM-6 | 0.19 | 1.31 | 0.19 | 1.34 | 0.20 | 1.34 | 0.10 | 0.10 |
| 25 | EM-7 | 0.18 | 1.27 | 0.19 | 1.31 | 0.20 | 1.32 | 0.10 | 0.10 |
| 26 | EM-8 | 0.16 | 1.33 | 0.18 | 1.37 | 0.19 | 1.38 | 0.10 | 0.10 |
| 27 | EM-9 | 0.16 | 1.35 | 0.18 | 1.39 | 0.19 | 1.42 | 0.10 | 0.10 |

Table C-3 shows that when imagewise exposed silver halide photographic materials having internal image forming silver halides were subjected to heating before development, superior positive images could be obtained. It is also clear from Table C-3 that in comparison with sample Nos. 19 and 20 which were silver halide photographic materials using conversion type emulsions, EM-1 and EM-2, sample Nos. 21 to 27 which were silver halide photographic materials using core/shell emulsions containing EM-1 or EM-2 as a core exhibited good characteristics in that they had low minimum densities.

EXAMPLE C-9

To each of the emulsions prepared in Examples C-1 to C-5 sodium 4-(diethylamino)-2-methylphenylsulfamate (1.2 g/m$^2$) the sulfobenzotriazole silver salt emulsion shown in Example C-7 (organic silver salt, with silver deposit of 2.2 g/m$^2$), the dye providing material C-1 (1.2 g/m$^2$) shown below, a surfactant and a hardener were added, and the resulting coating solution was applied to a polyethylene terephthalate base (150 μm thick) to give a silver deposit of 4.5 g/m$^2$ and dried.

Preparation of a dispersion of cyan dye providing material in gelatin

A dye providing material C-1 (10 g) having the structure shown below was uniformly dissolved in a mixture of TCP (20 g) and EA (40 ml). The resulting solution was added to 400 ml of a 7.5% aqueous gelatin solution containing 50 ml of a 5% aqueous solution of Alkanol XC and the two solutions were mixed under agitation. Thereafter, the mixture was homogenized by an ultrasonic homogenizer for 30 minutes, so as to obtain a dispersion of the cyan dye providing material in gelatin at a yield of 600 g.

Cyan dye providing material C-1

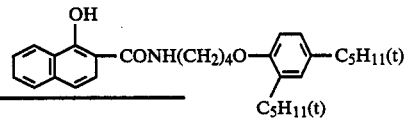

Each of the resulting samples was subjected to imagewise exposure through a sensitometric optical wedge, and placed on a heat block for heating at 30° C., 120° C., 140° C. or 160° C. for 40 seconds. The samples were subsequently processed by the same scheme as shown in Example C-8, thereby producing samples carrying dye images. The maximum density (Dmax) and minimum density (Dmin) were measured for the positive cyan color image formed on each of the samples, and the results are shown in Table C-4.

TABLE C-4

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 28 (Comp.-7) | EM-1 | 0.31 | 1.34 | 0.33 | 1.41 | 0.34 | 1.44 | 0.08 | 0.08 |
| 29 (Comp.-8) | EM-2 | 0.32 | 1.45 | 0.35 | 1.49 | 0.36 | 1.52 | 0.08 | 0.08 |
| 30 | EM-3 | 0.21 | 1.29 | 0.23 | 1.39 | 0.23 | 1.41 | 0.08 | 0.08 |
| 31 | EM-4 | 0.19 | 1.22 | 0.21 | 1.28 | 0.22 | 1.33 | 0.08 | 0.08 |
| 32 | EM-5 | 0.17 | 1.18 | 0.19 | 1.24 | 0.20 | 1.25 | 0.08 | 0.08 |
| 33 | EM-6 | 0.23 | 1.44 | 0.25 | 1.50 | 0.26 | 1.50 | 0.08 | 0.08 |
| 34 | EM-7 | 0.21 | 1.39 | 0.23 | 1.45 | 0.23 | 1.46 | 0.08 | 0.08 |
| 35 | EM-8 | 0.18 | 1.43 | 0.21 | 1.51 | 0.22 | 1.51 | 0.08 | 0.08 |
| 36 | EM-9 | 0.18 | 1.46 | 0.21 | 1.54 | 0.22 | 1.56 | 0.08 | 0.08 |

Table C-4 shows that when imagewise exposed silver halide photographic materials having internal image forming silver halides were subjected to heating before development, superior positive images could be obtained. It is also clear from Table C-4 that in comparison with sample Nos. 28 and 29 which were silver halide photographic materials using conversion type emulsions, EM-1 and EM-2, sample Nos. 30 to 36 which were silver halide photographic materials using core/-shell type emulsions containing EM-1 or EM-2 as a core exhibited good characteristics in that they had low minimum densities.

EXAMPLE C-10

To each of the emulsions prepared in Examples C-1 to C-5, methyl hydroquinone (1.0 g/m$^2$), 4-carboxymethyl-4-thiazoline-2-thione (0.06 g/m$^2$), the sulfobenzotriazole silver salt emulsion shown in Example C-7 (organic silver salt, with silver deposit of 2.0 g/m$^2$), 3-methyl-1,3,5-pentanetriol (4.0 g/m$^2$), gelatin (3.0 g/m$^2$), polyvinylpyrrolidone with an average molecular weight of 30,000 (3.0 g/m$^2$), a surfactant and a hardener were added, and the resulting coating solution was applied to a polyethylene terephthalate base (150 μm thick) to give a silver deposit of 4.0 g/m$^2$, and dried.

Each of the resulting samples was subjected to imagewise exposure through a sensitometric optical wedge, nd placed on a heat block for heating at 120° C., 140° C. or 160° C. for 20 seconds.

The samples were then developed by continued heating for an additional 40 seconds. The maximum density (Dmax) and minimum density (Dmin) were measured for the positive image formed on each of the samples, and the results are shown in Table C-5.

TABLE C-5

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 37 (Comp.-9) | EM-1 | 0.65 | 1.07 | 0.69 | 1.17 | 0.74 | 1.22 |
| 38 (Comp.-10) | EM-2 | 0.66 | 1.14 | 0.73 | 1.24 | 0.77 | 1.30 |
| 39 | EM-3 | 0.58 | 1.05 | 0.55 | 1.15 | 0.57 | 1.18 |
| 40 | EM-4 | 0.48 | 1.03 | 0.52 | 1.13 | 0.54 | 1.15 |
| 41 | EM-5 | 0.46 | 1.01 | 0.50 | 1.10 | 0.53 | 1.13 |
| 42 | EM-6 | 0.51 | 0.18 | 0.56 | 1.28 | 0.58 | 1.33 |
| 43 | EM-7 | 0.47 | 1.15 | 0.51 | 1.26 | 0.53 | 1.31 |
| 44 | EM-8 | 0.45 | 1.17 | 0.49 | 1.28 | 0.51 | 1.33 |
| 45 | EM-9 | 0.44 | 1.19 | 0.48 | 1.30 | 0.50 | 1.36 |

Table C-5 shows that when imagewise exposed silver halide photographic materials having internal image forming silver halides were initially heated before performing heat development, superior positive images could be obtained. It is also clear from Table C-5 that in comparison with sample Nos. 37 and 38 which were silver halide photographic materials using conversion type emulsions, EM-1 and EM-2, sample Nos. 39 to 45 which were silver halide photographic materials using core/shell type emulsions containing EM-1 or EM-2 as a core exhibited good characteristics in that they had low minimum densities.

EXAMPLE C-11

To each of the emulsions prepared in Examples C-1 to C-5, sodium 4-(diethylamino)-2-methylphenylsulfamate (2.0 g/m$^2$) the sulfobenzotriazole silver salt emulsion shown in Example C-7 (organic silver salt, with silver deposit of 2.0 g/m$^2$), the dye providing material M-2 (1.5 g/m$^2$) shown below, 3-methyl-1,3,5-pentanetriol (3.0 g/m$^2$), a surfactant and a hardener were added, and the resulting coating solution was applied to a polyethylene terephthalate base (150 μm thick) to give a silver deposit of 4.0 g/m$^2$, and dried.

Each of the resulting samples was subjected to imagewise exposure through a sensitometric optical wedge, and placed on a heat block for heating at 120° C., 140° C. or 160° C. for 20 seconds. Thereafter, the samples were developed by continued heating for an additional 40 seconds. The maximum density (Dmax) and minimum density (Dmin) were measured for the positive magenta image formed on each of the samples, and the results are shown in Table C-6.

Preparation of a dispersion of dye providing material in gelatin

A dye providing material M-2 (10 g) having the structure shown below was uniformly dissolved in 30 g of ethyl acetate and 10 g of tricresyl phosphate (TCP) by heating at about 60° C. The resulting solution was mixed under agitation with 120 ml of a 2% aqueous gelatin solution containing 30 ml of a 5% aqueous solution of Alkanol XC (Du Pont) as a dispersant. Thereafter, the mixture was homogenized by an ultrasonic homogenizer for 10 minutes, so as to obtain a dispersion of the dye providing material in gelatin.

Dye providing material M-2

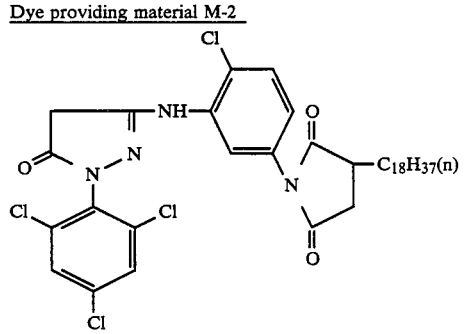

TABLE C-6

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 46 (Comp.-11) | EM-1 | 0.68 | 1.21 | 0.73 | 1.31 | 0.75 | 1.38 |
| 47 (Comp.-12) | EM-2 | 0.67 | 1.25 | 0.73 | 1.33 | 0.76 | 1.40 |
| 48 | EM-3 | 0.51 | 1.08 | 0.55 | 1.18 | 0.58 | 1.20 |
| 49 | EM-4 | 0.48 | 1.04 | 0.52 | 1.13 | 0.55 | 1.16 |
| 50 | EM-5 | 0.45 | 1.03 | 0.49 | 1.11 | 0.53 | 1.14 |
| 51 | EM-6 | 0.50 | 1.20 | 0.54 | 1.29 | 0.57 | 1.34 |

TABLE C-6-continued

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 52 | EM-7 | 0.48 | 1.17 | 0.50 | 1.27 | 0.54 | 1.32 |
| 53 | EM-8 | 0.44 | 1.19 | 0.49 | 1.30 | 0.52 | 1.37 |
| 54 | EM-9 | 0.43 | 1.20 | 0.48 | 1.33 | 0.50 | 1.40 |

Table C-6 shows that when imagewise exposed silver halide photographic materials having internal image forming silver halides were initially heated before conducting heat development, superior positive images could be obtained. It is also clear from Table C-6 that in comparison with sample Nos. 46 and 47 which were silver halide photographic materials using conversion type emulsions, EM-1 and EM-2, sample Nos. 48 to 54 which were silver halide photographic materials using core/shell type emulsions containing EM-1 or EM-2 as a core exhibited good characteristics in that they had low minimum densities.

EXAMPLE C-12

To each of the emulsions prepared in Examples C-1 to C-5 sodium 4-(diethylamino)-2-methylphenylsulfamate (2.0 g/m$^2$), the sulfobenzotriazole silver salt emulsion shown in Example C-7 (organic silver salt, with silver deposit of 2.0 g/m$^2$), the dye providing material Y-1 (1.8 g/m$^2$) shown below, 3-methyl-1,3,5-pentanetriol (4.0 g/m$^2$) gelatin (3.0 g/m$^2$), polyvinylpyrrolidone with an average molecular weight of 30,000 (3.0 g/m ), a surfactant and a hardener were added, and the resulting coating solution was applied to a polyethylene terephthalate base (150 μm thick) to give a silver deposit of 4.0 g/m$^2$, and dried.

Dye providing material Y-1

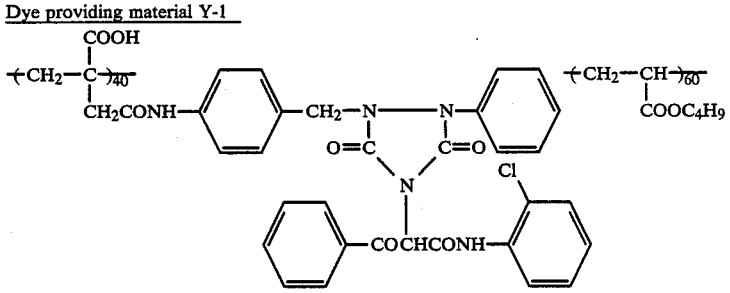

Preparation of a dispersion of yellow dye providing material in gelatin

A dye providing material Y-1 (5 g) was dissolved in 15 ml of EA. The resulting solution was added to 60 ml of a 5% aqueous gelatin solution containing 15 ml of a 5% aqueous solution of Alkanol XC and the two solutions were mixed under agitation. The mixture was homogenized by an ultrasonic homogenizer for 10 minutes, so as to obtain a dispersion of the dye providing material in gelatin at a yield of 100 g.

Each of the resulting samples was subjected to imagewise exposure through a sensitometric optical wedge, and placed on a heat block for heating at 120° C., 140° C. or 160° C. for 20 seconds.

Each of the samples was superposed on a heat transfer image-receiving element (to be described below) so that the coated surfaces were in contact with each other. The assembly was heat-developed at 150° C. for 1 minute by a commercial heat developer, Copy Mate (Graphic Corporation). Thereafter, the image-receiving element was immediately separated from the sample, and it carried a positive yellow color transfer image.

Preparation of a heat transfer image-receiving element

A photographic baryta paper was coated with a polyvinyl chloride containing latex NIPOLG-576 (Japan Zeon Co., Ltd.) and passed through a hot atmosphere (150° C.) to form an image-receiving element having a smooth latex coat.

The maximum density (Dmax) and minimum density (Dmin) were measured for the positive yellow color transfer image obtained from each of the samples. The results are shown in Table C-7.

TABLE C-7

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 55 (Comp.-13) | EM-1 | 0.28 | 1.31 | 0.31 | 1.43 | 0.31 | 1.45 |
| 56 (Comp.-14) | EM-2 | 0.27 | 1.42 | 0.30 | 1.53 | 0.31 | 1.54 |
| 57 | EM-3 | 0.19 | 1.28 | 0.20 | 1.38 | 0.20 | 1.40 |
| 58 | EM-4 | 0.17 | 1.24 | 0.18 | 1.35 | 0.19 | 1.37 |
| 59 | EM-5 | 0.15 | 1.19 | 0.16 | 1.27 | 0.17 | 1.30 |
| 60 | EM-6 | 0.19 | 1.40 | 0.21 | 1.48 | 0.22 | 1.50 |
| 61 | EM-7 | 0.18 | 1.37 | 0.19 | 1.45 | 0.20 | 1.45 |
| 62 | EM-8 | 0.15 | 1.44 | 0.17 | 1.49 | 0.18 | 1.51 |
| 63 | EM-9 | 0.14 | 1.46 | 0.17 | 1.50 | 0.18 | 1.52 |

Table C-7 shows that when imagewise exposed silver halide photographic materials having internal image forming silver halides were heated and heat-developed in superposition on an image-receiving element, superior positive images could be obtained. It is also clear from Table C-7 that in comparison with sample Nos. 55 and 56 which were silver halide photographic materials using conversion type emulsions, EM-1 and EM-2, sample Nos. 57 to 63 using core/shell type emulsions containing EM-1 or EM-2 as a core exhibited good characteristics in that they had low minimum densities.

EXAMPLE C-13

Each of the nine unexposed samples prepared in Example C-12 was subjected to imagewise exposure through a sensitometric optical wedge, and was superposed on a heat transfer image-receiving element which was of the same type as prepared in Example C-12 so that the coated surfaces were in contact with each other. The assembly was heated in a Copy Mate for 20 seconds at 120° C., 140° C. or 160° C., and subsequently heat-developed by heating at 150° C. for 1 minute. Thereafter, the image-receiving element was immediately separated from the sample, and a positive yellow color transfer image had formed on the receiving element.

The maximum density (Dmax) and minimum density (Dmin) were measured for the positive yellow color transfer image obtained from each of the samples. The results are shown in Table C-8.

TABLE C-8

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 64 (Comp.-15) | EM-1 | 0.32 | 1.07 | 0.34 | 1.18 | 0.34 | 1.21 |
| 65 (Comp.-16) | EM-2 | 0.31 | 1.22 | 0.33 | 1.35 | 0.34 | 1.37 |
| 66 | EM-3 | 0.22 | 1.05 | 0.24 | 1.15 | 0.24 | 1.17 |
| 67 | EM-4 | 0.21 | 1.00 | 0.23 | 1.11 | 0.24 | 1.12 |
| 68 | EM-5 | 0.19 | 0.96 | 0.22 | 1.07 | 0.23 | 1.09 |
| 69 | EM-6 | 0.21 | 1.21 | 0.23 | 1.33 | 0.24 | 1.35 |
| 70 | EM-7 | 0.19 | 1.19 | 0.21 | 1.30 | 0.21 | 1.31 |
| 71 | EM-8 | 0.18 | 1.22 | 0.19 | 1.35 | 0.19 | 1.36 |
| 72 | EM-9 | 0.17 | 1.23 | 0.18 | 1.36 | 0.19 | 1.38 |

Table C-8 shows that when imagewise exposed silver halide photographic materials having internal image forming silver halide were heated and heat-developed in superposition on an image-receiving elements, superior positive image could be obtained. It is also clear from Table C-8 that in comparison with sample Nos. 64 and 65 which were silver halide photographic materials using conversion type emulsions, EM-1 and EM-2, sample Nos. 66 to 72 which were silver halide photographic materials using core/shell type emulsions containing EM-1 or EM-2 as a core exhibited good characteristics in that they had low minimum densities.

EXAMPLE C-14

To each of the samples prepared in Examples C-1 to C-5, the reducing dye providing material M-3 (1.5 g/m$^2$) shown below, a reducing agent, or 1-phenyl-4-methyl-4-hydroxymethyl-3-pyrazolidinone (0.2 g/m$^2$), trimethylolethane (3.0 g/m$^2$), guanidinetrichloroacetic acid (0.6 g/m$^2$), polyvinylpyrrolidone (1.5 g/m$^2$), a surfactant and a hardener were added, and the resulting coating solution was applied to a polyethylene terephthalate base (150 μm thick) to give a silver deposit of 2.0 g/m$^2$, and dried.

Preparation of a dispersion of magenta reducing dye providing material in gelatin A reducing dye providing material M-3 (30 g) was dissolved in 30 g of dioctyl phthalate and 90 ml of EA. The resulting solution was added to 200 ml of a 10% aqueous gelatin solution containing Alkanol XC and the two solutions were mixed under agitation. The mixture was homogenized by an ultrasonic homogenier for 30 minutes, so as to obtain a dispersion of the reducing dye providing material in gelatin at a yield of 500 g.

Reducing dye providing material M-3

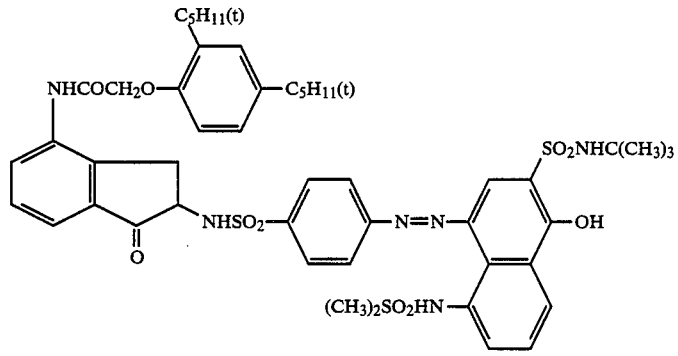

Each of the resulting samples was subjected to imagewise exposure through a sensitometric optical wedge, and placed on a heat block for heating at 30° C., 120° C., 140° C. or 160° C. for 1 minute.

A subbed polyethylene terephthalate base (100 μm) containing a white pigment was coated with an image-receiving layer composed of a 1:1 copolymer of styrene and N-benzyl-N,N-dimethyl-N-(3-maleimidopropyl-)ammonium chloride and an acid-treated gelatin. The so prepared image-receiving element was immersed in water and superposed on the previously prepared light-sensitive material in such a manner that the coated surfaces were held in contact with the image-receiving layer for 30 seconds. Thereafter, the image-receiving element was separated from the light-sensitive material and a positive magenta color transfer image had formed on the receiving element. The maximum density (Dmax) and minimum density (Dmin) were measured for the positive magenta color transfer image obtained from each of the samples, and the results are shown in Table C-9.

TABLE C-9

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 73 (Comp.-17) | EM-1 | 0.49 | 1.52 | 0.50 | 1.54 | 0.52 | 1.58 | 0.23 | 0.23 |
| 74 (Comp.-18) | EM-2 | 0.47 | 1.55 | 0.49 | 1.60 | 0.50 | 1.62 | 0.22 | 0.22 |
| 75 | EM-3 | 0.33 | 1.51 | 0.36 | 1.54 | 0.38 | 1.54 | 0.20 | 0.20 |
| 76 | EM-4 | 0.32 | 1.47 | 0.36 | 1.52 | 0.37 | 1.52 | 0.20 | 0.20 |
| 77 | EM-5 | 0.30 | 1.45 | 0.34 | 1.49 | 0.35 | 1.51 | 0.19 | 0.19 |
| 78 | EM-6 | 0.32 | 1.54 | 0.35 | 1.57 | 0.36 | 1.59 | 0.19 | 0.19 |
| 79 | EM-7 | 0.32 | 1.51 | 0.34 | 1.54 | 0.36 | 1.55 | 0.19 | 0.19 |
| 80 | EM-8 | 0.31 | 1.55 | 0.34 | 1.59 | 0.35 | 1.60 | 0.19 | 0.19 |
| 81 | EM-9 | 0.30 | 1.57 | 0.33 | 1.61 | 0.34 | 1.62 | 0.19 | 0.19 |

Table C-9 shows that when imagewise exposed silver halide photographic materials having internal image forming silver halides were subjected to heating before development, superior positive images could be obtained. It is also clear from Table C-9 that in comparison with sample Nos. 73 and 74 which were silver halide photographic materials using conversion type emulsions, EM11 and EM-2, sample Nos. 75 to 81 which were silver halide photographic materials using core/-shell type emulsions containing EM-1 or EM-2 as a core exhibited good characteristics in that they had low minimum densities.

EXAMPLE C-15

A subbed transparent polyethylene terephthalate base (150 μm thick) was coated with the following layers in the order written.

(1) Blue-sensitive, internal image forming silver halide emulsion layer:

This layer was composed of one of the emulsions (EM-1 and EM-3) that were prepared in Examples C-1 and C-3 and which comprised blue-sensitized internal image forming silver chlorobromide grains (silver deposit: 3.5 g/m$^2$), sodium 4-(diethylamino)-2-methylphenylsulfamate (1.5 g/m$^2$), the sulfobenzotriazole silver salt emulsion shown in Example C-15 (silver deposit: 3.5 g/m$^2$), the yellow dye providing material Y-1 shown in Example C-10 (2.0 g/m$^2$), polyethylene glycol with a molecular weight of 300 (3.0 g/m$^2$), 3-methyl-1,3,5-pentanetriol (1.5 g/m$^2$), gelatin (3.0 g/m$^2$), polyvinylpyrrolidone with an average molecular weight of 30,000 (3.0 g/m$^2$), a surfactant (0.05 g/m$^2$) and a hardener (0.15 g/m$^2$).

(2) Intermediate layer:

This layer was composed of gelatin (1.0 g/m$^2$), polyvinylpyrrolidone (1.0 g/m$^2$) and the non-diffusible dye providing material shown below (0.4 g/m$^2$):

Non-diffusible dye providing material:

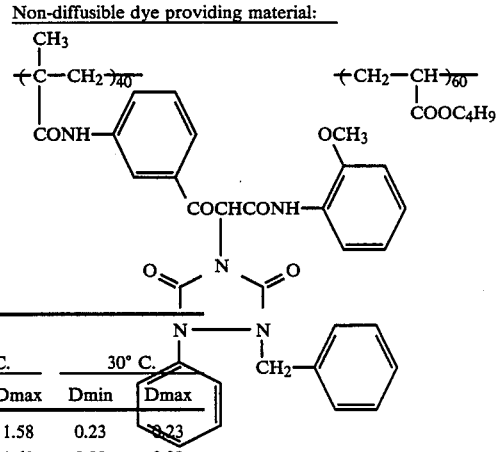

(3) Green-sensitive, internal image forming silver halide emulsion layer:

This layer was composed of one of the emulsions (EM-2, 6 and 8) that were prepared in Examples C-2 and C-4 and which comprised green-sensitized internal image forming silver chlorobromide and iodochlorobromide grains (silver deposit: 3.5 g/m$^2$), sodium 4-(diethylamino)-2-methylphenylsulfamate (1.2 g/m$^2$), a sulfobenzotriazole silver salt emulsion (silver deposit: 3.5 g/m$^2$), the magenta dye providing material M-4 shown below (2.0 g/m$^2$), polyethylene glycol (3.0 g/m$^2$), 3-methyl-1,3,5-pentanetriol (1.5 g/m$^2$), gelatin (3.0 g/m$^2$), polyvinylpyrrolidone (3.0 g/m$^2$), a surfactant (0.05 g/m$^2$) and a hardener (0.15 g/m$^2$).

Preparation of a dispersion of magenta dye providing material in gelatin

A dye providing material M-4 (5 g) having the structure shown below was dissolved in 15 ml of EA. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes so as to provide a dispersion of the dye providing material in gelatin at a yield of 100 g.

Dye providing material M-4

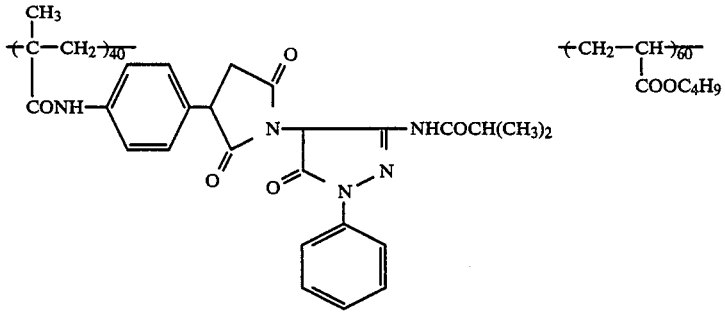

(4) Intermediate layer:

This layer was composed of gelatin (1.0 g/m$^2$) and polyvinylpyrrolidone (1.0 g/m$^2$)

(5) Red-sensitive, internal image forming silver halide emulsion layer:

This layer was composed of one of the emulsions (EM-2, 6 and 8) that were prepared in Examples C-2 and C-4 and which comprised red-sensitized internal image forming silver chlorobromide and iodochlorobromide grains (silver deposit: 3.0 g/m$^2$), sodium 4-(diethylamino)-2-methylphenylsulfamate (1.0 g/m$^2$), a sulfobenzotriazole silver salt emulsion (silver deposit: 3.0 g/m$^2$), the cyan dye providing material C-2 shown below (1.5 g/m$^2$), polyethylene glycol (2.5 g/m$^2$), 3-methyl-1,3,5-pentanetriol (1.0 g/m$^2$), gelatin (2.5 g/m$^2$), polyvinylpyrrolidone (2.5 g/m$^2$), a surfactant (0.05 g/m$^2$) and a hardener (0.13 g/m$^2$).

Preparation of a dispersion of cyan dye providing material in gelatin

A dye providing material C-2 (5 g) having the structure shown below was dissolved in 15 ml of EA. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes so as to provide a dispersion of the dye providing material in gelatin at a yield of 100 g.

Dye providing material C-2

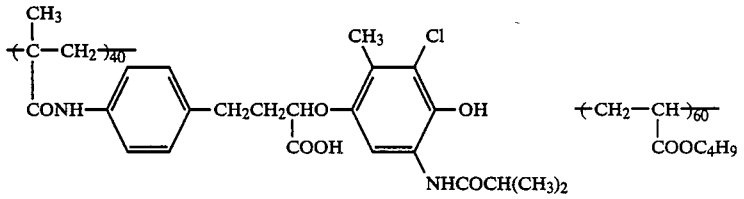

(6) Protective layer:

This layer was composed of gelatin (1.0 g/m$^2$), polyvinylpyrrolidone (1.0 g/m$^2$), a mat agent (0.3 g/m$^2$), a surfactant (0.1 g/m$^2$) and a hardener (0.05 g/m$^2$).

Each of the samples so prepared was subjected to imagewise exposure through a sensitometric optical wedge, and placed on a heat block for heating at 120° C., 140° C. or 160° C. for 20 seconds. Each of the samples, then, was superposed on a heat transfer image-receiving element of the same type as prepared in Example C-12 in such a manner that the coated surfaces were in contact with each other. The assembly was heat-developed at 150° C. for 1 minute. Thereafter, the image-receiving element was immediately separated from the sample, and it carried a positive multicolor transfer image. The maximum density (Dmax) and minimum density (Dmin) were measured for the positive color transfer image obtained from each of the samples. The results are shown in Table C-10.

TABLE C-10

| Sample No. | Color image | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|---|
| 82 | yellow | EM-1 | 0.45 | 1.36 | 1.36 | 1.43 | 0.47 | 1.45 |
| (Comp.-19) | magenta | EM-1 | 0.47 | 1.49 | 0.52 | 1.57 | 0.53 | 1.60 |
| | cyan | EM-2 | 0.46 | 1.47 | 0.50 | 1.53 | 0.53 | 1.55 |
| | yellow | EM-3 | 0.26 | 1.38 | 0.29 | 1.47 | 0.30 | 1.48 |
| 83 | magenta | EM-6 | 0.28 | 1.51 | 0.30 | 1.59 | 0.31 | 1.60 |
| | cyan | EM-6 | 0.27 | 1.49 | 0.29 | 1.58 | 0.32 | 1.61 |
| | yellow | EM-3 | 0.25 | 1.36 | 0.28 | 1.44 | 0.30 | 1.47 |
| 84 | magenta | EM-8 | 0.26 | 1.48 | 0.29 | 1.55 | 0.32 | 1.56 |
| | cyan | EM-8 | 0.26 | 1.45 | 0.30 | 1.53 | 0.33 | 1.56 |
| | yellow | EM-3 | 0.25 | 1.36 | 0.28 | 1.44 | 0.30 | 1.48 |
| 85 | magenta | EM-9 | 0.25 | 1.49 | 0.28 | 1.56 | 0.31 | 1.58 |
| | cyan | EM-9 | 0.25 | 1.46 | 0.29 | 1.54 | 0.32 | 1.58 |

Table C-10 shows multi-layered silver halide photographic materials using internal image forming silver halides also produced superior positive color images when they were processed by the method of the present invention. It is also clear from Table C-10 that in comparison with sample No. 82 which was a silver halide photographic material using conversion type emulsions, EM-1 and EM-2, sample Nos. 83 to 85 using core/shell type emulsions containing EM-1 or EM-2 as a core exhibited good characteristics in that they had low minimum densities.

EXAMPLE C-16

To each of the emulsions prepared in Examples C-1 to C-5, the sulfobenzotriazole silver salt emulsion shown in Example C-7 (organic silver salt, with silver deposit of 2.0 g/m$^2$), a surfactant and a hardener were added, and the resulting coating solution was applied to a polyethylene terephthalate (150 μm thick) to give a silver deposit of 4.0 g/m$^2$, and dried.

Each of the resulting samples was subjected to imagewise exposure through a sensitometric optical wedge, and placed on a heat block for heating at 120° C., 140° C. or 160° C. for 30 seconds. The samples were subsequently developed, fixed, washed and dried as in Example C-6. The maximum density and minimum densities were measured for the positive image formed on each of the samples. The results are shown in Table C-11.

TABLE C-11

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 86 (Comp.-20) | EM-1 | 0.31 | 1.06 | 0.31 | 1.13 | 0.32 | 1.15 |
| 87 (Comp.-21) | EM-2 | 0.32 | 1.20 | 0.33 | 1.30 | 0.34 | 1.33 |
| 88 | EM-3 | 0.20 | 1.09 | 0.21 | 1.18 | 0.22 | 1.21 |
| 89 | EM-4 | 0.19 | 1.07 | 0.20 | 1.16 | 0.21 | 1.20 |
| 90 | EM-5 | 0.18 | 1.11 | 0.19 | 1.20 | 0.21 | 1.24 |
| 91 | EM-6 | 0.20 | 1.18 | 0.21 | 1.29 | 0.22 | 1.34 |
| 92 | EM-7 | 0.18 | 1.16 | 0.19 | 1.27 | 0.20 | 1.31 |
| 93 | EM-8 | 0.17 | 1.21 | 0.18 | 1.32 | 0.19 | 1.35 |
| 94 | EM-9 | 0.16 | 1.22 | 0.17 | 1.33 | 0.18 | 1.37 |

Table C-11 shows that when imagewise exposed silver halide photographic materials having internal image forming silver halides were subjected to heating development, superior positive images could be obtained. It is also clear from Table C-11 that in comparison with sample Nos. 86 and 87 which were silver halide photographic materials using conversion type emulsions, EM-1 and EM-2, sample Nos. 88 to 94 which were silver halide photographic materials using core/shell type emulsions containing EM-1 or EM-2 as a core exhibited good characteristics in that they had low minimum densities.

EXAMPLE D-1

A conversion type silver chlorobromide emulsion was prepared by the following procedures.

To an aqueous solution containing 80 g of gelatin and 200 ml of an aqueous solution of 1 mole of silver nitrate, 200 ml of an aqueous solution of 1.2 moles of potassium chloride was added at a controlled temperature of 40° C. over a period of 1 minute. Following 1-minute physical ripening, 200 ml of an aqueous solution of 1 mole of potassium bromide was added, and physical ripening was conducted for an additional 1 minute. Washing was made to remove the water-soluble halides. After addition of 5 g of gelatin, water was added to make a total of 400 g.

The resulting silver chlorobromide emulsion comprised grains having an average size of 0.15 μm, and is hereunder referred to as EM-1.

EXAMPLE D-2

Using the grains in the conversion type emulsion prepared in Example 1 as cores, a core/shell emulsion was prepared by the following procedures.

To 400 g of the core emulsion (EM-1), 275 ml of an aqueous solution of 1 mole of silver nitrate, 275 ml of an aqueous solution of 1 mole of potassium bromide and 30 ml of an aqueous solution of 1 mole of potassium chloride were added simultaneously at 60° C. over a period of 5 minutes so as to precipitate a shell of silver chlorobromide. After removing the water-soluble halides by washing with water, 20 g of gelatin was added and water was added to make a total of 600 g. The resulting silver chlorobromide core/shell emulsion comprised grains having an average size of 0.2 μm, and is hereunder referred to as EM-2.

EXAMPLE D-3

A silver bromide core emulsion was prepared using the following solutions.

| | |
|---|---|
| Solution 1-A | |
| Ossein gelatin | 40 g |
| Distilled water | 400 ml |
| 10% Ethanol solution of sodium salt of polyisopropylene-polyethyleneoxy-disuccinate ester | 30 ml |
| KBr | 2 g |
| 1N $HNO_3$ | 76 ml |
| Solution 1-B | |
| $AgNO_3$ | 1200 g |
| 0.1N $HNO_3$ | 60 ml |
| Distilled water | to make 1750 ml |
| Solution 1-C | |
| Ossein gelatin | 35 g |
| KBr | 810 g |
| 10% Ethanol solution of sodium salt of polyisopropylene-polyethyleneoxy-disuccinate ester | 35 ml |
| Distilled water | to make 1750 ml |

At 40° C., solutions 1-B and 1-C were added to solution 1-A over a period of 32 minutes by the double-jet method using a mixer/agitator of the type shown in Unexamined Published Japanese Patent Application Nos. 92523/1982 and 92524/1982. The rate of addition was increased with time in a zigzag fashion as shown in Table D-1 below. The pAg value for solution 1-A was controlled to be at 9.0 by addition of a 20% aqueous KBr solution. Measurement of pAg values was conducted with a metallic silver electrode and a double junction type saturated Ag/AgCl reference electrode.

Solutions 1-B, 1-C and 20% aqueous KBr solution were added using a roller tube metering pump capable of variable flow rates.

The thus prepared emulsion was washed with water to remove any water-soluble halides. Thereafter, 130 g of gelatin was added and water was added to make a total of 6000 g. The resulting silver bromide core emulsion comprised grains having an average size of 0.13 μm, and is hereunder referred to as EM-3.

TABLE D-1

| Time (min) | Rate of additon (ml/min) Solution 1-B | Solution 1-C |
|---|---|---|
| 0 | 15.1 | 15.1 |
| 5 | 15.9 | 15.9 |
| 10 | 27.0 | 27.0 |
| 14 | 40.0 | 40.0 |
| 16.5 | 49.3 | 49.3 |
| 20.5 | 65.8 | 65.8 |
| 22.5 | 74.0 | 74.0 |
| 26.5 | 94.0 | 94.0 |
| 29.0 | 107.5 | 107.5 |
| 31.0 | 118.5 | 118.5 |
| 32.0 | 126.0 | 126.0 |

EXAMPLE D-4

A silver iodobromide core emulsion containing 1 mol % silver iodide was prepared by repeating the procedures of Example D-3 except that solution 1-C was replaced by the following solution 2-C.

| Solution 2-C | |
|---|---|
| Ossein gelatin | 35 g |
| KBr | 810 g |
| KI | 11.7 g |
| 10% Ethanol solution of sodium salt of polyisopropylene-poly-ethyleneoxy-disuccinate ester | 35 ml |
| Distilled water | to make 1750 ml |

The resulting silver iodobromide core emulsion comprised grains having an average size of 0.12 μm, and is hereunder referred to as EM-4.

EXAMPLE D-5

A silver iodobromide core emulsion containing 2 mol % silver iodide was prepared by repeating the procedures of Example D-3 except that solution 1-C was replaced by the following solution 3-C.

| Solution 3-C | |
|---|---|
| Ossein gelatin | 35 g |
| KBr | 810 g |
| KI | 23.4 g |
| 10% Ethanol solution of sodium salt of polyisopropylene-poly-ethyleneoxy-disuccinate ester | 35 ml |
| Distilled water | to make 1750 ml |

The resulting silver iodobromide core emulsion comprised grains having an average size of 0.11 μm, and is hereunder referred to as EM-5.

EXAMPLE D-6

A silver iodobromide core emulsion containing 4 mol % of silver iodide was prepared by repeating the procedures of Example D-3 except that solution 1-C was replaced by the following solution 4-C.

| Solution 4-C | |
|---|---|
| Ossein gelatin | 35 g |
| KBr | 810 g |
| KI | 46.9 g |
| 10% Ethanol solution of sodium salt of polyisopropylene-poly-ethyleneoxy-disuccinate ester | 35 ml |
| Distilled water | to make 1750 ml |

The resulting silver iodobromide core emulsion comprised grains having an average size of 0.10 μm, and is hereunder referred to as EM-6.

EXAMPLE D-7

To the silver bromide grains having an average size of 0.13 μm that were prepared in Example D-3, 50 mg per mole of silver of sodium thiosulfate and 10 mg per mole of silver of potassium chloroaurate were added, and the grain surfaces were chemically sensitized by heating at 60° C. for 90 minutes. A stabilizer and water were added to make a total of 1500 g (containing 1 mole of silver). Using the thus chemically sensitized silver bromide grains as cores, an internal image forming silver bromide core/shell emulsion was prepared from the following solutions.

| | |
|---|---|
| Solution 5-A | |
| Ossein gelatin | 5 g |
| Distilled water | 3300 ml |
| 10% Ethanol solution of sodium salt of polyisopropylene-poly-ethyleneoxy-disuccinate ester | 10 ml |
| 28% Aqueous ammonia solution | 60 ml |
| 56% aqueous acetic acid solution | 50 ml |
| Chemically sensitized silver bromide emulsion | 1500 g |
| Solution 5-B | |
| $AgNO_3$ | 280 g |
| 28% aqueous ammonia solution | 220 ml |
| Distilled water | to make 560 ml |
| Solution 5-C | |
| Ossein gelatin | 5 g |
| KBr | 210 g |
| 10% Ethanol solution of sodium salt of polyisopropylene-poly-ethylaneoxy-disuccinate ester | 10 ml |
| Distilled water | to make 560 ml |

At 40° C., solutions 5-B and 5-C were added to solution 5-A over a period of 20 minutes by the double-jet method using a mixer/agitator of the type shown in Unexamined Published Japanese Patent Application Nos. 92523/1982 and 92524/1982. The rate of addition was changed with time in a zigzag fashion as shown in Table D-2 below.

Throughout the addition period, the pAg value was controlled to be at 9.0 by addition of a 20% aqueous KBr solution, and the pH value was controlled at 7.5 by addition of a 28% aqueous acetic acid solution. The pAg values were measured by the same method as used in Example D-3, while the pH measurement was conducted with a glass electrode and a double junction type saturated Ag/AgCl reference electrode. The respective solutions were added using a roller tube metering pump capable of variable flow rates.

The thus prepared emulsion was washed with water to remove any water-soluble halides. Thereafter, 50 g of gelatin was added and water was added to make a total of 2200 g. The resulting silver bromide core/shell emulsion comprised grains having an average size of 0.18 μm, and is hereunder referred to as EM-7.

TABLE D-2

| Time (min) | Rate of addition (ml/min) Solution 5-B | Solution 5-C |
|---|---|---|
| 0 | 12.2 | 12.2 |
| 1 | 13.5 | 13.5 |
| 2 | 15.0 | 15.0 |
| 5 | 20.1 | 20.1 |
| 10 | 28.8 | 28.8 |
| 15 | 36.0 | 36.0 |
| 20 | 37.4 | 37.4 |

The silver bromide grains having an average size of 0.13 μm that were prepared in Example D-3 were chemically sensitized on the surfaces as in Example D-7.

Using the thus chemically sensitized silver bromide grains as cores, an internal image forming silver iodobromide core/shell emulsion containing 2 mol % AgI in the shell was prepared as in Example D-7 except that solution 5-C was replaced by the following solution 6-C.

| Solution 6-C | |
|---|---|
| Ossein gelatin | 5 g |
| KBr | 210 g |
| KI | 5.5 g |
| 10% Ethanol solution of sodium salt of polyisopropylene-poly-ethyleneoxy-disuccinate ester | 10 ml |
| Distilled water | to make 560 ml |

The resulting silver iodobromide core/shell emulsion comprised grains having an average size of 0.18 μm, and is hereunder referred to as EM-8.

EXAMPLE D-9

The silver bromide grains having an average size of 0.13 μm that were prepared in Example D-3 were chemically sensitized on the surfaces as in Example D-7.

Using the thus chemically sensitized silver bromide grains as cores, an internal image forming silver iodobromide core/shell emulsion containing 2 mol % AgI in the shell was prepared as in Example D-7 except that instead of solutions 5-B and 5-C, solutions 7-B and 7-C having the formulations indicated below were added over a period of 40 minutes.

| | |
|---|---|
| Solution 7-B | |
| $AgNO_3$ | 770 g |
| 28% Aqueous ammonia solution | 605 ml |
| Distilled water | to make 1540 ml |
| Solution 7-C | |
| Ossein gelatin | 15 g |
| KBr | 580 g |
| KI | 15.1 g |
| 10% Ethanol solution of sodium salt of polyisopropylene-poly-ethyleneoxy-disuccinate ester | 25 ml |
| Distilled water | to make 1540 ml |

The resulting silver iodobromide core/shell emulsion comprised grains having an average size of 0.25 μm, and is hereunder referred to as EM-9.

EXAMPLE D-10

To the silver iodobromide grains with 1 mol % AgI having an average size of 0.12 μm that were prepared in Example 4, 50 mg per mole of silver of sodium thiosulfate and 10 mg per mole of silver of potassium chloroaurate were added, and the grain surfaces were chemically sensitized by heating at 60° C. for 80 minutes. A stabilizer and water were added to make a total of 1500 g (containing 1 mole of silver). Using the thus chemically sensitized silver iodobromide grains as cores, an internal image forming silver iodobromide core shell emulsion with 3 mol % AgI was prepared as in Example D-7 except that instead of solutions 5-B and 5-C, solutions 8-B and 8-C having the formulations indicated below were added over a period of 23 minutes.

| | |
|---|---|
| Solution 8-B | |
| $AgNO_3$ | 313 g |
| 28% Aqueous ammonia solution | 246 ml |
| Distilled water | to make 626 ml |
| Solution 8-C | |
| Ossein gelatin | 5.6 g |
| KBr | 235 g |
| KI | 9.2 g |
| 10% Ethanol solution of sodium salt of polyisopropylene-poly-ethyleneoxy-disuccinate ester | 10 ml |
| Distilled water | to make 626 ml |

The resulting silver iodobromide core/shell emulsion comprised grains having an average size of 0.17 μm, and is hereunder referred to as EM-10.

EXAMPLE D-11

To the silver iodobromide grains with 2 mol % AgI having an average size of 0.11 μm that were prepared in Example D-5 50 mg per mole of silver of sodium thiosulfate and 10 mg per mole of silver of potassium chloroaurate were added, and the grain surfaces were chemically sensitized by heating at 60° C. for 80 minutes. A stabilizer and water were added to make a total of 1500 g (containing 1 mole of silver). Using the thus chemically sensitized silver iodobromide grains as cores, an internal image forming silver iodobromide core/shell emulsion with 5 mol % AgI was prepared as in Example D-7 except that instead of solutions 5-B and 5-C, solutions 9-B and 9-C having the formulations indicated below were added over a period of 25 minutes.

| | |
|---|---|
| Solution 9-B | |
| $AgNO_3$ | 353 g |
| 28% Aqueous ammonia solution | 277 ml |
| Distilled water | to make 705 ml |
| Solution 9-C | |
| Ossein gelatin | 6.3 g |
| KBr | 260 g |
| KI | 17.2 g |
| 10% Ethanol solution of sodium salt of polyisopropylene-poly-ethyleneoxy-disuccinate ester | 10 ml |
| Distilled water | to make 705 ml |

The resulting silver iodobromide core/shell emulsion comprised grains having an average size of 0.16 μm, and is hereunder referred to as EM-11.

EXAMPLE D-12

The resulting silver iodobromide core/shell emulsion comprised grains having an average size of 0.16 μm, and is hereunder referred as EM-11.

The silver iodobromide grains with 2 mol % AgI having an average size of 0.11 μm that were prepared in Example D-5 were chemically sensitized on the surfaces as in Example D-11.

Using the thus chemically sensitized silver iodobromide grains as cores, an internal image forming silver iodobromide core/shell emulsion containing 5 mol % AgI in the shell was prepared as in Example D-7 except that instead of solutions 5-B and 5-C, solutions 10-B and 10-C having the formulations indicated below were added over a period of 50 minutes.

| | |
|---|---|
| Solution 10-B | |
| $AgNO_3$ | 1013 g |
| 28% Aqueous ammonia solution | 795 ml |
| Distilled water | to make 2026 ml |
| Solution 10-C | |
| Ossein gelatin | 18 g |
| KBr | 700 g |
| KI | 49.5 g |
| 10% Ethanol solution of sodium salt of polyisopropylene-poly-ethyleneoxy-disuccinate ester | 35 ml |
| Distilled water | to make 2026 ml |

The resulting silver iodobromide core/shell emulsion comprised grains having an average size of 0.21 μm, and is hereunder referred to as EM-12.

EXAMPLE D-13

To the silver iodobromide grains with 4 mol % AgI having an average size of 0.10 μm that were prepared in Example D-6 50 mg per mole of silver of sodium thiosulfate and 10 mg per mole of silver of potassium chloroaurate were added, and the grain surfaces were chemically sensitized by heating at 60° C. for 70 minutes. A stabilizer and water were added to make a total of 1500 g (containing 1 mole of silver). Using the thus chemically sensitized silver iodobromide grains as cores, an internal image forming silver iodobromide core/shell emulsion with 8 mol % AgI was prepared as in Example D-7 except that instead of solutions 5-B and 5-C, solutions 11-B and 11-C having the formulations indicated below were added over a period of 25 minutes.

| | |
|---|---|
| Solution 11-B | |
| $AgNO_3$ | 403 g |
| 8% Aqueous ammonia solution | 317 ml |
| Distilled water | to make 806 ml |
| Solution 11-C | |
| Ossein gelatin | 7 g |
| KBr | 190 g |
| KI | 31.5 g |
| 10% Ethanol solution of sodium salt of polyisopropylene-poly-ethyleneoxy-disuccinate ester | 15 ml |
| Distilled water | to make 806 ml |

The resulting silver iodobromide core/shell emulsion comprised grains having an average size of 0.15 μm, and is hereunder referred to as EM-13.

EXAMPLE D-14

An internal image forming silver chloride core/shell emulsion was prepared by the following procedures.

To an aqueous solution containing 80 g of gelatin and 200 ml of an aqueous solution of 1 mole of silver nitrate, 200 ml of an aqueous solution of 1.2 moles of potassium chloride was added at a controlled temperature of 40° C. over a period of 1 minute. After removing the water-soluble halides by washing, 5 g of gelatin was added and water was added to make a total of 400 g. As a result, silver chloride core grains having an average size of 0.15 μm were obtained.

To these core grains, 40 mg per mole of silver of sodium thiosulfate and 8 mg per mole of silver of chloroauric acid were added and the surfaces of the grains were chemically sensitized by heating at 55° C. for 100 minutes. A stabilizer and water were added to make a total of 2500 g (containing 1 mole of silver). To 500 g of the chemically sensitized silver chloride grains, 275 mg of an aqueous solution of 1 mole of silver nitrate and 275 ml of an aqueous solution of 1.1 moles of potassium chloride were simultaneously added over a period of 10 minutes, so as to precipitate a shell of silver chloride. Washing was made to remove the water-soluble halides. After adding 20 g of gelatin, water was added to make a total of 600 g. The resulting internal image forming silver chloride core/shell emulsion comprised grains having an average size of 0.2 μm, and is hereunder referred to as EM-14.

EXAMPLE D-15

A silver chlorobromide core emulsion with 5 mol % AgCl was prepared as in Example D-7 except that solution 5-C was replaced by solution 12-C having the following formulation.

| | |
|---|---|
| Solution 12-C | |
| Ossein gelatin | 35 g |
| KBr | 800 g |
| KCl | 26.3 g |
| 10% Ethanol solution of sodium salt of polyisopropylene-poly-ethyleneoxy-disuccinate ester | 35 ml |
| Distilled water to make | 1750 ml |

The resulting silver chlorobromide core emulsion comprised grains having an average size of 0.10 μm.

To the obtained silver chlorobromide core grains, 50 mg per mole of silver of sodium thiosulfate and 10 mg per mole of silver of chloroauric acid were added, and the grain surfaces were chemically sensitized by heating at 56° C. for 100 minutes. A stabilizer and water were added to make a total of 1500 g (containing 1 mole of silver). Using the thus chemically sensitized silver chlorobromide grains as cores, an internal image forming silver chlorobromide core/shell emulsion with 5 mol % AgCl was prepared as in Example D-13 except that solution 11-C was replaced by solution 13-C having the following formulation.

| | |
|---|---|
| Solution 13-C | |
| Ossein gelatin | 7 g |
| KBr | 190 g |
| KCl | 9.0 g |
| 10% Ethanol solution of sodium salt of polyisopropylene-poly-ethyleneoxy-disuccinate ester | 15 ml |
| Distilled water to make | 806 ml |

The resulting silver chlorobromide core/shell emulsion comprised grains having an average size of 0.15 μm, and is hereunder referred to as EM-15.

EXAMPLE D-16

To each of the emulsions prepared in Examples D-1 and D-2 and D-7 to D-15, sodium 4-(diethylamino)-2-methylphenylsulfamate (1.0 g/m$^2$), a surfactant and a hardener were added, and the resulting coating solution was applied to a subbed polyethylene terephthalate base (150 μm thick) to give a silver deposit of 2.0 g/m², and dried.

Each of the resulting samples was subjected to imagewise exposure through a sensitometric optical wedge, and placed on a heat block for heating at 30° C., 120° C., 140° C. or 160° C. for 30 seconds. The samples were developed with a developer having the following formulation at 20° C. for 5 minutes.

| Developer formulation | |
|---|---|
| Methol | 2.5 g |
| Ascorbic acid | 10 g |
| Potassium bromide | 1 g |
| Sodium metaborate | 35 g |
| Water to make | 1000 ml |

The developed samples were fixed, washed and dried by the customary procedures. The maximum density (Dmax) and minimum density (Dmin) were measured for the positive image formed on each of the samples. The results are shown in Table D-3.

TABLE D-3

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 1 (Comp. 1) | EM-1 | 0.40 | 1.21 | 0.42 | 1.33 | 0.43 | 1.36 | 0.02 | 0.02 |
| 2 (Comp. 2) | EM-2 | 0.28 | 1.17 | 0.29 | 1.29 | 0.31 | 1.33 | 0.02 | 0.02 |
| 3 | EM-7 | 0.15 | 1.25 | 0.17 | 1.39 | 0.18 | 1.45 | 0.02 | 0.02 |
| 4 | EM-8 | 0.16 | 1.32 | 0.18 | 1.43 | 0.19 | 1.47 | 0.02 | 0.02 |
| 5 | EM-9 | 0.16 | 1.21 | 0.18 | 1.29 | 0.19 | 1.34 | 0.02 | 0.02 |
| 6 | EM-10 | 0.15 | 1.35 | 0.16 | 1.47 | 0.17 | 1.53 | 0.02 | 0.02 |
| 7 | EM-11 | 0.15 | 1.25 | 0.17 | 1.36 | 0.18 | 1.41 | 0.02 | 0.02 |
| 8 | EM-12 | 0.14 | 1.27 | 0.16 | 1.38 | 0.17 | 1.44 | 0.02 | 0.02 |
| 9 | EM-13 | 0.13 | 1.32 | 0.15 | 1.45 | 0.16 | 1.48 | 0.02 | 0.02 |
| 10 | EM-14 | 0.15 | 1.30 | 0.17 | 1.41 | 0.19 | 1.46 | 0.02 | 0.02 |
| 11 | EM-15 | 0.15 | 1.29 | 0.17 | 1.40 | 0.19 | 1.45 | 0.02 | 0.02 |

Table D-3 shows that when imagewise exposed silver halide photographic materials having internal image forming silver halides were subjected to heating before development, superior positive image could be obtained. It is also clear from Table D-3 that in comparison with sample Nos. 1 and 2 using conversion type emulsions, EM-1 and EM-2, sample Nos. 3 to 11 using internally sensitized core/shell emulsions exhibited good characteristics in that they had low minimum densities and high maximum densities.

EXAMPLE D-17

To each of the emulsions prepared in Examples D-1 and D-2 and D-7 to D-15, sodium 4-(diethylamino)-2-methylphenylsulfamate (1.0 g/m²), a sulfobenzotriazole silver salt emulsion (organic silver salt, with silver deposit of 2.0 g/m²) prepared by the method described below, a surfactant and hardener were added, and the resulting coating solution was applied to a polyethylene terephthalate base (150 μm thick) to give a silver deposit of 4.0 g/m², and dried.

Each of the resulting samples was subjected to imagewise exposure through a sensitometric optical wedge, and placed on a heat block for heating at 30° C., 120° C., 140° C., or 160° C. for 30 seconds. The samples were subsequently developed, fixed, washed and dried as in Example D-16. The maximum density (Dmax) and minimum density (Dmin) were measured for the positive image formed on each of the samples, and the results are shown in Table D-4.

Preparation of sulfobenzotriasole silver emulsion

In a mixed solvent of water (150 ml) and ethanol (150 ml), 40 g of poly(4-vinylpyrrolidone), 30 g of 4-sulfobenzotriazole and 6 g of sodium hydroxide were dissolved. To the stirred solution, 30 ml of an aqueous solution of 5 N silver nitrate was added so as to adjust the pH at between 6 and 8. Water was added to make a total of 600 ml, thereby providing a dispersion of organic silver salt.

TABLE D-4

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 12 (Comp. 3) | EM-1 | 0.32 | 1.36 | 0.33 | 1.45 | 0.35 | 1.48 | 0.02 | 0.02 |
| 13 (Comp. 4) | EM-2 | 0.19 | 1.23 | 0.21 | 1.34 | 0.22 | 1.36 | 0.02 | 0.02 |
| 14 | EM-7 | 0.11 | 1.43 | 0.13 | 1.52 | 0.14 | 1.55 | 0.02 | 0.02 |
| 15 | EM-8 | 0.10 | 1.52 | 0.12 | 1.61 | 0.13 | 1.63 | 0.02 | 0.02 |
| 16 | EM-9 | 0.11 | 1.37 | 0.13 | 1.49 | 0.15 | 1.53 | 0.02 | 0.02 |
| 17 | EM-10 | 0.09 | 1.53 | 0.11 | 1.62 | 0.12 | 1.66 | 0.02 | 0.02 |
| 18 | EM-11 | 0.11 | 1.41 | 0.12 | 1.52 | 0.13 | 1.55 | 0.02 | 0.02 |
| 19 | EM-12 | 0.10 | 1.43 | 0.12 | 1.54 | 0.13 | 1.58 | 0.02 | 0.02 |
| 20 | EM-13 | 0.09 | 1.51 | 0.10 | 1.59 | 0.11 | 1.63 | 0.02 | 0.02 |
| 21 | EM-14 | 0.10 | 1.50 | 0.13 | 1.57 | 0.14 | 1.59 | 0.02 | 0.02 |
| 22 | EM-15 | 0.11 | 1.49 | 0.14 | 1.55 | 0.14 | 1.58 | 0.02 | 0.02 |

Table D-4 shows that when imagewise exposed silver halide photographic materials having internal image forming silver halides were subjected to heating before development, superior positive images could be obtained. It is also clear from Table D-4 that in comparison with sample Nos. 12 and 13 using conversion type emulsions, EM-1 and EM-2, sample Nos. 14 to 22 using internal image forming core/shell type emulsions exhibited good characteristics in that they had low minimum densities and high maximum densities.

EXAMPLE D-18

To each of the emulsions prepared in Examples D-1 and D-2 and D-7 to D-15, sodium 4-(diethylamino)-2-methylphenylsulfamate (1.0 g/m$^2$), the dye providing material M-1 (0.8 g/m$^2$) shown below, a surfactant and a hardener were added, and the resulting coating solution was applied to a polyethylene terephthalate base (150 μm thick) to give a silver deposit of 2.0 g/m$^2$, and dried.

Preparation of a dispersion of dye providing material in gelatin

A dye providing material M-1 (10 g) having the structure shown below was uniformly dissolved in 30 g of ethyl acetate (hereunder referred to as EA) and 15 g of tricresyl phosphate (hereunder referred to as TCP) by heating at about 50° C.. The resulting solution was added to 400 ml of a 7.5% aqueous gelatin solution containing 30 ml of a 5% aqueous solution of Alkanol XC (Du Pont) and the two solutions were mixed under agitation. Thereafter, the mixture was homogenized by an ultrasonic homogenizer for 30 minutes, so as to obtain a dispersion of the dye providing material in gelatin at a yield of 600 g.

Dye providing material M-1

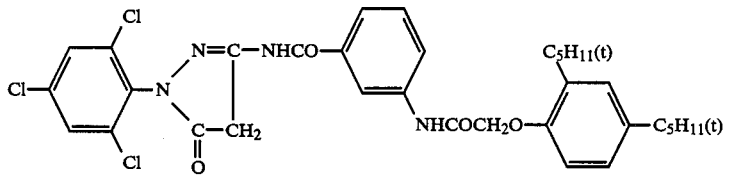

Each of the resulting samples was subjected to imagewise exposure through a sensitometric optical wedge, and placed on a heat block for heating at 30° C., 120° C., 140° C. or 160° C. for 30 seconds. The samples were subsequently processed by the scheme shown below, so as to obtain samples carrying dye images.

| Processing steps (30° C.) | Time |
|---|---|
| Color development | 3 min and 30 sec |

-continued

| Processing steps (30° C.) | Time |
|---|---|
| First washing | 1 min and 00 sec |
| Bleach-fixing | 1 min and 30 sec |
| Second washing | 1 min and 00 sec |

The respective processing solutions had the following formulations.

| | |
|---|---|
| Color development | |
| 4-Amino-3-methyl-N—(β-methanesulfonamidoethyl)aniline sulfate | 5 g |
| Sodium sulfite (anhydrous) | 2 g |
| Sodium carbonate (monohydrate) | 15 g |
| Potassium bromide | 1 g |
| Benzyl alcohol | 10 ml |
| Water to make | 1000 ml |
| (pH adjusted to 10.2 with potassium hydroxide) | |
| Bleach-fixing solution | |
| Ethylenediaminetetraacetic acid iron (III) ammonium dihydrate | 60 g |
| Ethylenediaminetetraacetic acid | 3 g |
| Sodium thiosulfate (70% aq. sol.) | 100 ml |
| Ammonium sulfite (40% aq. sol.) | 27.5 ml |
| Water to make | 1000 ml |
| (pH adjusted to 7.10 with potassium carbonate) | |

The maximum density (Dmax) and minimum density (Dmin) were measured for the positive magenta color image formed on each of the samples, and the results are shown in Table D-5.

TABLE D-5

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 23 (Comp. 5) | EM-1 | 0.31 | 1.26 | 0.33 | 1.33 | 0.34 | 1.35 | 0.09 | 0.09 |
| 24 (Comp. 6) | EM-2 | 0.20 | 1.25 | 0.23 | 1.31 | 0.23 | 1.34 | 0.09 | 0.09 |
| 25 | EM-7 | 0.10 | 1.33 | 0.12 | 1.39 | 0.13 | 1.42 | 0.09 | 0.09 |
| 26 | EM-8 | 0.10 | 1.42 | 0.11 | 1.51 | 0.12 | 1.54 | 0.09 | 0.09 |
| 27 | EM-9 | 0.10 | 1.36 | 0.12 | 1.44 | 0.13 | 1.48 | 0.09 | 0.09 |
| 28 | EM-10 | 0.11 | 1.44 | 0.12 | 1.52 | 0.13 | 1.55 | 0.09 | 0.09 |
| 29 | EM-11 | 0.11 | 1.48 | 0.12 | 1.56 | 0.13 | 1.58 | 0.09 | 0.09 |
| 30 | EM-12 | 0.10 | 1.41 | 0.12 | 1.49 | 0.13 | 1.52 | 0.09 | 0.09 |
| 31 | EM-13 | 0.10 | 1.50 | 0.11 | 1.57 | 0.12 | 1.60 | 0.09 | 0.09 |
| 32 | EM-14 | 0.11 | 1.47 | 0.12 | 1.53 | 0.13 | 1.55 | 0.09 | 0.09 |
| 33 | EM-15 | 0.11 | 1.48 | 0.12 | 1.54 | 0.13 | 1.56 | 0.09 | 0.09 |

Table D-5 shows that when imagewise exposed silver halide photographic materials having internal image forming silver halides were subjected to heating before development, superior positive images could be obtained. It is also clear from Table D-5 that in comparison with sample Nos. 23 and 24 using conversion type emulsions, EM-1 and EM-2, sample Nos. 25 to 33 using internally sensitized core/shell emulsions exhibited good characteristics in that they had low minimum densities and high maximum densities.

EXAMPLE D-19

To each of the emulsions prepared in Examples D-1 and D-2 and D-7 to D-15, sodium 4-(diethylamino)-2-methylphenylsulfamate (1.2 g/m$^2$), the sulfobenzotriazole silver salt emulsion shown in Example D-17 (organic silver salt, with silver deposit of 2.2 g/m$^2$), the dye providing material C-1 (1.2 g/m$^2$) shown below, a surfactant and a hardener were added, and the resulting coating solution was applied to a polyethylene terephthalate base (150 μm thick) to give a silver deposit of 4.5 g/m$^2$, and dried.

Preparation of a dispersion of cyan dye providing material in gelatin

A dye providing material C-1 (10 g) having the structure shown below was uniformly dissolved in a mixture of TCP (20 g) and EA (40 ml). The resulting solution was added to 400 ml of a 7.5% aqueous gelatin solution containing 50 ml of a 5% aqueous solution of alkanol XC and the two solutions were mixed under agitation. Thereafter, the mixture was homogenized by an ultrasonic homogenizer for 30 minutes, so as to obtain a dispersion of the cyan dye providing material in gelatin at a yield of 600 g.

Cyan dye providing material C-1

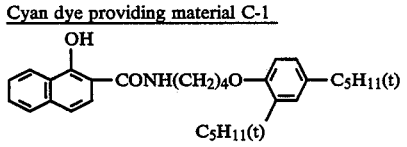

Each of the resulting samples was subjected to imagewise exposure through a sensitometric optical wedge, and placed on a heat block for heating at 30° C., 120° C., 140° C. or 160° C. for 40 seconds. The samples were subsequently processed by the same scheme as shown in Example D-8, thereby producing samples carrying dye images. The maximum density (Dmax) and minimum density (Dmin) were measured for the positive cyan color image formed on each of the samples, and the results are shown in Table D-6.

TABLE D-6

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 34 (Comp. 7) | EM-1 | 0.32 | 1.44 | 0.35 | 1.49 | 0.37 | 1.51 | 0.08 | 0.08 |
| 35 (Comp. 8) | EM-2 | 0.23 | 1.39 | 0.25 | 1.43 | 0.27 | 1.45 | 0.08 | 0.08 |
| 36 | EM-7 | 0.13 | 1.52 | 0.15 | 1.57 | 0.16 | 1.59 | 0.08 | 0.08 |
| 37 | EM-8 | 0.12 | 1.62 | 0.13 | 1.68 | 0.14 | 1.71 | 0.08 | 0.08 |
| 38 | EM-9 | 0.11 | 1.54 | 0.12 | 1.59 | 0.13 | 1.61 | 0.08 | 0.08 |
| 39 | EM-10 | 0.12 | 1.61 | 0.13 | 1.67 | 0.14 | 1.70 | 0.08 | 0.08 |
| 40 | EM-11 | 0.12 | 1.63 | 0.13 | 1.68 | 0.14 | 1.71 | 0.08 | 0.08 |
| 41 | EM-12 | 0.11 | 1.61 | 0.13 | 1.66 | 0.14 | 1.69 | 0.08 | 0.08 |
| 42 | EM-13 | 0.12 | 1.64 | 0.13 | 1.70 | 0.14 | 1.73 | 0.08 | 0.08 |
| 43 | EM-14 | 0.12 | 1.60 | 0.13 | 1.65 | 0.14 | 1.68 | 0.08 | 0.08 |
| 44 | EM-15 | 0.12 | 1.61 | 0.13 | 1.66 | 0.14 | 1.70 | 0.08 | 0.08 |

Table D-6 shows that when imagewise exposed silver halide photographic materials having internal image forming silver halides were subjected to heating before development, superior positive images could be obtained. It is also clear from Table D-6 that in comparison with sample Nos. 34 and 35 using conversion type emulsions, EM-1 and EM-2, sample Nos. 36 to 44 using internally sensitized core/shell emulsions exhibited good characteristics in that they had low minimum densities and high maximum densities.

EXAMPLE D-20

To each of the emulsions prepared in Examples D-1 and D-2 and D-7 to D-15, methyl hydroquinone (1.0 g/m$^2$), 4-carboxymethyl-4-thiazoline-2-thione (0.06 g/m$^2$), the sulfobenzotriazole silver salt emulsion shown in Example D-17 (organic silver salt, with silver deposit of 2.0 g/m$^2$), 3-methyl-1,3,5-pentanetriol (4.0 g m$^2$), gelatin 3.0 g/m$^2$), polyvinylpyrrolidone with an average molecular weight of 30,000 (3.0 g/m$^2$), a surfactant and a hardener were added, and the resulting coating solution was applied to a polyethylene terephthalate base (150 μm thick) to give a silver deposit of 4.0 g/m$^2$, and dried.

Each of the resulting samples was subjected to imagewise exposure through a sensitometric optical wedge, and placed on a heat block for heating at 120° C., 140° C. or 160° C. for 20 seconds.

The samples were then developed by continued heating for an additional 40 seconds. The maximum density (Dmax) and minimum density (Dmin) were measured for the positive image formed on each of the samples, and the results are shown in Table D-7.

TABLE D-7

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 45 (Comp. 9) | EM-1 | 0.67 | 1.12 | 0.74 | 1.23 | 0.77 | 1.29 |
| 46 (Comp. 10) | EM-2 | 0.51 | 1.16 | 0.57 | 1.27 | 0.59 | 1.31 |
| 47 | EM-7 | 0.38 | 1.27 | 0.44 | 1.39 | 0.46 | 1.46 |
| 48 | EM-8 | 0.37 | 1.33 | 0.41 | 1.42 | 0.43 | 1.49 |
| 49 | EM-9 | 0.36 | 1.26 | 0.40 | 1.37 | 0.42 | 1.47 |
| 50 | EM-10 | 0.37 | 1.32 | 0.42 | 1.38 | 0.45 | 1.46 |
| 51 | EM-11 | 0.36 | 1.35 | 0.40 | 1.44 | 0.43 | 1.51 |
| 52 | EM-12 | 0.37 | 1.33 | 0.41 | 1.43 | 0.43 | 1.50 |

TABLE D-7-continued

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 53 | EM-13 | 0.36 | 1.39 | 0.41 | 1.48 | 0.44 | 1.55 |
| 54 | EM-14 | 0.36 | 1.31 | 0.39 | 1.40 | 0.43 | 1.46 |
| 55 | EM-15 | 0.37 | 1.32 | 0.41 | 1.41 | 0.44 | 1.48 |

Table D-7 shows that when imagewise exposed silver halide photographic materials using internal image forming silver halides were subjected to heating before development, superior positive images could be obtained. It is also clear from Table D-7 that in comparison with sample Nos. 45 and 46 using conversion type emulsions, EM-1 and EM-2, sample Nos. 47 to 55 using internally sensitized core/shell emulsions exhibited good characteristics in that they had low minimum densities and high maximum densities.

EXAMPLE D-21

To each of the emulsions prepared in Examples D-1 and D-2 and D-7 to D-15, sodium 4-(diethylamino)-2-methylphenylsulfamate (2.0 g/m$^2$), the sulfobenzotriazole silver salt emulsion shown in Example D-17 (organic silver salt, with silver deposit of 2.0 g/m$^2$), the dye providing material M-2 (1.5 g/m$^2$) shown below, 3-methyl-1,3,5-pentanetriol (3.0 g/m$^2$)), a surfactant and a hardener were added, and the resulting coating solution was applied to a polyethylene terephthalate base (150 μm thick) to give a silver deposit of 4.0 g/m$^2$), and dried.

Each of the resulting samples was subjected to imagewise exposure through a sensitometric optical wedge, and placed on a heat block for heating at 120° C., 140° C. or 160° C. for 20 seconds. The samples were then developed by continued heating for an additional 40 seconds. The maximum density (Dmax) and minimum density (Dmin) were measured for the positive magenta color image formed on each of the samples. The results are shown in Table D-8.

Preparation of a dispersion of dye providing material in gelatin

A dye providing material M-2 (10 g) having the structure shown below was uniformly dissolved in 30 g of ethyl acetate and 10 g of tricresyl phosphate (TCP) by heating at about 60° C. The resulting solution was mixed under agitation with 120 ml of a 2% aqueous gelatin solution containing 30 ml of a 5% aqueous solution of Alkanol XC (Du Pont) as a dispersant. Thereafter, the mixture was homogenized by an ultrasonic homogenizer for 10 minutes, so as to obtain a dispersion of the dye providing material in gelatin.

Dye providing material M-2

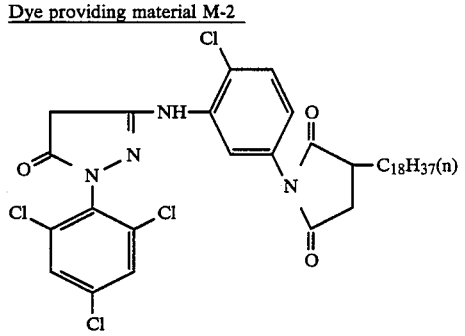

TABLE D-8

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 56 (Comp. 11) | EM-1 | 0.69 | 1.20 | 0.76 | 1.30 | 0.79 | 1.36 |
| 57 (Comp. 12) | EM-2 | 0.53 | 1.23 | 0.59 | 1.32 | 0.63 | 1.38 |
| 58 | EM-7 | 0.35 | 1.34 | 0.44 | 1.43 | 0.47 | 1.47 |
| 59 | EM-8 | 0.33 | 1.39 | 0.41 | 1.48 | 0.44 | 1.52 |
| 60 | EM-9 | 0.36 | 1.33 | 0.43 | 1.42 | 0.46 | 1.48 |
| 61 | EM-10 | 0.35 | 1.36 | 0.42 | 1.43 | 0.46 | 1.46 |
| 62 | EM-11 | 0.36 | 1.39 | 0.44 | 1.48 | 0.48 | 1.52 |
| 63 | EM-12 | 0.37 | 1.37 | 0.43 | 1.46 | 0.46 | 1.50 |
| 64 | EM-13 | 0.34 | 1.40 | 0.41 | 1.40 | 0.43 | 1.54 |
| 65 | EM-14 | 0.35 | 1.37 | 0.40 | 1.44 | 0.42 | 1.47 |
| 66 | EM-15 | 0.36 | 1.36 | 0.41 | 1.45 | 0.43 | 1.49 |

Table D-8 shows that when imagewise exposed silver halide photographic materials having internal image forming silver halides were subjected to heating before development, superior positive images could be obtained. It is also clear from Table D-8 that in comparison with sample Nos. 56 and 57 using conversion type emulsions, EM-1 and EM-2, sample Nos. 58 to 66 using internally sensitized core/shell emulsions exhibited good characteristics in that they had low minimum densities and high maximum densities.

EXAMPLE D-22

To each of the emulsions prepared in Examples D-1 and D-2 and D-7 to D-15, sodium 4-(diethylamino)-2-methylphenylsulfamate (2.0 g/m$^2$), the sulfobenzotriazole silver salt emulsion shown in Example D-17 (organic silver salt, with silver deposit of 2.0 g/m$^2$), the dye providing material Y-1 (1.8 g/m$^2$) shown below, 3-methyl-1,3,5-pentanetriol (4.0 g/m$^2$), gelatin (3.0 g/m$^2$), polyvinylpyrrolidone with an average molecular weight of 30,000 (3.0 g/m$^2$), a surfactant and a hardener were added, and the resulting coating solution was applied to a polyethylene terephthalate base (150 μm thick) to give a silver deposit of 4.0 g/m$^2$, and dried.

Preparation of a dispersion of yellow dye providing material in gelatin

A dye providing material Y-1 (5 g) was dissolved in 15 ml of EA. The resulting solution was added to 60 ml of a 5% aqueous gelatin solution containing 15 ml of a 5% aqueous solution of Alkanol XC and the two solutions were mixed under agitation. The mixture was homogenized by an ultrasonic homogenizer for 10 minutes, so as to obtain a dispersion of the dye providing material in gelatin at a yield of 100 g.

Dye providing material Y-1

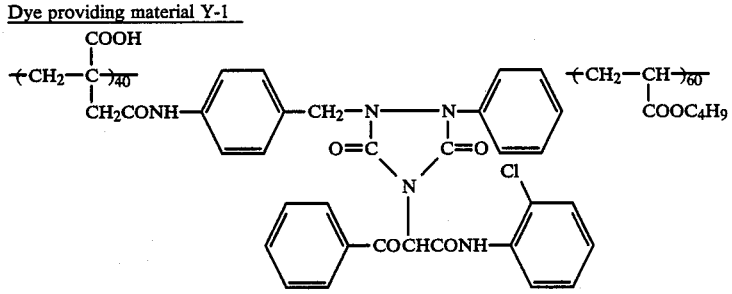

Each of the resulting samples was subjected to imagewise exposure through a sensitometric optical wedge, and placed on a heat block for heating at 120° C., 140° C. or 160° C. for 20 seconds. Each of the samples was superposed on a heat transfer image-receiving element (to be described below) so that the coated surfaces were in contact with each other. The assembly was heat-developed at 150° C. for 1 minute by a commercial heat developer, Copy Mate (Graphic Corporation). Thereafter, the image-receiving element was immediately separated from the sample, and it carried a positive yellow color transfer image.

Preparation of a heat transfer image-receiving element

A photographic baryta paper was coated with a polyvinyl chloride containing latex NIPOLG-576 (Japan Zeon Co., Ltd.) and passed through a hot atmosphere (150° C.) to form an image-receiving element having a smooth latex coat.

The maximum density (Dmax) and minimum density (Dmin) were measured for the positive yellow color transfer image obtained from each of the samples. The results are shown in Table D-9.

TABLE D-9

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 67 (Comp. 13) | EM-1 | 0.29 | 1.39 | 0.32 | 1.47 | 0.33 | 1.50 |
| 68 (Comp. 14) | EM-2 | 0.19 | 1.28 | 0.21 | 1.37 | 0.22 | 1.40 |
| 69 | EM-7 | 0.11 | 1.56 | 0.12 | 1.63 | 0.13 | 1.66 |
| 70 | EM-8 | 0.10 | 1.57 | 0.11 | 1.65 | 0.12 | 1.69 |
| 71 | EM-9 | 0.09 | 1.51 | 0.10 | 1.58 | 0.11 | 1.62 |
| 72 | EM-10 | 0.09 | 1.58 | 0.10 | 1.66 | 0.11 | 1.68 |
| 73 | EM-11 | 0.10 | 1.61 | 0.11 | 1.69 | 0.12 | 1.73 |
| 74 | EM-12 | 0.10 | 1.58 | 0.11 | 1.65 | 0.12 | 1.68 |
| 75 | EM-13 | 0.10 | 1.64 | 0.11 | 1.71 | 0.12 | 1.74 |
| 76 | EM-14 | 0.10 | 1.56 | 0.11 | 1.64 | 0.12 | 1.68 |
| 77 | EM-15 | 0.10 | 1.55 | 0.11 | 1.64 | 0.12 | 1.69 |

Table D-9 shows that when imagewise exposed silver halide photographic materials having internal image forming silver halides were subjected to heating before development, superior positive images could be obtained. It is also clear from Table D-9 that in comparison with sample Nos. 67 and 68 using conversion type emulsions, EM-1 and EM-2, sample Nos. 69 to 77 using internally sensitized core/shell emulsions exhibited good characteristics in that they had low minimum densities and high maximum densities.

EXAMPLE D-23

Each of the ten samples prepared in Example D-22 was subjected to imagewise exposure through a sensitometric optical wedge, and superposed on a heat transfer image-receiving element which was of the same type as prepared in Example D-22 so that the coated surfaces were in contact with each other. The assembly was heated in a Copy Mate at 120° C., 140° C. or 160° C. for 20 seconds, and then heat-developed by heating at 150° C. for 1 minute. Immediately thereafter, the image-receiving element was separated from the sample, and a positive yellow color transfer image had formed on the receiving element.

The maximum density (Dmax) and minimum density (Dmin) were measured for the positive yellow color transfer image obtained from each of the samples. The results are shown in Table D-10.

TABLE D-10

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 78 | EM-1 | 0.32 | 1.11 | 0.34 | 1.18 | 0.35 | 1.20 |

TABLE D-10-continued

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| (Comp. 15) 79 | EM-2 | 0.21 | 1.05 | 0.22 | 1.13 | 0.24 | 1.16 |
| (Comp. 16) 80 | EM-7 | 0.13 | 1.29 | 0.14 | 1.37 | 0.15 | 1.41 |
| 81 | EM-8 | 0.12 | 1.33 | 0.13 | 1.41 | 0.14 | 1.45 |
| 82 | EM-9 | 0.11 | 1.28 | 0.12 | 1.36 | 0.13 | 1.40 |
| 83 | EM-10 | 0.11 | 1.36 | 0.12 | 1.44 | 0.13 | 1.47 |
| 84 | EM-11 | 0.11 | 1.39 | 0.12 | 1.46 | 0.14 | 1.50 |
| 85 | EM-12 | 0.12 | 1.40 | 0.13 | 1.49 | 0.14 | 1.53 |
| 86 | EM-13 | 0.12 | 1.41 | 0.13 | 1.51 | 0.13 | 1.55 |
| 87 | EM-14 | 0.12 | 1.40 | 0.13 | 1.49 | 0.14 | 1.52 |
| 88 | EM-15 | 0.12 | 1.39 | 0.13 | 1.48 | 0.14 | 1.51 |

Table D-10 shows that when imagewise exposed silver halide photographic materials having internal image forming silver halides were subjected to heating before development, superior positive images could be obtained. It is also clear from Table D-10 that in comparison with sample Nos. 78 and 79 using conversion type emulsions, EM-1 and EM-2, sample Nos. 80 to 88 using internally sensitized core/shell emulsions exhibited good characteristics in that they had low minimum densities and high maximum densities.

EXAMPLE D-24

To each of the samples prepared in Examples D-1 and D-2 and D-7 to D-15, the reducing dye providing material M-3 (1.5 g/m$^2$) shown below, a reducing agent, or 1-phenyl-4-methyl-4-hydroxymethyl-3-pyrazolidinone (0.2 g/m$^2$), trimethylolethane (3.0 g/m$^2$), guanidine-trichloroacetic acid (0.6 g/m$^2$), polyvinylpyrrolidone (1.5 g/m$^2$), a surfactant and a hardener were added, and the resulting coating solution was applied to a polyethylene terephthalate base (150 μm thick) to give a silver deposit of 2.0 g/m$^2$, and dried.

Preparation of a dispersion of magenta reducing dye providing material in gelatin A reducing dye providing material M-3 (30 g) was dissolved in 30 g of dioctyl phthalate and 90 ml of EA. The resulting solution was added to 200 ml of a 10% aqueous gelatin eat me solution containing Alkanol XC and the two solutions were mixed under agitation. The mixture was homogenized by an ultrasonic homogenizer for 30 minutes, so as to obtain a dispersion of the reducing dye providing material in gelatin at a yield of 500 g.

Reducing dye providing material M-3

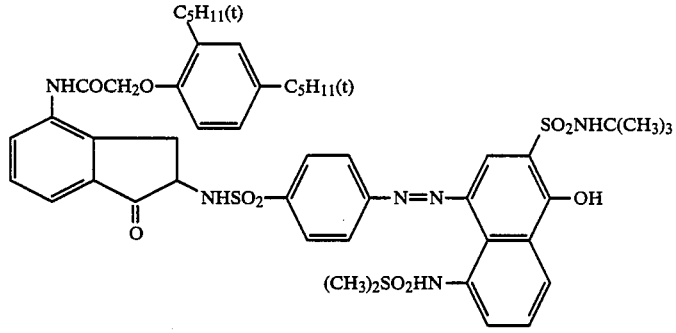

Each of the resulting samples was subjected to imagewise exposure through a sensitometric optical wedge, and placed on a heat block for heating at 30° C., 120° C., 140° c or 160° C. for 1 minute.

A subbed polyethylene terephthalate base (100 μm) containing a white pigment was coated with an image-receiving layer composed of a 1:1 copolymer of styrene and N-benzyl-N, N-dimethyl-N-(3-maleimidopropyl-)ammonium chloride and an acid-treated gelatin. The so prepared image-receiving element was immersed in water and superposed on the previously prepared light-sensitive material in such a manner that the coated surfaces were held in contact with the image-receiving layer for 30 seconds. Thereafter, the image-receiving element was separated from the light-sensitive material and a positive magenta color transfer image had formed on the receiving element. The maximum density (Dmax) and minimum density (Dmin) were measured for the positive magenta color transfer image obtained from each of the samples, and the results are shown in Table D-11.

TABLE D-11

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 89 (Comp. 17) | EM-1 | 0.49 | 1.50 | 0.51 | 1.53 | 0.53 | 1.55 | 0.20 | 0.20 |
| 90 (Comp. 18) | EM-2 | 0.33 | 1.47 | 0.36 | 1.51 | 0.38 | 1.53 | 0.19 | 0.19 |
| 91 | EM-7 | 0.24 | 1.60 | 0.25 | 1.65 | 0.26 | 1.67 | 0.19 | 0.19 |

TABLE D-11-continued

| Sample No. | Heating temperature Emulsion | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|
| 92 | EM-8 | 0.23 | 1.62 | 0.24 | 1.68 | 0.25 | 1.71 | 0.19 | 0.19 |
| 93 | EM-9 | 0.22 | 1.60 | 0.23 | 1.66 | 0.24 | 1.69 | 0.19 | 0.19 |
| 94 | EM-10 | 0.22 | 1.64 | 0.23 | 1.71 | 0.25 | 1.74 | 0.19 | 0.19 |
| 95 | EM-11 | 0.22 | 1.65 | 0.23 | 1.73 | 0.24 | 1.79 | 0.19 | 0.19 |
| 96 | EM-12 | 0.23 | 1.69 | 0.24 | 1.76 | 0.25 | 1.81 | 0.19 | 0.19 |
| 97 | EM-13 | 0.23 | 1.70 | 0.24 | 1.76 | 0.25 | 1.82 | 0.19 | 0.19 |
| 98 | EM-14 | 0.23 | 1.68 | 0.24 | 1.74 | 0.25 | 1.78 | 0.19 | 0.19 |
| 99 | EM-15 | 0.23 | 1.66 | 0.24 | 1.73 | 0.25 | 1.76 | 0.19 | 0.19 |

Table D-11 shows that when imagewise exposed silver halide photographic materials having internal image forming silver halides were subjected to heating before development, superior positive images could be obtained. It is also clear from Table D-11 that in comparison with sample Nos. 89 and 90 using conversion type emulsions, EM-1 and EM-2, sample Nos. 91 to 99 using internally sensitized core/shell emulsions exhibited good characteristics in that they had low minimum densities and high maximum densities.

EXAMPLE D-25

A subbed transparent polyethylene terephthalate base (150 μm thick) was coated with the following layers in the order written. (1) Blue-sensitive, internal image forming silver chloroiodobromide emulsion layer:

This layer was composed of one of the emulsions shown in Table D-12 that were prepared in Examples D-1 - D-15 and which comprised blue-sensitized internal image forming silver halide grains (silver deposit: 3.5 g/m$^2$), sodium 4-(diethylamino)-2-methylphenylsulfamate (1.5 g/m$^2$), the sulfobenzotriazole silver salt emulsion shown in Example D-17 (silver deposit: 3.5 g/m$^2$), the yellow dye providing material Y-1 shown in Example D-22 (2.0 g/m$^2$), polyethylene glycol with a molecular weight of 300 (3.0 g/m$^2$)), 3-methyl-1,3,5-pentanetriol (1.5 g/m$^2$), gelatin (3.0 g/m$^2$), polyvinylpyrrolidone with an average molecular weight of 30,000 (3.0 g/m$^2$), a surfactant (0.05 g/m$^2$) and a hardener (0.15 g/m$^2$).

(2) Intermediate layer:

This layer was composed of gelatin (1.0 g/m$^2$), polyvinylpyrrolidone (1.0 g/m$^2$) and the non-diffusible dye providing material shown below (0.4 g/m$^2$):

Non-diffusible dye providing material:

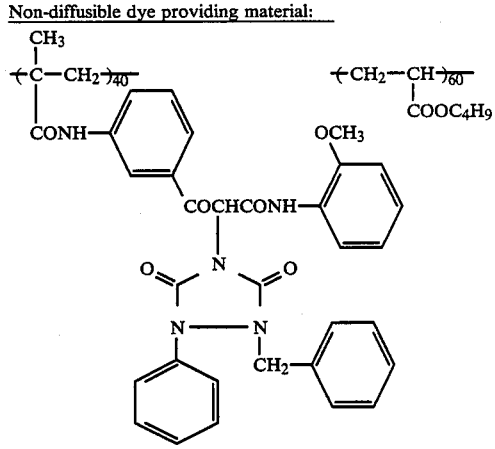

(3) Green-sensitive, internal image forming silver chloroiodobromide emulsion layer:

This layer was composed of one of the emulsions shown in Table D-12 that were prepared in Examples D-1 to D-15 and which comprised green-sensitized internal image forming silver halide grains (silver deposit: 3.5 g/m$^2$), sodium 4-(diethylamino)-2-methylphenylsulfamate (1.2 g/m$^2$), a sulfobenzotriazole silver salt emulsion (silver deposit: 3.5 g/m$^2$), the magenta dye providing material M-4 shown below (2.0 g/m$^2$), polyethylene glycolo (3.0 g/m$^2$), 3-methyl-1,3,5 -pentanetriol (1.5 g/m$^2$), gelatin (3.0 g/m$^2$), polyvinylpyrrolidone (3.0 g/m$^2$), a surfactant (0.05 g/m$^2$) and a hardener (0.15 g/m$^2$).

Preparation of a dispersion of magenta dye providing material in gelatin

A dye providing material M-4 (5 g) having the structure shown below was dissolved in 15 ml of EA. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes so as to provide a dispersion of the dye providing material in gelatin at a yield of 100 g.

Dye providing material M-4

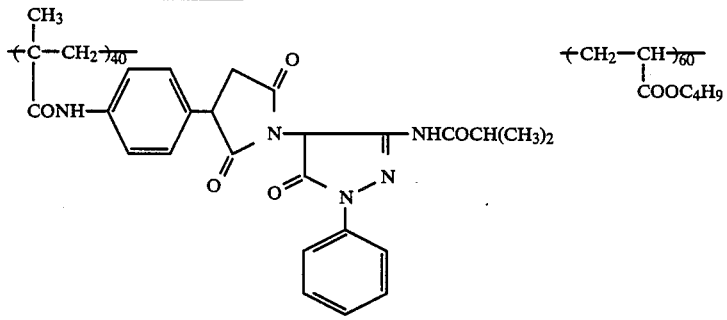

(4) Intermediate layer:

This layer was composed of gelatin (1.0 g/m$^2$) and polyvinylpyrrolidone (1.0 g/m$^2$).

(5) Red-sensitive, internal image forming silver chlorobromide emulsion layer:

Dye providing material C-2

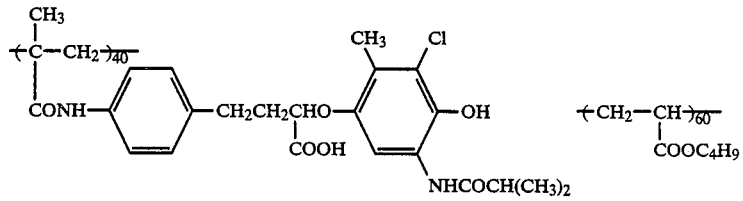

This layer was composed of one of the emulsions shown in Table D-12 that were prepared in Examples D-1 to D-15 and which comprised red-sensitized internal image forming silver halide grains (silver deposit: 3.0 g/m$^2$)), sodium 4-(diethylamino)-2-methylphenylsulfamate (1.0 g/m$^2$), a sulfobenzotriazole silver salt emulsion (silver deposit: 3.0 g/m$^2$)), the cyan dye providing material C-2 shown below (1.5 g/m$^2$), polyethylene glycol (2.5 g/m$^2$), 3-methyl-1,3,5-pentanetriol (1.0 g/m$^2$), gelatin (2.5 g/m$^2$), polyvinylpyrrolidone (2.5 g/m$^2$), a surfactant (0.05 g/m$^2$)) and a hardener (0.13 g/m$^2$).

Preparation of a dispersion of cyan dye providing material in gelatin

A dye providing material C-2 (5 g) having the structure shown below was dissolved in 15 ml of EA. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes so as to provide a dispersion of the dye providing material in gelatin at a yield of 100 g.

(6) Protective layer:

This layer was composed of gelatin (1.0 g/m$^2$), polyvinylpyrrolidone (1.0 g/m$^2$), a mat agent (0.3 g/m$^2$), a surfactant (0.1 g/m$^2$) and a hardener (0.05 g/m$^2$).

Each of the samples so prepared was subjected to imagewise exposure through a sensitometric optical wedge, and placed on a heat block for heating at 120° C., 140° C. or 160° C. for 20 seconds. Each of the samples was then superposed on a heat transfer image-receiving element of the same type as prepared in Example D-22 in such a manner that the coated surfaces were in contact with each other. The assembly was heat-developed at 150° C. for 1 minutes. Thereafter, the image-receiving element was immediately separated from the sample, and it carried a positive multicolor transfer image. The maximum density (Dmax) and minimum density (Dmin) were measured for the positive color transfer image obtained from each of the samples. The results are shown in Table D-12.

TABLE D-12

| Sample No. | Color image | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|---|
| 100 | yellow | EM-1 | 0.47 | 1.33 | 0.49 | 1.39 | 0.52 | 1.42 |
| (Comp. | magenta | EM-1 | 0.49 | 1.46 | 0.53 | 1.49 | 0.55 | 1.51 |
| 19) | cyan | EM-1 | 0.49 | 1.45 | 0.52 | 1.49 | 0.55 | 1.52 |
| 101 | yellow | EM-2 | 0.29 | 1.36 | 0.32 | 1.42 | 0.34 | 1.45 |
| (Comp. | magenta | EM-2 | 0.28 | 1.46 | 0.32 | 1.52 | 0.34 | 1.55 |
| 20) | cyan | EM-2 | 0.29 | 1.44 | 0.33 | 1.51 | 0.35 | 1.54 |
| | yellow | EM-7 | 0.14 | 1.55 | 0.15 | 1.61 | 0.16 | 1.64 |
| 102 | magenta | EM-7 | 0.15 | 1.58 | 0.16 | 1.62 | 0.17 | 1.66 |
| | cyan | EM-7 | 0.15 | 1.60 | 0.16 | 1.64 | 0.17 | 1.68 |
| | yellow | EM-9 | 0.12 | 1.67 | 0.14 | 1.71 | 0.15 | 1.74 |
| 103 | magenta | EM-8 | 0.13 | 1.72 | 0.15 | 1.79 | 0.16 | 1.82 |
| | cyan | EM-8 | 0.13 | 1.74 | 0.15 | 1.80 | 0.16 | 1.84 |
| | yellow | EM-10 | 0.12 | 1.71 | 0.14 | 1.76 | 0.15 | 1.79 |
| 104 | magenta | EM-10 | 0.12 | 1.72 | 0.14 | 1.77 | 0.15 | 1.81 |
| | cyan | EM-10 | 0.13 | 1.73 | 0.15 | 1.79 | 0.16 | 1.84 |

TABLE D-12-continued

| Sample No. | Color image | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|---|
| | yellow | EM-12 | 0.13 | 1.72 | 0.14 | 1.77 | 0.16 | 1.81 |
| 105 | magenta | EM-11 | 0.13 | 1.75 | 0.14 | 1.81 | 0.16 | 1.85 |
| | cyan | EM-11 | 0.13 | 1.78 | 0.14 | 1.84 | 0.16 | 1.86 |
| | yellow | EM-13 | 0.13 | 1.74 | 0.14 | 1.79 | 0.15 | 1.82 |
| 106 | magenta | EM-13 | 0.13 | 1.77 | 0.14 | 1.81 | 0.15 | 1.85 |
| | cyan | EM-13 | 0.14 | 1.79 | 0.15 | 1.83 | 0.16 | 1.86 |
| | yellow | EM-14 | 0.14 | 1.62 | 0.15 | 1.67 | 0.16 | 1.70 |
| 107 | magenta | EM-14 | 0.16 | 1.67 | 0.17 | 1.71 | 0.18 | 1.74 |
| | cyan | EM-14 | 0.16 | 1.69 | 0.17 | 1.73 | 0.18 | 1.76 |
| | yellow | EM-15 | 0.13 | 1.60 | 0.14 | 1.66 | 0.15 | 1.70 |
| 108 | magenta | EM-15 | 0.15 | 1.64 | 0.16 | 1.69 | 0.16 | 1.72 |
| | cyan | EM-15 | 0.15 | 1.67 | 0.16 | 1.72 | 0.16 | 1.74 |

Table D-12 shows that multi-layered silver halide photographic materials using internal image forming silver halides also produced superior positive color images when they were processed by the method of the present invention. It is also clear from Table D-12 that in comparison with sample Nos. 100 and 101 which used conversion type emulsions, EM-1 and EM-2, sample Nos. 102 to 108 using internally sensitized core/shell emulsions exhibited good characteristics in that they had low minimum densities and high maximum densities.

EXAMPLE D-26

To each of the emulsions prepared in Examples D-1 and D-2 and D-7 to D-15, the sulfobenzotriazole silver salt emulsion shown in Example D-15 (organic silver salt, with silver deposit of 2.0 g/m$^2$), a surfactant and a hardener were added, and the resulting coating solution was applied to a polyethylene terephthalate (150 μm thick) to give a silver deposit of 4.0 g/m$^2$, and dried.

Each of the resulting samples was subjected to imagewise exposure through a sensitometric optical wedge, and placed on a heat block for heating at 120° C., 140° C. or 160° C. for 30 seconds. The samples were subsequently developed, fixed, washed and dried as in Example D-16. The maximum density (Dmax) and minimum density (Dmin) were measured for the positive image formed on each of the samples. The results are shown in Table D-13.

TABLE D-13

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 109 (Comp. 21) | EM-1 | 0.33 | 1.19 | 0.34 | 1.27 | 0.36 | 1.31 |
| 110 (Comp. 22) | EM-2 | 0.20 | 1.08 | 0.21 | 1.16 | 0.22 | 1.21 |
| 111 | EM-7 | 0.12 | 1.30 | 0.13 | 1.39 | 0.14 | 1.40 |
| 112 | EM-8 | 0.10 | 1.41 | 0.12 | 1.48 | 0.13 | 1.52 |
| 113 | EM-9 | 0.11 | 1.28 | 0.12 | 1.36 | 0.14 | 1.41 |
| 114 | EM-10 | 0.10 | 1.40 | 0.11 | 1.49 | 0.13 | 1.51 |
| 115 | EM-11 | 0.12 | 1.30 | 0.13 | 1.38 | 0.14 | 1.41 |
| 116 | EM-12 | 0.11 | 1.32 | 0.12 | 1.40 | 0.13 | 1.44 |
| 117 | EM-13 | 0.09 | 1.41 | 0.10 | 1.47 | 0.11 | 1.52 |
| 118 | EM-14 | 0.10 | 1.39 | 0.11 | 1.46 | 0.13 | 1.50 |
| 119 | EM-15 | 0.11 | 1.37 | 0.12 | 1.45 | 0.14 | 1.48 |

Table D-13 shows that when imagewise exposed silver halide photographic materials having internal image forming silver halides were subjected to heating before development, superior positive images could be obtained. It is also clear from Table D-13 that in comparison with sample Nos. 109 and 110 which used conversion type emulsions, EM-1 and EM-2, sample Nos. 111 to 119 using internally sensitized core/shell emulsions exhibited good characteristics in that they had low minimum densities and high maximum densities.

EXAMPLE E-1

A conversion type silver chlorobromide emulsion was prepred by the following procedures.

To an aqueous solution containing 80 g of gelatin and 200 ml of an aqueous solution of 1 mole of silver nitrate, 200 ml of an aqueous solution of 1.2 moles of potassium chloride was added at a controlled temperature of 40° C. over a period of 1 minute. Following 1-minute physical ripening, 200 ml of an aqueous solution of 1 mole of potassium bromide was added, and physical ripening was conducted for an additional 1 minute. Washing was made to remove the water-soluble halides. After addition of 5 g of gelatin, water was added to make a total of 400 g.

The resulting silver chlorobromide emulsion comprised grains having an average size of 0.15 μm, and is hereunder referred to as EM-1.

EXAMPLE E-2

Using the grains in the conversion type emulsion prepared in Example E-1 as cores, a core/shell emulsion was prepared by the following procedures.

To 400 g of the core emulsion (EM-1), 275 ml of an aqueous solution of 1 mole of silver nitrate, 275 ml of an aqueous solution of 1 mole of potassium bromide and 30 ml of an aqueous solution of 1 mole of potassium chloride were added simultaneously at 60° C. over a period of 5 minutes so as to precipitate a shell of silver chlorobromide. After removing the water-soluble halides by washing with water, 20 g of gelatin was added and water was added to make a total of 600 g. The resulting silver chlorobromide core/shell emulsion comprised grains having an average size of 0.2 μm,.and is hereunder referred to as EM-2.

EXAMPLE E-3

Using the grains in the conversion type emulsion prepared in Example E-1 as cores, a silver chlorobromide core/shell emulsion was prepared as in the preparation of EM-2 in Example E-2 except that 10 ml of a 0.01 % aqueous solution of potassium hexachloroiridate was added to 400 g of the core emulsion EM-1. The resulting emulsion comprised grains having an average size of 0.2 μm and is hereinder referred to as EM-3.

EXAMPLE E-4

A silver bromide core emulsion was prepared using the following solutions.

| | |
|---|---|
| Solution 1-A | |
| Ossein gelatin | 40 g |
| Distilled water | 400 ml |
| 10% Ethanol solution of sodium salt of polyisopropylene-poly-ethyleneoxy-disuccinate ester | 30 ml |
| KBr | 2 g |
| 1N $HNO_3$ | 76 ml |
| Solution 1-B | |
| $AgNO_3$ | 1200 g |
| 0.1N $HNO_3$ | 60 ml |
| Ditilled water | to make 1750 ml |
| Solution 1-C | |
| Ossein gelatin | 35 g |
| KBr | 810 g |
| 10% Ethanol solution of sodium salt of polyisopropylene-poly-ethyleneoxy-disuccinate ester | 35 ml |
| Distilled water | to make 1750 ml |

At 40° C., solutions 1-B and 1-C were added to solution 1-A over a period of 32 minutes by the double-jet method using a mixer/agitator of the type shown in Unexamined Published Japanese Patent Application Nos. 92523/1982 and 92524/1982. The rate of addition was increased with time in a zigzag fashion as shown in Table below. The pAg value for solution 1-A was controlled to be at 9.0 by addition of a 20 % aqueous KBr solution. Measurement of pAg values was conducted with a metallic silver electrode and a double junction type saturated Ag/AgCl reference electrode.

Solutions 1-B, 1-C and 20 % aqueous KBr solution were added using a roller tube metering pump capable of variable flow rates.

The thus prepared emulsion was washed with water to remove any water-soluble halides. Thereafter, 130 g of gelatin was added and water was added to make a total of 6000 g. The resulting silver bromide core emulsion comprised grains having an average size of 0.13 μm, and is hereunder referred to as EM-4.

TABLE E-1

| | Rate of addition (ml/min) | |
|---|---|---|
| Time (min) | Solution 1-B | Solution 1-C |
| 0 | 15.1 | 15.1 |
| 5 | 15.9 | 15.9 |
| 10 | 27.0 | 27.0 |
| 14 | 40.0 | 40.0 |
| 16.5 | 49.3 | 49.3 |
| 20.5 | 65.8 | 65.8 |
| 22.5 | 74.0 | 74.0 |

TABLE E-1-continued

| | Rate of addition (ml/min) | |
|---|---|---|
| Time (min) | Solution 1-B | Solution 1-C |
| 26.5 | 94.0 | 94.0 |
| 29.0 | 107.5 | 107.5 |
| 31.0 | 118.5 | 118.5 |
| 32.0 | 126.0 | 126.0 |

EXAMPLE E-5

A silver is iodobromide core emulsion containing 1 mol % silver iodide was prepared by repeating the procedures of Example E-4 except that solution 1-C was replaced by the following solution 2-C.

| Solution 2-C | |
|---|---|
| Ossein gelatin | 35 g |
| KBr | 810 g |
| KI | 11.7 g |
| 10% Ethanol solution of sodium salt of polyisopropylene-poly-ethyleneoxy-disuccinate ester | 35 ml |
| Distilled water | to make 1750 ml |

The resulting silver iodobromide core emulsion comprised grains having an average size of 0.12 μm, and is hereunder referred to as EM-5.

EXAMPLE E-6

A silver iodobromide core emulsion containing 2 mol % silver iodide was prepared by repeating the procedures of Example E-4 except that solution 1-C was replaced by the following solution 3-C.

| Solution 3-C | |
|---|---|
| Ossein gelatin | 35 g |
| KBr | 810 g |
| KI | 23.4 g |
| 10% Ethanol solution of sodium salt of polyisopropylene-polyethyleneoxy-disuccinate ester | 35 ml |
| Distilled water | to make 1750 ml |

The resulting silver iodobromide core emulsion comprised grains having an average size of 0.11 μm, and is hereunder referred to as EM-6.

EXAMPLE E-7

A silver iodobromide core emulsion containing 4 mol % silver iodide was prepared by repeating the procedures of Example E-4 except that solution 1-C was replaced by the following solution 4-C.

| Solution 4-C | |
|---|---|
| Ossein gelatin | 35 g |
| KBr | 810 g |
| KI | 46.9 g |
| 10% Ethanol solution of sodium salt of polyisopropylene-polyethyleneoxy-disuccinate ester | 35 ml |
| Distilled water | to make 1750 ml |

The resulting silver iodobromide core emulsion comprised grains having an average of 0.10 μm, and is hereunder referred to as EM-7.

EXAMPLE E-8

To the silver bromide grains having an average size of 0.13 μm that were prepared in Example E-4, 50 mg per mole of silver of sodium thiosulfate and 10 mg per mole of silver of potassium chloroaurate were added, and the grain surfaces were chemically sensitized by heating at 60° C. for 90 minutes. A stabilizer and water were added to make a total of 1500 g (containing 1 mole of silver). Using the thus chemically sensitized silver bromide grains as cores, an internal image forming silver bromide core/shell emulsion was prepared from the following solutions.

| | |
|---|---|
| Solution 5-A | |
| Ossein gelatin | 5 g |
| Distilled water | 3300 ml |
| 10% Ethanol solution of sodium salt of polyisopropylene-polyethyleneoxy-disuccinate ester | 10 ml |
| 28% Aqueous ammonia solution | 60 ml |
| 56% aqueous acetic acid solution | 50 ml |
| Chemically sensitized silver bromide emulsion | 1500 g |
| Solution 5-B | |
| $AgNO_3$ | 280 g |
| 28% aqueous ammonia solution | 220 ml |
| Distilled water | to make 560 ml |
| Solution 5-C | |
| Ossein gelatin | 5 g |
| KBr | 210 g |
| 10% Ethanol solution of sodium salt of polyisopropylene-polyethyleneoxy-disuccinate ester | 10 ml |
| Distilled water | to make 560 ml |

At 40° C., solutions 5-B and 5-C were added to solution 5-A over a period of 20 minutes by the double-jet method using a mixer/agitator of the type shown in Unexamined Published Japanese Patent Application Nos. 925523/1982 and 92524/19882. The rate of addition was changed with time in a zigzag fashion as shown in Table E-2 below.

Throughout the addition period, the pAg value was controlled to be at 9.0 by addition of a 20 % aqueous KBr solution, and the pH value was controlled at 7.5 by addition of a 28 % aqueous acetic acid solution. The pAg values were measured by the same method as used in Example E-4, while the pH measurement was conducted with a glass electrode and a double junction type saturated Ag/AgCl reference electrode. The respective solutions were added using a roller tube metering pump capable of variable flow rates.

The thus prepared emulsion was washed with water to remove any water-soluble halides. Thereafter, 50 g of gelatin was added and water was added to make a total of 2200 g. The resulting silver bromide core/shell emulsion comprised grains having an average size of 0.18 μm, and is hereunder referred to as EM-8.

TABLE E-2

| | Rate of addition (ml/min) | |
|---|---|---|
| Time (min) | Solution 5-B | Solution 5-C |
| 0 | 12.2 | 12.2 |
| 1 | 13.5 | 13.5 |
| 2 | 15.0 | 15.0 |
| 5 | 20.1 | 20.1 |
| 10 | 28.8 | 28.8 |
| 15 | 36.0 | 36.0 |
| 20 | 37.4 | 37.4 |

EXAMPLE E-9

The silver bromide grains having an average size of 0.13 μm that were prepared in Example E-4 were chemically sensitized on the surfaces as in Example E-8.

Using the thus chemically sensitized silver bromide grains as cores, an internal image forming silver iodobromide core/shell emulsion containing 2 mol % AgI in the shell was prepared as in Example E-8 except that solution 5-C was replaced by the following solution 6-C.

| | |
|---|---|
| Solution 6-C | |
| Ossein gelatin | 5 g |
| KBr | 210 g |
| KI | 5.5 g |
| 10% Ethanol solution of sodium salt of polyisopropylene-polyethyleneoxy-disuccinate ester | 10 ml |
| Distilled water | to make 560 ml |

The resulting silver iodobromide core/shell emulsion comprised grains having an average size of 0.18 μm, and is hereunder referred to as EM-9.

EXAMPLE E-10

The silver bromide grains having an average size of 0.13 μm that were prephred in Example E-4 were chemically sensitized on the surfaces as in Example E-8.

Using the thus chemically sensitized silver bromide grains as cores, an internal image forming silver iodobromide core/shell emulsion containing 2 mol % AgI in the shell was prepared as in Example E-8 except that instead of solutions 5-B and 5-C, solutions 7-B and 7-C having the formulations indicated below were added over a period of 40 minutes.

| | |
|---|---|
| Solution 7-B | |
| $AgNO_3$ | 770 g |
| 28% Aqueous ammonia solution | 605 ml |
| Distilled water | to make 1540 ml |
| Solution 7-C | |
| Ossein gelatin | 15 g |
| KBr | 580 g |
| KI | 15.1 g |
| 10% Ethanol solution of sodium salt of polyisopropylene-polyethyleneoxy-dissucinate ester | 25 ml |
| Distilled water | to make 1540 ml |

The resulting silver iodobromide core/shell emulsion comprised grains having an average size of 0.23 μm, and is hereunder referred to as EM-10.

EXAMPLE E-11

To the silver iodobromide grains with 1 mol % AgI having an average size of 0.12 μm that were prepared in Example E-5, 50 mg per mole of silver of sodium thiosulfate and 10 mg per mole of silver of potassium chloroaurate were added, and the grain surfaces were chemically sensitized by heating at 60° C. for 80 minutes. A stabilizer and water were added to make a total of 1500 g (containing 1 mole of silver). Using the thus chemically sensitized silver iodobromide grains as cores, an internal image forming silver iodobromide core/shell emulsion with 3 mol % AgI was prepared as in Example E-8 except that instead of solutions 5-B and 5-C, solutions 8-B and 8-C having the formulations indicated below were added over a period of 23 minutes.

| | |
|---|---|
| Solution 8-B | |
| $AgNO_3$ | 313 g |
| 28% Aqueous ammonia solution | 246 g |
| Distilled water | to make 626 ml |
| Solution 8-C | |
| Ossein gelatin | 5.6 g |
| KBr | 235 g |
| KI | 9.2 g |
| 10% Ethanol solution of sodium salt of polyisopropylene-polyethyleneoxy-disuccinate ester | 10 ml |
| Distilled water | to make 626 ml |

The resulting silver iodobromide core/shell emulsion comprised grains having an average size of 0.17 μm, and is hereunder referred to as EM-11.

EXAMPLE E-12

To the silver iodobromide grains with 2 mol % AgI having an average size of 0.11 μm that were prepared in Example E-6, 50 mg per mole of silver of sodium thiosulfate and 10 mg per mole of silver of potassium chloroaurate were added, and the grain surfaces were chemically sensitized by heating at 60° C. for 80 minutes. A stabilizer and water were added to make a total of 1500 g (containing 1 mole of silver). Using the thus chemically sensitized silver iodobromide grains as cores, an internal image forming silver iodobromide core/ shell emulsion with 5 mol % AgI was prepared as in Example E-8 except that instead of solutions 5-B and 5-C, solutions 9-B and 9-C having the formulations indicated below were added over a period of 25 minutes.

| | |
|---|---|
| Solution 9-B | |
| $AgNO_3$ | 353 g |
| 28% Aqueous ammonia solution | 277 ml |
| Distilled water | to make 705 ml |
| Solution 9-C | |
| Ossein gelatin | 6.3 g |
| KBr | 260 g |
| KI | 17.2 g |
| 10% Ethanol solution of sodium salt of polyisopropylene-poly-ethyleneoxy-disuccinate ester | 10 ml |
| Distilled water | to make 705 ml |

The resulting silver iodobromide core/shell emulsion comprised grains having an average size of 0.16 μm, and is hereunder referred to as EM-12.

EXAMPLE E-13

The silver iodobromide grains with 2 mol % AgI having an average size of 0.11 μm that were prepared in Example E-6 were chemically sensitized on the surfaces as in Example E-12.

Using the thus chemically sensitized silver iodobromide grains as cores, an internal image forming silver iodobromide core/shell emulsion containing 5 mol % AgI in the shell was prepared as in Example E-8 except that instead of solutions 5-B and 5-C, solutions 10-B and 10-C having the formulations indicated below were added over a period of 50 minutes.

| | |
|---|---|
| Solution 10-B | |
| $AgNO_3$ | 1013 g |
| 28% Aqueous ammonia solution | 795 ml |

-continued

| | |
|---|---|
| Distilled water | to make 2026 ml |
| Solution 10-C | |
| Ossein gelatin | 18 g |
| KBr | 700 g |
| KI | 49.5 g |
| 10% Ethanol solution of sodium salt of polyisopropylene-polyethyleleoxy-disuccinate ester | 35 ml |
| Distilled water | to make 2026 ml |

The resulting silver iodobromide core/shell emulsion comprised grains having an average size of 0.21 μm, and is hereunder referred to as EM-13.

EXAMPLE E-14

To the silver iodobromide grains with 4 mol % AgI having an average size of 0.10 μm that were prepared in Example E-7, 50 mg per mole of silver of sodium thiosulfate and 10 mg per mole of silver of potassium chloroaurate were added, and the grain surfaces were chemically sensitized by heating at 60° C. for 70 minutes. A stabilizer and water were added to make a total of 1500 g (containing 1 mole of silver). Using the thus chemically sensitized silver iodobromide grains as cores, an internal image forming silver iodobromide core/shell emulsion with 8 mol % AgI was prepared as in Example E-8 except that instead of solutions 5-B and 5-C, solutions 11-B and 11-C having the formulations indicated below were added over a period of 25 minutes.

| | |
|---|---|
| Solution 11-B | |
| $AgNO_3$ | 403 g |
| 28% Aqueous ammonia solution | 317 ml |
| Distilled water | to make 806 ml |
| Solution 11-C | |
| Ossein gelatin | 7 g |
| KBr | 190 g |
| KI | 31.5 g |
| 10% Ethanol solution of sodium salt of polyisopropylene-poly-ethyleneoxy-disuccinate ester | 15 ml |
| Distilled water | to make 806 ml |

The resulting silver iodobromide core/shell emulsion comprised grains having an average size of 0.15 μm, and is hereunder referred to as EM-14.

EXAMPLE E-15

An internal image forming silver chloride core/shell emulsion was prepared by the following procedures.

To an aqueous solution containing 80 g of gelatin and 200 ml of an aqueous solution of 1 mole of silver nitrate, 200 ml of an aqueous solution of 1.2 moles of potassium chloride was added at a controlled temperature of 40° C. over a period of 1 minute. After removing the water-soluble halides by washing, 5 g of gelatin was added and water was added to make a total of 400 g. As a result, silver chloride core grains having an average size of 0.15 μm were obtained.

To these core grains, 40 mg per mole of silver of sodium thiosulate and 8 mg per mole of silver of chloroauric acid were added and the surfaces of the grains were chemically sensitized by heating at 55° C. for 100 minutes. A stabilizer and water were added to make a total of 2500 g (containing 1 mole of silver). To 500 g of the chemically sensitized silver chloride grains, 275 mg of an aqueous solution of 1 mole of silver nitrate and 275 ml of an aqueous solution of 1.1 moles of potassium chloride were simultaneously added over a period of 10 minutes, so as to precipitate a shell of silver chloride. Washing was made to remove the water-soluble halides. After adding 20 g of gelatin, water was added to make a total of 600 g. The resulting internal image forming silver chloride core/shell emulsion comprised grains having an average size of 0.2 μm, and is hereunder referred to as EM-15.

EXAMPLE E-16

A silver chlorobromide core emulsion with 5 mol % AgCl was prepared as in Example E-4 except that solution 1-C was replaced by solution 12-C having the following formulation.

| Solution 12-C | |
|---|---|
| Ossein gelatin | 35 g |
| KBr | 800 g |
| KCl | 26.3 g |
| 10% Ethanol solution of sodium salt of polyisopropylene-polyethyleneoxy-disuccinate ester | 35 ml |
| Distilled water | to make 1750 ml |

The resulting silver chlorobromide core emulsion comprised grains having an average size of 0.10 μm.

To the obtained silver chlorobromide core grains, 50 mg per mole of silver of sodium thiosulfate and 10 mg per mole of silver of chloroauric acid were added, and the grain surfaces were chemically sensitized by heating at 56° C. for 100 minutes. A stabilizer and water were added to make a total of 1500 g (containing 1 mole of silver). Using the thus chemically sensitized silver chlorobromide grains as cores, an internal image forming silver chlorobromide core/shell emulsion with 5 mol % AgCl was prepared as in Example E-14 except that solution 11-C was replaced by solution 13-C having the following formulation.

| Solution 13-C | |
|---|---|
| Ossein gelatin | 7 g |
| KBr | 190 g |
| KCl | 9.0 g |
| 10% Ethanol solution of sodium salt of polyisopropylene-polyethylene-oxy-disuccinate ester | 15 ml |
| Distilled water | to make 806 ml |

The resulting silver chlorobromide core/shell emulsion comprised grains having an average size of 0.15 μm, and is hereunder referred to as EM-16.

EXAMPLE E-17

Using the emulsions prepared in Examples E-1 to E-3 and E-8 to E-16, light-sensitive materials (sample Nos. 1 to 12) were prepared by the following procedures.

| Preparation of light-sensitive materials | |
|---|---|
| (a) one of the light-sensitive, internal image forming silver halide emulsions made in Examples E-1 to E-3 and E-8 to E-16 | 1.0 g/m$^2$ |
| (b) gelatin (binder) | 1.0 g/m$^2$ |
| (c) surfactant | 0.2 g/m$^2$ |
| (d) hardener | 0.02 g/m$^2$ |

The components (a) to (d) were mixed and a solution was made from the mixture by heating. The resulting solution was coated onto a polyethylene terephthalate film (100 μm) to give a wet thickness of 50 μm. A protective layer was formed on the emulsion coat by application of a 3% gelatin solution in a wet thickness of 20 μm.

Each of the dry samples was subjected to imagewise exposure $10^4$ lux.sec) through a sensitometric optical wedge and placed on a heat block for heating for 15 seconds at a temperature between 120 and 160° C. Fifteen seconds after completion of the heating, the samples were subjected to overall exposure under a tungsten lamp for 10 seconds at varying intensities of $10^3$, $0.5\times10^3$ and $10^2$ luxes.

Each exposed samples was developed at 20° C. for 5 minutes with a developer having the following formulation.

| Developer formulation | |
|---|---|
| Methanol | 2.5 g |
| Ascorbic acid | 10 g |
| Potassium bromide | 1 g |
| Sodium metaborate | 35 g |
| Water | to make 1,000 ml |

The developed samples were subsequently fixed, washed and dried by the customary procedures.

The maximum density (Dmax) and minimum density (Dmin) were measured for the positive image formed on each of the samples, and the results are shown in Table E-3. Density measurements were made using a Sakura Densitometer PDA-65, product of Konishiroku Photo Industry Co., Ltd. No image was obtained from samples that were subjected to overall exposure at room temperature, rather than at elevated temperatures.

TABLE E-3

| Sample No. | Emulsion | Heating temperature Overall exposure ($10^2$ lux) | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|---|
| | | 1 | 0.44 | 0.48 | 0.45 | 0.51 | 0.46 | 0.52 | 0.02 | 0.02 |
| 1 | ME-1 | 5 | 0.35 | 0.55 | 0.37 | 1.10 | 0.38 | 0.97 | 0.02 | 0.02 |
| | | 10 | 0.36 | 0.92 | 0.38 | 0.98 | 0.39 | 0.96 | 0.02 | 0.02 |
| | | 1 | 0.34 | 0.56 | 0.35 | 0.72 | 0.36 | 0.74 | 0.02 | 0.02 |
| 2 | ME-2 | 5 | 0.28 | 0.72 | 0.29 | 1.30 | 0.30 | 1.30 | 0.02 | 0.02 |
| | | 10 | 0.28 | 1.12 | 0.29 | 1.50 | 0.30 | 1.50 | 0.02 | 0.02 |
| | | 1 | 0.34 | 0.59 | 0.35 | 0.76 | 0.36 | 0.78 | 0.02 | 0.02 |
| 3 | ME-3 | 5 | 0.29 | 0.81 | 0.30 | 1.37 | 0.31 | 1.38 | 0.02 | 0.02 |
| | | 10 | 0.29 | 1.22 | 0.30 | 1.60 | 0.31 | 1.62 | 0.02 | 0.02 |
| | | 1 | 0.29 | 0.62 | 0.30 | 0.82 | 0.31 | 0.84 | 0.02 | 0.02 |
| 4 | ME-8 | 5 | 0.22 | 0.77 | 0.23 | 1.36 | 0.24 | 1.37 | 0.02 | 0.02 |

TABLE E-3-continued

| Sample No. | Emulsion | Heating temperature Overall exposure ($10^2$ lux) | 120° C. Dmin | 120° C. Dmax | 140° C. Dmin | 140° C. Dmax | 160° C. Dmin | 160° C. Dmax | 30° C. Dmin | 30° C. Dmax |
|---|---|---|---|---|---|---|---|---|---|---|
| | | 10 | 0.21 | 1.13 | 0.22 | 1.48 | 0.23 | 1.50 | 0.02 | 0.02 |
| | | 1 | 0.28 | 0.66 | 0.29 | 0.78 | 0.30 | 0.79 | 0.02 | 0.02 |
| 5 | ME-9 | 5 | 0.21 | 0.78 | 0.21 | 1.38 | 0.22 | 1.39 | 0.02 | 0.02 |
| | | 10 | 0.21 | 1.14 | 0.21 | 1.57 | 0.23 | 1.59 | 0.02 | 0.02 |
| | | 1 | 0.27 | 0.67 | 0.28 | 0.77 | 0.29 | 0.78 | 0.02 | 0.02 |
| 6 | ME-10 | 5 | 0.20 | 0.80 | 0.21 | 1.32 | 0.21 | 1.33 | 0.02 | 0.02 |
| | | 10 | 0.20 | 1.11 | 0.21 | 1.56 | 0.22 | 1.57 | 0.02 | 0.02 |
| | | 1 | 0.28 | 0.66 | 0.29 | 0.76 | 0.30 | 0.78 | 0.02 | 0.02 |
| 7 | ME-11 | 5 | 0.20 | 0.82 | 0.21 | 1.36 | 0.22 | 1.38 | 0.02 | 0.02 |
| | | 10 | 0.20 | 1.12 | 0.21 | 1.58 | 0.22 | 1.60 | 0.02 | 0.02 |
| | | 1 | 0.27 | 0.65 | 0.28 | 0.75 | 0.29 | 0.77 | 0.02 | 0.02 |
| 8 | ME-12 | 5 | 0.20 | 0.80 | 0.21 | 1.33 | 0.22 | 1.33 | 0.02 | 0.02 |
| | | 10 | 0.20 | 1.10 | 0.21 | 1.47 | 0.22 | 1.48 | 0.02 | 0.02 |
| | | 1 | 0.26 | 0.65 | 0.27 | 0.75 | 0.28 | 0.76 | 0.02 | 0.02 |
| 9 | ME-13 | 5 | 0.19 | 0.81 | 0.20 | 1.35 | 0.21 | 1.35 | 0.02 | 0.02 |
| | | 10 | 0.19 | 1.13 | 0.20 | 1.44 | 0.20 | 1.44 | 0.02 | 0.02 |
| | | 1 | 0.27 | 0.64 | 0.28 | 0.72 | 0.29 | 0.73 | 0.02 | 0.02 |
| 10 | ME-14 | 5 | 0.20 | 0.79 | 0.21 | 1.30 | 0.21 | 1.31 | 0.02 | 0.02 |
| | | 10 | 0.21 | 1.14 | 0.22 | 1.39 | 0.23 | 1.40 | 0.02 | 0.02 |
| | | 1 | 0.28 | 0.65 | 0.29 | 0.78 | 0.30 | 0.80 | 0.02 | 0.02 |
| 11 | ME-15 | 5 | 0.21 | 0.80 | 0.22 | 1.35 | 0.22 | 1.35 | 0.02 | 0.02 |
| | | 10 | 0.22 | 1.12 | 0.23 | 1.51 | 0.24 | 1.50 | 0.02 | 0.02 |
| | | 1 | 0.28 | 0.65 | 0.29 | 0.79 | 0.30 | 0.80 | 0.02 | 0.02 |
| 12 | ME-16 | 5 | 0.22 | 0.81 | 0.23 | 1.37 | 0.24 | 1.38 | 0.02 | 0.02 |
| | | 10 | 0.22 | 1.13 | 0.23 | 1.56 | 0.24 | 1.57 | 0.02 | 0.02 |

Table E-3 shows that when imagewide exposed light-sensitive layers having internal image forming silver halide emulsions were subjected to overall exposure under heating before development, superior positive images could be obtained.

EXAMPLE E-18

The sample Nos. 1 to 12 prepared in Example E-17 were imagewise exposed in a sensitometer and heated for 15 seconds under the conditions used in Example E-17. Thereafter, the samples were removed from the heat block, left to cool to room temperature where they were subjected to overall exposure, and developed by the same developer as used in Example E-17. Subsequently, the samples were fixed, washed and dried. The maximum density (Dmax) and minimum density (Dmin) were measured for the positive image formed on each of the samples that were given overall exposure 15 minutes after they were removed from the heat block. The results are shown in Table E-4.

TABLE E-4

| Sample No. | Emulsion | Heating temperature Overall exposure ($10^2$ lux) | 120° C. Dmin | 120° C. Dmax | 140° C. Dmin | 140° C. Dmax | 160° C. Dmin | 160° C. Dmax |
|---|---|---|---|---|---|---|---|---|
| | | 1 | 0.41 | 0.43 | 0.42 | 0.46 | 0.45 | 0.48 |
| 1 | ME- 1 | 5 | 0.33 | 0.51 | 0.34 | 0.92 | 0.34 | 0.90 |
| | | 10 | 0.35 | 0.88 | 0.34 | 0.92 | 0.36 | 0.90 |
| | | 1 | 0.30 | 0.51 | 0.31 | 0.55 | 0.33 | 0.57 |
| 2 | ME- 2 | 5 | 0.26 | 0.66 | 0.27 | 1.10 | 0.28 | 1.10 |
| | | 10 | 0.26 | 0.98 | 0.27 | 1.27 | 0.28 | 1.28 |
| | | 1 | 0.28 | 0.53 | 0.29 | 0.59 | 0.30 | 0.60 |
| 3 | ME- 3 | 5 | 0.24 | 0.67 | 0.25 | 1.17 | 0.26 | 1.17 |
| | | 10 | 0.24 | 0.99 | 0.25 | 1.31 | 0.26 | 1.30 |
| | | 1 | 0.26 | 0.54 | 0.27 | 0.57 | 0.28 | 0.59 |
| 4 | ME- 8 | 5 | 0.21 | 0.68 | 0.22 | 1.16 | 0.22 | 1.16 |
| | | 10 | 0.20 | 1.02 | 0.21 | 1.30 | 0.22 | 1.32 |
| | | 1 | 0.26 | 0.56 | 0.27 | 0.59 | 0.28 | 0.60 |
| 5 | ME- 9 | 5 | 0.20 | 0.66 | 0.21 | 1.11 | 0.22 | 1.12 |
| | | 10 | 0.20 | 1.01 | 0.21 | 1.31 | 0.22 | 1.31 |
| | | 1 | 0.26 | 0.55 | 0.27 | 0.58 | 0.28 | 0.57 |
| 6 | ME-10 | 5 | 0.20 | 0.64 | 0.21 | 1.12 | 0.21 | 1.13 |
| | | 10 | 0.20 | 1.00 | 0.21 | 1.33 | 0.21 | 1.34 |
| | | 1 | 0.25 | 0.55 | 0.26 | 0.57 | 0.27 | 0.58 |
| 7 | ME-11 | 5 | 0.19 | 0.65 | 0.20 | 1.11 | 0.21 | 1.11 |
| | | 10 | 0.19 | 1.01 | 0.20 | 1.36 | 0.21 | 1.37 |
| | | 1 | 0.26 | 0.54 | 0.27 | 0.59 | 0.28 | 0.60 |
| 8 | ME-12 | 5 | 0.19 | 0.66 | 0.20 | 1.14 | 0.21 | 1.14 |
| | | 10 | 0.20 | 1.01 | 0.21 | 1.35 | 0.22 | 1.37 |
| | | 1 | 0.24 | 0.54 | 0.25 | 0.59 | 0.26 | 0.58 |
| 9 | ME-13 | 5 | 0.18 | 0.68 | 0.19 | 1.11 | 0.20 | 1.12 |
| | | 10 | 0.18 | 1.03 | 0.19 | 1.33 | 0.20 | 1.34 |
| | | 1 | 0.25 | 0.51 | 0.26 | 0.57 | 0.27 | 0.57 |

TABLE E-4-continued

| Sample No. | Emulsion | Heating temperature Overall exposure ($10^2$ lux) | 120° C. Dmin | 120° C. Dmax | 140° C. Dmin | 140° C. Dmax | 160° C. Dmin | 160° C. Dmax |
|---|---|---|---|---|---|---|---|---|
| 10 | ME-14 | 5 | 0.20 | 0.61 | 0.21 | 1.12 | 0.22 | 1.12 |
| | | 10 | 0.20 | 1.05 | 0.21 | 1.33 | 0.22 | 1.34 |
| | | 1 | 0.27 | 0.52 | 0.28 | 0.57 | 0.29 | 0.58 |
| 11 | ME-15 | 5 | 0.20 | 0.60 | 0.21 | 1.09 | 0.22 | 1.11 |
| | | 10 | 0.20 | 1.04 | 0.21 | 1.31 | 0.22 | 1.32 |
| | | 1 | 0.27 | 0.51 | 0.28 | 0.58 | 0.20 | 0.58 |
| 12 | ME-16 | 5 | 0.21 | 0.61 | 0.22 | 1.12 | 0.23 | 1.13 |
| | | 10 | 0.21 | 1.03 | 0.22 | 1.33 | 0.22 | 1.33 |

The above data show that the results obtained when imagewise exposed light-sensitive layers were subjected to overall exposure after the heated layers were cooled to room temperature were comparable to those obtained when overall exposure was conducted at elevated temperatures.

EXAMPLE E-19

Preparation of sulfobenzotriazole silver emulsion

In a mixed solvent of water (150 ml) and ethanol (150 ml), 40 g of poly(4-vinylpyrrolidone), 30 g of 4-sulfobenzotriazole and 6 g of sodium hydroxide were dissolved. To the stirred solution, 30 ml of an aqueous solution of 5 N silver nitrate was added so as to adjust the pH at between 6 and 8. Water was added to make a total of 600 ml, thereby providing a dispersion of organic silver salt.

Using this organic silver salt in combination with internal image forming silver halide emulsion of the same types as used in Example E-17, light-sensitive coating solutions having the formulations shown below were prepared. They were then applied to polyethylene terephthalate films (100 μm) in a wet thickness of 50 μm, thereby providing sample Nos. 13 to 24 of heat developable photographic material.

| Preparation of light-sensitive coating solutions | |
|---|---|
| (a) One of the light-sensitive, internal image forming silver halide emulsion prepared in Examples E-1 to E-3 and | 0.9 g/m$^2$ |

-continued

| Preparation of light-sensitive coating solutions | |
|---|---|
| E-8 to E-16 | |
| (b) 4-Carboxymethyl-4-thiazoline-2-thione (toning agent) | 0.03 g/m$^2$ |
| (c) Methyl hydroquinone (reducing agent) | 0.6 g/m$^2$ |
| (d) 4-Sulfobenzotriazole silver salt (organic salt) | 0.9 g/m$^2$ |
| (e) Poly(4-vinylpyrrolidone) (binder) | 1.25 g/m$^2$ |
| (f) Gelatin (binder) | 12.5 g/m$^2$ |
| (g) 3-Methylpentane-1,3,5-triol (hot solvent) | 2 g/m$^2$ |
| (h) Surfactant | 0.1 g/m$^2$ |

Each of the heat developable photographic materials was subjected to imagewise exposure under a tungsten lamp through a sensitometric optical wedge and placed on a heat block for heating for 10 seconds at a temperature between 120 and 160° C. Ten seconds after completion of the heating, the samples were subjected to overall exposure under a tungsten lamp at varying intensities of $10^3$, $0.5\times10^3$ and $10^2$ luxes. Thereafter, the samples were developed by continued heating for an additional 20 seconds.

All the samples developed produced positive images of high contrast (indicated by the difference between maximum and minimum densities). The maximum density (Dmax) and minimum density (Dmin) were measured for the positive image formed on each of the samples, and the results are shown in Table E-5.

Density measurements were made using a Sakura Densitometer PDA-65, product of Konishiroku Photo Industry Co., Ltd.

TABLE E-5

| Sample No. | Emulsion | Heating temperature Overall exposure ($20^2$ lux) | 120° C. Dmin | 120° C. Dmax | 140° C. Dmin | 140° C. Dmax | 160° C. Dmin | 160° C. Dmax |
|---|---|---|---|---|---|---|---|---|
| | | 1 | 0.42 | 0.58 | 0.48 | 0.63 | 0.49 | 0.66 |
| 13 | ME-1 | 5 | 0.37 | 0.60 | 0.40 | 1.27 | 0.40 | 1.30 |
| | | 10 | 0.37 | 0.80 | 0.40 | 1.22 | 0.41 | 1.27 |
| | | 1 | 0.31 | 0.60 | 0.33 | 0.65 | 0.33 | 0.67 |
| 14 | ME-2 | 5 | 0.22 | 0.64 | 0.24 | 1.30 | 0.24 | 1.32 |
| | | 10 | 0.22 | 0.86 | 0.24 | 1.30 | 0.24 | 1.32 |
| | | 1 | 0.33 | 0.68 | 0.34 | 0.76 | 0.35 | 0.78 |
| 15 | ME-3 | 5 | 0.24 | 0.74 | 0.25 | 1.35 | 0.26 | 1.40 |
| | | 10 | 0.24 | 0.98 | 0.25 | 1.37 | 0.27 | 1.40 |
| | | 1 | 0.23 | 0.72 | 0.24 | 0.78 | 0.24 | 0.79 |
| 16 | ME-8 | 5 | 0.18 | 0.80 | 0.19 | 1.45 | 0.20 | 1.47 |
| | | 10 | 0.16 | 1.02 | 0.17 | 1.44 | 0.18 | 1.47 |
| | | 1 | 0.22 | 0.70 | 0.22 | 0.80 | 0.23 | 0.80 |
| 17 | ME-9 | 5 | 0.17 | 0.80 | 0.18 | 1.46 | 0.19 | 1.48 |
| | | 10 | 0.15 | 1.00 | 0.16 | 1.45 | 0.17 | 1.48 |
| | | 1 | 0.21 | 0.70 | 0.22 | 0.80 | 0.22 | 0.81 |
| 18 | ME-10 | 5 | 0.18 | 0.79 | 0.19 | 1.48 | 0.20 | 1.50 |
| | | 10 | 0.16 | 0.99 | 0.17 | 1.47 | 0.18 | 1.49 |
| | | 1 | 0.23 | 0.73 | 0.23 | 0.79 | 0.24 | 0.79 |

TABLE E-5-continued

| Sample No. | Emulsion | Heating temperature Overall exposure ($10^2$ lux) | 120° C. Dmin | 120° C. Dmax | 140° C. Dmin | 140° C. Dmax | 160° C. Dmin | 160° C. Dmax |
|---|---|---|---|---|---|---|---|---|
| 19 | ME-11 | 5 | 0.18 | 0.82 | 0.19 | 1.47 | 0.19 | 1.49 |
| | | 10 | 0.17 | 1.08 | 0.18 | 1.50 | 0.19 | 1.51 |
| | | 1 | 0.22 | 0.70 | 0.23 | 0.76 | 0.24 | 0.77 |
| 20 | ME-12 | 5 | 0.19 | 0.80 | 0.20 | 1.50 | 0.21 | 1.50 |
| | | 10 | 0.18 | 1.11 | 0.19 | 1.49 | 0.20 | 1.50 |
| | | 1 | 0.23 | 0.70 | 0.24 | 0.79 | 0.25 | 0.78 |
| 21 | ME-13 | 5 | 0.20 | 0.81 | 0.21 | 1.46 | 0.22 | 1.48 |
| | | 10 | 0.20 | 1.06 | 0.21 | 1.48 | 0.22 | 1.50 |
| | | 1 | 0.24 | 0.71 | 0.25 | 0.78 | 0.26 | 0.79 |
| 22 | ME-14 | 5 | 0.19 | 0.82 | 0.19 | 1.42 | 0.20 | 1.44 |
| | | 10 | 0.19 | 1.03 | 0.20 | 1.44 | 0.21 | 1.43 |
| | | 1 | 0.23 | 0.69 | 0.24 | 0.76 | 0.25 | 0.77 |
| 23 | ME-15 | 5 | 0.18 | 0.79 | 0.19 | 1.44 | 0.20 | 1.45 |
| | | 10 | 0.18 | 1.04 | 0.19 | 1.43 | 0.20 | 1.45 |
| | | 1 | 0.23 | 0.69 | 0.24 | 0.75 | 0.24 | 0.76 |
| 24 | ME-16 | 5 | 0.18 | 0.82 | 0.19 | 1.48 | 0.19 | 1.50 |
| | | 10 | 0.17 | 1.06 | 0.18 | 1.47 | 0.19 | 1.49 |

Table E-5 shows that superior positive images could also be obtained when the moethod of the present invention was applied to heat developable photographic materials.

Dye providing material M-1

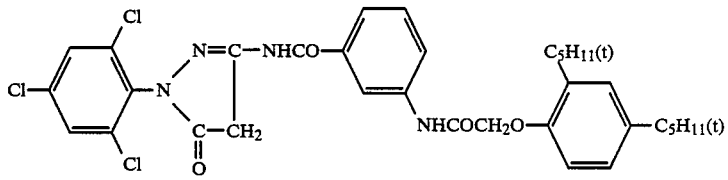

EXAMPLE E-20

Using the emulsions prepared in Example E-1 to E-3 and E-8 to E-16, light-sensitive materials (sample Nos. 25 to 36) were prepared by the following procedures.

| Preparation of light-sensitive materials | |
|---|---|
| (a) one of the light-sensitive, internal image forming silver halide emulsions made in Examples E-1 to E-3 and E-8 to E-16 | 1.0 g/m$^2$ |
| (b) dye providing material, M-1 | 0.5 g/m$^2$ |
| (c) gelatin (binder) | 1.5 g/m$^2$ |
| (d) surfactant | 0.2 g/m$^2$ |
| (e) hardener | 0.03 g/m$^2$ |

The components (a) to (e) were mixed and a solution was made from the mixture by heating. The resulting solution was coated onto a polyethylene terephthalate film (100 μm) to give a wet thickness of 50 μm.

A protective layer was formed on the emulsion coat by application of a 3% gelatin solution in a wet thickness of 20 μm.

Preparation of a dispersion of dye providing material (M-1) in gelatin

A dye providing material M-1 (10 g) having the structure shown below was uniformly dissolved in 30 g of ethyl acetate (hereunder referred to as EA) and 15 g of tricresyl phosphate (hereunder referred to as TCP) by heating at about 50° C. The resulting solution was added to 400 ml of a 7.5% aqueous gelatin solution containing 30 ml of a 5% aqueous solution of Alkanol XC (Du Pont) and the two solutions were mixed under agitation. Thereafter, the mixture was homogenized by an ultrasonic homogenizer for 30 minutes, so as to obtain a dispersion of the dye providing material in gelatin at a yield of 600 g.

Each of the resulting samples was subjected to imagewise exposure through a sensitometric optical wedge, and placed on a heat block foe heating at between 120 and 160° C. for 15 seconds. Fifteen seconds after completion of the heating, the samples were given overall exposure under a tungsten lamp at an intensity of $10^2$ lux. The samples were subsequently processed by the scheme shown below, so as to obtain samples carrying dye images.

| Processing steps (30° C.) | Time |
|---|---|
| Color development | 3 min and 30 sec |
| First washing | 1 min and 00 sec |
| Bleach-fixing | 1 min and 30 sec |
| Second washing | 1 min and 00 sec. |

The respective processing solutions had the following formulations.

| Color development | |
|---|---|
| 4-Amino-3-methyl-N—(β-methanesulfonamidoethyl)aniline sulfate | 5 g |
| Sodium sulfite (anhydrous) | 2 g |
| Sodium carbonate (monohydrate) | 15 g |
| Potassium bromide | 1 g |
| Benzyl alcohol | 10 ml |
| Water | to make 1,000 ml |
| (pH adjusted to 10.2 with potassium hydroxide) | |
| **Bleach-fixing solution** | |
| Ethylenediaminetetraacetic acid iron (III) ammonium dihydrate | 60 g |
| Ethylenediaminetetraacetic acid | 3 g |

-continued

| | |
|---|---|
| Sodium thiosulfate (70% aq. sol.) | 100 ml |
| Ammonium sulfite (40% aq. sol.) | 27.5 ml |
| Water | to make 1,000 ml |
| (pH adjusted to 7.10 with potassium carbonate) | |

The maximum density (Dmax) and minimum density (Dmin) were measured for the positive magenta color image formed on each of the samples, and the results are shown in Table E-6.

Density measurements were made using a Sakura Densitometer PDA-65, product of Konishiroku Photo Industry.

TABLE E-6

| Sample No. | Heating temperature Emulsion | 120° C. Dmin | 120° C. Dmax | 140° C. Dmin | 140° C. Dmax | 160° C. Dmin | 160° C. Dmax |
|---|---|---|---|---|---|---|---|
| 25 | EM-1 | 0.35 | 0.98 | 0.37 | 1.03 | 0.39 | 1.04 |
| 26 | EM-2 | 0.27 | 1.07 | 0.28 | 1.11 | 0.30 | 1.13 |
| 27 | EM-3 | 0.26 | 1.12 | 0.27 | 1.14 | 0.28 | 1.14 |
| 28 | EM-8 | 0.18 | 1.11 | 0.19 | 1.13 | 0.20 | 1.15 |
| 29 | EM-9 | 0.19 | 1.08 | 0.20 | 1.14 | 0.21 | 1.15 |
| 30 | EM-10 | 0.17 | 1.07 | 0.18 | 1.15 | 0.18 | 1.16 |
| 31 | EM-11 | 0.19 | 1.12 | 0.20 | 1.17 | 0.21 | 1.18 |
| 32 | EM-12 | 0.18 | 1.09 | 0.19 | 1.13 | 0.19 | 1.14 |
| 33 | EM-13 | 0.19 | 1.06 | 0.20 | 1.08 | 0.21 | 1.13 |
| 34 | EM-14 | 0.20 | 1.13 | 0.21 | 1.19 | 0.22 | 1.20 |
| 35 | EM-15 | 0.18 | 1.14 | 0.19 | 1.16 | 0.19 | 1.17 |
| 36 | EM-16 | 0.17 | 1.11 | 0.18 | 1.12 | 0.19 | 1.14 |

Table E-6 shows that good dye images were obtained from the samples of the present invention.

EXAMPLE E-21

Using the emulsions prepared in Examples E-1 to E-3 and E-8 to E-16, sample Nos. 37 to 48 were prepared by the following procedures.

| | |
|---|---|
| (a) one of the light-sensitive, internal image forming silver halide emulsions made in Examples E-1 to E-3 and E-8 to E-16 | 50 g |
| (b) dispersion of 4-sulfobenzotriazole silver salt (organic silver salt) | 40 ml |
| (c) sulfobenzotriazole (10% aq. sol.) | 5 ml |
| (d) gelatin dispersion of the dye providing material (M-2) shown below | 40 ml |
| (e) 10% ethanol solution of guanidinetrichloroacetic acid | 10 ml |
| (f) sodium 4-(diethylamino)-2-methylphenylsulfamate | 0.5 g |
| (g) 10% gelatin | 60 ml |
| (h) 3-methylpentane-1,3,5-triol | 6 g |
| (i) polyvinylpyrrolidone | 7 g |
| (j) surfactant (5% aq. sol.) | 1 ml |
| (k) $H_2O$ | 4.5 ml |

The components (a) to (k) were mixed and an solution was made from the mixture by heating. The resulting solution was coated onto a polyethylene terephthalate film (150 μm) to give a wet thickness of 85 μm. A protective layer was formed on the emulsion coat by application of 1.5 g/m² of a gelatin layer containing a hardener.

Preparation of a dispersion of dye providing material (M-2) in gelatin

A dye providing material M-2 (10 g) having the structure shown below was uniformly dissolved in 30 g of EA and 10 g of TCP by heating at about 60° C. The resulting solution was mixed under agitation with 120 ml of a 2% aqueous gelatin solution containing 30 ml of a 5% aqueous solution of Alkanol XC (Du Pont) as a dispersant. Thereafter, the mixture was homogenized by an ultrasonic homogenizer for 10 minutes, so as to obtain a dispersion of the dye providing material in gelatin.

Dye providing material, M-2

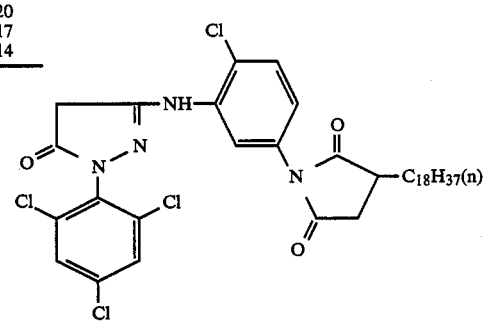

Each of the resulting samples were subjected to imagewise exposure through a sensitometric optical wedge and placed on a heat block for heating at 150° C. Ten seconds after the start of heating, the samples were subjected to overall exposure under a tungsten lamp for 10 seconds at an intensity of 500 lux. After the overall exposure, the samples were heated at 150° C. for an additional 40 seconds. The so processed samples produced positive magenta images of high contrast (as indicated by tye difference between maximum and minimum densities).

Density measurements were made by using Sakura Densitometer PDA-65, product of Konishiroku Photo Industry Co., Ltd. The results are shown in Table E-7.

TABLE E-7

| Sample No. | Emulsion | Magenta image Dmin | Magenta image Dmax |
|---|---|---|---|
| 37 | EM-1 | 0.65 | 1.31 |
| 38 | EM-2 | 0.56 | 1.38 |
| 39 | EM-3 | 0.50 | 1.40 |
| 40 | EM-8 | 0.43 | 1.37 |
| 41 | EM-9 | 0.41 | 1.38 |
| 42 | EM-10 | 0.39 | 1.41 |
| 43 | EM-11 | 0.40 | 1.40 |
| 44 | EM-12 | 0.39 | 1.39 |
| 45 | EM-13 | 0.41 | 1.36 |
| 46 | EM-14 | 0.40 | 1.40 |
| 47 | EM-15 | 0.42 | 1.42 |
| 48 | EM-16 | 0.41 | 1.41 |

Table E-7 shows that good dye images were obtained from the samples of the present invention.

EXAMPLE E-22

Using the samples prepared in Examples E-1 to E-3 and E-8 to E-16, sample Nos. 49 to 60 were prepared by the following procedures.

| | | |
|---|---|---|
| (a) | one of the internal image forming silver halide emulsions made in Examples E-1 to E-3 and E-8 to E-16 | 50 g |
| (b) | gelatin dispersion of the dye providing material (Y-1) shown below | 45 ml |
| (c) | sodium 4-(diethylamino)-2-methylphenyl-sulfamate | 0.5 g |
| (d) | 10% ethanol solution of guanidinetrichloro-acetic acid | 10 ml |
| (e) | 3-methylpentane-1,3,5-triol | 7 g |
| (f) | urea | 0.05 g |
| (g) | 10% gelatin | 60 ml |
| (h) | polyvinylpyrrolidone | 6 g |
| (i) | surfactant (5% aq. sol.) | 1 ml |
| (j) | $H_2O$ | 10 ml |

The components (a) to (j) were mixed and a solution was made from the mixture by heating. The resulting solution was coated onto a subbed transparent polyethylene film (150 m) thick to give a wet thickness of 85 μm. A protective layer was formed on the emulsion coat by application of 1.5 g/m² of gelatin.

Each of sample Nos. 49 to 60 for heat-developable color photographic material was subjected to image-wise exposure under a tungsten lamp through a sensitometirc optical wedge, and placed on a heat block for heating at 150° C. Ten seconds after the start of heating, each of the samples was subjected to overall exposure under a tungsten lamp at varying intensities of $10^2$, $5\times10^2$, and $10^3$ luxes for a period of 10 seconds. After the overall exposure, the samples were heated at 150° C. for an additional 40 seconds.

The so processed samples produced not only developed silver images but also positive yellow images of high contrast (as indicated by the difference between maximum and minimum densities).

Density measurements were made by using Sakura Densitometer PDA-65, product of Konishiroku Photo Industry Co., Ltd. The results are shown in Table E-8.

Preparation of a dispersion of dye providing material (Y-1) in gelatin

A dye providing material Y-1 (10 g) having the structure shown below was uniformly dissolved in 30 g of EA and 10 g of TCP by heating at about 60° C. The resulting solution was mixed under agitation with 120 ml of a 2% aqueous gelatin solution containing 30 ml of a 5% aqueous solution of Alkanol XC (Du Pont) as a dispersant. Thereafter, the mixture was homogenized by an ultrasonic homogenizer for 10 minutes, so as to obtain a dispersion of the dye providing material in gelatin.

Dye providing material, Y-1

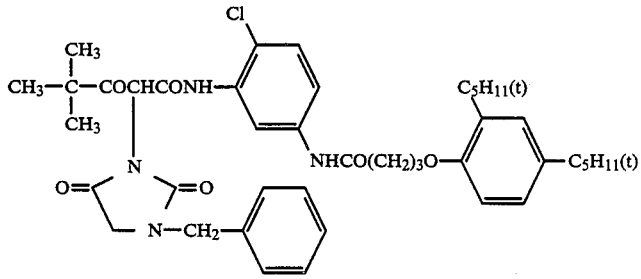

TABLE E-8

| Sample No. | Overall Exposure Emulsion | $10^2$ lux Dmin | $10^2$ lux Dmax | $5\times10^2$ lux Dmin | $5\times10^2$ lux Dmax | $10^3$ lux Dmin | $10^3$ lux Dmax |
|---|---|---|---|---|---|---|---|
| 49 | EM-1 | 0.65 | 1.27 | 0.69 | 1.38 | 0.75 | 1.41 |
| 50 | EM-2 | 0.54 | 1.30 | 0.58 | 1.41 | 0.61 | 1.44 |
| 51 | EM-3 | 0.51 | 1.32 | 0.56 | 1.43 | 0.59 | 1.47 |
| 52 | EM-8 | 0.42 | 1.34 | 0.46 | 1.45 | 0.48 | 1.48 |
| 53 | EM-9 | 0.43 | 1.38 | 0.47 | 1.49 | 0.49 | 1.52 |
| 54 | EM-10 | 0.41 | 1.33 | 0.44 | 1.44 | 0.47 | 1.46 |
| 55 | EM-11 | 0.42 | 1.34 | 0.45 | 1.45 | 0.48 | 1.48 |
| 56 | EM-12 | 0.39 | 1.32 | 0.43 | 1.43 | 0.45 | 1.46 |
| 57 | EM-13 | 0.40 | 1.37 | 0.44 | 1.46 | 0.46 | 1.49 |
| 58 | EM-14 | 0.41 | 1.36 | 0.45 | 1.45 | 0.47 | 1.47 |
| 59 | EM-15 | 0.39 | 1.35 | 0.42 | 1.43 | 0.43 | 1.46 |
| 60 | EM-16 | 0.38 | 1.35 | 0.41 | 1.42 | 0.43 | 1.45 |

Table E-8 shows that good dye images were obtained from the samples of the present invention.

EXAMPLE E-23

Using the emulsions prepared in Examples E-1 to E-3 and E-8 to E-16, sample Nos. 61 to 72 were prepared by the following procedures.

| | | |
|---|---|---|
| (a) | one of the internal image forming silver halide emulsion made in Examples E-1 to E-3 and E-8 to E-16 | 50 g |
| (b) | gelatin dispersion of the dye providing material (C-1) shown below | 40 ml |
| (c) | dispersion of 4-sulfobenzotriazole silver salt | 40 ml |
| (d) | sodium 4-(diethylamino)-2-methylphenyl-sulfamate | 0.5 g |
| (e) | gelatin | 2 g |
| (f) | 3-methyl-1,3,5-pentanetriol | 6 g |
| (g) | development accelerator (3% aq. sol.) | 5 ml |
| (h) | surfactant (5% aq. sol.) | 2 ml |
| (i) | hardener (3% aq. sol.) | 5 ml |
| (j) | $H_2O$ | 10 ml |

The components (a) to (j) were mixed and the mixture was adjusted to a pH of 5.5 while it was held at 35° C.±1° C. The resulting solution was coated onto a subbed polyethylene terephthalate film (150 μm thick) to give a silver deposit of 1.1 g/m².

Preparation of a dispersion of dye providing material (C-1) in gelatin

Thirty grams of the dye providing material (C-1) shown below was dissolved in 26 g of dioctyl phthalate and 96 g of ethyl acetate, and the resulting solution was mixed with 350 ml of a 1.7% aqueous gelatin solution containing 80 ml of a 5% aqueous solution of Alkanol XC (Du Pont). The mixture was homogenized by an ultrasonic homogenizer to prepare an oil-in-water dispersion of the dye providing material.

Dye providing material, C-1

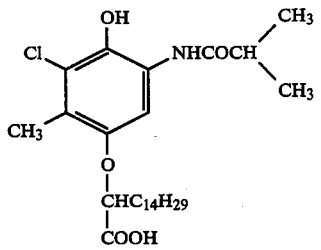

Each of the resulting samples of heat developable color photographic material was subjected to imagewise exposure under a tungsten lamp through a sensitometric optical wedge, and placed on a heat block for heating at 150° C. Ten seconds after the start of heating, the samples were subjected to overall exposure under a tungsten lamp for 10 seconds at an intensity of 100 lux and left to stand to cool down to room temperature.

A photographic baryta paper coated with a polyvinyl chloride containing latex, NIPOL G-576 (Japan Zeon Co., Ltd.) was passed through a hot (150° C.) atmosphere to provide a heat transfer image-receiving element with a smooth coat of image-receiving layer. Each of the previously overall exposed, heat developable photographic materials was superposed on this image-receiving element so that the coated surfaces were in contact with each other. The assembly was heat-developed at 150° C. for 1 minute in a commercial heat developer, Copy Mate Model II (Graphic Product Incorporation). Immediately thereafter, the image-receiving element was separated and a positive transfer cyan color image had formed on the receiving element. The maximum reflection density (Dmax) and minimum reflection density (Dmin) were measured by Sakura Densitometer PDA-65 (product of Konishiroku Photo Industry Co., Ltd.) for the positive image formed on each of the samples. The results are shown in Table E-9.

TABLE E-9

| Sample No. | Emulsion | Cyan image Dmin | Cyan image Dmax |
|---|---|---|---|
| 61 | EM-1 | 0.43 | 1.68 |

TABLE E-9-continued

| Sample No. | Emulsion | Cyan image Dmin | Cyan image Dmax |
|---|---|---|---|
| 62 | EM-2 | 0.36 | 1.73 |
| 63 | EM-3 | 0.32 | 1.75 |
| 64 | EM-8 | 0.26 | 1.71 |
| 65 | EM-9 | 0.25 | 1.72 |
| 66 | EM-10 | 0.24 | 1.74 |
| 67 | EM-11 | 0.25 | 1.73 |
| 68 | EM-12 | 0.24 | 1.71 |
| 69 | EM-13 | 0.26 | 1.70 |
| 70 | EM-14 | 0.25 | 1.75 |
| 71 | EM-15 | 0.26 | 1.76 |
| 72 | EM-16 | 0.25 | 1.75 |

Table E-9 shows that good color images were obtained from the samples of the present invention.

EXAMPLE E-24

Using the emulsions prepared in Examples E-1 to E-3 and E-8 to E-16, sample Nos. 73 to 84 were prepared by the following procedures.

| | |
|---|---|
| (a) one of the internal image forming silver halide emulsions made in Examples E-1 to E-3 and E-8 to E-16 | 50 g |
| (b) gelatin dispersion of the dye providing material, Y-2, shown below | 40 ml |
| (c) dispersion of 4-sulfobenzotriazole | |
| (d) sodium 4-(diethylamino)-2-methylphenylsulfamate | 0.5 g |
| (e) gelatin | 2 g |
| (f) polyvinylpyrrolidone (av. mol. wt. 30,000) | 3 g |
| (g) polyethylene glycol (mol. wt. 300) | 3 g |
| (h) 3-methyl-1,3,5-pentanetriol | 3 g |
| (i) $H_2O$ | 10 ml |

The components (a) to (i) were mixed and a coating solution prepared therefrom as in Example E-23 was applied to a polyethylene terephthalate film (150 μm thick) to give a silver deposit of 0.95 g/m$^2$.

Each of the resulting samples of heat-developable photographic material was subjected to imagewise exposure under a tungsten lamp through a sensitometric optical wedge, and placed on a heat block for heating at 150° C. Ten seconds after the start of heating, the samples were subjected to overall exposure under a tungsten lamp for 10 seconds at an intensity of 100 lux and then left to stand to cool down to room temperature.

Instead of the dispersion of dye providing material C-1 used in Example E-23, a dispersion of the dye providing material Y-2 (for its structure, see below) prepared by the following procedures was used: 4 g of Y-2 was dissolved in 12 ml of ethyl acetate, and the resulting solution was mixed with 30 ml of a 2.5% aqueous gelatin solution containing a surfactant, and after adding water to make a total of 60 ml, the mixture was homogenized by an ultrasonic homogenizer to prepare a dispersion of the dye providing polymer.

Dye providing material, Y-2

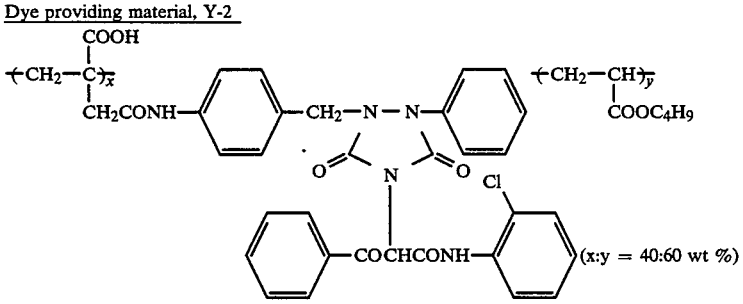

Each of the overall exposed samples was superposed on a heat transfer image-receiving element of the same type as prepared in Example E-23 so that the contact with each other. The assembly was heat-developed at 150° C. for 1 minute in Copy Mate Model II.

When the image-receiving element was separated from the sample immediately thereafter, a positive yellow transfer image had formed on the receiving element. The maximum and minimum reflection densities of the positive image were measured as in Example E-23, and the results are shown in Table E-10.

TABLE E-11

| Sample No. | Emulsion | Yellow image Dmin | Dmax |
|---|---|---|---|
| 73 | EM-1 | 0.58 | 1.66 |
| 74 | EM-2 | 0.44 | 1.70 |
| 75 | EM-3 | 0.40 | 1.73 |
| 76 | EM-8 | 0.30 | 1.69 |
| 77 | EM-9 | 0.29 | 1.70 |
| 78 | EM-10 | 0.28 | 1.73 |
| 79 | EM-11 | 0.28 | 1.72 |
| 80 | EM-12 | 0.29 | 1.70 |
| 81 | EM-13 | 0.30 | 1.71 |
| 82 | EM-14 | 0.28 | 1.70 |
| 83 | EM-15 | 0.29 | 1.75 |
| 84 | EM-16 | 0.29 | 1.76 |

Table E-10 shows that good dye images were obtained from the samples of the present invention.

EXAMPLE E-25

Instead of the dispersion o dye providing material C-1 used in sample Nos. 61 to 72 for heat-developable photographic material prepared in Example E-23, a dispersion of reducing dye providing material M-3 (for its structure, see below) prepared by the following procedures was used: 30 g of M-3 was dissolved in 30 g of dioctyl phthalate and 90 ml of ethyl acetate, and after mixing the resulting solution with an aqueous gelatin solution containing a surfactant, the mixture was homogenized with an ultrasonic homogenizer, so as to provide 500 ml of an oil-in-water dispersion of the dye providing material.

Dye providing material, M-3

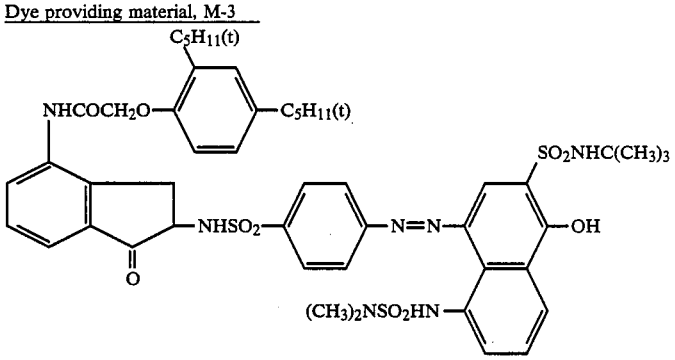

Using the dispersion of M-3 and the emulsions prepared in Examples E-1 to E-3 and E-8 to E-16, sample Nos. 85 to 96 were prepared by the following procedures.

| | | |
|---|---|---|
| (a) | one of the internal image forming silver halide emulsions made in Examples E-1 to E-3 and E-8 to E-16 | 60 g |
| (b) | dispersion of dye providing material, M-3 | 50 ml |
| (c) | trimethylolethane | 10 g |
| (d) | 10% ethanol solution of guanidinetrichloroacetic acid | 10 ml |
| (e) | polyvinylpyrrolidone (10% aq. sol.) | 30 ml |
| (f) | hardener (3% aq. sol.) | 5 ml |
| (g) | gelatin | 2 g |
| (h) | $H_2O$ | 20 ml |

The components (a) to (h) were mixed and a solution was made from the mixture by heating. The resulting solution was coated onto a subbed polyethylene terephthalate film to give a silver deposit of 1.3 g/m$^2$.

Each of the resulting samples No. 85 to No. 96 was subjected to imagewise exposure under a tungsten lamp through a sensitometric optical wedge, and placed on a heat block for heating at 150° C. Fifteen seconds after start of the heating, the samples were subjected to overall exposure under a tungsten lamp for 10 seconds at an intensity of 250 lux. The samples then were placed on a heat block for uniform heating at 150° C. for 40 seconds.

A subbed polyethylene terephthalate base (100 μm) containing a white pigment was coated with an image-receiving layer composed of a 1:1 copolymer of styrene and N-benzyl-N,N-dimethyl-N-(3-maleimidopropyl-)ammonium chloride and an acid-treated gelatin. The so prepared image-receiving element was immersed in water and superposed on the previously overall-exposed light-sensitive material in such a manner that the coated surfaces were held in contact with the imaged-receiving layer for 30 seconds. Thereafter, the image-receiving element was separated from the light-sensitive material and a positive magenta color transfer image had formed on the receiving element. The maximum density (Dmax) and minimum density (Dmin) were measured for the positive magenta color transfer image obtained from each of the samples, and the results are shown in Table E-11.

TABLE E-11

| Sample No. | Emulsion | Magenta image Dmin | Dmax |
|---|---|---|---|
| 85 | EM-1 | 0.63 | 1.57 |
| 86 | EM-2 | 0.48 | 1.61 |
| 87 | EM-3 | 0.45 | 1.62 |
| 88 | EM-8 | 0.36 | 1.68 |
| 89 | EM-9 | 0.34 | 1.70 |
| 90 | EM-10 | 0.33 | 1.71 |
| 91 | EM-11 | 0.34 | 1.71 |
| 92 | EM-12 | 0.35 | 1.70 |
| 93 | EM-13 | 0.36 | 1.72 |
| 94 | EM-14 | 0.33 | 1.71 |
| 95 | EM-15 | 0.33 | 1.73 |
| 96 | EM-16 | 0.34 | 1.74 |

TabIe E-11 shows that good dye images were obtained from the samples of the present invention.

EXAMPLE E-26

Sample Nos. 97 to 108 for heat-developable color photographic material were prepared as in Example E-25 except that 0.4 g of 1-phenyl-4-methyl-4-hydroxymethyl-3-pyrazolidinone (reducing agent) and 2 g of polyethylene glycol were added to the light-sensitive coating solution prepared in Example E-25.

These samples were treated and photographically processed as in Example E-25, and the results are shown in Table E-12.

TABLE E-12

| Sample No. | Emulsion | Magenta image Dmin | Dmax |
|---|---|---|---|
| 97 | EM-1 | 0.46 | 1.70 |
| 98 | EM-2 | 0.36 | 1.72 |
| 99 | EM-3 | 0.33 | 1.73 |
| 100 | EM-8 | 0.27 | 1.77 |
| 101 | EM-9 | 0.25 | 1.78 |
| 102 | EM-10 | 0.25 | 1.76 |
| 103 | EM-11 | 0.26 | 1.75 |
| 104 | EM-12 | 0.27 | 1.74 |
| 105 | EM-13 | 0.23 | 1.75 |
| 106 | EM-14 | 0.23 | 1.75 |
| 107 | EM-15 | 0.24 | 1.77 |
| 108 | EM-16 | 0.24 | 1.77 |

Table E-12 shows that good dye images were obtained form the samples of the present invention.

EXAMPLE E-27

A subbed transparent polyethylene terephthalate base (150 μm) was coated with the following layers in the order written, so as to make sample Nos. 109 to 117 for multi-layered, multi-color heat-developable photographic material.

(1) Red-sensitive, internal image forming silver halide emulsion layer:

This layer was composed of one of the emulsions that were prepared in Examples, E-1, E-2, E-8, E-9 and E-11 to E-16 and which comprised red-sensitized internal image forming silver halide grains (silver deposit : 2.0 g/m$^2$), 4-sulfobenzotriazole silver (silver deposit: 2.0 g/m$^2$), the cyan dye providing material C-2 shown below (1.5 g/m2), 3-d methyl-1,3,5-pentanetriol (2.5 g/m$^2$), sodium 4- (diethylamino)d-d 2-methylsulfamate (1.2 g/m$^2$), gelatin (2.0 g/m$^2$) and polyvinylpyrrolidone (2.0 g/m$^2$)

Preparation of a dispersion of cyan dye providing material (C-2) in gelatin

A dye providing material C-2 (5 g) having the structure shown below was dissolved in 15 ml of EA. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes so as to provide a dispersion of the dye providing material in gelatin at a yield of 100 g Dye providing material, C-2

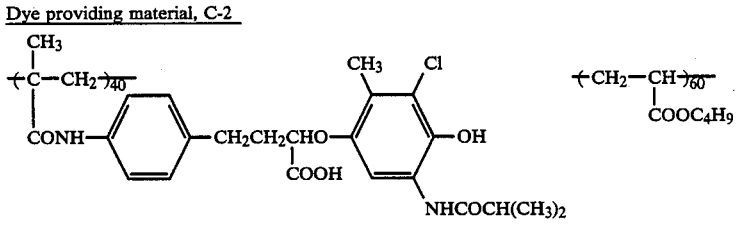

(2) Intermediate layer:

This layer was composed of gelatin (0.4 g/m$^2$) and polyvinylpyrrolidone (0.4 g/m$^2$).

(3) Green-sensitive, internal image forming silver halide emulsion layer:

This layer was composed of one of the emulsions that were prepared in Examples E-1, E-3, E-8, E-9 and E-11 to E-16 and which comprised green-sensitized internal image forming silver halide grains (silver deposit: 1.7 g/m$^2$), 4-sulfobenzotriazole silver (silver deposit: 1.7 g/m$^2$), the magenta dye providing material M-4 shown below (0.7 g/m$^2$), 3-methyl-1,3,5-pentanetriol (2.0 g/m$^2$), sodium 4-(diethylamino)-2methylsulfamate (1.0 g/m$^2$), gelatin (2.0 g/m$^2$) and polyvinylpyrrolidone (2.0 g/m$^2$).

Preparation of a dispersion of magenta dye providing material (M-4) in gelatin

A dye providing material M-4 (5 g) having the structure shown below was dissolved in 15 ml of EA. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes so as to provide a dispersion of the dye providing material in gelatin at a yield of 100 g.

Dye providing material M-4

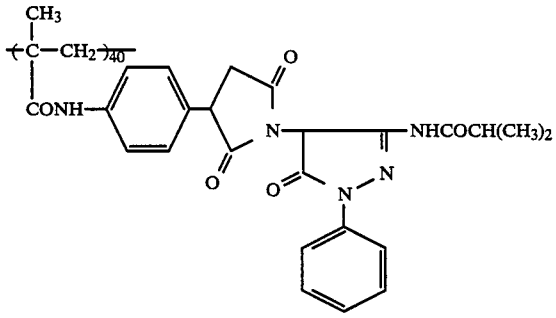

(4) Intermediate layer:

This layer was composed of gelatin (0.4 g/m$^2$) and polyvinylpyrrolidone (0.4 g/m$^2$).

(5) Blue-sensitive, internal image forming silver halide emulsion layer:

This layer was composed of one of the emulsions that were prepared in Examples E-1, E-3, E-8 and E-11 to E-16 and which comprised blue-sensitized internal image forming silver halide grains (silver deposit: 2.0 g/m$^2$), 4-sulfobenzotriazole silver (silver deposit: 2.0 g/m$^2$), the yellow dye providing material Y-2 used in Example 24 (1.5 g/m$^2$), 3-methyl-1,3,5-pentanetriol (2.5 g/m$^2$), sodium 4-(diethylamino)-2-methylsulfamate (1.2 g/m$^2$), gelatin (2.0 g/m$^2$) and polyvinylpyrrolidone (2.0 g/m$^2$).

(6) Intermediate layer:

This layer was composed of a compound having the structure shown below (0.6 g/m$^2$), gelatin (0.4 g/m$^2$) and polyvinylpyrrolidone (0.4 g/m$^2$).

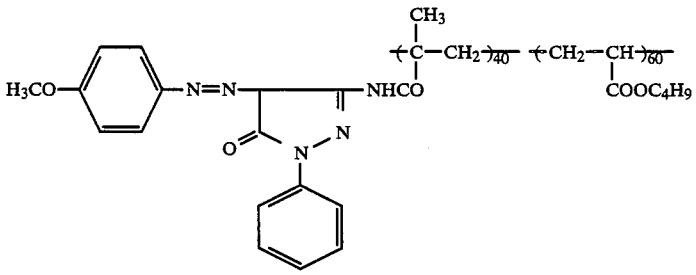

(7) Protective layer:

This layer was composed of gelatin (0.3 g/m$^2$) and glyoxal (0.03 g/m$^2$).

Each of the sample Nos. 109 to 117 was subjected to imagewise exposure under a tungsten lamp through a sensitometric optical wedge and placed on a heat block for heating at 150° C. After heating for 10 seconds, the samples were subjected to overall exposure under a tungsten lamp for 10 seconds at an intensity of 100 lux, and then left to stand to cool down to room temperature.

Each of the exposed samples were superposed on a heat transfer image-receiving element of the same type as used in Example E-23 so that the coated surfaces were in contact with each other. The assembly was heat-developed at 150° C. for 1 minute in Copy Mate Model II. Immediately thereafter, the image-receiving element was separated from the sample and a color image was found to have diffusion-transferred to the receiving element The maximum reflection density (Dmax) and minimum reflection density (Dmin) were measured by Sakura Densitometer for the positive image formed on each of the samples. The results are shown in Table E-13.

TABLE E-13

| Sample No. | Color image | Emulsion | Dmin | Dmax |
|---|---|---|---|---|
| | Cyan image | EM-1 | 0.40 | 1.82 |
| 109 | Magenta image | EM-1 | 0.38 | 1.89 |
| | Yellow image | EM-1 | 0.53 | 1.77 |
| | Cyan image | EM-2 | 0.33 | 1.83 |
| 110 | Magenta image | EM-3 | 0.30 | 1.89 |
| | Yellow image | EM-3 | 0.41 | 1.78 |
| | Cyan image | EM-8 | 0.28 | 1.85 |
| 111 | Magenta image | EM-8 | 0.24 | 1.91 |
| | Yellow image | EM-8 | 0.32 | 1.81 |
| | Cyan image | EM-9 | 0.25 | 1.85 |
| 112 | Magenta image | EM-9 | 0.22 | 1.91 |
| | Yellow image | EM-10 | 0.28 | 1.82 |
| | Cyan image | EM-11 | 0.27 | 1.83 |
| 113 | Magenta image | EM-11 | 0.24 | 1.90 |
| | Yellow image | EM-11 | 0.29 | 1.81 |
| | Cyan image | EM-12 | 0.28 | 1.82 |
| 114 | Magenta image | EM-12 | 0.25 | 1.90 |
| | Yellow image | EM-13 | 0.28 | 1.79 |
| | Cyan image | EM-14 | 0.27 | 1.83 |
| 115 | Magenta image | EM-14 | 0.25 | 1.91 |
| | Yellow image | EM-14 | 0.27 | 1.82 |
| | Cyan image | EM-15 | 0.26 | 1.81 |
| 116 | Magenta image | EM-15 | 0.24 | 1.90 |
| | Yellow image | EM-15 | 0.28 | 1.78 |
| | Cyan image | EM-16 | 0.25 | 1.80 |
| 117 | Magenta image | EM-16 | 0.23 | 1.88 |
| | Yellow image | EM-16 | 0.27 | 1.77 |

Table E-13 shows that good positive dye images were also obtained when the present invention was applied to multi-layered, heat-developable color photographic materials.

EXAMPLE F-1

Preparation of silver halide emulsions

Preparation of EM-1:

To an aqueous solution containing 80 g of gelatin and 200 ml of an aqueous solution of 1 mole of silver nitrate, 200 ml of an aqueous solution of 1.2 moles of potassium chloride was added at a controlled temperature of 40° C. over a period of 1 minute. Following 1-minute physical ripening, 200 ml of an aqueous solution of 1 mole of potassium bromide was added, and physical ripening was conducted for an additional 1 minute. Washing was made to remove the water-soluble halides. After addition of 5 g of gelatin, water was added to make a total of 400 g.

The resulting silver chlorobromide emulsion comprised grains having an average size of 0.15 pm, and is hereunder referred to as EM-1.

Preparation of EM-2:

Using the grains in the conversion type emulsion, EM-1, as cores, a core/shell emulsion was prepared by the following procedures.

To 400 g of the core emulsion (EM-1), 275 ml of an aqueous solution of 1 mole of silver nitrate, 275 ml of an aqueous solution of 1 mole of potassium bromide and 30 ml of an aqueous solution of 1 mole of potassium chloride were added simultaneously at 60.C over a period of 5 minutes so as to precipitate a shell of silver chlorobromide. After removing the water-soluble halides by washing with water, 20 g of gelatin was added and water was added to make a total of 600 g. The resulting silver chlorobromide core/ shell emulsion comprised grains having an average size of 0.2 μm, and is hereunder referred to as EM-2.

Preparation of EM-3:

Using the grains in the conversion type emulsion, EM-1, as cores, a core/shell emulsion was prepared by the repeating procedures for the preparation of EM-2 except that to 400 g of the core emulsion (EM-1), 10 ml of a 0.01% aqueous solution of potassium hexachlororidate was added. The resulting silver chlorobromide core/shell emulsion comprised grains having an average size of 0.2 μm, and is hereunder referred to as EM-3.

Preparation of EM-4:

A silver bromide core emulsion was prepared using the following solutions.

| | |
|---|---|
| Solution 1-A | |
| Ossein gelatin | 40 g |
| Distilled water | 400 ml |
| 10% Ethanol solution of sodium salt of polyisopropylene-polyethyleneoxy-disuccinate ester | 30 ml |
| KBr | 2 g |
| 1N $HNO_3$ | 76 ml |
| Solution 1-B | |
| $AgNO_3$ | 1200 g |
| 0.1 N $HNO_3$ | 60 ml |
| Distilled water to make | 1750 ml |
| Solution 1-C | |
| Ossein gelatin | 35 g |
| KBr | 810 g |
| 10% Ethanol solution of sodium salt of polyisopropylene-polyethyleneoxy-disuccinate ester | 35 ml |
| Distilled water to make | 1750 ml |

At 40° C., solution 1-B and 1-C were added to solution 1-A over a period of 32 minutes by the double-jet method using a mixer/agitator of the type shown in Unexamined Published Japanese Patent Application Nos. 92523/1982 and 92524/1982. The rate of addition was increased with time in a zigzag fashion as shown in Table F-B on the next page. The pAg value for solution 1-A was controlled to be at 9.0 by addition of a 20% aqueous KBr solution. Measurement of pAg values was conducted with a metallic silver electrode and a double junction type saturated Ag/AgCl reference electrode.

Solutions 1-B, 1-C and 20% aqueous KBr solution were added using a roller tube metering pump capable of variable flow rates.

The thus prepared emulsion was washed with water to remove any water-soluble halides. Thereafter, 130 g of gelatin was added and water was added to make a total of 6000 g. The resulting silver bromide core emulsion comprised grains having an average size of 0.13 μm, and is hereunder referred to as EM-4.

TABLE F-B

| | Rate of addition (ml/min) | |
|---|---|---|
| Time (min) | Solution 1-B | Solution 1-C |
| 0 | 15.1 | 15.1 |
| 5 | 15.9 | 15.9 |
| 10 | 27.0 | 27.0 |
| 14 | 40.0 | 40.0 |
| 16.5 | 49.3 | 49.3 |
| 20.5 | 65.8 | 65.8 |
| 22.5 | 74.0 | 74.0 |
| 26.5 | 94.0 | 94.0 |
| 29.0 | 107.5 | 107.5 |
| 31.0 | 118.5 | 118.5 |
| 32.0 | 126.0 | 126.0 |

Preparation of EM-5:

To the silver bromide grains in EM-4 having an average size of 0.13 μm, 50 mg per mole of silver of sodium thiosulfate and 10 mg per mole of silver of potassium chloroaurate were added, and the grain surfaces were chemically sensitized by heating at 60° C. for 90 minutes. A stabilizer and water were added to make a total of 1500 g (containing 1 mole of silver). Using the thus chemically sensitized silver bromide grains as cores, an internal image forming silver bromide core/shell emulsion was prepared from the following solutions.

| | |
|---|---|
| Solution 2-A | |
| Ossein gelatin | 5 g |
| Distilled water | 3300 ml |
| 10% Ethanol solution of sodium salt of polyisopropylene-polyethyleneoxy-disuccinate ester | 10 ml |
| 28% aqueous ammonia solution | 60 ml |
| 56% aqueous acetic acid solution | 50 ml |
| Chemically sensitized silver bromide emulsion | 1500 g |
| Solution 2-B | |
| $AgNO_3$ | 280 g |
| 28% aqueous ammonia solution | 220 ml |
| Distilled water to make | 560 ml |
| Solution 2-C | |
| Ossein gelatin | 5 g |
| KBr | 210 g |
| 10% Ethanol solution of sodium salt of polyisopropylene-polyethyleneoxy-disuccinate ester | 10 ml |
| Distilled water to make | 560 ml |

At 40° C., solutions 2-B and 2-C were added to solution 2-A over a period of 20 minutes by the double-jet method using a mixer/agitator of the type shown in Unexamined Published Japanese Patent Application Nos. 92523/1982 and 92524/1982. The rate of addition was changed with time in a zigzag fashion as shown in Table F-C below.

Throughout the addition period, the pAg value was controlled to be at 9.0 by addition of a 20% aqueous KBr solution, and the pH value was controlled at 7.5 by addition of a 28% aqueous acetic acid solution. The pAg values were measured by the same method as described in the Preparation of EM-4, while the pH measurement was conducted with a glass electrode and a double junction type saturated Ag/AgCl reference electrode. The respective solutions were added using a roller tube metering pump capable of variable flow rates.

The thus prepared emulsion was washed with water to remove any water-soluble halides. Thereafter, 50 g of gelatin was added and water was added to make a total of 2200 g. The resulting silver bromide core/shell emulsion comprised grains having an average size of 0.18 μm, and is hereunder referred to as EM-5.

TABLE F-C

| Time (min) | Rate of addition (ml/min) Solution 2-B | Solution 2-C |
|---|---|---|
| 0 | 12.2 | 12.2 |
| 1 | 13.5 | 13.5 |
| 2 | 15.0 | 15.0 |
| 5 | 20.1 | 20.1 |
| 10 | 28.8 | 28.8 |
| 15 | 36.0 | 36.0 |
| 20 | 37.4 | 37.4 |

Preparation of EM-6:

The silver bromide grains in EM-4 having an average size of 0.13 μm were chemically sensitized on the surfaces as in the Preparation of EM-5.

Using the thus chemically sensitized silver bromide grains as cores, an internal image forming silver iodobromide core/shell emulsion containing 2 mol % AgI in the shell was prepared as in the Preparation of EM-5 except that solution 2-C was replaced by the following solution 3-C.

| Solution 3-C | |
|---|---|
| Ossein gelatin | 5 g |
| KBr | 210 g |
| KI | 5.5 g |
| 10% Ethanol solution of sodium salt of polyisopropylene-polyethyleneoxy-disuccinate ester | 10 ml |
| Distilled water | to make 560 ml |

The resulting silver iodobromide core/shell emulsion comprised grains having an average size of 0.18 μm, and is hereunder referred to as EM-6.

Preparation of EM-7:

An internal image forming silver chloride core/shell emulsion was prepared by the following procedures.

To an aqueous solution containing 80 g of gelatin and 200 ml of an aqueous solution of 1 mole of silver nitrate, 200 ml of an aqueous solution of 1.2 moles of potassium chloride was added at a controlled temperature of 40° C. over a period of 1 minute. After removing the water-soluble halides by washing, 5 g of gelatin was added and water was added to make a total of 400 g. As a result, silver chloride core grains having an average size of 0.15 μm were obtained.

To these core grains, 40 mg per mole of silver of sodium thiosulfate and 8 mg per mole of silver of chloroauric acid were added and the surfaces of the grains were chemically sensitized by heating at 55° C. for 100 minutes. A stabilizer and water were added to make a total of 2500 g (containing 1 mole of silver). To 500 g of the chemically sensitized silver chloride grains, 275 mg of an aqueous solution of 1 mole of silver nitrate and 275 ml of an aqueous solution of 1.1 moles of potassium chloride were simultaneously added over a period of 10 minutes, so as to precipitate a shell of silver chloride. Washing was made to remove the water-soluble halides. After adding 20 g of gelatin, water was added to make a total of 600 g. The resulting internal image forming silver chloride core/shell emulsion comprised grains having an average size of 0.2 μm, and is hereunder referred to as EM-7.

Preparation of EM-8:

A silver chlorobromide core emulsion with 5 mol % AgCl was prepared as in the Preparation of EM-5 except that solution 2-C was replaced by solution 4-C having the following formulation.

| Solution 4-C | |
|---|---|
| Ossein gelatin | 35 g |
| KBr | 800 g |
| KCl | 26.3 g |
| 10% Ethanol solution of sodium salt of polyisopropylene-polyethyleneoxy-disuccinate ester | 35 ml |
| Distilled water | to make 1750 ml |

The resulting silver chlorobromide core emulsion comprised grains having an average size of 0.10 μm.

To the obtained silver chlorobromide core grains, 50 mg per mole of silver of sodium thiosulfate and 10 mg per mole of silver of chloroauric acid were added, and the grain surfaces were chemically sensitized by heating at 56° C. for 100 minutes. A stabilizer and water were added to make a total of 1500 g (containing 1 mole of silver). Using the thus chemically sensitized silver chlorobromide grains as cores, an internal image forming silver chlorobromide core/shell emulsion with 5 mol % AgCl in the shell was prepared as in the Preparation of EM-5 except that solutions 2-B and 2-C were replaced by solutions 5-B and 5-C having the following formulations.

| Solution 5-B | |
|---|---|
| $AgNO_3$ | 403 g |
| Ammonia (28% aq. sol.) | 317 ml |
| Distilled water | to make 806 ml |

| Solution 5-C | |
|---|---|
| Ossein gelatin | 7 g |
| KBr | 190 g |
| KCl | 9 g |
| 10% Ethanol solution of sodium salt of polyisopropylene-polyethyleneoxy-disuccinate ester | 15 ml |
| Distilled water | to make 806 ml |

The resulting silver chlorobromide core/shell emulsion comprised grains having an average size of 0.15 μm, and is hereunder referred to as EM-8.

Preparation of coating solutions

To each of the emulsions EM-1 to EM-8 thus prepared, a surfactant (di-2-ethylhexylsodium sulfosuccinate) and a hardener (formaldehyde) were added. To the mixture, one of the foggants listed in Table F-1 was added in the form of a solution in N-dimethylformamide. The resulting coating solution was applied to a subbed polyethylene terephthalate (PET) base (150 μm) to give a silver deposit of 2.0 g/m$^2$, and dried.

Each of the resulting samples was subjected to image-wise exposure through a sensitometric optical wedge and placed on a heat block for heating at 30° C., 120° C., 140° C. or 160° C. for 70 seconds. Each of the exposed samples was developed at 20° C. for 5 minutes by a developer having the following formulation.

| Developer formulation | |
|---|---|
| Methol | 2.5 g |
| Ascorbid acid | 10 g |

-continued

| Developer formulation | |
|---|---|
| Potassium bromide | 1 g |
| Sodium metaborate | 35 g |
| Water | to make 1000 ml |

The samples then were fixed, washed and dried by the customary procedures.

The transmission density for the exposed and unexposed areas of each sample was measured by Sakura photoelectric densitometer, PDA-65, and the results are showing in Table F-1.

TABLE F-1

| | | | | Heating Tempurature | | | | | | | |
|---|---|---|---|---|---|---|---|---|---|---|---|
| | | | | 30° | | 120° | | 140 ° | | 160° | |
| | | Foggant | | | | | | | | | |
| Sample No. | Emulsion (EM) No. | Compound No. | Amount (g/l EM) | exposed area | un-exposed area | exposed area | un-exposed area | exposed area | un-exposed area | exposed area | un-exposed area |
| 1-1 (Comp.1) | 1 | — | — | 0.01 | 0.01 | 0.01 | 0.01 | 0.02 | 0.01 | 0.03 | 0.01 |
| 1-2 (Comp.2) | 2 | — | — | 0.01 | 0.01 | 0.01 | 0.01 | 0.02 | 0.01 | 0.03 | 0.01 |
| 1-3 (Comp.3) | 3 | — | — | 0.01 | 0.01 | 0.01 | 0.01 | 0.02 | 0.01 | 0.03 | 0.01 |
| 1-4 (Comp.4) | 5 | — | — | 0.01 | 0.01 | 0.01 | 0.01 | 0.02 | 0.01 | 0.03 | 0.01 |
| 1-5 (Comp.5) | 6 | — | — | 0.01 | 0.01 | 0.01 | 0.01 | 0.02 | 0.01 | 0.03 | 0.01 |
| 1-6 (Comp.6) | 7 | — | — | 0.01 | 0.01 | 0.01 | 0.01 | 0.02 | 0.01 | 0.03 | 0.01 |
| 1-7 (Comp.7) | 8 | — | — | 0.01 | 0.01 | 0.01 | 0.01 | 0.02 | 0.01 | 0.02 | 0.01 |
| 1-8 | 1 | 11 | 0.10 | 0.01 | 0.01 | 0.19 | 0.32 | 0.21 | 0.48 | 0.27 | 0.61 |
| 1-9 | 1 | 11 | 1.00 | 0.01 | 0.01 | 0.20 | 0.39 | 0.24 | 0.51 | 0.32 | 0.65 |
| 1-10 | 1 | 44 | 0.01 | 0.01 | 0.01 | 0.19 | 0.38 | 0.22 | 0.52 | 0.28 | 0.62 |
| 1-11 | 1 | 44 | 0.10 | 0.01 | 0.01 | 0.22 | 0.47 | 0.24 | 0.58 | 0.32 | 0.68 |
| 1-12 | 1 | 53 | 0.01 | 0.01 | 0.01 | 0.18 | 0.38 | 0.21 | 0.52 | 0.26 | 0.66 |
| 1-13 | 1 | 53 | 0.10 | 0.01 | 0.01 | 0.20 | 0.47 | 0.23 | 0.57 | 0.31 | 0.69 |
| 1-14 | 1 | 62 | 0.01 | 0.01 | 0.01 | 0.19 | 0.40 | 0.21 | 0.51 | 0.27 | 0.68 |
| 1-15 | 1 | 62 | 0.10 | 0.01 | 0.01 | 0.20 | 0.49 | 0.23 | 0.58 | 0.32 | 0.71 |
| 1-16 | 2 | 11 | 0.10 | 0.01 | 0.01 | 0.15 | 0.30 | 0.19 | 0.51 | 0.21 | 0.59 |
| 1-17 | 2 | 11 | 1.00 | 0.01 | 0.01 | 0.16 | 0.37 | 0.22 | 0.63 | 0.24 | 0.72 |
| 1-18 | 2 | 44 | 0.01 | 0.01 | 0.01 | 0.17 | 0.40 | 0.19 | 0.62 | 0.21 | 0.65 |
| 1-19 | 2 | 44 | 0.10 | 0.01 | 0.01 | 0.18 | 0.46 | 0.22 | 0.68 | 0.23 | 0.81 |
| 1-20 | 2 | 53 | 0.01 | 0.01 | 0.01 | 0.15 | 0.39 | 0.18 | 0.61 | 0.20 | 0.70 |
| 1-21 | 2 | 53 | 0.10 | 0.01 | 0.01 | 0.17 | 0.47 | 0.20 | 0.67 | 0.22 | 0.82 |
| 1-22 | 2 | 62 | 0.01 | 0.01 | 0.01 | 0.15 | 0.38 | 0.18 | 0.61 | 0.20 | 0.69 |
| 1-23 | 2 | 62 | 0.10 | 0.01 | 0.01 | 0.17 | 0.49 | 0.20 | 0.69 | 0.22 | 0.85 |
| 1-24 | 3 | 11 | 0.10 | 0.01 | 0.01 | 0.13 | 0.45 | 0.15 | 0.51 | 0.16 | 0.60 |
| 1-25 | 3 | 11 | 1.00 | 0.01 | 0.01 | 0.14 | 0.58 | 0.16 | 0.62 | 0.17 | 0.70 |
| 1-26 | 3 | 44 | 0.01 | 0.01 | 0.01 | 0.15 | 0.51 | 0.16 | 0.63 | 0.17 | 0.70 |
| 1-27 | 3 | 44 | 0.10 | 0.01 | 0.01 | 0.17 | 0.63 | 0.18 | 0.76 | 0.19 | 0.83 |
| 1-28 | 3 | 53 | 0.01 | 0.01 | 0.01 | 0.13 | 0.53 | 0.15 | 0.64 | 0.16 | 0.72 |
| 1-29 | 3 | 53 | 0.10 | 0.01 | 0.01 | 0.16 | 0.64 | 0.17 | 0.78 | 0.18 | 0.88 |
| 1-30 | 3 | 62 | 0.01 | 0.01 | 0.01 | 0.13 | 0.53 | 0.15 | 0.65 | 0.16 | 0.73 |
| 1-31 | 3 | 62 | 0.10 | 0.01 | 0.01 | 0.16 | 0.62 | 0.17 | 0.79 | 0.18 | 0.89 |
| 1-32 | 5 | 11 | 0.10 | 0.01 | 0.01 | 0.12 | 0.45 | 0.14 | 0.52 | 0.15 | 0.61 |
| 1-33 | 5 | 11 | 1.00 | 0.01 | 0.01 | 0.13 | 0.46 | 0.15 | 0.68 | 0.16 | 0.76 |
| 1-34 | 5 | 44 | 0.01 | 0.01 | 0.01 | 0.14 | 0.51 | 0.15 | 0.63 | 0.15 | 0.72 |
| 1-35 | 5 | 44 | 0.10 | 0.01 | 0.01 | 0.15 | 0.62 | 0.17 | 0.73 | 0.17 | 0.82 |
| 1-36 | 5 | 53 | 0.01 | 0.01 | 0.01 | 0.13 | 0.55 | 0.14 | 0.67 | 0.15 | 0.75 |
| 1-37 | 5 | 53 | 0.10 | 0.01 | 0.01 | 0.14 | 0.63 | 0.15 | 0.76 | 0.16 | 0.87 |
| 1-38 | 5 | 62 | 0.01 | 0.01 | 0.01 | 0.13 | 0.56 | 0.14 | 0.67 | 0.15 | 0.76 |
| 1-39 | 5 | 62 | 0.10 | 0.01 | 0.01 | 0.14 | 0.63 | 0.15 | 0.78 | 0.16 | 0.88 |
| 1-40 | 6 | 11 | 0.10 | 0.01 | 0.01 | 0.12 | 0.46 | 0.14 | 0.56 | 0.14 | 0.63 |
| 1-41 | 6 | 11 | 1.00 | 0.01 | 0.01 | 0.13 | 0.48 | 0.15 | 0.69 | 0.16 | 0.76 |
| 1-42 | 6 | 44 | 0.01 | 0.01 | 0.01 | 0.13 | 0.51 | 0.15 | 0.64 | 0.15 | 0.72 |
| 1-43 | 6 | 44 | 0.10 | 0.01 | 0.01 | 0.14 | 0.67 | 0.16 | 0.73 | 0.17 | 0.83 |
| 1-44 | 6 | 53 | 0.01 | 0.01 | 0.01 | 0.13 | 0.56 | 0.14 | 0.66 | 0.15 | 0.77 |
| 1-45 | 6 | 53 | 0.10 | 0.01 | 0.01 | 0.15 | 0.67 | 0.16 | 0.78 | 0.17 | 0.87 |
| 1-46 | 6 | 62 | 0.01 | 0.01 | 0.01 | 0.13 | 0.58 | 0.14 | 0.69 | 0.15 | 0.77 |
| 1-47 | 6 | 62 | 0.10 | 0.01 | 0.01 | 0.15 | 0.69 | 0.16 | 0.81 | 0.17 | 0.89 |
| 1-48 | 7 | 11 | 0.10 | 0.01 | 0.01 | 0.13 | 0.48 | 0.14 | 0.57 | 0.15 | 0.63 |
| 1-49 | 7 | 11 | 1.00 | 0.01 | 0.01 | 0.13 | 0.57 | 0.15 | 0.69 | 0.16 | 0.75 |
| 1-50 | 7 | 44 | 0.01 | 0.01 | 0.01 | 0.14 | 0.53 | 0.15 | 0.66 | 0.15 | 0.73 |
| 1-51 | 7 | 44 | 0.10 | 0.01 | 0.01 | 0.14 | 0.65 | 0.16 | 0.74 | 0.17 | 0.82 |
| 1-52 | 7 | 53 | 0.01 | 0.01 | 0.01 | 0.13 | 0.61 | 0.14 | 0.68 | 0.15 | 0.77 |
| 1-53 | 7 | 53 | 0.10 | 0.01 | 0.01 | 0.14 | 0.64 | 0.15 | 0.76 | 0.16 | 0.87 |

TABLE F-1-continued

| Sample No. | Emulsion (EM) No. | Foggant Compound No. | Foggant Amount (g/l EM) | Heating Tempurature 30° exposed area | 30° un-exposed area | 120° exposed area | 120° un-exposed area | 140° exposed area | 140° un-exposed area | 160° exposed area | 160° un-exposed area |
|---|---|---|---|---|---|---|---|---|---|---|---|
| 1-54 | 7 | 62 | 0.01 | 0.01 | 0.01 | 0.13 | 0.57 | 0.14 | 0.69 | 0.15 | 0.78 |
| 1-55 | 7 | 62 | 0.10 | 0.01 | 0.01 | 0.14 | 0.65 | 0.15 | 0.79 | 0.16 | 0.90 |
| 1-56 | 8 | 11 | 0.10 | 0.01 | 0.01 | 0.12 | 0.42 | 0.14 | 0.58 | 0.15 | 0.65 |
| 1-57 | 8 | 11 | 1.00 | 0.01 | 0.01 | 0.13 | 0.47 | 0.15 | 0.69 | 0.16 | 0.75 |
| 1-58 | 8 | 44 | 0.01 | 0.01 | 0.01 | 0.14 | 0.50 | 0.15 | 0.68 | 0.15 | 0.74 |
| 1-59 | 8 | 44 | 0.10 | 0.01 | 0.01 | 0.14 | 0.57 | 0.16 | 0.72 | 0.17 | 0.85 |
| 1-60 | 8 | 53 | 0.01 | 0.01 | 0.01 | 0.13 | 0.61 | 0.14 | 0.69 | 0.15 | 0.79 |
| 1-61 | 8 | 53 | 0.10 | 0.01 | 0.01 | 0.14 | 0.69 | 0.15 | 0.80 | 0.16 | 0.88 |
| 1-62 | 8 | 62 | 0.01 | 0.01 | 0.01 | 0.13 | 0.60 | 0.14 | 0.72 | 0.15 | 0.79 |
| 1-63 | 8 | 62 | 0.10 | 0.01 | 0.01 | 0.14 | 0.70 | 0.15 | 0.83 | 0.16 | 0.93 |

As is clear from Table F-1, the samples of silver halide photographic material having internal image forming silver halide emulsion layers containing foggant compound No. 11, 44, 53 or 62 in accordance with the present invention were capable of producing superior positive images when they were heated after imagewise exposure and before development. Similarly good results were obtained from other foggant compounds that are not shown in Table F-1 but which were within the scope of the present invention, as well as from the combinations of two or more of such compounds.

EXAMPLE F-2

To each of the emulsions prepared in Example F-1 were added a dispersion of the dye image providing material M-1 (0.8 g/m$^2$) shown below, a surfactant (di-2-ethylhexylsodium sulfosuccinate) and a hardener (formaldehyde). To the mixtures, foggant compound No. 11, 44, 53 or 62 within the scope of the present invention was added in the form of a solution in N,N-dimethylformamide. Each of the resulting coating solutions was applied to a subbed polyethylene terephthalate (PET) base to give a silver deposit of 2.0 g/m$^2$, and dried.

Preparation of a dispersion of dye image providing material (M-1) in gelatin A dye image providing material M-1 (10 g) having the structure shown below was uniformly dissolved in 30 g of ethyl acetate and 15 g of tricresyl phosphate (TC) by heating at about 50° C. The resulting solution was added to 400 ml of a 7.5% aqueous gelatin solution containing 30 ml of a 5% aqueous solution of Alkanol XC (Du Pont) and the two solutions were mixed under agitation. Thereafter, the mixture was homogenized by an ultrasonic homegenizer for 30 minutes and ethyl acetate was removed, so as to obtain a dispersion of the dye providing material in gelatin at a yield of 600 g.

Each of the resulting samples was subjected to imagewise exposure through a sensitometric optical wedge and placed on a heat block for heating at 30° C., 120° C., 140° C. or 160° C. for 70 seconds. The samples were subsequently processed by the scheme shown below, so as to obtain samples carrying dye images.

| Processing steps (30° C.) | Time |
|---|---|
| Color development | 3 min and 30 sec |
| First washing | 1 min and 00 sec |
| Bleach-fixing | 1 min and 30 sec |
| Second washing | 1 min and 00 sec |

The respective processing solutions had the following formulations.

| Color development | |
|---|---|
| 4-Amino-3-methyl-N—(β-methanesulfonamidoethyl)aniline sulfate | 5 g |
| Sodium sulfite (anhydrous) | 2 g |
| Sodium carbonate (monohydrate) | 15 g |
| Potassium bromide | 1 g |
| Benzyl alcohol | 10 ml |
| Water | to make 1000 ml |
| (pH adjusted to 10.2 with potassium hydroxide) | |

| Bleach-fixing solution | |
|---|---|
| Ethylenediaminetetraacetic acid iron (III) ammonium dihydrate | 60 g |
| Ethylenediaminetetraacetic acid | 3 g |
| Sodium thiosulfate (70% aq. sol.) | 100 ml |
| Ammonium sulfite (40% aq. sol.) | 27.5 ml |
| Water | to make 1000 ml |
| (pH adjusted to 7.10 with potassium carbonate) | |

The density for the exposed and unexposed areas of the positive magenta color image formed in each of the samples was measured, and the results are shown in Table F-2.

Dye providing material, M-1

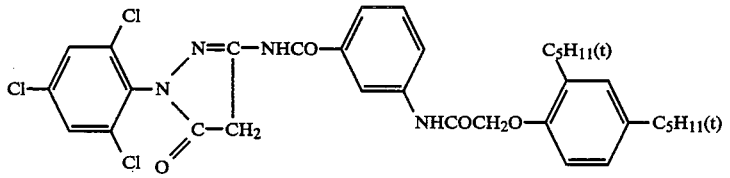

TABLE F-2

| Sample No. | Emulsion (EM) No. | Foggant Compound No. | Foggant Amount (g/l EM) | Heating Temperature 30° exposed area | 30° un-exposed area | 120° exposed area | 120° un-exposed area | 140° exposed area | 140° un-exposed area | 160° exposed area | 160° un-exposed area |
|---|---|---|---|---|---|---|---|---|---|---|---|
| 2-1 (Comp. 8) | 1 | — | — | 0.08 | 0.08 | 0.10 | 0.09 | 0.11 | 0.10 | 0.13 | 0.10 |
| 2-2 (Comp. 9) | 3 | — | — | 0.08 | 0.08 | 0.09 | 0.09 | 0.10 | 0.09 | 0.10 | 0.09 |
| 2-3 (Comp. 10) | 8 | — | — | 0.08 | 0.08 | 0.09 | 0.09 | 0.10 | 0.09 | 0.10 | 0.09 |
| 2-4 | 1 | 11 | 0.10 | 0.08 | 0.08 | 0.33 | 0.78 | 0.36 | 0.90 | 0.40 | 1.00 |
| 2-5 | 1 | 11 | 1.00 | 0.08 | 0.08 | 0.39 | 1.01 | 0.46 | 1.10 | 0.52 | 1.25 |
| 2-6 | 1 | 44 | 0.01 | 0.08 | 0.08 | 0.31 | 1.01 | 0.36 | 1.03 | 0.40 | 1.07 |
| 2-7 | 1 | 44 | 0.10 | 0.08 | 0.08 | 0.32 | 1.10 | 0.40 | 1.24 | 0.48 | 1.32 |
| 2-8 | 1 | 53 | 0.01 | 0.08 | 0.08 | 0.24 | 1.10 | 0.30 | 1.32 | 0.32 | 1.42 |
| 2-9 | 1 | 53 | 0.10 | 0.08 | 0.08 | 0.30 | 1.39 | 0.35 | 1.44 | 0.38 | 1.45 |
| 2-10 | 1 | 62 | 0.01 | 0.08 | 0.08 | 0.25 | 0.95 | 0.30 | 1.29 | 0.33 | 1.38 |
| 2-11 | 1 | 62 | 0.10 | 0.08 | 0.08 | 0.26 | 1.30 | 0.32 | 1.42 | 0.34 | 1.46 |
| 2-12 | 3 | 11 | 0.10 | 0.08 | 0.08 | 0.20 | 0.88 | 0.24 | 1.01 | 0.26 | 1.06 |
| 2-13 | 3 | 11 | 1.00 | 0.08 | 0.08 | 0.22 | 1.12 | 0.26 | 1.18 | 0.27 | 1.29 |
| 2-14 | 3 | 44 | 0.01 | 0.08 | 0.08 | 0.20 | 1.06 | 0.23 | 1.36 | 0.25 | 1.40 |
| 2-15 | 3 | 44 | 0.10 | 0.08 | 0.08 | 0.22 | 1.38 | 0.25 | 1.41 | 0.27 | 1.49 |
| 2-16 | 3 | 53 | 0.01 | 0.08 | 0.08 | 0.12 | 1.30 | 0.13 | 1.45 | 0.15 | 1.52 |
| 2-17 | 3 | 53 | 0.10 | 0.08 | 0.08 | 0.14 | 1.45 | 0.16 | 1.52 | 0.18 | 1.58 |
| 2-18 | 3 | 62 | 0.01 | 0.08 | 0.08 | 0.12 | 1.32 | 0.14 | 1.46 | 0.15 | 1.55 |
| 2-19 | 3 | 62 | 0.10 | 0.08 | 0.08 | 0.14 | 1.46 | 0.16 | 1.53 | 0.17 | 1.58 |
| 2-20 | 8 | 11 | 0.10 | 0.08 | 0.08 | 0.16 | 0.90 | 0.17 | 1.05 | 0.17 | 1.08 |
| 2-21 | 8 | 11 | 1.00 | 0.08 | 0.08 | 0.22 | 1.14 | 0.26 | 1.22 | 0.28 | 1.34 |
| 2-22 | 8 | 44 | 0.01 | 0.08 | 0.08 | 0.19 | 1.10 | 0.21 | 1.30 | 0.24 | 1.39 |
| 2-23 | 8 | 44 | 0.10 | 0.08 | 0.08 | 0.21 | 1.34 | 0.23 | 1.40 | 0.25 | 1.48 |
| 2-24 | 8 | 53 | 0.01 | 0.08 | 0.08 | 0.12 | 1.32 | 0.13 | 1.48 | 0.16 | 1.53 |
| 2-25 | 8 | 53 | 0.10 | 0.08 | 0.08 | 0.13 | 1.47 | 0.15 | 1.54 | 0.17 | 1.56 |
| 2-26 | 8 | 62 | 0.01 | 0.08 | 0.08 | 0.12 | 1.33 | 0.14 | 1.49 | 0.15 | 1.57 |
| 2-27 | 8 | 62 | 0.10 | 0.08 | 0.08 | 0.14 | 1.46 | 0.16 | 1.55 | 0.17 | 1.59 |

As is clear from Table F-2, the samples of silver halide photographic material having internal image forming silver halide emulsion layers containing foggant compound No. 11, 44, 53 or 62 in accordance with the present invention were capable of producing superior positive images when they were heated after imagewise exposure and before development. Similarly good results were obtained from other emulsions and foggant compounds that are not shown in Table F-2 but which were within the scope of the present invention, as well as from the combinations of two or more of such compounds.

EXAMPLE F-3

To each of the emulsions prepared in Example F-1, illustrative reducing dye providing material (5) (1.5 g/m$^2$), a reducing agent, or 1-phenyl-4-methyl-4-hydroxymethyl-3-pyrazolidinone (0.2 g/m$^2$), trimethylolethane (3.0 g/m$^2$), guanidinetrichloroacetic acid (0.6 g/m$^2$), polyvinylpyrrolidone (1.5 g/m$^2$), a surfactant (di-2-ethylhexylsodium sulfosuccinate) and a hardener (formaldehyde) were added. To the mixtures, foggant compound No. 5, 48, 52 or 59 within the scope of the present invention was added. Each of the resulting coating solutions was applied to a polyethylene terephthalate (PET) base (150 μm thick) to give a silver deposit of 2.0 g/m$^2$, and dried.

Preparation of a dispersion of magenta reducing dye providing material (5) in gelatin An illustrative reducing dye providing material (5) (30 g) was dissolved in 30 g of dioctyl phthalate and 90 ml of ethyl acetate. The resulting solution was added to 200 ml of a 10% aqueous gelatin solution containing Alkanol XC and the two solutions were mixed under agitation. The mixture was homogenized by an ultrasonic homogenizer for 30 minutes and the ethyl acetate was removed, so as to obtain a dispersion of the reducing dye providing material (5) in gelatin at a yield of 500 g.

Each of the resulting samples was subjected to imagewise exposure through a sensitometric optical wedge, and placed on a heat block for heating at 30° C., 120° C., 140° C. or 160° C. for 70 seconds.

A subbed polyethylene terephthalate (PET) base (100 μm) containing a white pigment was coated with an image-receiving layer composed of the mordant copolymer shown below (3 g/m$^2$) and an acid-treated gelatin (3 g/m$^2$). The so prepared image-receiving element was immersed in water and superposed on the previously prepared light-sensitive material in such a manner that the coated surfaces were held in contact with the image-receiving layer for 30 seconds. Thereafter, the image-receiving element was separated from the light-sensitive material and a positive magenta color transfer image had formed on the receiving element. The maximum density (Dmax) and minimum density (Dmin) were measured for the positive magenta color transfer image obtained from each of the samples, and the results are shown in Table F-3.

Mordant copolymer

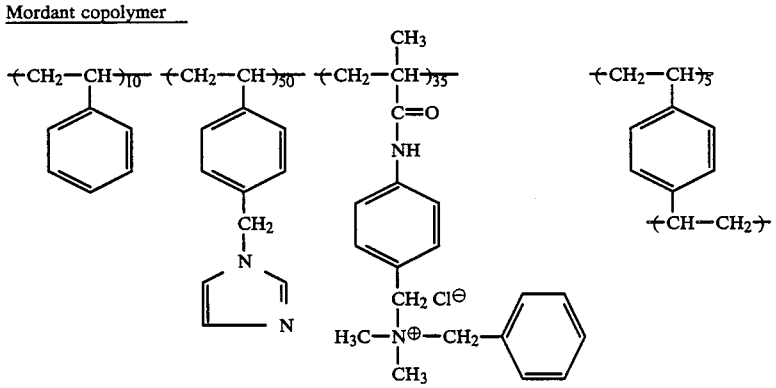

TABLE F-3

| Sample No. | Emulsion (EM) No. | Foggant Compound No. | Foggant Amount (g/l EM) | Heating Temperature 30° exposed area | 30° un-exposed area | 120° exposed area | 120° un-exposed area | 140° exposed area | 140° un-exposed area | 160° exposed area | 160° un-exposed area |
|---|---|---|---|---|---|---|---|---|---|---|---|
| 3-1 (Comp. 11) | 1 | — | — | 0.21 | 0.21 | 0.20 | 0.20 | 0.20 | 0.20 | 0.21 | 0.20 |
| 3-2 (Comp. 12) | 3 | — | — | 0.20 | 0.20 | 0.20 | 0.20 | 0.20 | 0.20 | 0.20 | 0.20 |
| 3-3 (Comp. 13) | 6 | — | — | 0.19 | 0.19 | 0.20 | 0.20 | 0.20 | 0.20 | 0.20 | 0.20 |
| 3-4 | 1 | 5 | 0.20 | 0.21 | 0.21 | 0.26 | 1.36 | 0.32 | 1.56 | 0.41 | 1.59 |
| 3-5 | 1 | 5 | 2.00 | 0.21 | 0.21 | 0.30 | 1.42 | 0.36 | 1.58 | 0.47 | 1.70 |
| 3-6 | 1 | 48 | 0.01 | 0.21 | 0.21 | 0.25 | 1.36 | 0.32 | 1.58 | 0.39 | 1.60 |
| 3-7 | 1 | 48 | 0.10 | 0.21 | 0.21 | 0.29 | 1.44 | 0.35 | 1.63 | 0.41 | 1.72 |
| 3-8 | 1 | 52 | 0.01 | 0.21 | 0.21 | 0.25 | 1.60 | 0.27 | 1.66 | 0.32 | 1.71 |
| 3-9 | 1 | 52 | 0.10 | 0.21 | 0.21 | 0.27 | 1.67 | 0.29 | 1.76 | 0.37 | 1.83 |
| 3-10 | 1 | 59 | 0.01 | 0.21 | 0.21 | 0.24 | 1.58 | 0.25 | 1.65 | 0.30 | 1.79 |
| 3-11 | 1 | 59 | 0.10 | 0.21 | 0.21 | 0.26 | 1.68 | 0.28 | 1.76 | 0.35 | 1.89 |
| 3-12 | 3 | 5 | 0.20 | 0.20 | 0.20 | 0.22 | 1.38 | 0.27 | 1.58 | 0.29 | 1.66 |
| 3-13 | 3 | 5 | 2.00 | 0.20 | 0.20 | 0.23 | 1.42 | 0.29 | 1.65 | 0.32 | 1.73 |
| 3-14 | 3 | 48 | 0.01 | 0.20 | 0.20 | 0.22 | 1.40 | 0.26 | 1.56 | 0.28 | 1.68 |
| 3-15 | 3 | 48 | 0.10 | 0.20 | 0.20 | 0.23 | 1.56 | 0.27 | 1.63 | 0.30 | 1.77 |
| 3-16 | 3 | 52 | 0.01 | 0.20 | 0.20 | 0.21 | 1.65 | 0.23 | 1.76 | 0.24 | 1.80 |
| 3-17 | 3 | 52 | 0.10 | 0.20 | 0.20 | 0.22 | 1.67 | 0.25 | 1.82 | 0.27 | 1.88 |
| 3-18 | 3 | 59 | 0.01 | 0.20 | 0.20 | 0.21 | 1.68 | 0.23 | 1.80 | 0.25 | 1.86 |
| 3-19 | 3 | 59 | 0.10 | 0.20 | 0.20 | 0.22 | 1.72 | 0.25 | 1.87 | 0.27 | 1.89 |
| 3-20 | 6 | 5 | 0.20 | 0.19 | 0.19 | 0.21 | 1.40 | 0.26 | 1.60 | 0.27 | 1.66 |
| 3-21 | 6 | 5 | 2.00 | 0.19 | 0.19 | 0.22 | 1.42 | 0.27 | 1.67 | 0.30 | 1.76 |
| 3-22 | 6 | 48 | 0.01 | 0.19 | 0.19 | 0.21 | 1.43 | 0.25 | 1.58 | 0.26 | 1.71 |
| 3-23 | 6 | 48 | 0.10 | 0.19 | 0.19 | 0.22 | 1.57 | 0.25 | 1.65 | 0.28 | 1.79 |
| 3-24 | 6 | 52 | 0.01 | 0.19 | 0.19 | 0.20 | 1.65 | 0.23 | 1.77 | 0.23 | 1.84 |
| 3-25 | 6 | 52 | 0.10 | 0.19 | 0.19 | 0.21 | 1.68 | 0.24 | 1.83 | 0.26 | 1.90 |
| 3-26 | 6 | 59 | 0.01 | 0.19 | 0.19 | 0.21 | 1.69 | 0.23 | 1.82 | 0.24 | 1.87 |
| 3-27 | 6 | 59 | 0.10 | 0.19 | 0.19 | 0.21 | 1.76 | 0.24 | 1.86 | 0.25 | 1.91 |

As is clear from Table F-3, the sample of silver halide photographic material having internal image forming silver halide emulsion layers containing foggant compound No. 5, 48, 52 or 59 in accordance with the present invention produced superior positive transfer magenta color images on the image-receiving element when, after imagewise exposure, they were heated, superposed on said receiving element, and separated therefrom after the lapse of a given time period.

Needless to say, similarly good results were obtained from other emulsions and foggant compounds that are not shown in Table F-3 but which were within the scope of the present invention, as well as from the combinations or two or more of such compounds.

EXAMPLE F-4

To each of the internal image forming silver halide emulsions prepared in Example F-1, an aqueous solution of polyvinyl alcohol (degree of saponification, 98%; viscosity average degree of polymerization, 550; 1.5 g/m$^2$) having dissolved therein 3-amino-4-aryl-5-mercapto-1,2,4-triazole (0.018 g/m$^2$), phthalazine (0.10 g/m$^2$), phthalic acid (0.13 g/m$^2$), and t-butyl hydroquinone (0.27 g/m$^2$) was added. Thereafter, an aqueous gelatin (0.52 g/m$^2$) solution, a sulfobenzotriazole silver emulsion (1.0 g/m$^2$) prepared by the method shown below, a surfactant (di-2-ethylhexylsodium sulfosuccinate), and a hardener (formaldehyde) were added. To the mixtures, foggant compound No. 1, 48, 52 or 63 which was within the scope of the present invention was added in the form of a solution in N,N-dimethylformamide. Each of the resulting coating solutions was applied to a photographic baryta paper to give a silver deposit of 2 g/m$^2$, and dried. Thereafter, diacetyl cellulose (1.5 g/m$^2$) was applied and dried to form a protective coat.

Preparation of sulfobenzotriazole silver emulsion

In a mixed solvent of water (150 ml) and ethanol (150 ml), 40 g of poly(4-vinylpyrrolidone), 30 g of 4-sulfobenzotriazole and 6 g of sodium hydroxide were dissolved. To the stirred solution, 30 ml of an aqueous solution of 5N silver nitrate was added so as to adjust the pH at between 6 and 8. Water was added to make a total of 600 ml, thereby providing a dispersion of organic silver salt.

Each of the resulting samples was subjected to imagewise exposure through a sensitometric optical wedge and developed by heating on a heat block at 30° C., 100° C., 120° C. or 140° C. for 20 seconds.

The maximum and minimum densities were measured for the image formed on each of the samples, and the results are shown in Table F-4.

TABLE F-4

| Sample No. | Emulsion (EM) No. | Foggant Compound No. | Foggant Amount (g/l EM) | Heating Temperature 30° exposed area | 30° un-exposed area | 120° exposed area | 120° un-exposed area | 140° exposed area | 140° un-exposed area | 160° exposed area | 160° un-exposed area |
|---|---|---|---|---|---|---|---|---|---|---|---|
| 4-1 (Comp. 14) | 1 | — | — | 0.02 | 0.02 | 0.11 | 0.28 | 0.12 | 0.41 | 0.16 | 0.49 |
| 4-2 (Comp. 15) | 3 | — | — | 0.02 | 0.02 | 0.10 | 0.41 | 0.11 | 0.54 | 0.15 | 0.60 |
| 4-3 (Comp. 16) | 6 | — | — | 0.02 | 0.02 | 0.10 | 0.42 | 0.11 | 0.58 | 0.15 | 0.63 |
| 4-4 | 1 | 1 | 0.50 | 0.04 | 0.02 | 0.13 | 1.09 | 0.16 | 1.22 | 0.23 | 1.26 |
| 4-5 | 1 | 1 | 5.00 | 0.04 | 0.02 | 0.14 | 1.16 | 0.17 | 1.30 | 0.25 | 1.36 |
| 4-6 | 1 | 48 | 0.05 | 0.04 | 0.02 | 0.13 | 1.12 | 0.16 | 1.26 | 0.21 | 1.31 |
| 4-7 | 1 | 48 | 0.50 | 0.04 | 0.02 | 0.14 | 1.20 | 0.17 | 1.34 | 0.24 | 1.36 |
| 4-8 | 1 | 52 | 0.03 | 0.04 | 0.02 | 0.12 | 1.26 | 0.14 | 1.35 | 0.19 | 1.39 |
| 4-9 | 1 | 52 | 0.30 | 0.04 | 0.02 | 0.13 | 1.33 | 0.15 | 1.38 | 0.20 | 1.42 |
| 4-10 | 1 | 63 | 0.03 | 0.04 | 0.02 | 0.12 | 1.25 | 0.14 | 1.33 | 0.19 | 1.37 |
| 4-11 | 1 | 63 | 0.30 | 0.04 | 0.02 | 0.13 | 1.34 | 0.15 | 1.40 | 0.20 | 1.46 |
| 4-12 | 3 | 1 | 0.50 | 0.03 | 0.02 | 0.12 | 1.20 | 0.13 | 1.25 | 0.18 | 1.28 |
| 4-13 | 3 | 1 | 5.00 | 0.03 | 0.02 | 0.13 | 1.25 | 0.14 | 1.33 | 0.19 | 1.37 |
| 4-14 | 3 | 48 | 0.05 | 0.03 | 0.02 | 0.12 | 1.18 | 0.13 | 1.26 | 0.17 | 1.29 |
| 4-15 | 3 | 48 | 0.50 | 0.03 | 0.02 | 0.13 | 1.23 | 0.14 | 1.32 | 0.18 | 1.36 |
| 4-16 | 3 | 52 | 0.03 | 0.03 | 0.02 | 0.10 | 1.28 | 0.11 | 1.35 | 0.13 | 1.38 |
| 4-17 | 3 | 52 | 0.30 | 0.03 | 0.02 | 0.11 | 1.36 | 0.12 | 1.41 | 0.14 | 1.46 |
| 4-18 | 3 | 63 | 0.03 | 0.03 | 0.02 | 0.10 | 1.28 | 0.11 | 1.36 | 0.13 | 1.39 |
| 4-19 | 3 | 63 | 0.30 | 0.03 | 0.02 | 0.11 | 1.38 | 0.12 | 1.43 | 0.14 | 1.48 |
| 4-20 | 6 | 1 | 0.50 | 0.03 | 0.04 | 0.12 | 1.20 | 0.13 | 1.26 | 0.18 | 1.29 |
| 4-21 | 6 | 1 | 5.00 | 0.03 | 0.04 | 0.13 | 1.26 | 0.14 | 1.35 | 0.19 | 1.39 |
| 4-22 | 6 | 48 | 0.05 | 0.03 | 0.04 | 0.12 | 1.19 | 0.13 | 1.26 | 0.17 | 1.30 |
| 4-23 | 6 | 48 | 0.50 | 0.03 | 0.04 | 0.13 | 1.26 | 0.14 | 1.35 | 0.18 | 1.38 |
| 4-24 | 6 | 52 | 0.03 | 0.03 | 0.04 | 0.10 | 1.30 | 0.11 | 1.35 | 0.13 | 1.39 |
| 4-25 | 6 | 52 | 0.30 | 0.03 | 0.04 | 0.11 | 1.36 | 0.12 | 1.43 | 0.14 | 1.48 |
| 4-26 | 6 | 63 | 0.03 | 0.03 | 0.04 | 0.10 | 1.27 | 0.11 | 1.35 | 0.13 | 1.40 |
| 4-27 | 6 | 63 | 0.30 | 0.03 | 0.04 | 0.11 | 1.36 | 0.12 | 1.40 | 0.14 | 1.48 |

As is clear from Table F-4, the samples of silver halide photographic material having internal image forming silver halide emulsion layers containing foggant compound No. 1, 48, 52 or 63 in accordance with the present invention were capable of producing superior positive images by heating them after imagewise exposure and before development.

Similarly good results were obtained from other emulsions and foggant compounds that are not listed in Table F-4 but which are within the scope of the present invention, as well as from the combinations of two or more of such foggant compounds.

EXAMPLE F-5

To each of the internal image forming silver halide emulsions prepared in Example F-1, sodium 4-(diethylamino)-2-methylsulfamate (2.0 g/m$^2$), the sulfobenzotriazole silver salt emulsion prepared in Example F-4 (organic silver salt, with a silver deposit of 2.0 g/m$^2$), the dye providing material M-2 (1.5 g/m$^2$) shown below, 3-methyl-1,3,5-pentanetriol (3.0 g/m$^2$), a surfactant (di-2-ethylhexylsodium sulfosuccinate) and a hardener (formaldehyde) were added. To the mixtures, one of the following foggant compounds within the scope of the present invention was added: compound Nos. 1, 8, 11, 22, 26, 31, 40, 44, 45, 48, 52, 53, 58, 59, 62, 70, 82, 86 and 91. Each of the resulting coating solutions was applied to a polyethylene terephthalate (PET) base (150 pm) to give a silver deposit of 4.0 g/m$^2$, and dried.

Preparation of a dispersion of dye providing material (M-2) in gelatin

A dye providing material M-2 (10 g) having the structure shown below was uniformly dissolved in 30 g of ethyl acetate and 10 g of tricresyl phosphate (TCP) by heating at about 60° C. The resulting solution was mixed under agitation with 120 ml of a 2% aqueous gelatin solution containing a 5% aqueous solution of Alakanol XC (Du Pont) as a dispersant. Thereafter, the mixture was homogenized by an ultrasonic homogenizer for 10 minutes and the ethyl acetate was removed, so as to obtain a gelatin dispersion of the dye providing material (M-2) in a yield of 170 g.

Dye providing material, M-2

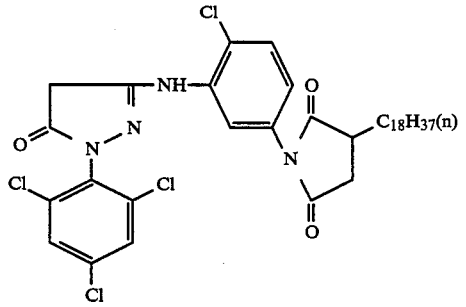

Each of the resulting samples was subjected to imagewise exposure through a sensitometric optical wedge and placed on a heat block for heating at 120° C., 140° C., or 160° C. for 20 seconds. The samples then were developed by continued heating for an additional 70 seconds.

The maximum and minimum densities were measured for the positive magenta color image formed on each of the samples, and the results are shown in Table F-5.

compound Nos. 1, 8, 11, 22, 26, 31, 40, 44, 45, 48, 52, 53, 58, 59, 62, 70, 82, 86 and 91) were capable of producing superior positive magenta color images by heating them after imagewise exposure and before development.

Similarly good results were obtained from other emulsions and foggant compounds that are not listed in Table F-5 but which are within the scope of the present invention, as well as from the combinations of two or more such foggant compounds.

EXAMPLE F-6

To each of the internal image forming silver halide emulsions prepared in Example F-1, sodium 4-(diethylamino)-2-methylphenyl-sulfamate (2.2 g/m$^2$), a 5-methylbenzotriazole silver salt emulsion (organic silver salt, with a silver deposit of 1.8 g/m$^2$) prepared by the method shown below, an illustrative dye providing material (13) (1.8 g/m$^2$), 3-methyl-1,3,5-pentanetriol (3.0 g/m$^2$), gelatin (3.0 g/m$^2$), polyvinylpyrrolidone with an average molecular weight of 30,000 (3.0 g/m$^2$), a surfactant (di-2-ethylhexylsodium sulfosuccinate) and a hardener (formaldehyde) were added. To the mixtures, compound No. 2, 52, 62 or 78 which was a foggant within the scope of the present invention was added. Each of the resulting coating solutions was applied to a polyethylene terephthalate base (150 μm

TABLE F-5

| | | Foggant | | Heating Temperature 30° | | 120° | | 140° | | 160° | |
|---|---|---|---|---|---|---|---|---|---|---|---|
| Sample No. | Emulsion (EM) No. | Compound No. | Amount (g/l EM) | exposed area | un-exposed area | exposed area | un-exposed area | exposed area | un-exposed area | exposed area | un-exposed area |
| 5-1 (Comp. 17) | 3 | — | — | 0.19 | 0.19 | 0.31 | 0.71 | 0.43 | 0.88 | 0.48 | 0.99 |
| 5-2 | 3 | 1 | 0.60 | 0.19 | 0.19 | 0.30 | 1.23 | 0.38 | 1.32 | 0.41 | 1.37 |
| 5-3 | 3 | 1 | 6.00 | 0.20 | 0.20 | 0.39 | 1.33 | 0.45 | 1.43 | 0.47 | 1.46 |
| 5-4 | 3 | 8 | 0.50 | 0.19 | 0.19 | 0.29 | 1.20 | 0.37 | 1.28 | 0.39 | 1.33 |
| 5-5 | 3 | 8 | 5.00 | 0.20 | 0.20 | 0.38 | 1.28 | 0.44 | 1.40 | 0.46 | 1.43 |
| 5-6 | 3 | 11 | 0.60 | 0.19 | 0.19 | 0.30 | 1.22 | 0.37 | 1.30 | 0.40 | 1.36 |
| 5-7 | 3 | 11 | 6.00 | 0.20 | 0.20 | 0.37 | 1.33 | 0.43 | 1.41 | 0.45 | 1.45 |
| 5-8 | 3 | 22 | 0.50 | 0.19 | 0.19 | 0.30 | 1.22 | 0.38 | 1.29 | 0.40 | 1.34 |
| 5-9 | 3 | 22 | 5.00 | 0.20 | 0.20 | 0.39 | 1.30 | 0.46 | 1.41 | 0.47 | 1.45 |
| 5-10 | 3 | 26 | 0.20 | 0.20 | 0.19 | 0.32 | 1.30 | 0.38 | 1.35 | 0.40 | 1.39 |
| 5-11 | 3 | 26 | 2.00 | 0.20 | 0.20 | 0.39 | 1.38 | 0.44 | 1.45 | 0.46 | 1.48 |
| 5-12 | 3 | 31 | 0.50 | 0.19 | 0.19 | 0.30 | 1.20 | 0.35 | 1.28 | 0.39 | 1.32 |
| 5-13 | 3 | 31 | 5.00 | 0.20 | 0.20 | 0.38 | 1.29 | 0.43 | 1.41 | 0.45 | 1.43 |
| 5-14 | 3 | 40 | 0.60 | 0.19 | 0.19 | 0.29 | 1.19 | 0.34 | 1.26 | 0.37 | 1.30 |
| 5-15 | 3 | 40 | 6.00 | 0.20 | 0.20 | 0.39 | 1.28 | 0.42 | 1.40 | 0.44 | 1.42 |
| 5-16 | 3 | 44 | 0.06 | 0.20 | 0.19 | 0.28 | 1.35 | 0.34 | 1.42 | 0.38 | 1.47 |
| 5-17 | 3 | 44 | 0.60 | 0.21 | 0.20 | 0.32 | 1.41 | 0.37 | 1.51 | 0.40 | 1.56 |
| 5-18 | 3 | 45 | 0.08 | 0.20 | 0.19 | 0.27 | 1.33 | 0.35 | 1.40 | 0.38 | 1.45 |
| 5-19 | 3 | 45 | 0.80 | 0.21 | 0.20 | 0.32 | 1.40 | 0.38 | 1.50 | 0.42 | 1.54 |
| 5-20 | 3 | 48 | 0.20 | 0.20 | 0.19 | 0.28 | 1.36 | 0.32 | 1.42 | 0.36 | 1.47 |
| 5-21 | 3 | 48 | 2.00 | 0.21 | 0.20 | 0.31 | 1.42 | 0.36 | 1.50 | 0.40 | 1.53 |
| 5-22 | 3 | 52 | 0.02 | 0.20 | 0.19 | 0.28 | 1.41 | 0.32 | 1.49 | 0.34 | 1.53 |
| 5-23 | 3 | 52 | 0.20 | 0.20 | 0.19 | 0.31 | 1.45 | 0.36 | 1.53 | 0.39 | 1.60 |
| 5-24 | 3 | 53 | 0.02 | 0.19 | 0.19 | 0.28 | 1.42 | 0.31 | 1.50 | 0.34 | 1.54 |
| 5-25 | 3 | 53 | 0.20 | 0.20 | 0.20 | 0.31 | 1.47 | 0.35 | 1.54 | 0.38 | 1.62 |
| 5-26 | 3 | 58 | 0.03 | 0.20 | 0.19 | 0.29 | 1.30 | 0.33 | 1.42 | 0.36 | 1.46 |
| 5-27 | 3 | 58 | 0.30 | 0.21 | 0.20 | 0.32 | 1.36 | 0.36 | 1.48 | 0.39 | 1.51 |
| 5-28 | 3 | 59 | 0.02 | 0.19 | 0.19 | 0.27 | 1.36 | 0.30 | 1.44 | 0.34 | 1.49 |
| 5-29 | 3 | 59 | 0.20 | 0.20 | 0.20 | 0.30 | 1.43 | 0.33 | 1.52 | 0.37 | 1.57 |
| 5-30 | 3 | 62 | 0.02 | 0.19 | 0.19 | 0.28 | 1.42 | 0.32 | 1.50 | 0.34 | 1.65 |
| 5-31 | 3 | 62 | 0.20 | 0.20 | 0.20 | 0.31 | 1.49 | 0.34 | 1.55 | 0.36 | 1.59 |
| 5-32 | 3 | 70 | 0.03 | 0.19 | 0.19 | 0.27 | 1.35 | 0.29 | 1.43 | 0.33 | 1.47 |
| 5-33 | 3 | 70 | 0.30 | 0.20 | 0.20 | 0.31 | 1.47 | 0.34 | 1.51 | 0.37 | 1.56 |
| 5-34 | 3 | 82 | 0.05 | 0.20 | 0.19 | 0.26 | 1.26 | 0.30 | 1.35 | 0.33 | 1.42 |
| 5-35 | 3 | 82 | 0.50 | 0.20 | 0.19 | 0.30 | 1.30 | 0.32 | 1.41 | 0.38 | 1.52 |
| 5-36 | 3 | 86 | 0.10 | 0.20 | 0.19 | 0.26 | 1.24 | 0.30 | 1.34 | 0.32 | 1.44 |
| 5-37 | 3 | 86 | 1.00 | 0.20 | 0.19 | 0.31 | 1.30 | 0.32 | 1.42 | 0.34 | 1.54 |
| 5-38 | 3 | 91 | 0.05 | 0.20 | 0.19 | 0.30 | 1.39 | 0.36 | 1.46 | 0.40 | 1.50 |
| 5-39 | 3 | 91 | 0.50 | 0.21 | 0.21 | 0.33 | 1.44 | 0.38 | 1.53 | 0.42 | 1.59 |

As is clear from Table F-5, the samples of silver halide photographic material having internal image forming silver halide emulsions containing the foggant compounds within the scope of the present invention (i.e., thick) to give a silver deposit of 4.0 g/m$^2$, and dried to make a color photographic material.

Preparation of 5-methylbenzotriazole silver salt emulsion

In a mixed solvent of water (200 ml) and ethanol (200 ml), 60 g of 5-methylbenzotriazole and 17.6 g of sodium hydroxide were added. To the stirred solution, 100 ml of an aqueous solution of 4N silver nitrate. The resulting mixture was subjected to filtration and the solid residue was thoroughly washed first with water, then with methanol, so as to obtain a high-purity solid methylbenzotriazole silver salt emulsion that was free of any excess unreacted matter.

To 60 g of the methylbenzotriazole silver salt emulsion, 60 ml of 20% poly(4-vinylpyrrolidone), 12 ml of 10% aqueous solution of sulfobenzotriazole and 150 ml of water were added. The mixture was stirred in a ball mill for 24 hours to make a dispersion of 5-methylbenzotriazole silver salt.

Preparation of yellow dye providing material (13) in gelatin

A dye providing material (13) (5 g) was dissolved in 15 ml of ethyl acetate. The resulting solution was added to 60 ml of a 5% aqueous gelatin solution containing 15 ml of a 5% aqueous solution of Alkanol XC and the two solutions were mixed under agitation. The mixture was homogenized by an ultrasonic homogenizer for 10 minutes, so as to obtain a dispersion of the dye providing material in gelatin at a yield of 100 g.

Each of the resulting samples was subjected to imagewise exposure through a sensitometric optical wedge and placed on a heat block for heating at 120° C. (heating temperature A), 140° C. (temperature B) or 160° C. (temperature C) for 20 seconds.

Each of the exposed color light-sensitive materials was superposed on a heat transfer image-receiving element (to be described below) so that the coated surfaces were in contact with each other. The assembly was heat-developed at 150° C. for 70 seconds by a commercial heat developer, Copy Mate (Graphic Corporation). Immediately after the heat development, the image-receiving element was separated from the light-sensitive sample, and it carried a positive yellow color transfer image.

Preparation of a heat transfer image-receiving element

A photographic baryta paper was coated with a polyvinyl chloride (Japan Zeon Co., Ltd., 12 g/m$^2$), dioctyl phthalate (DOP, 2.4 g/m$^2$) and an ultraviolet absorber (UV-1 as shown below, 0.6 g/m$^2$), all being dissolved in tetrahydrofuran. The assembly was passed through a hot atmosphere (150° C.) to form an image-receiving element having a smooth coat of image-receiving layer.

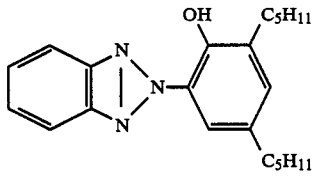

UV-1

The maximum and minimum densities were measured for the positive yellow color transfer image obtained from each of the samples The results are shown in Table F-6.

TABLE F-6

| | | | | Heating Temperature | | | | | | | |
|---|---|---|---|---|---|---|---|---|---|---|---|
| | | | | 30° C. × 90 sec | | (A) | | (B) | | (C) | |
| | | Foggant | | | | | | | | | |
| Sample No. | Emulsion (EM) No. | Compound No. | Amount (g/l EM) | exposed area | unexposed area | exposed area | unexposed area | exposed area | unexposed area | exposed area | unexposed area |
| 6-1 (Comp. 18) | 1 | — | — | 0.08 | 0.08 | 0.14 | 0.43 | 0.17 | 0.60 | 0.22 | 0.69 |
| 6-2 (Comp. 19) | 3 | — | — | 0.08 | 0.08 | 0.12 | 0.53 | 0.13 | 0.67 | 0.16 | 0.75 |
| 6-3 (Comp. 20) | 6 | — | — | 0.08 | 0.08 | 0.12 | 0.56 | 0.13 | 0.69 | 0.15 | 0.76 |
| 6-4 | 1 | 2 | 0.50 | 0.08 | 0.08 | 0.28 | 1.38 | 0.30 | 1.47 | 0.33 | 1.66 |
| 6-5 | 1 | 2 | 5.00 | 0.08 | 0.08 | 0.30 | 1.46 | 0.32 | 1.55 | 0.34 | 1.67 |
| 6-6 | 1 | 52 | 0.05 | 0.08 | 0.08 | 0.28 | 1.41 | 0.31 | 1.51 | 0.35 | 1.69 |
| 6-7 | 1 | 52 | 0.50 | 0.08 | 0.08 | 0.30 | 1.47 | 0.32 | 1.65 | 0.36 | 1.74 |
| 6-8 | 1 | 62 | 0.02 | 0.08 | 0.08 | 0.28 | 1.47 | 0.30 | 1.59 | 0.33 | 1.69 |
| 6-9 | 1 | 62 | 0.20 | 0.09 | 0.08 | 0.30 | 1.66 | 0.32 | 1.71 | 0.35 | 1.80 |
| 6-10 | 1 | 78 | 0.01 | 0.08 | 0.08 | 0.28 | 1.49 | 0.30 | 1.59 | 0.33 | 1.69 |
| 6-11 | 1 | 78 | 0.10 | 0.09 | 0.08 | 0.30 | 1.67 | 0.32 | 1.70 | 0.35 | 1.80 |
| 6-12 | 3 | 2 | 0.50 | 0.08 | 0.08 | 0.11 | 1.40 | 0.13 | 1.50 | 0.14 | 1.67 |
| 6-13 | 3 | 2 | 5.00 | 0.08 | 0.08 | 0.12 | 1.51 | 0.14 | 1.59 | 0.15 | 1.70 |
| 6-14 | 3 | 52 | 0.05 | 0.08 | 0.08 | 0.11 | 1.53 | 0.13 | 1.61 | 0.14 | 1.70 |
| 6-15 | 3 | 52 | 0.50 | 0.08 | 0.08 | 0.12 | 1.63 | 0.13 | 1.69 | 0.14 | 1.76 |
| 6-16 | 3 | 62 | 0.02 | 0.08 | 0.08 | 0.11 | 1.52 | 0.12 | 1.60 | 0.13 | 1.70 |
| 6-17 | 3 | 62 | 0.20 | 0.08 | 0.08 | 0.12 | 1.68 | 0.12 | 1.73 | 0.13 | 1.82 |
| 6-18 | 3 | 78 | 0.01 | 0.08 | 0.08 | 0.11 | 1.56 | 0.12 | 1.61 | 0.13 | 1.72 |
| 6-19 | 3 | 78 | 0.10 | 0.08 | 0.08 | 0.12 | 1.68 | 0.13 | 1.71 | 0.13 | 1.82 |
| 6-20 | 6 | 2 | 0.50 | 0.08 | 0.08 | 0.11 | 1.55 | 0.13 | 1.62 | 0.14 | 1.73 |
| 6-21 | 6 | 2 | 5.00 | 0.08 | 0.08 | 0.12 | 1.66 | 0.13 | 1.71 | 0.15 | 1.79 |
| 6-22 | 6 | 52 | 0.05 | 0.08 | 0.08 | 0.11 | 1.55 | 0.13 | 1.63 | 0.14 | 1.71 |
| 6-23 | 6 | 52 | 0.50 | 0.08 | 0.08 | 0.12 | 1.65 | 0.13 | 1.72 | 0.14 | 1.79 |
| 6-24 | 6 | 62 | 0.02 | 0.08 | 0.08 | 0.11 | 1.53 | 0.12 | 1.62 | 0.13 | 1.73 |
| 6-25 | 6 | 62 | 0.20 | 0.08 | 0.08 | 0.12 | 1.69 | 0.12 | 1.75 | 0.13 | 1.84 |
| 6-26 | 6 | 78 | 0.01 | 0.08 | 0.08 | 0.11 | 1.55 | 0.12 | 1.63 | 0.13 | 1.76 |
| 6-27 | 6 | 78 | 0.10 | 0.08 | 0.08 | 0.12 | 1.69 | 0.13 | 1.74 | 0.13 | 1.85 |

As is clear from Table F-6, the samples of silver halide photographic material having silver halide emulsion layers containing one of the foggant compound of the present invention, i.e., Nos. 2, 52, 62 and 78, were capable of producing superior positive transfer yellow color images on the heat transfer image-receiving element when, after imagewise exposure, they were heated, superposed on said image-receiving element, heated again and separated therefrom after the lapse of a given time period.

Similarly good results were obtained from other emulsions and foggant compounds that are not listed in Table F-6 but which are within the scope of the present invention, as well as from the combinations of two or more of such foggant compounds.

EXAMPLE F-7

Samples of color photographic material were prepared as in Example F-6 and exposed imagewise through a sensitometric optical wedge. Each of the exposed samples was superposed on a heat transfer image-receiving element of the same type as prepared in Example F-6 so that the coated surfaces were in contact with each other. The assembly was heated in Copy Mate for 20 seconds at 120° C. (heating temperature D), 140° C. (temperature E) or 160° C. (temperature F). Subsequently, the assembly was heat-developed by heating at 150° C. for 70 seconds. Immediately after the development, the image-receiving element was separated from the assembly and a positive transfer yellow color image had formed on the receiving element. The maximum and minimum densities were measured for the positive yellow color image formed on each of the samples, and the results are shown in Table F-7.

TABLE F-7

| | | | | Heating Temperature | | | | | | | |
|---|---|---|---|---|---|---|---|---|---|---|---|
| | | | | 30° C. × 90 sec | | (A) | | (B) | | (C) | |
| | | Foggant | | | | | | | | | |
| Sample No. | Emulsion (EM) No. | Compound No. | Amount (g/l EM) | exposed area | unexposed area | exposed area | unexposed area | exposed area | unexposed area | exposed area | unexposed area |
| 7-1 (Comp. 21) | 1 | — | — | 0.12 | 0.12 | 0.14 | 0.41 | 0.15 | 0.57 | 0.20 | 0.67 |
| 7-2 (Comp. 22) | 3 | — | — | 0.10 | 0.10 | 0.12 | 0.52 | 0.13 | 0.65 | 0.14 | 0.73 |
| 7-3 (Comp. 23) | 6 | — | — | 0.11 | 0.11 | 0.12 | 0.56 | 0.13 | 0.68 | 0.14 | 0.75 |
| 7-4 | 1 | 2 | 0.50 | 0.08 | 0.08 | 0.28 | 1.37 | 0.30 | 1.46 | 0.33 | 1.63 |
| 7-5 | 1 | 2 | 5.00 | 0.08 | 0.08 | 0.30 | 1.44 | 0.32 | 1.54 | 0.33 | 1.65 |
| 7-6 | 1 | 52 | 0.05 | 0.08 | 0.08 | 0.28 | 1.40 | 0.30 | 1.48 | 0.33 | 1.67 |
| 7-7 | 1 | 52 | 0.50 | 0.08 | 0.08 | 0.30 | 1.44 | 0.31 | 1.63 | 0.33 | 1.71 |
| 7-8 | 1 | 62 | 0.02 | 0.08 | 0.08 | 0.28 | 1.45 | 0.29 | 1.57 | 0.31 | 1.68 |
| 7-9 | 1 | 62 | 0.20 | 0.08 | 0.08 | 0.30 | 1.62 | 0.31 | 1.70 | 0.32 | 1.77 |
| 7-10 | 1 | 78 | 0.01 | 0.08 | 0.08 | 0.28 | 1.47 | 0.29 | 1.57 | 0.31 | 1.68 |
| 7-11 | 1 | 78 | 0.10 | 0.08 | 0.08 | 0.30 | 1.63 | 0.31 | 1.68 | 0.32 | 1.78 |
| 7-12 | 3 | 2 | 0.50 | 0.08 | 0.08 | 0.11 | 1.39 | 0.13 | 1.48 | 0.14 | 1.65 |
| 7-13 | 3 | 2 | 5.00 | 0.08 | 0.08 | 0.12 | 1.49 | 0.13 | 1.57 | 0.14 | 1.70 |
| 7-14 | 3 | 52 | 0.05 | 0.08 | 0.08 | 0.11 | 1.51 | 0.13 | 1.60 | 0.14 | 1.67 |
| 7-15 | 3 | 52 | 0.50 | 0.08 | 0.08 | 0.12 | 1.62 | 0.13 | 1.67 | 0.14 | 1.75 |
| 7-16 | 3 | 62 | 0.02 | 0.08 | 0.08 | 0.11 | 1.50 | 0.12 | 1.58 | 0.13 | 1.67 |
| 7-17 | 3 | 62 | 0.20 | 0.08 | 0.08 | 0.12 | 1.66 | 0.12 | 1.71 | 0.13 | 1.80 |
| 7-18 | 3 | 78 | 0.01 | 0.08 | 0.08 | 0.11 | 1.55 | 0.12 | 1.59 | 0.13 | 1.70 |
| 7-19 | 3 | 78 | 0.10 | 0.08 | 0.08 | 0.12 | 1.67 | 0.12 | 1.68 | 0.13 | 1.81 |
| 7-20 | 6 | 2 | 0.50 | 0.08 | 0.08 | 0.11 | 1.54 | 0.13 | 1.61 | 0.14 | 1.71 |
| 7-21 | 6 | 2 | 5.00 | 0.08 | 0.08 | 0.12 | 1.66 | 0.13 | 1.69 | 0.14 | 1.75 |
| 7-22 | 6 | 52 | 0.05 | 0.08 | 0.08 | 0.11 | 1.53 | 0.13 | 1.62 | 0.14 | 1.69 |
| 7-23 | 6 | 52 | 0.50 | 0.08 | 0.08 | 0.12 | 1.64 | 0.13 | 1.72 | 0.14 | 1.75 |
| 7-24 | 6 | 62 | 0.02 | 0.08 | 0.08 | 0.11 | 1.51 | 0.12 | 1.61 | 0.13 | 1.71 |
| 7-25 | 6 | 62 | 0.20 | 0.08 | 0.08 | 0.12 | 1.67 | 0.12 | 1.73 | 0.13 | 1.80 |
| 7-26 | 6 | 78 | 0.01 | 0.08 | 0.08 | 0.11 | 1.53 | 0.12 | 1.61 | 0.13 | 1.74 |
| 7-27 | 6 | 78 | 0.10 | 0.08 | 0.08 | 0.12 | 1.66 | 0.13 | 1.72 | 0.13 | 1.81 |

As is clear from Table F-7, the samples of silver halide photographic material having internal image forming silver halide emulsion layers containing one of the foggant compounds of the present invention, i.e., compound Nos. 2, 52, 62 and 78, were capable of forming superior positive transfer yellow color images on the heat transfer image-receiving element when, after imagewise exposure, they were superposed on said receiving element, heated and separated therefrom after the lapse of a given time period.

Similarly good results were obtained from other emulsions and foggant compounds that are not listed in Table F-7 but which are within the scope of the present invention, as well a from the combinations of two or more of such foggant compounds.

EXAMPLE F-8

A subbed transparent polyethylene terephthalate base (150 μm thick) was coated with the following layers in the order written, so as to prepare a sample of multi-layered color photographic material.

(1) Blue-sensitive, internal image forming silver chloroiodobromide emulsion layer:

This layer was composed of one of the emulsions that were prepared in Example F-1 and which comprised blue-sensitized internal image forming silver halide grains (silver deposit: 3.2 g/m$^2$), sodium 4-(diethylamino)-2-methylphenylsulfamate (1.5 g/m$^2$), the 5-methylbenzotriazole silver salt emulsion prepared in Example F-6 (silver deposit: 3.2 g/m$^2$), the yellow dye providing material (13) shown in Example F-6 (2.0 g/m$^2$), polyethylene glycol with a molecular weight of 300 (2.7 g/m$^2$), 3-methyl-1,3,5-pentanetriol (1.3 g/m$^2$), gelatin (2.7 g/m$^2$), polyvinylpyrrolidone with an average molecular weight of 30,000 (2.7 g/m$^2$), a surfactant (di-2-ethylhexylsodium sulfosuccinate, 0.05 g/m$^2$), a hardener (formaldehyde, 0.15 g/m$^2$) and one of the foggant compounds within the scope of the present invention, i.e., compound Nos. 44, 52, 60, 86 and 91.

(2) Intermediate layer:

This layer was composed of gelatin (1.0 g/m$^2$), polyvinylpyrrolidone (1.0 g/m$^2$) and the non-diffusible dye providing material shown below (0.4 g/m$^2$).

Non-diffusible dye providing material:

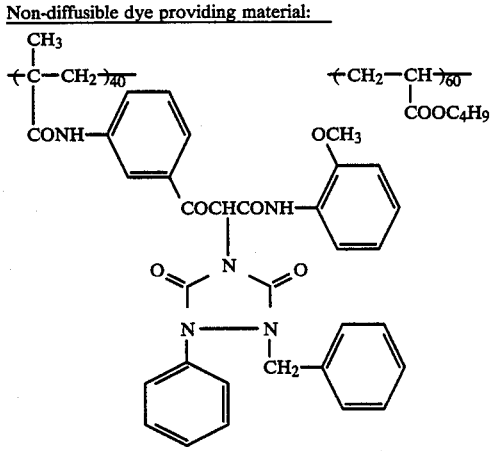

(3) Green-sensitive, internal image forming silver chloroiodobromide emulsion layer:

This layer was composed of one of the emulsions prepared in Example F-1 and which comprised green-sensitized internal image forming silver halide grains (silver deposit: 3.2 g/m$^2$), sodium 4-(diethylamino)-2-methylphenylsulfamate (1.2 g/m$^2$), 5-methylbenzotriazole silver salt emulsion (silver deposit: 3.2 g/m$^2$), illustrative magenta dye providing material (16) (1.6 g/m$^2$), polyethylene glycol (2.7 g/m$^2$), 3-methyl-1,3,5-pentanetriol (1.3 g/m$^2$), gelatin (3.0 g/m$^2$), polyvinylpyrrolidone (3.0 g/m$^2$), a surfactant (di-2-ethylhexylsodium sulfosuccinate, 0.05 g/m$^2$), a hardener (formaldehyde, 0.15 g/m$^2$), and one of the foggant compounds within the scope of the present invention (i.e., compound Nos. 44, 52, 60, 86 and 91).

Preparation of a dispersion of magenta dye providing material (16) in gelatin

An illustrative dye providing material (16) (5 g) was dissolved in 15 ml of ethyl acetate. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes and the ethyl acetate was removed, so as to provide a dispersion of the dye providing material (16) in gelatin at a yield of 100 g.

(4) Intermediate layer:

This layer was composed of gelatin (1.0 g/m$^2$) and polyvinylpyrrolidone (1.0 g/m$^2$).

(5) Red-sensitive, internal image forming silver chlorobromide emulsion layer:

This layer was composed of one of the emulsions that were prepared in Example F-1 and which comprised red-sensitized internal image forming silver halide grains (silver deposit: 2.7 g/m$^2$), sodium 4-(diethylamino)-2-methylphenylsulfamate (1.0 g/m$^2$), 5-methylbenzotriazole silver salt emulsion (silver deposit: 2.7 g/m$^2$), cyan dye providing material (17) shown below (1.5 g/m$^2$), polyethylene glycol (2.2 g/m$^2$), 3-methyl-1,3,5-pentanetriol (0.9 g/m$^2$), gelatin (2.3 g/m$^2$), polyvinylpyrrolidone (2.3 g/m$^2$), a surfactant (di-2-ethylhexylsodium sulfosuccinate, 0.05 g/m$^2$), a hardener (formaldehyde, 0.13 g/m$^2$) and one of the foggant compounds within the scope of the present invention (i.e., compound Nos. 44, 52, 60, 86 and 91).

Preparation of a dispersion of cyan dye providing material (17) in gelatin

An illustrative dye providing material (17) (5 g) was dissolved in 15 ml of ethyl acetate. The resulting solution was added to 60 ml of a 5% aqueous gelatin solution containing 15 ml of a 5% aqueous solution of Alkanol XC, and the two solutions were mixed under agitation. The mixture was homogenized by an ultrasonic homogenizer for 10 minutes and the ethyl acetate was removed, so as to provide a dispersion of the dye providing material (17) in gelatin at a yield of 100 g.

(6) Protective layer:

This layer was composed of gelatin (1.0 g/m$^2$), polyvinylpyrrolidone (1.0 g/m$^2$), a mat agent (0.3 g/m$^2$), a surfactant (di-2-ethylhexylsodium sulfosuccinate, 0.1 g/m$^2$) and a hardener (formaldehyde, 0.05 g/m$^2$).

Each of the resulting samples of multi-layered color photographic material was subjected to imagewise exposure through a sensitometric optical wedge and placed on a heat block for heating at 140° C. (heating temperature G) or 160° C. (temperature H) for a period of 60 seconds. Each of the heated samples was superposed on a heat transfer image-receiving element of the same type as prepared in Example F-6 in such a manner that the coated surfaces were in contact with each other. Thereafter, the assembly was immediately separated from the sample, and it carried a positive multicolor transfer image. The maximum and minimum densities were measured for the positive yellow, magenta and cyan color images obtained from each of the samples. The results are shown in Table F-8.

As is clear from Table F-8, superior positive color images were also obtained from the samples of multi-layered silver halide photographic material containing one of the foggant compound Nos. 44, 52, 60, 86 and 91 which were within the scope of the present invention. Similarly good results were obtained from other emulsions and foggant compounds that are not listed in Table F-8 but which are within the scope of the present invention, as well as from the combinations of two or more of such foggant compounds.

TABLE F-8

| Sample No. | Emulsion (EM) No. | Foggant Compound No. | Foggant Amount (g/l EM) | Heating Temperature (G) Yellow exposed area | Yellow unexposed area | Magenta exposed area | Magenta unexposed area | Cyan exposed area | Cyan unexposed area | Heating Temperature (H) Yellow exposed area | Yellow unexposed area | Magenta exposed area | Magenta unexposed area | Cyan exposed area | Cyan unexposed area |
|---|---|---|---|---|---|---|---|---|---|---|---|---|---|---|---|
| 8-1 (Comp. 24) | 1 | — | — | 0.15 | 0.40 | 0.12 | 0.32 | 0.14 | 0.41 | 0.17 | 0.50 | 0.14 | 0.42 | 0.16 | 0.53 |
| 8-2 (Comp. 25) | 3 | — | — | 0.14 | 0.43 | 0.11 | 0.33 | 0.14 | 0.45 | 0.15 | 0.52 | 0.13 | 0.46 | 0.16 | 0.56 |
| 8-3 | 1 | 44 | 0.07 | 0.23 | 1.53 | 0.25 | 1.58 | 0.24 | 1.60 | 0.26 | 1.58 | 0.27 | 1.70 | 0.27 | 1.70 |
| 8-4 | 1 | 52 | 0.10 | 0.24 | 1.61 | 0.23 | 1.69 | 0.23 | 1.70 | 0.25 | 1.69 | 0.26 | 1.78 | 0.25 | 1.75 |
| 8-5 | 1 | 60 | 0.08 | 0.21 | 1.58 | 0.20 | 1.67 | 0.21 | 1.70 | 0.23 | 1.66 | 0.23 | 1.73 | 0.22 | 1.75 |
| 8-6 | 1 | 86 | 0.08 | 0.21 | 1.54 | 0.20 | 1.63 | 0.21 | 1.65 | 0.22 | 1.63 | 0.21 | 1.70 | 0.22 | 1.70 |
| 8-7 | 1 | 91 | 0.07 | 0.23 | 1.51 | 0.22 | 1.60 | 0.21 | 1.71 | 0.24 | 1.60 | 0.23 | 1.72 | 0.23 | 1.73 |
| 8-8 | 3 | 44 | 0.07 | 0.23 | 1.66 | 0.20 | 1.70 | 0.21 | 1.70 | 0.26 | 1.72 | 0.22 | 1.83 | 0.23 | 1.80 |
| 8-9 | 3 | 52 | 0.10 | 0.22 | 1.75 | 0.18 | 1.88 | 0.18 | 1.89 | 0.23 | 1.86 | 0.20 | 2.01 | 0.20 | 2.03 |
| 8-10 | 3 | 60 | 0.08 | 0.21 | 1.69 | 0.17 | 1.86 | 0.18 | 1.83 | 0.22 | 1.81 | 0.19 | 1.96 | 0.20 | 1.95 |
| 8-11 | 3 | 86 | 0.08 | 0.21 | 1.70 | 0.17 | 1.80 | 0.17 | 1.80 | 0.22 | 1.81 | 0.18 | 1.97 | 0.19 | 1.92 |
| 8-12 | 3 | 91 | 0.07 | 0.22 | 1.63 | 0.19 | 1.69 | 0.18 | 1.70 | 0.23 | 1.76 | 0.20 | 1.85 | 0.20 | 1.92 |

What is claimed is:

1. A positive image forming method comprising in sequence the following steps:

subjecting to imagewise exposure a silver halide photographic material having a silver halide emulsion layer containing a non-prefogged internal image forming silver halide;

increasing the surface sensitivity of said silver halide by heating in the substantial absence of water; and performing development.

2. A positive image forming method according to claim 1 wherein said silver halide photographic material contains the internal image forming silver halide in an amount of 0.001–100 g/m$^2$ in terms of silver.

3. A positive image forming method according to claim 1 wherein said internal image forming silver halide comprises grains which range from 0.001 to 2 $\mu$m in size.

4. A positive image forming method according to claim 1 wherein said silver halide photographic material is a heat-developable photographic material having formed on a base a silver halide emulsion layer containing at least said internal image forming silver halide, a reducing agent, an organic silver salt and a binder.

5. A positive image forming method according to claim 1 wherein said silver halide photographic material is a heat-developable photographic material having formed on a base a silver halide emulsion layer containing at least said internal image forming silver halide, a dye providing material that is capable of releasing or forming a diffusible dye upon heat development, a reducing agent, an organic silver salt and a binder.

6. A positive image forming method according to claim 1 wherein the heating is performed at 80°–200° C. for 0.5–300 grains seconds.

7. A positive image forming method according to claim 1 wherein said step of overall exposure is carried out at an intensity of 0.1–10$^5$ luxes for a period of 0.5–300 seconds.

8. A positive image forming method according to claim 1 wherein said step of overall exposure is started at least one second after the start of said heating.

9. A positive image forming method according to claim 1 wherein said silver halide photographic material has formed on a base a silver halide emulsion layer containing at least a dye providing material and a non-prefogged internal image forming silver halide, said method comprising a step of imagewise exposure, a step of heating said silver halide photographic material in order to increase the surface sensitivity of said silver halide in the substantial absence of water, a step of overall exposure which is performed either simultaneously with, or subsequent to, said heating step, a step of development, and a step of transferring to an image-receiving element a dye that has been formed in, or released from, said silver halide exmulsion layer as a result of heating.

10. A positive image forming method according to claim 9 wherein said core/shell type silver halide is made of silver iodobromide.

11. A positive image forming method according to claim 1 wherein said core/shell type silver halide has a higher silver iodide content in the shell than in the core.

12. A positive image forming method according to claim 1 wherein said step of increasing the surface sensitivity of said silver halide in the substantial absence of water being performed by heating in the presence of a foggant, which is followed by a development step.

13. A positive image forming method according to claim 12 wherein said foggant has an activation energy for fogging action of at least 20 kcal at 100° C. or higher.

14. The method of claim 1 wherein said heating is carried out at the same time as or prior to overall exposure.

15. The method of claim 1 wherein internal image forming silver halide is a core/shell type silver halide, said core being a conversion type silver halide.

16. The method of claim 1 wherein internal image forming silver halide is a metal ion doped silver halide or a core/shell type silver halide having a chemically sensitized core.

* * * * *